US005559594A

United States Patent [19]

Ohhata et al.

[11] Patent Number: 5,559,594

[45] Date of Patent: Sep. 24, 1996

[54] COPYING METHOD AND APPARATUS FOR COPYING A DOCUMENT IN TWO-IN-ONE MODE

[75] Inventors: Akira Ohhata, Toyohashi; Masao Kondo, Toyokawa, both of Japan

[73] Assignee: Minolta Co., Ltd., Osaka, Japan

[21] Appl. No.: 394,793

[22] Filed: Feb. 27, 1995

[30] Foreign Application Priority Data

Feb. 28, 1994 [JP] Japan ..... 6-055213
Feb. 28, 1994 [JP] Japan ..... 6-055232

[51] Int. Cl.[6] ..... G03G 21/00

[52] U.S. Cl. ..... 355/317; 271/226; 355/308; 355/313

[58] Field of Search ..... 355/308, 309, 355/311, 313, 317, 319, 320, 321, 77; 271/226, 227, 264, 266

[56] References Cited

U.S. PATENT DOCUMENTS

| | | | |
|---|---|---|---|
| 4,640,607 | 2/1987 | Bray | 355/313 |
| 4,912,518 | 3/1990 | Matsuo et al. | 355/313 |
| 4,958,198 | 9/1990 | Hamakawa | 355/309 |
| 5,006,904 | 4/1991 | Matsuo et al. | 355/313 |
| 5,079,599 | 1/1992 | Kato et al. | 355/313 |

FOREIGN PATENT DOCUMENTS

| | | |
|---|---|---|
| 5-158303 | 6/1993 | Japan . |
| 5-73095 | 10/1993 | Japan . |

*Primary Examiner*—Sandra L. Brase
*Attorney, Agent, or Firm*—Brinks Hofer Gilson & Lione

[57] ABSTRACT

A copying machine for copying a document in two-in-one mode comprises a scale (120), an automatic document feeder (ADF) (60), a document selection key (105) and a control circuit (CPU2). A scale (120) is arranged upstream or downstream of the glass platen (29) in the document conveying direction and protruded upward from an upper surface of the glass platen (29). The ADF (60) has a first mode and a second mode. In the first mode the ADF (60) conveys two document sheets to an exposure position (SP) with their ends made coincident with each other without restricting them by the scale (120). In the second mode the ADF (60) conveys two documents sheets on the glass platen (29) with an interval provided therebetween and making the ends of the two document sheets coincident with each other by restricting one of the two sheets arranged on one side close to the scale (120). The ADF (60) is controlled by the control circuit (CPU2) in the mode selected by the document selection key (105) according to the quality of the document.

13 Claims, 96 Drawing Sheets

SS-5-3-13
FEED AMOUNT SET
SS-5-3-101
SWITCH 105a OFF?
NO(THIN PAPER)
YES(HIT-AND-FEED)
SS-5-3-102
STOP POS. ADJUST. MODE ?
YES (ADJUST. MODE)
NO(NORMAL)
SS-5-3-103
ONE SHEET SET FLAG=0 ?
NO
YES
SS-5-3-104
THIN PAPER FLAG←0
SS-5-3-105
P02←L/2+α/2
SS-5-3-106
P04←L+α
SS-5-3-107
P08←SB−α/2
SS-5-3-108
THIN PAPER FLAG←1
SS-5-3-109
P02←L/2
SS-5-3-110
P04←L
SS-5-3-111
P08←SB
SS-5-3-112
P02←P02+ADJ1/2
P04←P04+ADJ1
P14←P14−ADJ2
P08←P08−ADJ3
RTS

S=0,3
S=1
SS5-4-2
M3 FORWARD ROTATION BY H1
SS5-4-3
PLSCNT1=P01?
NO
B
YES
SS5-4-4
SE2 OFF?
NO
YES
SS5-4-10
LSIZE←1
SS5-4-5
SE1 ON?
NO
YES
SS5-4-9
K←1
SS5-4-6
K←3
SS5-4-7
DECELERATE M3
SS5-4-8
S←2
SS5-4-11
S←7
RTS

COPYING METHOD AND APPARATUS FOR COPYING A DOCUMENT IN TWO-IN-ONE MODE

BACKGROUND OF THE INVENTION

1. Field of the Invention

The present invention relates to a copying machine for copying a document through the steps of feeding out a plurality of stacked document sheets one by one, arranging two document sheets on a glass platen in series with respect to a document conveying direction, and copying images of the two document sheets onto one large-size sheet.

2. Description of the Prior Art

Conventionally, as a copying method using an electrophotographic method, from copy-saving and filing-space-saving points of view, a two-in-one mode copying method (hereinafter, referred to as "two-in-one mode") has been known by a Japanese Patent Laid-Open Publication No. 3-114071, a Japanese Patent Publication No. 5-73095, and the like. In this two-in-one mode, document sheets placed on a document tray of an automatic document feeder (ADF) are fed onto the glass platen one by one. On the glass platen, the document sheets are set in such a way that two sheets at each one time are arranged in series with respect to the document conveying direction and that one end of one document sheet is made coincident with an exposure reference (for example, one side line of a scale provided upstream or downstream of the glass platen in the document conveying direction) while one end of the other sheet is made coincident with the other end of the one document sheet. Then, the two document sheets are exposed to light by a single scanning Operation. As a result, the two document sheets are copied onto a copying sheet of the same size as the original document sheet. More specifically, if the document sheets are of A4 size transverse, then the two document sheets are copied onto a sheet of A4 size longitudinal in reduction at a magnification factor of 0.707.

In the two-in-one mode as described above, it is important to arrange the two document sheets with their ends coincident with each other at the exposure position on the glass platen irrespectively of the quality of the document, and to make one end of the first document sheet accurately coincident with the exposure reference.

Two ways may be available for solving the above problem. A first way is to give such a feed amount that two document sheets reach the exposure position, with the rear end of the first document sheet coincident with the front end of the second document sheet, whereby the two document sheets are stopped in the exposure position. A second way is to convey the document sheets with a gap provided between the first and the second document sheets, and bringing the front end of one document sheet positioned on the side close to the scale into contact with the scale, whereby the one document sheet is moved relative to the other document sheet so that the interval between the document sheets is lessened.

However, in the second way including the step of bringing the document sheet into contact with the scale, if the document sheet is thin paper having a low bending strength or paper having a very high coefficient of friction, the document sheet may be bent when brought into contact with the scale, which in turn may incur paper jam, as possible problems. Therefore, although the second way has an advantage that the document sheets can be arranged more accurately to the exposure reference, the first way would be preferred to the second way when thin document sheets or the like are used. Also, the interval between one document sheet and another to be set in the second way should be controlled to a proper value depending on the quality (strength) of the paper used or the like.

In the two-in-one mode, in view of the bookbinding state of copied sheets, it is necessary to copy the image of a document sheet having the smaller page number out of the two sheets of document onto the left half of a sheet and to copy the original image having the larger page number onto the right half of the sheet. Therefore, when the two-in-one mode is executed with a copying machine which consists of a copying machine main body having an exposure reference at the left end of the glass platen as viewed from the operator side and an automatic document feeder for feeding stacked document sheets in order of decreasing page number of the document sheets and for conveying a document sheet in a direction from right to left side on the glass platen, it has been arranged that one end of the document sheet having a larger page number is made coincident with the exposure reference.

According to the above-described copying machine, when the number of document sheets stacked on the document tray is an even number, all the document sheets are copied in such a way that the image of one document sheet having a smaller page number is copied onto the left side of a sheet and the image of another document sheet having a larger page number is copied onto the right side of the sheet. However, when the number of document sheets stacked on the document tray is an odd number, the first-page document sheet to be set last would be copied with its one half blank. For prevention of this, even if the last-page document sheet is first set in one sheet alone previously, its one end is made coincident with the exposure reference so that only the last-page document would be copied onto an opposite side, i.e., the right side on a sheet, as a problem. This problem could be solved by such a measure that the last-page document sheet is positioned with its top on the operator side, i.e., upside down, or that the document sheet is conveyed from left to right side. Unfortunately, it would be unreasonable to expect such an operation on users.

Some automatic document feeders are arranged to feed document sheets stacked on the document tray by starting with its first page or with its last page. Also, other automatic document feeders are arranged to feed document sheets in a direction from left to right side on the glass platen. Meanwhile, some copying machines have the exposure reference position on the left side of the glass platen, and ethers on the right side.

SUMMARY OF THE INVENTION

The present invention has been developed to substantially eliminate the above-described disadvantages.

Accordingly, it is an object of the present invention to provide a copying machine which is capable of properly executing the two-in-one mode according to the document.

It is an another object of the present invention to provide a copying method by which an image of a document having a smaller page number is copied onto the left side of a sheet while an image of a document having a larger page number is copied onto the right side of the sheet, and by which even if the number of document sheets is an odd number, an image of the first or last page document is copied to a specified position of a sheet.

The invention has been developed with a view to the above object.

The invention of the first aspect, therefore, provides a copying machine for copying a document through the steps of feeding a plurality of stacked document sheets one by one; arranging two document sheets on a glass platen in series with respect to a document conveying direction; and copying images of the two document sheets onto one sheet by a single exposure scanning process, the copying machine comprising:

a scale arranged upstream or downstream of the glass platen in the document conveying direction and protruded upward from an upper surface of the glass platen;

a document conveying means having a first mode and a second mode, in the first mode the document conveying means conveying two document sheets to an exposure position with their ends made coincident with each other without restricting them by the scale, in the second mode the document conveying means conveying two document sheets on the glass platen with an interval provided therebetween and making the ends of the two document sheets coincident with each other by restricting one of the two sheets arranged on one side close to the scale;

selection means for selecting either the first mode or the second mode according to the quality of the document; and control means for controlling the document conveying means in the mode selected by the selection means.

In the preferred embodiment of the invention, the scale is biased upward by spring means and is position-restricted in a state protruding from the glass platen by a specified height so as to be pressed down by a scale pressing mechanism. In the second mode the scale is held in a position where the scale is lowered from the upper surface of the glass platen by the scale pressing mechanism.

Preferably, the document conveying means may give the document a conveying amount corresponding to a distance such that the document overruns the scale, whereby the document surely comes into contact with the scale.

Preferably, the selection means may comprise a key provided on an operational panel of the copying machine for inquiring whether the document is thin paper or not, whereby the first mode is selected when pressing down the key while the second mode is selected when not pressing down the key.

According to the above-described invention, for copying the document in the two-in-one mode, when the first mode is selected according to the quality of the document, two document sheets is conveyed in series with their ends coincident with each other and set to the exposure position. When the second mode is selected, on the other hand, two document sheets is set onto the glass platen by bringing one document sheet into contact with the scale so that no gap is provided between the two document sheets. Also, the interval between the two document sheets is controlled by the interval setting means so that ends of the sheets become coincident with each other without causing any gap when one document sheet is brought into contact with the scale. Accordingly, two document sheets can be arranged on the glass platen without gap at all times, irrespectively of the type of the document or the like, so that copied images free from image defects due to positional shift or document sheet overlap can be obtained. In an embodiment as will be described below, it is arranged that the document sheets are fed from an end of the glass on its one side opposite to the scale. However, the case is the same as above also when the document sheets are fed onto the glass by being passed above the scale from an end of the scale and, after being passed once, switched back to be hit against the scale.

The invention of the second aspect provides a copying method for copying a document through the steps of feeding a plurality of stacked document sheets one by one; arranging two document sheets on a glass platen in series with respect to a document conveying direction; and copying images of the two document sheets onto one sheet by a single exposure scanning process, the copying method further comprising:

a step of relatively changing a stop position on the glass platen where a document sheet fed out first or last is stopped and a copy start position on the sheet when the number of stacked document sheets is an odd number.

In a preferred embodiment of the invention, the method further comprises a step of detecting whether or not the number of the document is an odd number by making the document circulate an automatic document feeder over one cycle without being accompanied by the copying operation. Alternatively, the method may further comprises a step of detecting whether or not the number of the document is an odd number according to the number inputted by keys provided on an operational panel of the copying machine.

Preferably, the document sheet fed out first or last may be conveyed alone on the glass platen while the other document are conveyed in two-in-one mode.

In one preferred embodiment, the document sheet fed out first or last is stopped to a position apart from an exposure reference by an extent of the document size, and wherein the copying process is started from a former-half portion of the sheet.

In another preferred embodiment, the document sheet fed out first or last is stopped to a position coincident with an exposure reference, and wherein the copying process is started from a latter-half portion of the sheet.

If the last page of the document is inserted from the non-scale side, it is proper that a document to be fed last is set in one sheet alone by being separated according to its document size from the scale side. Also, if the document is set to the scale in the normal way, it may be arranged that after a half part from the front end of a sheet is erased prior to copying, the image of the document set to the scale position is copied onto the second half of the sheet.

According to the above-described invention, even when an odd number of document sheets are copied by the two-in-one mode, the image of the last-page document sheet can be produced to a desired position and copied images can be arranged into a specified sequence in a book-bound state. Also, an attachment having a staple function may be provided to the copying machine so that the sheets onto which the document images have been copied can be bound into book form automatically after copying.

BRIEF DESCRIPTION OF THE DRAWINGS

Further objects and advantages of the present invention will become clear from the following description taken in conjunction with the preferred embodiments thereof with reference to the accompanying drawings.

FIG. 12 is a side view of the scale pressing mechanism according to the second embodiment, showing a state that the plunger of the solenoid has been fully pulled in;

FIG. 120 is a flow chart showing the both-sides set subroutine in the CPU2 subsequent to FIG. 119;

FIG. 121 is a flow chart showing the both-sides set subroutine in the CPU2 subsequent to FIG. 120;

FIG. 122 is a flow chart showing the both-sides set subroutine in the CPU2 subsequent to FIG. 121;

FIG. 123 is a flow chart showing the both-sides set subroutine in the CPU2 subsequent to FIG. 122;

FIG. 124 is a flow chart showing the both-sides set subroutine in the CPU2 subsequent to FIG. 123;

FIG. 125 is a flow chart showing the input operation subroutine in the CPU1;

FIG. 126 is a plan view showing the key arrangement and the like of the control section of the copying machine; and FIG. 127 is a flow chart showing the indication subroutine in the CPU1.

DETAILED DESCRIPTION OF THE PREFERRED EMBODIMENTS

<General Construction and Operation of the Copying Machine>

Figure 1:
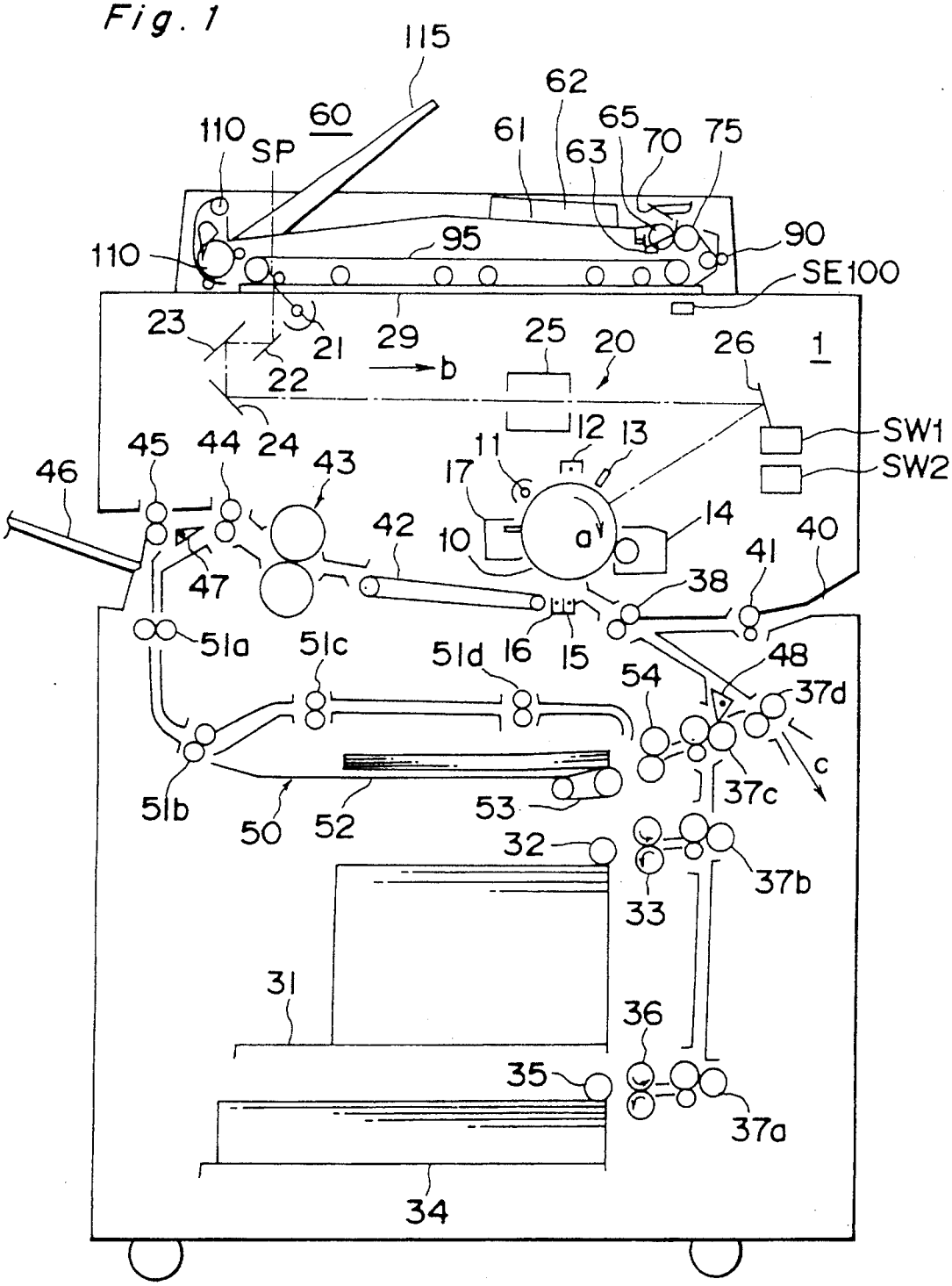
FIG. 1 is a schematic arrangement diagram of an automatic document feeder (ADF) and a copying machine main body, in which an automatic paper feeder according to the present invention is provided.

FIG. 1 shows the general construction of the copying machine, wherein at a generally center portion of a copying machine body generally denoted by numeral 1, a photosensitive drum 10 having a photosensitive layer on its outer circumference is installed so as to be rotatable in a direction of arrow "a" at a constant peripheral speed. Around the photosensitive drum 10, there are provided, in its rotating direction, a main eraser 11, a corona charger 12, a sub-eraser 13, a developing unit 14 of the magnetic brush type, a transfer charger 15, a paper-separating charger 16, and a cleaner 17 of the blade type. Also, an optical system 20 is disposed above the photosensitive drum 10.

The photosensitive drum 10 rotates in the direction of arrow "a", whereupon the main eraser 11, the corona charger 12, and the sub-eraser 13 perform the processes of erasing, charging, and inter-image and end-of-image erasing, respectively, and thereafter the image of a document set on a glass platen 29 is exposed to light by the optical system 20. As a result of this exposure, an electrostatic latent image formed on the photosensitive drum 10 is visualized as a toner image by the developing unit 14.

The optical system 20, disposed just under the glass platen 29, concurrently scans and illuminates the image of the document set with its one end coincident with an exposure reference or standard position SP, so that the photosensitive drum 10 is exposed to the resulting reflected light. During the image scanning operation, an exposure lamp 21 and a first mirror 22 move in a direction of arrow "b" at a speed v/m (m: magnification of copying) with respect to the peripheral speed v of the photosensitive drum 10 (constant whether the magnification is full or varied). Further, at the same time, a second mirror 23 and a third mirror 24 move in the direction of arrow "b" at a speed v/2m. Also, with a change in the magnification, a projection lens 25 moves on the optical axis, while a fourth mirror 26 swings or rotates so that the optical length is corrected.

Copying sheets, i.e. copying paper, are accommodated in an upper-stage paper feed unit 31 of the elevator type and a lower-stage paper feed unit 34 of the tray type, and fed from either one of them based on the selection by the operator. The paper feed units 31, 34 are provided with feed rollers 32, 35, and separating rollers 33, 36 each composed of a forward roller and a reverse roller. A sheet of paper fed from the upper-stage paper feed unit 31 is fed through conveyor rollers **37*b*, 37*c* to a timing roller 38 provided immediately before an image transfer unit. A sheet of paper fed from the lower-stage paper feed unit 34 is fed through conveyor rollers 37*a*, 37*b*, 37*c* to the timing roller 38**.

This copying machine also allows paper feed by manual operation, in which case a sheet of copying paper inserted from a manual feed port 40 is fed through a feed roller 41 to the timing roller 38. The sheet of paper fed to the timing roller 38 temporarily stands by here until it is sent out to a transfer section when the timing roller 38 is turned on in synchronization with an image formed on the photosensitive drum 10. The sheet is brought into close contact with the photosensitive drum 10 in the transfer section, where a toner image is transferred by corona discharge from the transfer charger 15, and then the sheet is separated from the photosensitive drum 10 by the corona discharge from the paper-separating charger 16 and by the sturdiness of the sheet itself. Thereafter, the sheet is fed through a conveyor belt 42 to a fixing unit 43, where toner is fixed, and then the sheet is discharged through a conveyor roller 44 and a discharge roller 45 onto a discharge tray 46. Meanwhile, the photosensitive drum 10 continues rotating in the direction of arrow "a" even after the transfer process, under which the photosensitive drum 10 has residual toner removed therefrom by the cleaner 17 and residual charges erased by the main eraser 11, thus being ready for the next copying process.

Within the copying machine body 1, there are provided a paper re-feed unit 50 and paper-path switching claws 47, 48 for processing both-sides or combined copy. The switching claw 47 is set normally to a solid-line position, and guides the sheet to the discharge tray 46. In the mode of both-sides copy or combined copy, a sheet onto the first surface (front surface) of which the image of an odd-numbered sheet of the document has been transferred is discharged through conveyor rollers **51*a*, 51*b*, 51*c*, 51*d* to an intermediate tray 52, by the switching claw 47 being set to a position which is slightly rotated counterclockwise. Then the sheet is accommodated on the intermediate tray 52 with its image surface upward. After a specified number of sheets have been accommodated on the intermediate tray 52, with a re-feed signal issued, the sheets are fed one by one, beginning to be fed with the lowest-layer of the sheets, by the rotation of a separating roller 54 to the conveyor roller 37*c***.

In the both-sides copy mode, the re-fed sheet is fed to the timing roller 38 while being guided upward by the switching claw 48 set to a solid-line position. Then, the image is transferred onto the second surface (rear surface) of the sheet, fixed, and then discharged to the discharge tray 46. In the combined copy mode, the re-fed sheet is conveyed in a direction of arrow "c" by a conveyor roller **37*d* by the switching claw 48 being set to a position which is slightly rotated clockwise. Immediately before the rear end of the sheet passes a nip portion of the conveyor roller 37*d*, the conveyor roller 37*d* is switched to the reverse rotation, whereby the sheet is reversed upward down and frontward back and sent out as such. Thereafter, the image is overlappingly transferred onto the first surface (front surface), fixed, and discharged onto the discharge tray 46**.

In the copying machine body 1, after the start of a copying process, while the first sheet is standing by immediately before the timing roller 38, a first-out paper feeding process that the second and following sheets are also previously fed to the paper feed path. For example, in the paper feed from the lower-stage paper feed unit 34, the second sheet in succession to the first sheet is fed to the paper feed path and moreover even the third sheet is fed to immediately before the conveyor roller 37*a*. Such a first-out paper feed process is performed not only in the multi-copy mode but also in the single copy mode using an ADF 60, which functions to enhance the copying speed.

<Construction and Operation of ADF>

The construction and operation of the ADF 60 is now described in detail. First, the outlined construction and operation of the ADF 60 are described in detail by referring to FIG. 2. The ADF 60 is generally composed of a document feed section 601, a document conveying section 602, and a document discharge section 603. The document feed section 601 comprises a document tray 61, an front-end restricting plate 63, a pickup roller 65, a document pressing plate 70, a separating roller 75, a separating pad 80, and a register roller 90, where the components except the document tray 61 are all covered with an openable/closable cover 604. The document conveying section 602 comprises a driving roller 96 disposed close to the document feed section 601, a subordinate roller 97 disposed close to the document discharge section 603, and a conveyor belt 95. These components are covered with a cover 605 which constitutes the document tray 61. The document discharge section 603 comprises a reverse roller 100, a discharge roller 110, and a discharged-paper tray 115. The components except the discharged-paper tray 115 are all covered with an openable/closable cover 606.

This ADF 60 is installed on the upper surface of the copying machine body 1 so that the conveyor belt 95 is positioned on the glass platen 29. The ADF 60 is arranged to be openable to the upper surface of the glass platen 29 by an unshown hinge fitting provided on a back side or a side opposite to the operational side of the ADF 60.

To set the document manually onto the glass platen 29, the operator lifts the ADF 60 upward to make the upper surface of the glass platen 29 opened. The opening or closing of the ADF 60 is detected by a magnet sensor SE100 as shown in FIG. 1. The ADF 60 will not be operable until the magnet sensor SE100 detects that the ADF 60 is properly closed.

Figure 2:
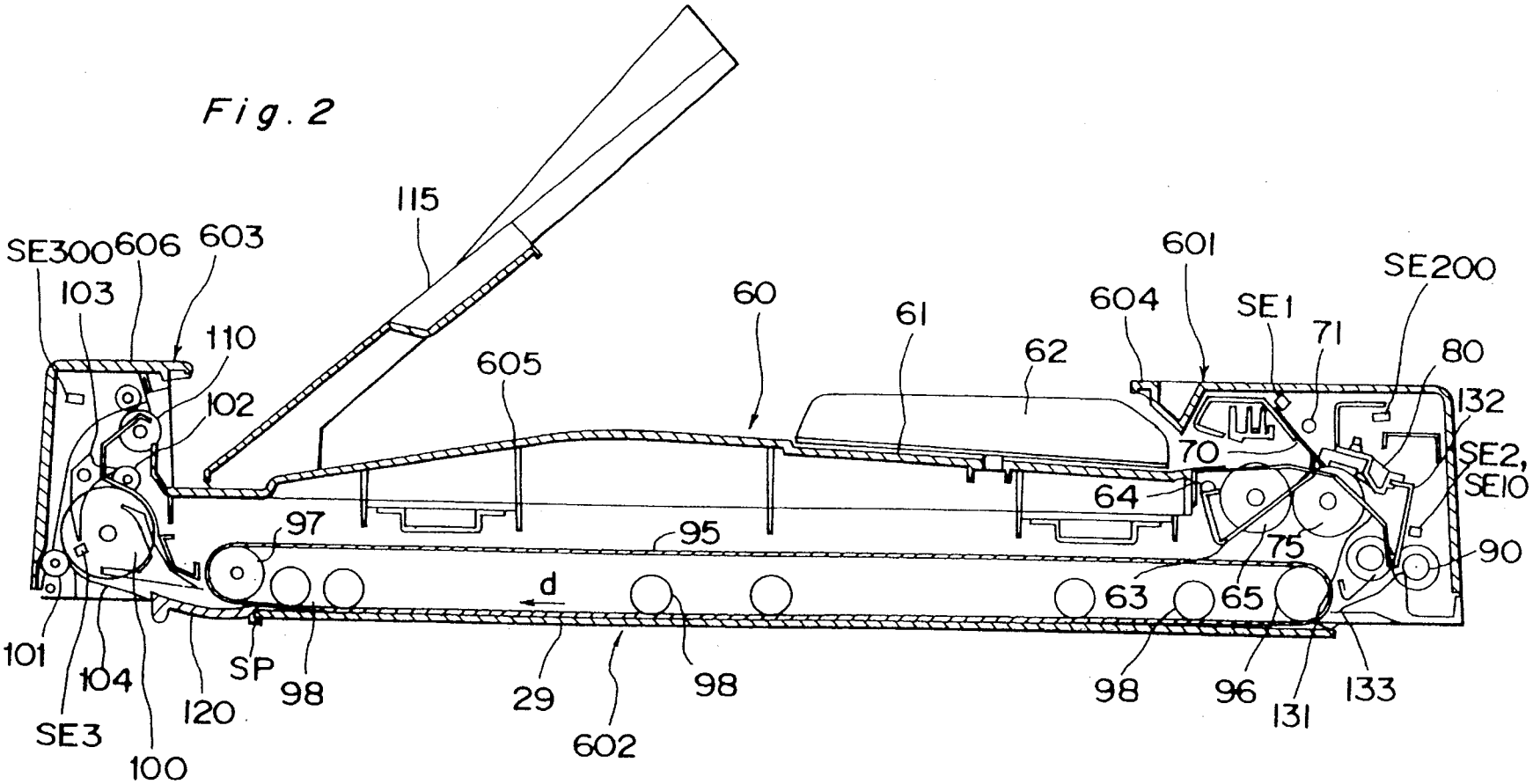
FIG. 2 is a sectional view showing the internal arrangement of the ADF.

A document to be fed is loaded on the document tray 61 with the first page of the document upward. In this state, the document is position-restricted in the widthwise direction by a side restricting plate 62, and position-restricted at its front end by the front-end restricting plate 63. The front-end restricting plate 63 and the pressing plate 70 are arranged to be rotatable on shafts 64, 71, respectively. In the paper feeding process, the front-end restricting plate 63 will have withdrawn downward when the first to last sheets of the document are completely fed. When the first document sheet is fed, the document pressing plate 70 moves downward from its withdrawal position as shown in FIG. 2, so as to press the front-end portion of the sheet against the pickup roller 65, thereby imparting a paper feed pressure to the sheet.

The pickup roller 65 and the separating roller 75 are driven to rotate both clockwise in the paper feeding process. The document sheets pass between the separating roller 75 and the separating pad 80, one by one starting with the lowest-layer one, so as to be fed to the register roller 90. The register roller 90 holds the fed sheet temporarily stood by at its nip portion, and after a certain time duration, is driven to convey the sheet to the entrance of the glass platen 29.

The conveyor belt 95 is stretched endlessly between the driving roller 96 and the subordinate roller 97 so as to cover the entire surface of the glass platen 29. Within the conveyor belt 95, a multiplicity of backup rollers 98 are rotatably provided in order to make the conveyor belt 95 pressed against the glass platen 29. The conveyor belt 95 is driven to rotate in the direction of arrow "d", whereby the document sheet is set with its front end registered with the standard position SP (exposure standard), for starting the exposure, which is a boundary between a scale 120 and the glass platen 29.

In proximity to the reverse roller 100 there are provided pinch rollers 101, 102 and a switching claw 103, the latter being purposed to switch the paper path for reversing the document sheet in the both-sides document mode. Normally, the switching claw 103 is set to the solid-line position and, after completion of the exposure, the document sheet is discharged from on the glass platen 29 based on the rotation of the conveyor belt 95 in the direction of arrow "d" and the clockwise rotation of the reverse roller 100. The discharged sheet is then guided upward by a guide plate 104 and the switching claw 103, and discharged onto the discharged-paper tray 115 by the discharge roller 110. Since the second surface (rear surface) of the document is first processed in the case of the both-sides document mode, the both-sides document, before fed onto the glass platen 29, is rotated clockwise by a specified angle from a state as shown in the figure. In this state, the document is first conveyed around the reverse roller 100 so as to be reversed, and returned onto the glass platen 29 with its second surface downward. In this process, the conveyor belt 95 is driven to rotate in a direction opposite to that of arrow "d". Further, after the second surface has completely been exposed, the both-sides document is again conveyed around the reverse roller 100 so as to be reversed for the process of copying the first surface (front surface).

Figure 65:
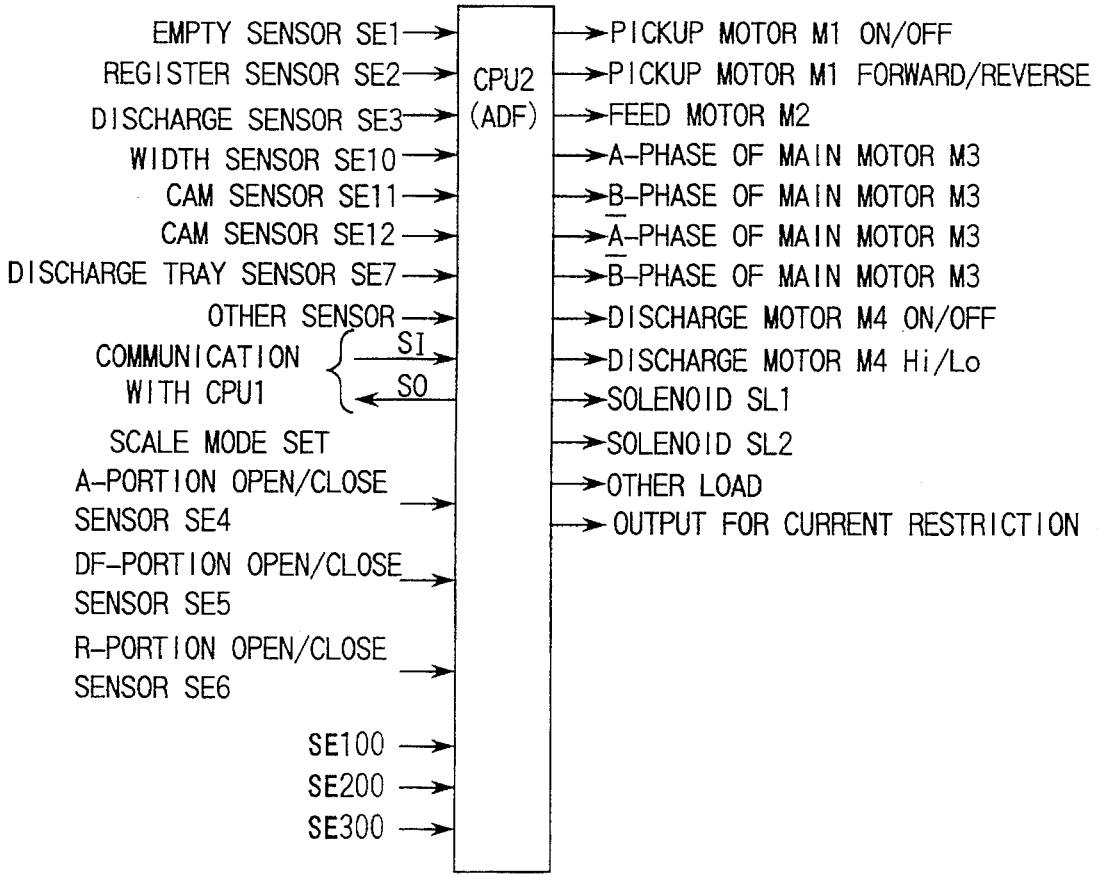
FIG. 65 is a block diagram showing the control section of the ADF.

The reverse roller 100 and the discharge roller 110 are driven to rotate by a discharge motor M4 (see FIG. 65). The ADF 60 is provided with various types of sensors SE1, SE2, SE3, and SE10 for detecting the document. The sensor SE1 detects the presence or absence of a document on the tray 61. The sensor SE2, provided immediately before the register roller 90, detects the reaching and passage of the document, and detects the length of the document in cooperation with a timer when the document is sent out from the register roller 90. The sensor SE10, juxtaposed with the sensor SE2, detects the size of the document in its widthwise direction. Based on document detection signals at the sensors SE2 and SE10, the size of the document is decided including whether the document is of longitudinal feed (longer side of the document is parallel to the conveying direction) or of transverse feed (shorter side of the document is parallel to the conveying direction). Further, the sensor SE3, disposed at the entrance of the reverse roller 100, detects a document passing therethrough.

<Explanation of Scale 120 and Others>

The scale 120 is graduated for placing the document with its one end registered with the mark of its size when the document is manually placed on the glass platen 29 with the ADF 60 lifted. The scale 120 has a function of forcedly stopping at the exposure standard position SP the document sheet conveyed on the glass platen 29 by the conveyor belt 95 in the operation of the ADF 60, as well as a function of designating the position of a document when the document is manually replaced with another.

The scale 120 is oppositely disposed at an end portion of the glass platen 29 downstream of the document conveying direction. As shown in FIGS. 3 to 6, the scale 120 is rotatably mounted to holders 121 provided on both back and front sides of an upper-surface frame 2 of the copying machine body 1, with a pin 122 serving as a fulcrum, in such a state that a front-end portion of the scale 120 or a portion thereof on the glass platen 29 side is biased upward by a spring 123.

This scale 120 has at its bottom a protrusion 120*a* confronting the upper-surface frame 2 and a protrusion 120*b* protruding into a space below the glass platen 29. There are also provided a plurality of portions such as a tangle-preventing portion 120*f*, which is provided below a front-end surface 120*c* so as to protrude toward an end surface of the glass platen 29, a lever-contact portion 120*d*, which is provided above on the back side, and a cut portion 120*e* of a specified length, which is provided at an upper end corner portion on the front-end side.

Figure 3:
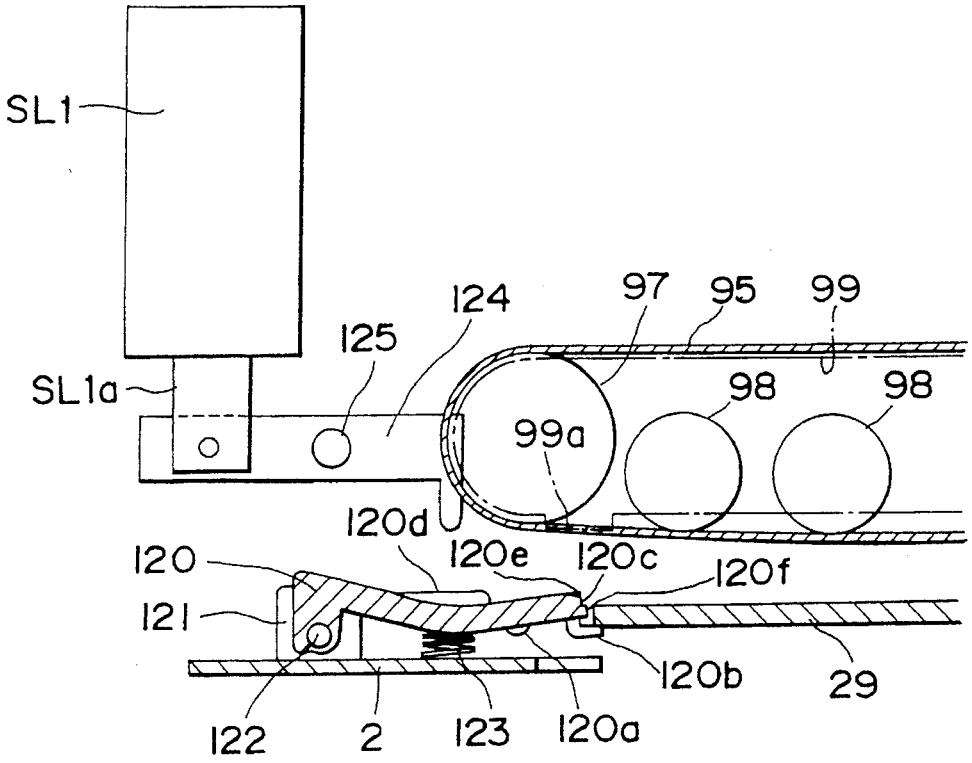
FIG. 3 is a sectional view of a first embodiment of the scale pressing mechanism, showing the position of the scale with the conveyor belt away from the glass platen.

Thus, as shown in FIG. 3, with the ADF 60 opened to the copying machine body 1, the scale 120 is position-restricted in a state that the protrusion 120*b* is engaged with the lower surface of the glass platen 29 based on the biasing force of the spring 123 and that the front-end is protruded from the glass platen 29 by a specified height. In this state, the tangle-prevention part 120*f* is held below the upper surface of the glass platen 29. As a consequence, the document placed on the glass platen 29 is accurately positioned with its one end in contact with the front-end surface 120*c* of the scale.

With the ADF 60 closed to the copying machine body 1, a protrusion portion 99*a* of a frame 99 that supports the rollers 96, 97 and the conveyor belt 95 is in contact with the scale 120, while the scale 120 is maintained such that its front-end portion is in contact with the conveyor belt 95 and protruded from the upper surface of the glass platen 29 by a specified height. The scale 120 is so set as to descend in the above state to lower than the state of FIG. 3. The frame 99 is kept parallel to the glass platen 29 by an unshown positioning member. Accordingly, when the ADF 60 is mounted on the copying machine body 1, the positional relation between the front-end of the scale 120 and the conveyor belt 95 supported by the frame 99 as well as the contact state between the same can be maintained readily and reliably in proper state. As a result, the scale 120 no longer needs to be controlled for its rotation, whereas the document will no longer pass by without being restricted by the scale 120 based on insufficiency of the pressing force or the pressing amount. Accordingly, the document can be restricted reliably by the scale 120. Further, improved is the accuracy with which the document is stopped when the front-end of the document is brought into contact with the scale 120, so that any skew (tilted feed) can be corrected reliably.

Figure 5:
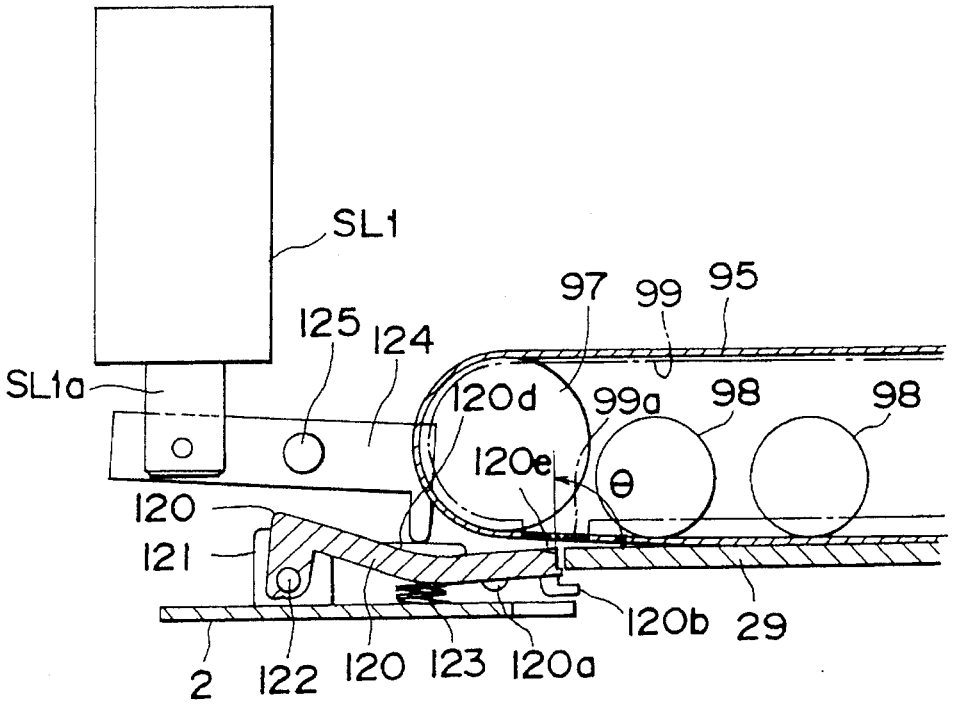
FIG. 5 is a sectional view of the scale pressing mechanism according to the first embodiment, showing a state that the scale is lowered.
Figure 6:
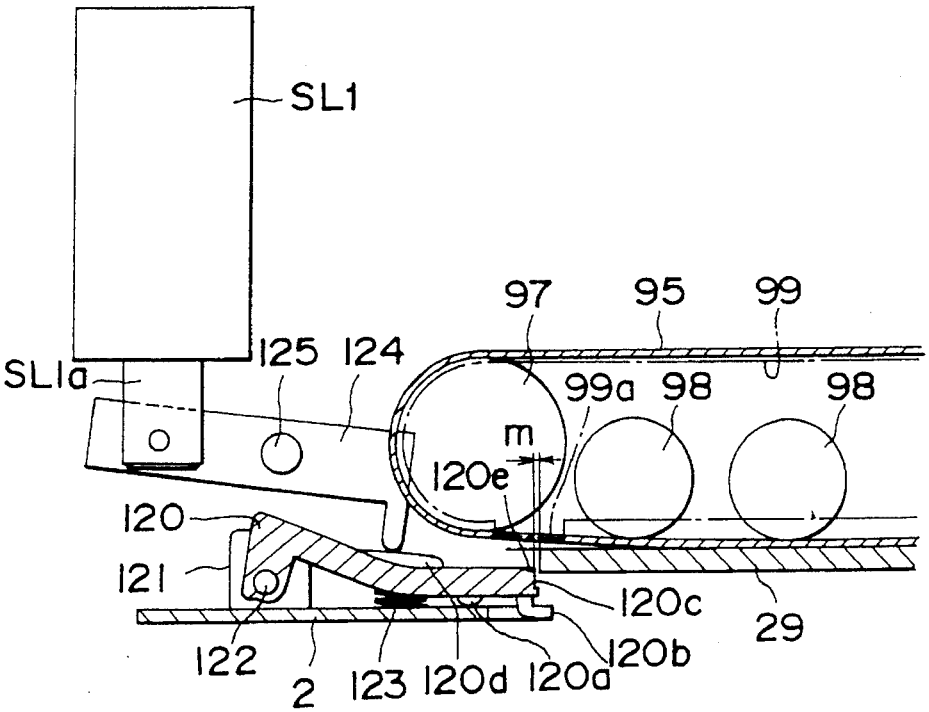
FIG. 6 is a sectional view of the scale pressing mechanism according to the first embodiment, showing a state that the scale has been lowered.
Figure 7:
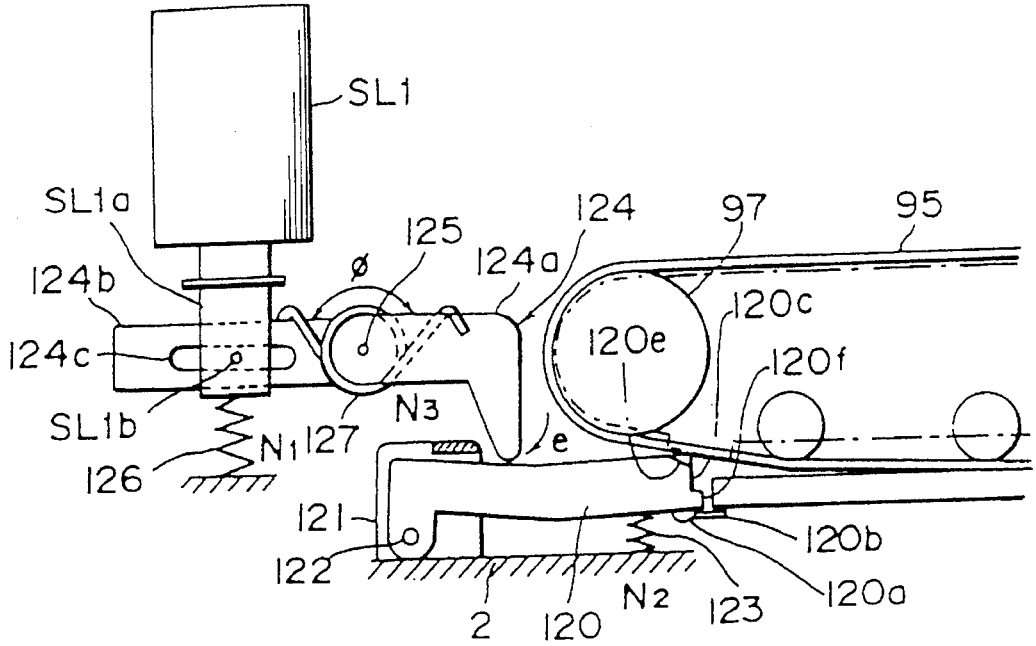
FIG. 7 is a side view of a second embodiment of the scale pressing mechanism, showing a state that the scale has been raised.
Figure 8:
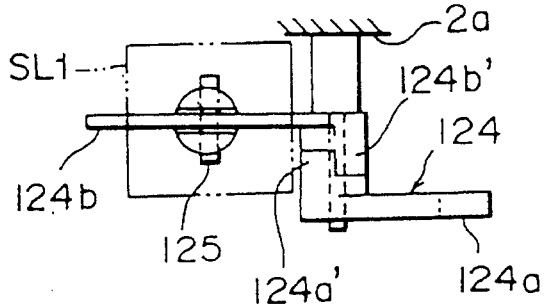
FIG. 8 is a partial plan view of the scale pressing mechanism according to the second embodiment.

A lever 124 for rotating the scale 120 is rotatably supported by a shaft 125 provided on an inner frame (not shown) of the ADF 60 and has its one end rotatably coupled with a plunger SL1*a* of a solenoid SL1. When the solenoid SL1 is turned from off to on state, the lever 124 is brought into contact with the lever-contact portion 120*d* as shown in FIGS. 5 and 6, whereby the scale 120 is rotated clockwise so that its front-end is pushed down to under the glass platen 29.

With the above arrangement adopted, the document conveyed on the glass platen 29 from right to left side as viewed in the figure is stopped as its end on the downstream side in its moving direction is brought into contact with the front-end surface 120*c* of the scale 120. Thereafter, the copying machine body 1 starts the exposure process. Upon completion of the exposure process, the solenoid SL1 is switched from off to on state, so that the lever 124 rotates clockwise in the figure on the shaft 125, pressing the lever-contact portion 120*d*. As a result, the scale 120 rotates clockwise in the figure on the shaft 122 so that the front-end portion of the scale lowers below the upper surface of the glass platen 29, whereby the document is conveyed to the discharge side (left side) as the conveyor belt 95 moves.

It is to be noted that when the rotating axis 122 of the scale 120 is arranged below the upper surface of the glass platen 29, a clearance "m" (see FIG. 6) between the front-end surface 120*c* of the scale and the glass platen 29 becomes smaller with the scale 120 lowering. Also, an angle θ (see FIG. 5) formed by the front-end surface 120*c* of the scale and the upper surface of the glass platen 29 is set so as to be more than right angles with respect to the document path direction, whether the scale 120 is protruded from the upper surface of the glass platen or has lowered below the same. As a result, even if the front end of the document is caught on the front-end surface 120*c* of the scale with the scale 120 positioned below the glass platen 29, the document will have its front end raised by its own sturdiness and the guide function of the angle θ enough to easily pass the front-end portion of the scale. Consequently, the document will never be entangled in the clearance between the scale 120 and the glass platen 29, while the document is free from jam and damage at the front end of the document.

<Second Embodiment of the Scale Pressing Mechanism>

Figure 9:
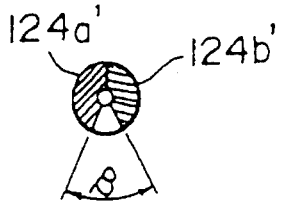
FIG. 9 is a sectional view of the lever member of the scale pressing mechanism according to the second embodiment.
Figure 10:
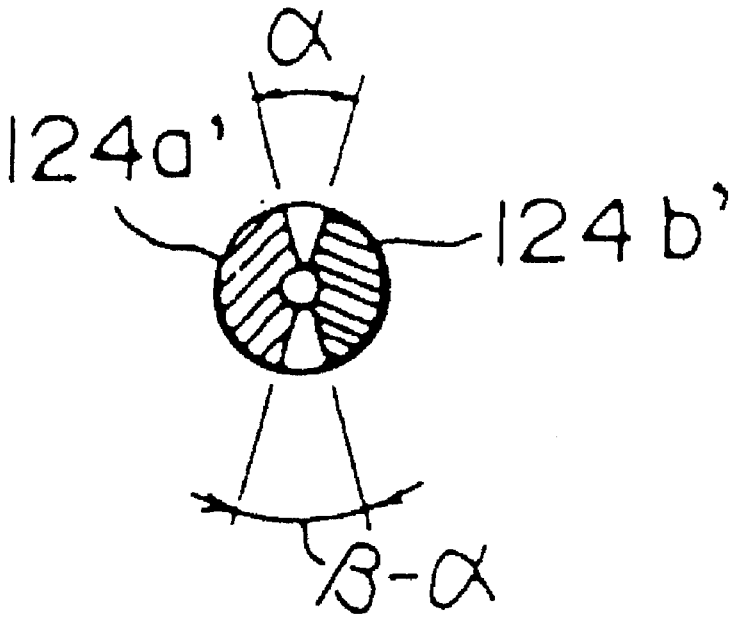
FIG. 10 is a sectional view of the lever member of the scale pressing mechanism according to the second embodiment.

FIG. 7 through 12 illustrate another embodiment of the mechanism for pressing the scale 120. In this pressing mechanism, the lever 124 is made up of two lever members 124*a*, 124*b* and a coupling portion of these lever members 124*a*, 124*b* is rotatably supported by a pin 125 fixed to an inner frame 2*a* of the ADF 60. At the pin-coupling portion between the lever members 124*a*, 124*b*, there are formed fan-in-section portions 124*a*', 124*b*' about a center of the fixed pin 125, as shown in FIGS. 9 and 10, the fan-in-section portions being arranged so that they are opposed to each other with the fixed pin 125 therebetween and that one lever member 124*a* (124*b*) is rotatable about the fixed pin 125 by a specified angle relative to the other lever member 124*b* (124*a*). Wound around the fan-in-section portions 124*a*', 124*b*' is a stroke-absorbing spring 127 whose two ends are engaged with the lever members 124*a*, 124*b*, respectively. One lever member 124*a* is biased clockwise relative to the other lever member 124*b* so as to be restricted into the state of FIG. 9, whereas in the normal mode the lever members 124*a*, 124*b* form an angle ϕ (see FIG. 6) as an intersecting angle of their upper surfaces. Besides, a long hole 124*c* provided in the lever member 124*b* is coupled with the plunger SL1*a* of the solenoid SL1 provided upward. The plunger SL1*a* is biased upward by a spring 126 provided on the inner frame 2*a* of the ADF 60. The biasing force of the spring 126 is so controlled that with the solenoid SL1 is off, the lever member 124*a* is brought into contact with the scale 120 but the scale 120 is not be pressed down. That is, if the biasing forces of the springs 126, 123, and 127 are N1, N2, and N3, respectively, then the biasing forces are controlled so as to meet the relationship that N3>N2>N1. Accordingly, even if there is an error in mounting the ADF 60 onto the copying machine body 1, the lever 124 can be positively brought into contact with the scale 120. Thus, even when the solenoid SL1 is switched to the on state so that the scale 120 is pressed down by the lever 124, there will occur no collision noise of the lever 124 and the scale 120. Furthermore, it is also possible to absorb any possible noise of the scale 120 colliding with an ascend-restricting member (such as the conveyor belt 95 or the protrusion portion 99*a*) when the solenoid SL1 is switched to the off state.

Figure 11:
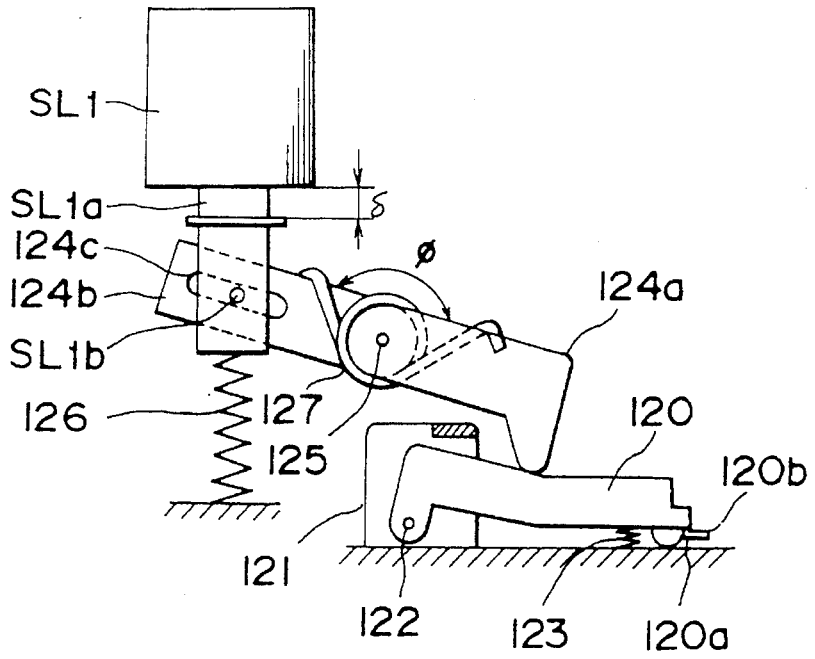
FIG. 11 is a side view of the scale pressing mechanism according to the second embodiment, showing a state that the moving solenoid is pressing the scale.

In the scale pressing mechanism having the above arrangement, when the solenoid SL1 is switched to the on state, the lever 124 rotates clockwise so that the front end of the lever member 124*a* presses the scale 120 as shown in FIG. 11. The scale 120 rotates on the shaft 122 while the protrusion 120*a* for use of scale descent positioning comes into contact with the upper-surface frame 2 of the copying machine body, where the front end portion of the scale 120 stops at a position slightly below the glass platen 29. At this time point, the drive stroke of the solenoid SL1 has an unreached portion left; that is, the plunger SL1*a* has not been absorbed completely. The resultant remainder 6 is determined by taking into account the combining accuracy of the copying machine body 1 and the ADF 60 and the like, and should be larger than zero. Until this time point, since the biasing force of the spring 127 is larger than the biasing force of the spring 123, N2, the intersecting angle of the levers 124*a* and 124*b* is maintained at $\phi$.

Figure 12:
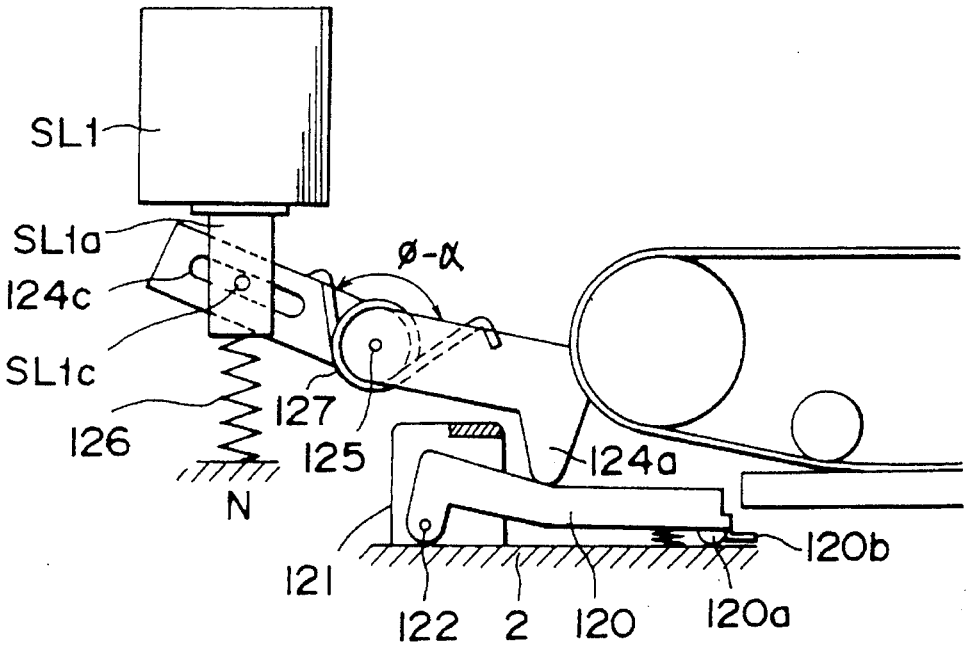

If the plunger SL1*a* is absorbed further than in the above state, the absorbing force of the solenoid SL1 at this time point is larger than the biasing force of the spring 127 so that, relative to the lever member 124*a* position-restricted by contact with the scale 120, the other lever member 124*b* rotates clockwise so as to absorb the stroke remainder $\delta$ of the plunger SL1*a*, as shown in FIG. 12, with the result that the upper-surface intersecting angle of the lever members 124*a* and 124*b* is $\phi-\alpha(\alpha<\beta)$ and the relative angle of the lever 124*a* and the lever 124*b* is in a state as shown in FIG. 10, as the plunger SL1*a* is in the final absorption state. Accordingly, the plunger SL1*a* is completely absorbed in its on state, that is, the plunger SL1*a* will never be held in an incomplete absorption state. As a result, the load in the on state is low so that current consumption can be reduced to a minimum.

<Third Embodiment of Scale Pressing Mechanism>

Figure 13:
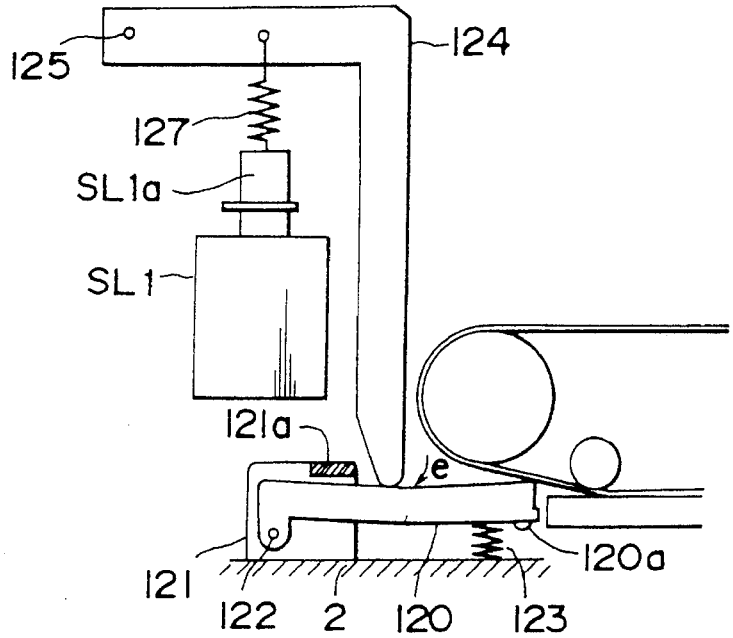
FIG. 13 is a side view showing a third embodiment of the scale pressing mechanism.

FIG. 13 illustrates another embodiment of the mechanism for pressing the scale 120. In this embodiment, the scale 120 is biased upward by the spring 123 into contact with the belt 95, and position-restricted with its front-end surface protruded from the upper surface of the glass platen 29. The lever 124 is disposed inside the ADF 60, and held rotatably on the shaft 125, with its generally center portion coupled with the plunger SL1*a* of the solenoid SL1 via the stroke-absorbing spring 127. With the solenoid SL1 off, the front end of the lever 124 is brought into contact with the scale 120 by the moment due to the dead weight of the lever 124 and the plunger SL1*a*, where it is arranged that the scale 120 will not be pressed down. In this mechanism, with the solenoid SL1 switched to the on state, the plunger SL1*a* descends so that the lever 124 rotates clockwise about the shaft 125 and is positioned as the scale descent positioning protrusion 120*a* is brought into contact with the upper-surface frame 2 and the front end portion of the scale is lowered slightly below the glass platen 29. At this time point, the plunger SL1*a* has not been attracted completely. However, the amount of subsequent travel of the plunger SL1*a* is absorbed into the extension and deformation of the stroke-absorbing spring 127.

<Fourth Embodiment of Scale Pressing Mechanism>

Figure 14:
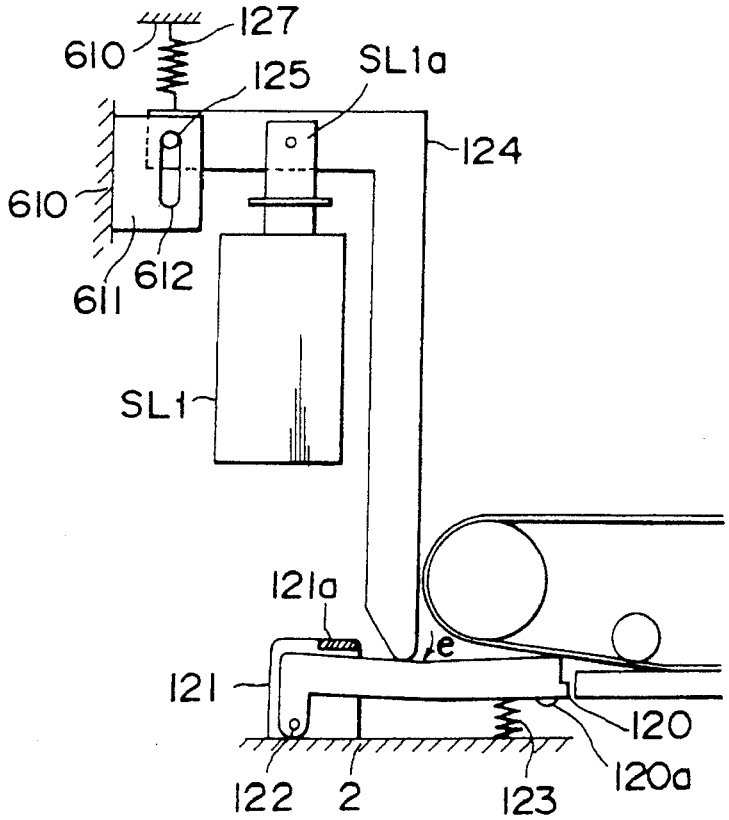
FIG. 14 is a side view showing a fourth embodiment of the scale pressing mechanism.
Figure 15:
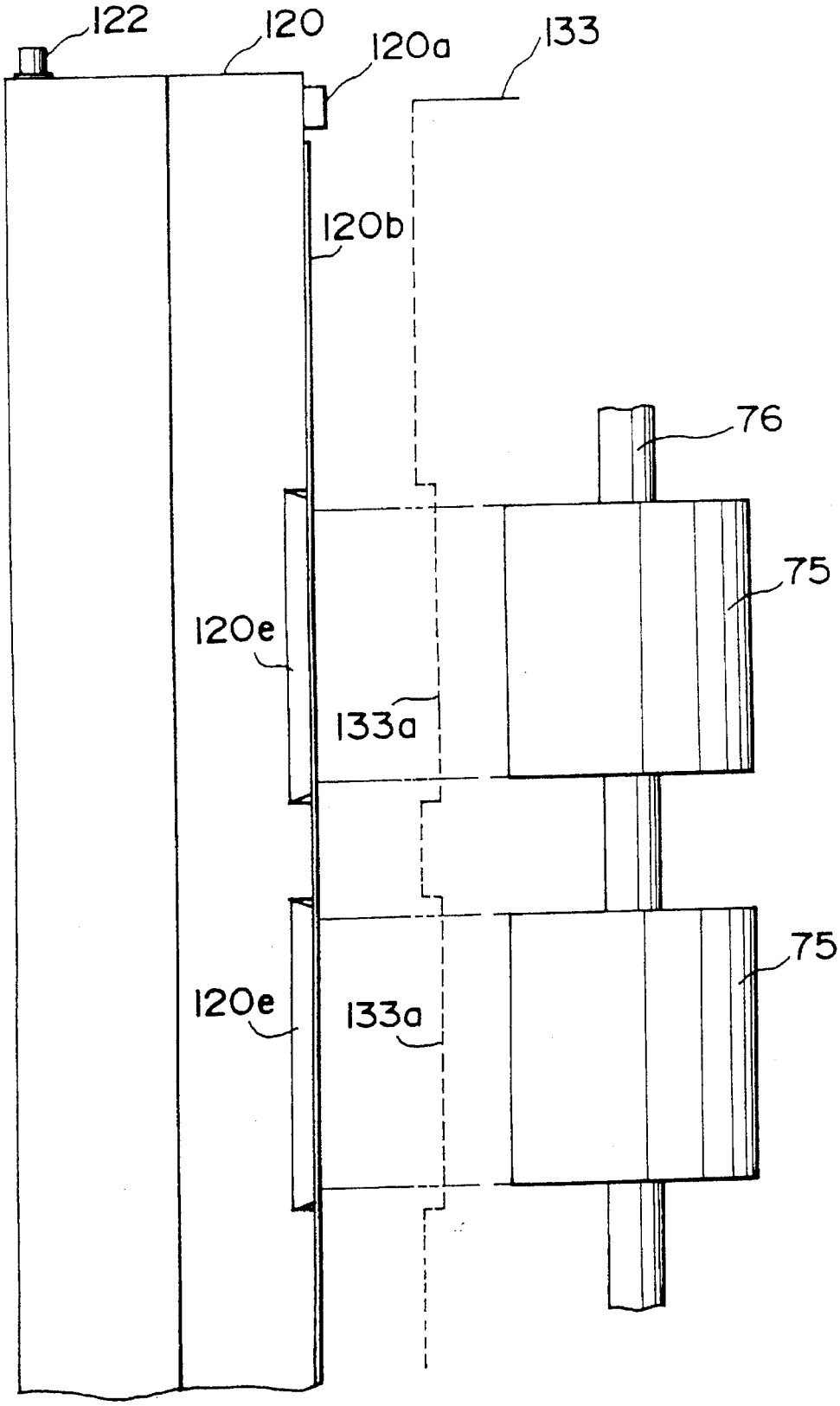
FIG. 15 is an explanatory view of the planar positional relation among the front end portion of the scale, the cut portion of the film, and the separating roller.

FIG. 14 illustrates another embodiment of the scale pressing mechanism. In this embodiment, the scale 120 is biased upward by the spring 123 into contact with the belt 95, with its front-end surface is protruded from the upper surface of the glass platen 29. The lever 124 has at its one end a shaft 125, which is engaged with a long hole 612 extending vertically of a rib 611 fixed to an inner frame 610 of the ADF 60. The lever 124 is also biased upward by being coupled with the stroke-absorbing spring 127 whose one end is fixed to the inner frame 610. The plunger SL1*a* of the solenoid SL1 is coupled with the generally center portion of the lever 124, and it is arranged that with the solenoid SL1 off, the free end of the lever 124 is brought into contact with the scale 120, where the scale 120 will not be pressed down. In this mechanism, when the solenoid SL1 is switched to the on state, the lever 124 rotates clockwise with the plunger SL1*a* descending, thereby pressing down the scale 120. The scale 120 stops with the scale descent positioning protrusion 120*a* in contact with the upper-surface frame 2. At this time point, the stroke of the solenoid SL1 has an unreached portion left, the subsequent movement of the plunger SL1*a* being absorbed by the stroke-absorbing spring 127 and the downward movement of the long hole 612 of the shaft 125. In addition, regardless of the above-described embodiment, the driving source may alternatively be a rotary solenoid or a motor. The driving force transfer means may be composed of a material and shape having flexibility itself, and may have a torque limiter type absorbing mechanism using frictional force or magnetic force may be employed.

Now explained the function of the cut portion 120*e* provided at the front end portion of the scale 120. In the ADF 60, as described before, a plurality of document sheets fed to between the separating roller 75 and the separating pad 80 based on the feeding function of the pickup roller 65 are separated one by one by the separating function of the separating roller 75 and the separating pad 80. In this process, there occurs a slip between the document sheet under feed toward the glass platen 29 and the separating pad 80 and yet the separating pad 80 is composed of a material having a relatively high coefficient of friction. As a result, there is generated paper dust or powder of chipped document images (images with poorly fixed prints or images particularly such as of copied document or hand-written document) at portions of the document which make contact with the separating pad 80. The resultant powder adheres to the document or temporarily adheres to the separating pad 80 to then adhere subsequent document sheets. Similarly, when the separated document sheet passes the separating pad 80 based on the drive by the register roller 90, paper dust adheres to it as well. When the paper dust or the like adhering to the document is brought into contact with portions of high contact pressure or large contact angles to the document, such as the front end portions of a resin film 133 (see FIG. 2) and the scale 120, the paper dust adhering onto the document is scraped off such that the glass platen 29 may be dirtied or that the powder may fall inside the copying machine body 1 through the gap between the glass platen 29 and the upper-surface frame 2, causing the optical system or the chargers to be dirtied with the result of deterioration in the image quality. Thus, on the front end portions of the scale 120 and the resin film 133, cut portions 120*e* and 133*a*, respectively, are provided so as to be positioned on a line of the separating roller 75 extended in the document conveying direction. Therefore, the paper dust on the document adhering onto the contact portion with the separating pad 80 will never be scraped off by the resin film 133 or the scale 120, whereby the above problems are solved. In addition, although a movable scale has been employed for the ADF of the present embodiment, the case is the same also with a stationary scale. As the paper separating system, although a separating pad has been employed, yet the case is the same also with other various types of systems such as a reverse roller system. Furthermore, if paper dust or the like is generated at the register roller and the reverse roller, a cut portion may be provided at its corresponding site. Meanwhile, the ADF may also be arranged so that the conveying unit of the glass platen is implemented by components other than the belt, such as rollers. Also, similar advantages can be obtained by such an arrangement that copying is done while the document is being passed on a fixed image reader at a constant speed.

<Document Feed Section>

Figure 16:
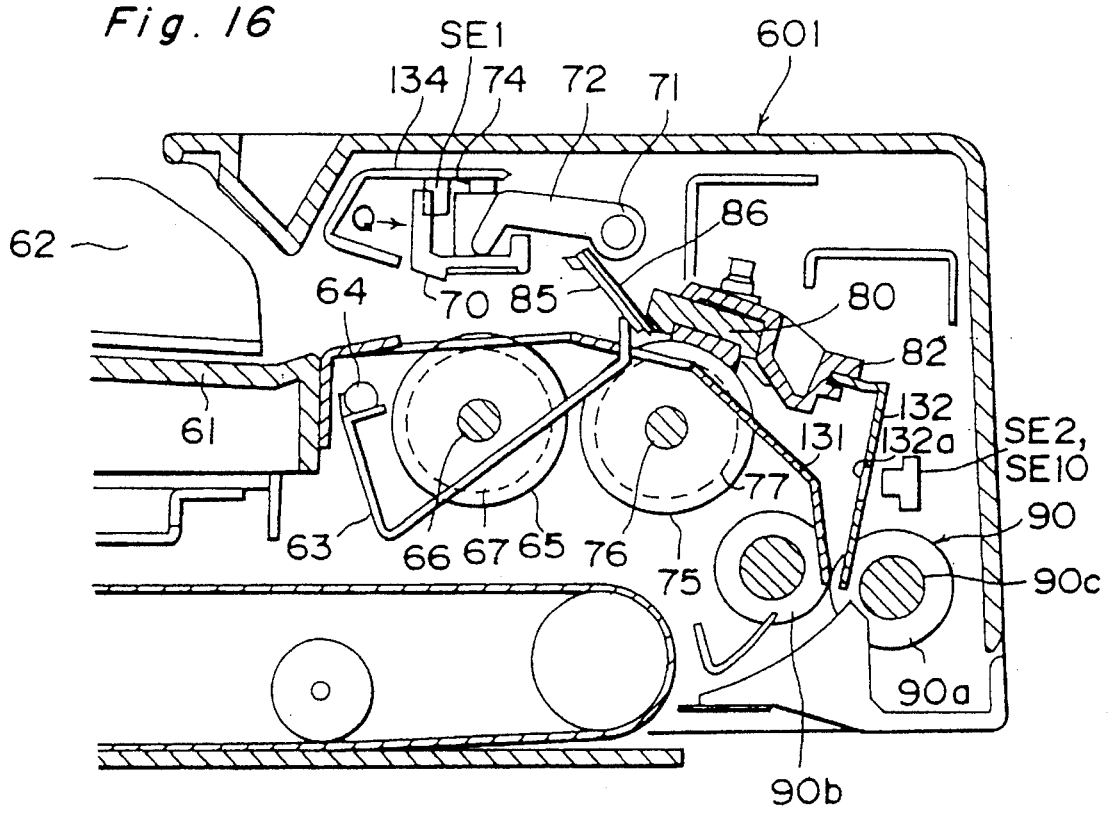
FIG. 16 is a sectional view of the document feed section in the ADF.

The document feed section 601 is now explained. Referring to FIG. 16, a document guide plate 131 is provided so as to extend from a front end of the tray 61 at a level slightly lower than the upper portions of the pickup roller 65 and the separating roller 75, with the front end extended to the register roller 90. Another document guide plate 132 is provided so as to extend from above the separating roller 75 to downstream of the register roller 90. The front-end restricting plate 63 is provided below the document guide plate 131 as it is fixed to the shaft 64, and is movable between a restricting position (shown in the figure) where the front end is protruded from the document guide plate 131 and a withdrawal position where the front end is withdrawn below the guide plate 131. Normally, the front-end restricting plate 63 is set to the restricting position, where the front-end restricting plate 63 receives the front end of the document set to the tray 61 so as to give the operator a set-up feeling, while the front-end restricting plate 63 also functions to properly align the front end of the document. This front-end restricting plate 63 withdraws below the guide plate 131 when a document feed start signal is issued, and will be held in this withdrawal position until the last document sheet is fed.

Figure 17:
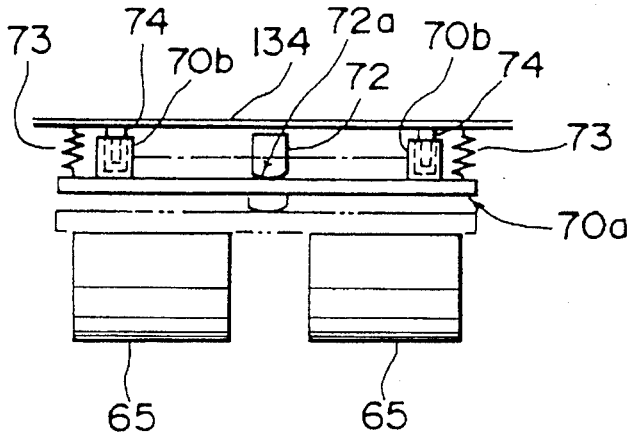
FIG. 17 is a front view showing a state that the pressing plate is pressed in the document feed section.
Figure 18:
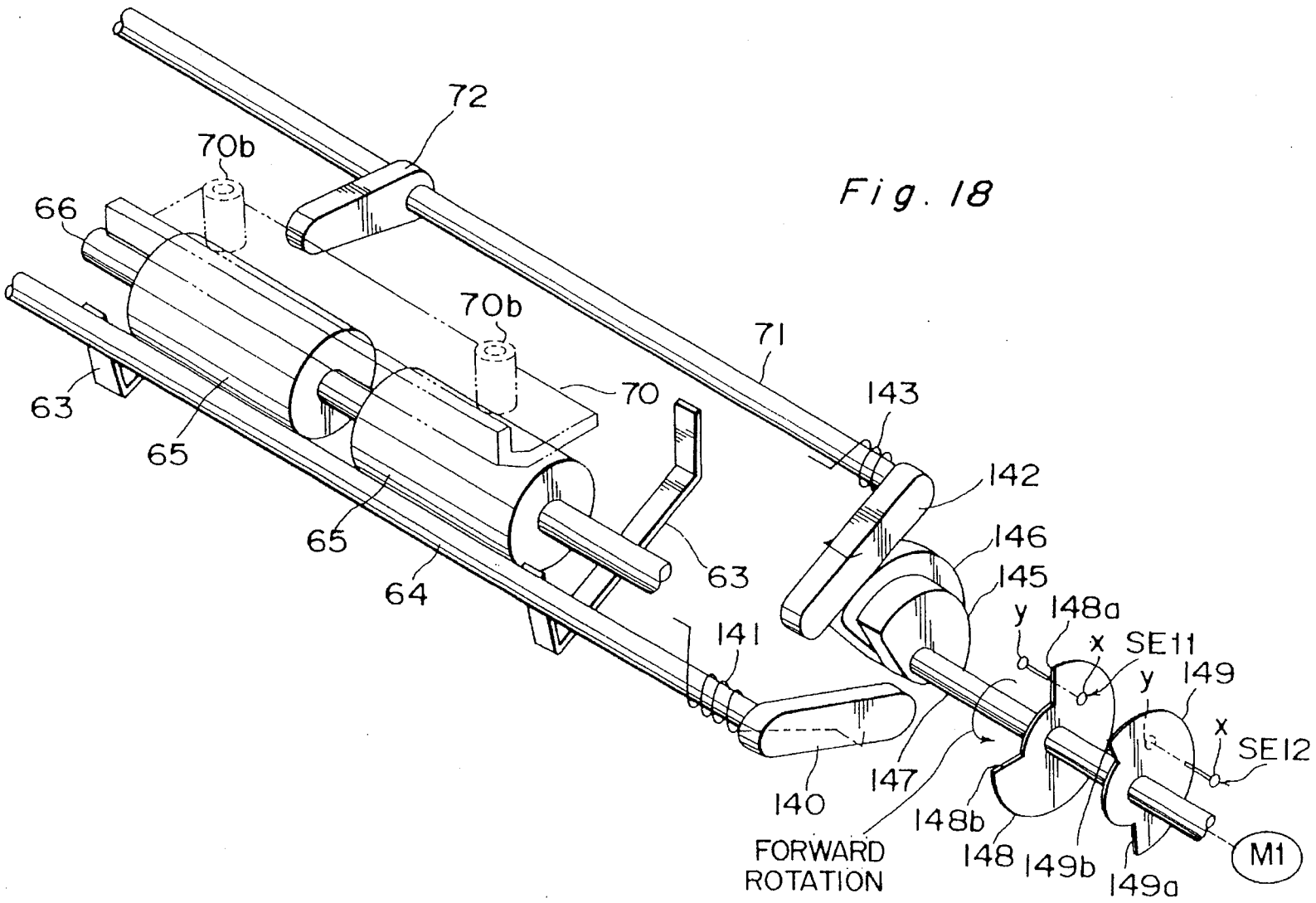
FIG. 18 is a perspective view showing the driving mechanism for the front-end restricting plate and the pressing plate in the document feed section.

The document pressing plate 70 is provided above the pickup roller 65, and is arranged as shown in FIG. 17 so that a plurality of guide sleeves **70*b* provided to the document pressing plate 70 can be inserted into guide pins 74 fixed to a guide plate 134, whereby the plate is capable of moving up and down, and coming into and out of contact with the pickup roller 65. The document pressing plate 70 also has tensile coil springs 73 each one end of which is coupled with a corresponding one of both ends of the document pressing plate 70, and the other end of which is coupled with the guide plate 134, in which arrangement the document pressing plate 70 is normally biased upward. A lever 72 is fixed to the shaft 71 as shown in FIG. 18, rotatable on the shaft 71. The shaft 71, reciprocatable by a rotation driving means shown in FIG. 18, normally holds the lever 72 positioned in a solid-line position, whereas the shaft 71 is urged to rotate counterclockwise in the paper feed operation, thereby biasing the document pressing plate 70 toward the pickup roller 65, so that the fed document is pressed against the pickup roller 65 with a specified pressure. The document pressing plate 70 is moved in parallel with and vertically to the pickup roller 65 in order to implement a reliable paper-separating function by attaining a constant angle at which the document rushes in between a pre-separating plate 85 and a separating roller 75, regardless of the number of document sheets as well as the thickness thereof. Also, as shown in FIG. 17, the document pressing plate 70 is so arranged that the guide sleeves 70*b* and the guide pins 74 are engaged with each other with a clearance therebetween, and that a pressing surface 72*a* of the lever 72 is formed of a spherical surface, which spherical surface is in contact with a rear surface of the document pressing plate 70. This arrangement allows the document pressing plate 70 to come into parallel contact with the two feed rollers 65** and to apply pressure evenly thereto, whereby the document can be prevented from any skew.

A frictional force $\mu 1$ between the separating roller 75 and the document, a frictional force $\mu 2$ between the separating pad 80 and the document, and a frictional force $\mu 3$ are so set that $\mu 1 > \mu 2 > \mu 3$. By this setting, out of a few document sheets fed together by the pickup roller 65, only the lowest-layer one sheet is allowed to pass through between the separating roller 75 and the separating pad 80.

Furthermore, as shown in FIG. 16, the pre-separating plate 85 and an elastic sheet 86 stuck thereonto are provided immediately before the separating pad 80. The pre-separating plate 85 is provided on a down slope which descends from upward of the front-end restricting plate 63 in the paper feed direction, the lower end of the pre-separating plate 85 being in close proximity to the surface of the separating roller 75 with a slight clearance immediately before the separating pad 80. The lower end of the elastic sheet 86 is in close proximity to the surface of the separating roller 75 with an even slighter clearance therebetween. A plurality of document sheets fed together by the pickup roller 65 are brought, at their front ends, into contact with the pre-separating plate 85, where the lower-layer the document sheet is, the more forward it goes on, so that only one or two document sheets will pass by the lower end of the pre-separating plate 85. The elastic sheet 86 serves as an aid for the pre-separating function of the pre-separating plate 85. In FIG. 16, reference numeral **132*a* denotes a detection hole for detecting the document sheet under conveyance between the guide plates 131 and 132** by the sensors SE2 and SE10.

<Drive Mechanism for Front-End Restricting Plate 63 and Pressing Plate 70>

The drive mechanism for the front-end restricting plate 63 and the pressing plate 70 is now described. Referring to FIG. 18, the shaft 64 to which the front-end restricting plate 63 is fixedly secured has a lever 140 integrally fixed to its one end and normally biased counterclockwise by a torsion spring 141. The front-end restricting plate 63 is set by this biasing force to a restricting position where it is protruded from the guide plate 131. The shaft 71 to which the lever 72 of the pressing plate 70 has a lever 142 integrally fixed to its one end and normally biased counterclockwise. By this biasing force, the pressing plate 70 elastically presses the document onto the pickup roller 65.

Fan-shaped cam plates 145, 146 are disposed between the levers 140, 142 and a shaft 147 for the cam plates 145, 146 is coupled with a pickup motor M1 which is rotatable forward and reverse. The lever 140 is opposed to the outer circumferential surface of the cam plate 145, while the lever 142 is opposed to the outer circumferential surface of the cam plate 146. The levers 140, 142 is rotated based on the forward/reverse rotation of the cam plates 145, 146, whereby the positions of the front-end restricting plate 63 and the document pressing plate 70 are set. Discs 148, 149 are fixed to the cam shaft 147 and cutout edges 148*a*, 148*b*, 149*a*, 149*b* of these discs 148, 149 pass optical axes of photosensors SE11, SE12 (light-emitting element x, light-emitting element y) of transmission type. By on/off operations of the photosensors SE11, SE12 based on the above arrangement, the rotation of the cam plates 145, 146 is controlled.

Figure 19:
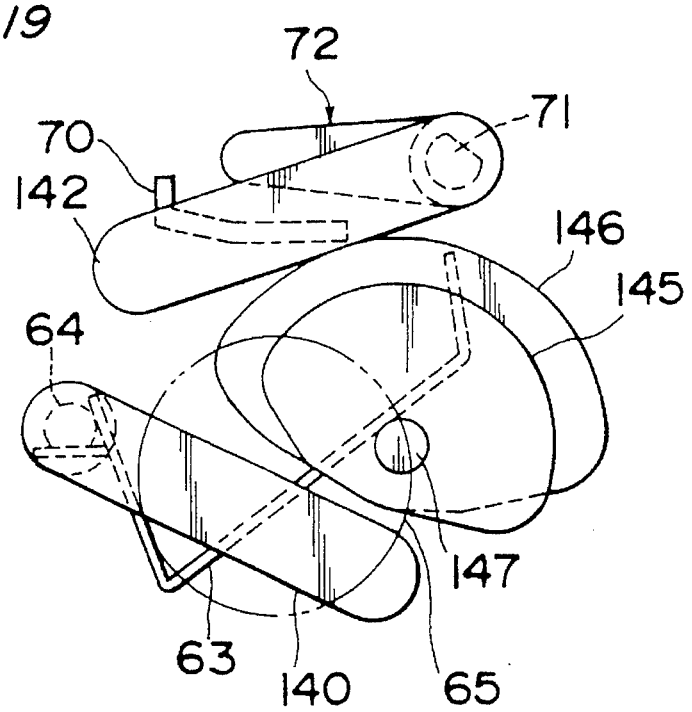
FIG. 19 is an explanatory view of a state in which the front-end restricting plate as shown in FIG. 18 is in the restricting position and the pressing plate is in a non-pressing position.
Figure 21:
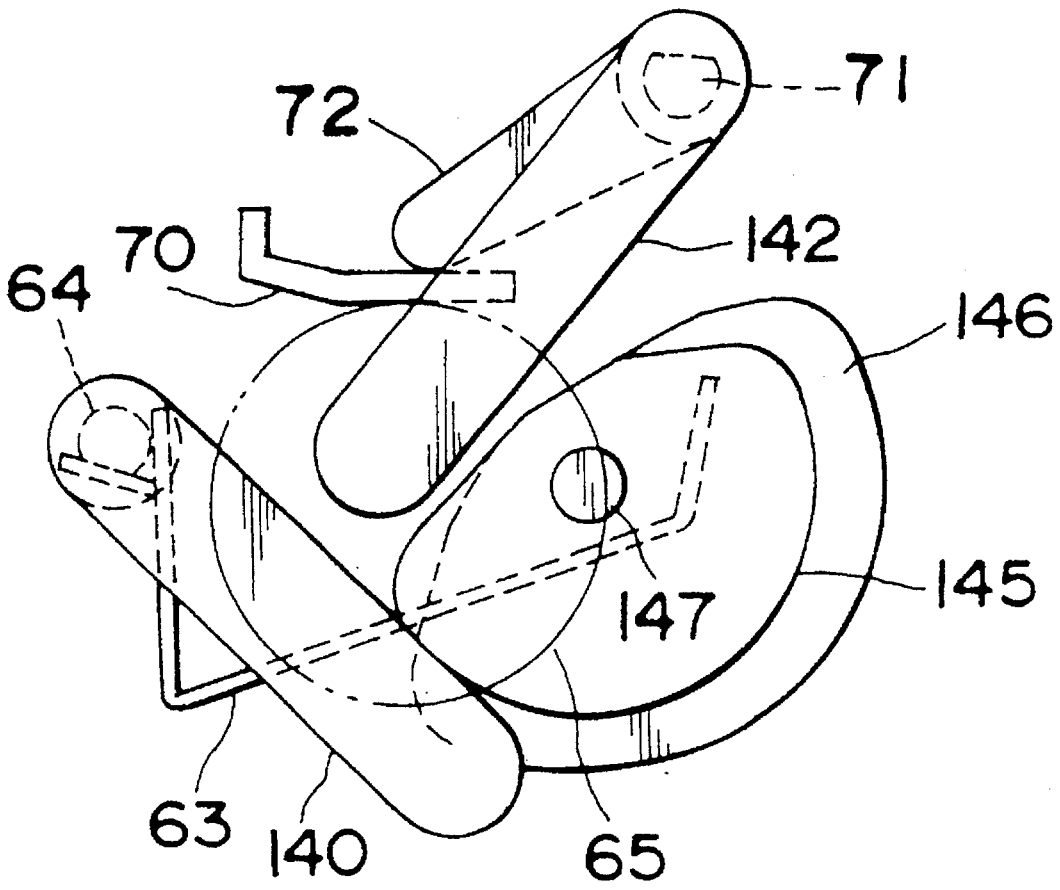
FIG. 21 is an explanatory view of a state in which the front-end restricting plate as shown in FIG. 18 is in a non-restricting position and the pressing plate is in the pressing position.

More specifically, with the ADF 60 in the standby state, the levers 140, 142 and the cam plates 145, 146 are in a position as shown in FIG. 19 (home position), where the front-end restricting plate 63 is set at the restricting position and the pressing plate 70 is set at the withdrawn position. After the power is turned on, the pickup motor M1 is driven to rotate reverse, so that the cam plates 145, 146 and the discs 148, 149 rotate reverse, in the clockwise direction, along with the shaft 147. Immediately after the reverse rotation, the sensor SE11 detects the edge 148*a* of the disc 148, turning off, whereby the home positions of the cam plates 145, 146 are verified and the pickup motor M1 is temporarily turned off. When a document replacement signal is issued thereafter, the pickup motor M1 is rotated reverse so that the cam plates 145, 146 are rotated clockwise, where the sensor SE12 detects the edge 149*b* of the disc 149, turning off. As a result of this, the pickup motor M1 is turned off but stops at a more or less overrun position as shown in FIG. 21. At this point, the lever 142 is separated from the larger diameter portion of the cam plate 146, rotating downward by a spring force of a torsion spring 143. Meanwhile, the lever 72 rotates so that the pressing plate 70 vertically moves downward to press the front end portion of the document against the pickup roller 65, imparting a paper feed pressure. Also, the lever 140 comes into contact with the larger diameter portion of the cam plate 145 so that the front-end restricting plate 63 rotates downward, withdrawing below the guide plate 131.

Figure 20:
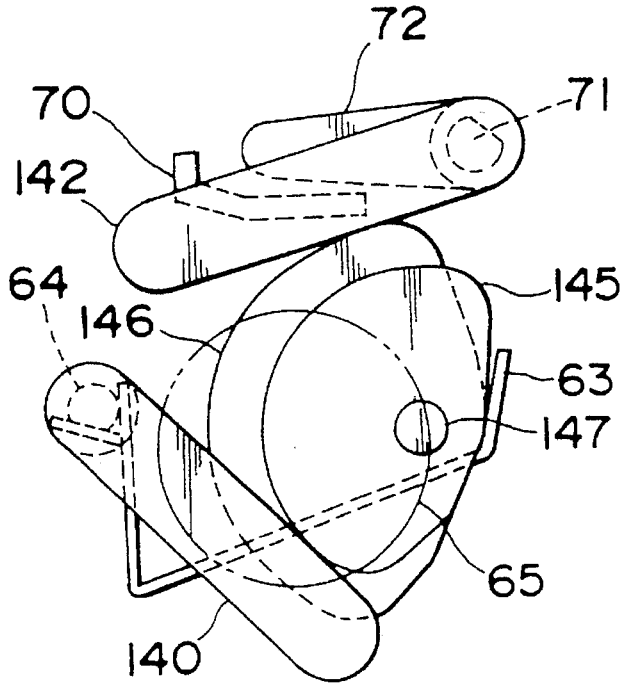
FIG. 20 is an explanatory view of a state in which the front-end restricting plate as shown in FIG. 18 is in a non-restricting position and the pressing plate is in a non-pressing position.

In this state, the pickup roller 65 and the separating roller 75 are driven to rotate, whereby the first-sheet document is fed. When the front end of the document fed has reached the register roller 90, the pickup motor M1 is driven to rotate reverse. As a result, the cam plates 145, 146 rotate reverse, in the clockwise direction, so that the sensor SE12 is turned on by the edge 149*a* of the disc 149, whereby the pickup motor M1 is turned off. At this point, the levers 140, 142 are such that the front-end restricting plate 63 is held in the standby position and the pressing plate 70 withdraws upward, releasing the press against the document, as shown in FIG. 20.

For the second and following document sheets, the pickup motor M1 is driven to rotate forward so that the cam plates 145, 146 rotate forward, in the counterclockwise direction. Then the sensor SE11 detects the edge 148*b* of the disc 148, whereby the pickup motor M1 is turned off but stops at a more or less overrun position as shown in FIG. 21. Thereafter, as in the foregoing case, the pickup roller 65 and the separating roller 75 are driven to rotate, whereby the second and following document sheets are fed. When the front end of the document fed has reached the register roller 90, the pickup motor M1 is driven to rotate reverse, returning to the press-releasing position as shown in FIG. 20.

Figure 22:
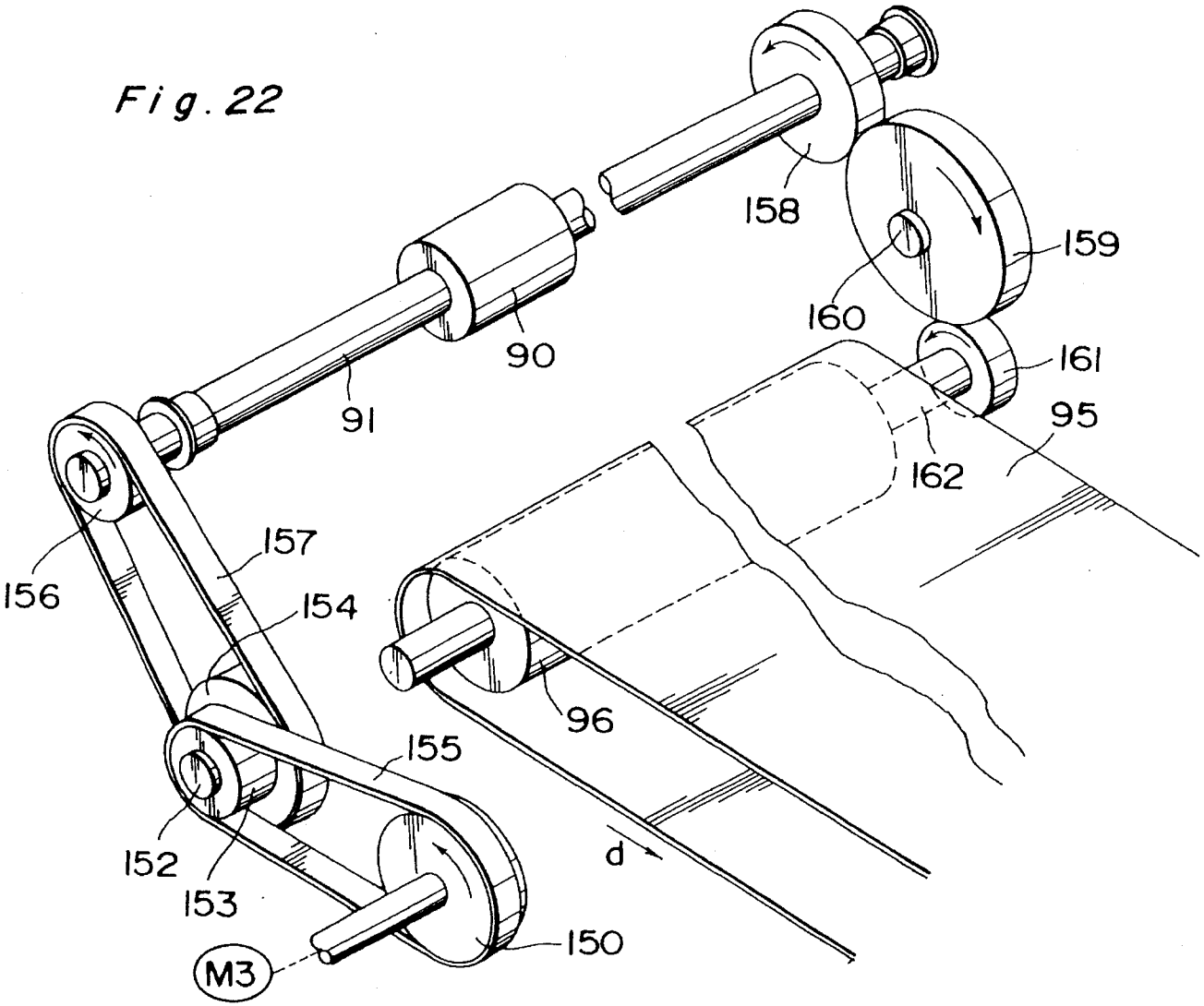
FIG. 22 is a perspective view showing the drive mechanism for the register roller and the conveyor belt.

As described above, by the pickup motor M1 being operated, the rotational angle can be minimized whether the document is pressed from the home position (FIGS. 19 to 21) or from the press-releasing position (FIGS. 21 and 22). Also, in order that the cam plates 145, 146 will not shift due to the overrun of the pickup motor M1, the sensor position and the disc are so designed that when the pickup motor M1 is driven to rotate reverse, the edge 149*b* of the disc 149 will be detected by the sensor SE12 slightly earlier than the edge 148*b* of the disc 148 will be detected by the sensor SE11, and that when the pickup motor M1 is driven conversely to rotate forward, the edge 148*b* of the disc 148 will be detected by the sensor SE11 slightly earlier than the edge 149*b* of the disc 149 will be detected by the sensor SE12.

Consequently, in the present embodiment, the drive mechanism for the front-end restricting plate 63 and the pressing plate 70 is simplified with a single system, and yet there will occur no noise at the time of drive because the cam plates 145, 146 are used for the drive. Besides, the front-end restricting plate 63 will be held in the withdrawal position for a full duration from start to end of the paper feed operation, thus the document being free from any damage or skew. Furthermore, the pressing plate 70 will press the document only while the front end portion of the document is passing the separating roller 75, and thereafter will withdraw upward. As a result, the possibility that misfeed such as double-sheet feed may occur is eliminated.

<Register Roller>

Now the register roller 90 is explained. Referring to FIG. 16, the register roller 90 temporarily receives at its nip portion the front end of the document fed by the rotation of the pickup roller 65 and the separating roller 75, thereby correcting any skew of the document by making its front end aligned. In a specified time after the front end of the document fed is detected by the sensor SE2, a feed motor M2 is turned off, causing the pickup roller 65 and the separating roller 75 to be stopped rotating. At this time point, the front end portion of the document comes into contact with the nip portion of the register roller 90, forming a slight loop. After that, the register roller 90 is driven to rotate by a main motor M3 being turned on at a timing coincident with the copying Operation of the copying machine main body 1, feeding out the document to the entrance of the glass platen 29. Like this, in the present embodiment, the pickup roller 65 and the separating roller 75 are driven by the feed motor M2 while the register roller 90 as well as the conveyor belt 95 are driven by the main motor M3, independently of each other. Besides, one-way clutches 67, 77 are provided between the pickup roller 65 and its drive shaft 66 and between the separating roller 75 and its drive shaft 76, respectively. Thus, it is arranged that even when the feed motor M2 is in the off state, the pickup roller 65 and the separating roller 75 can idly rotate clockwise when the document is fed out by the register roller 90.

Now the register roller 90 and the conveyor belt 95 are explained. As shown in FIG. 22, a timing belt 155 is stretched between an output pulley 150 provided on the output shaft of the main motor M3 and a pulley 153 rotatably supported on a shaft fixed to an unshown frame. A timing belt 157 is stretched between a pulley 154 integrated with the pulley 153 and a pulley 156 fixed to a shaft 91 of the register roller 90. A gear 158 is fixed to the other end of the shaft 91 of the register roller 90. The gear 158 is engaged with a gear 159 rotatably supported by a shaft 160 fixed to an unshown frame, and further the gear 159 is engaged with a gear 161 fixed to a shaft 162 of the driving roller 96. With this arrangement, when the main motor M3 rotates in an arrow direction, the register roller 90 and the driving roller 96 rotate in the same direction while the conveyor belt 95 moves in a direction "d". Also, the main motor M3, which is rotatable both forward and reverse, can convey the document temporarily in a direction reverse to the direction "d" in the two-in-one mode or both-sides mode.

<Arrangement of Register Roller 90, Feed Roller 65, and Separating Roller 75>

Figure 23:
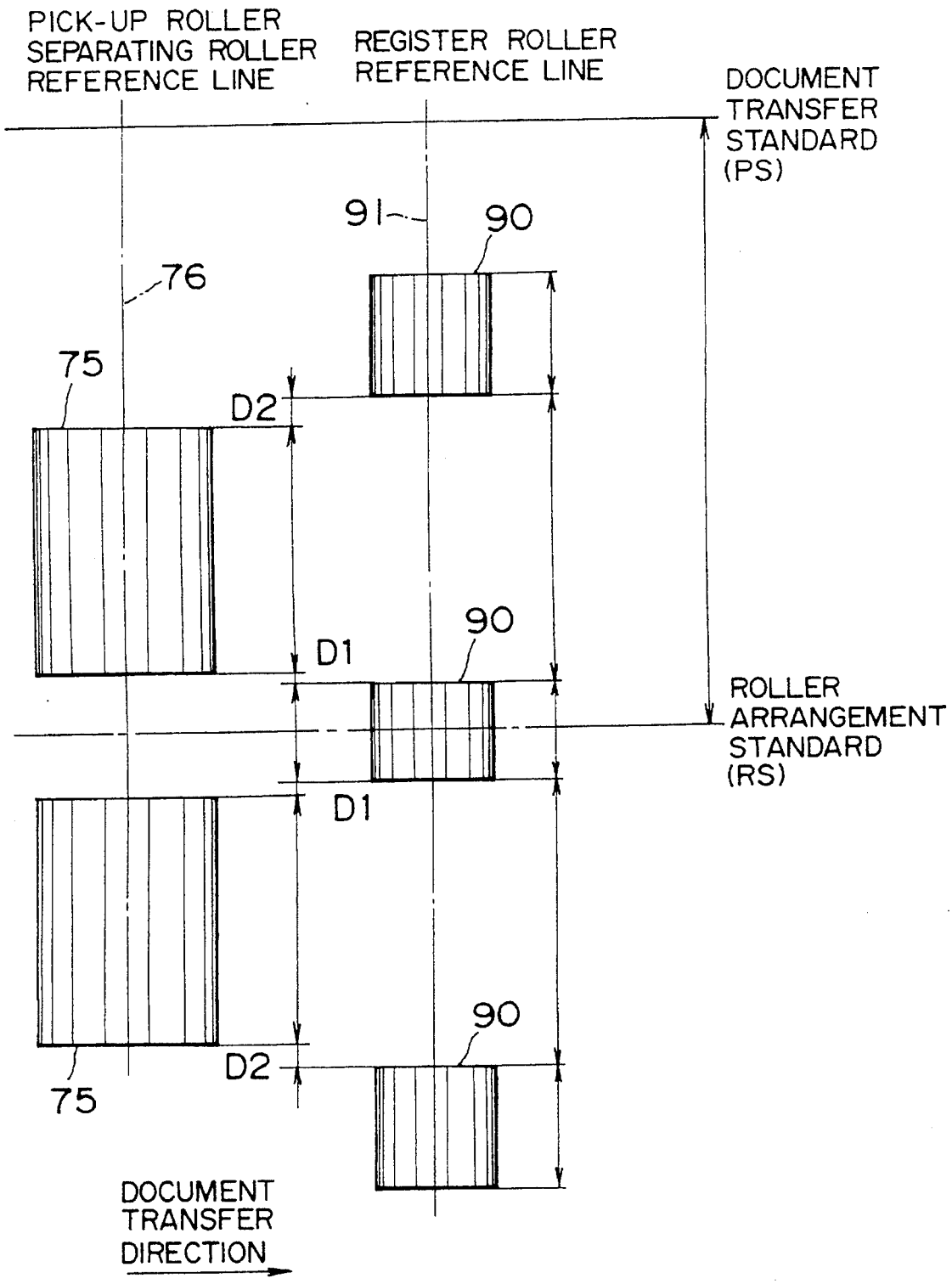
FIG. 23 is an explanatory view of the planar positional relation between the register roller and the separating roller.

The arrangement relation among the register roller 90, the feed roller 65, and the separating roller 75 is described with reference to FIG. 23. The ADF 60 of the present embodiment is provided with a paper standard PS on a back side of the copying machine, i.e., a side opposite to the operational side. The register roller 90 and the separating roller 75 are arranged symmetrically with respect to a roller arrangement standard RS. This is intended to prevent the document from skewing due to the moment that may act when the document nipped between the separating roller 75 and the separating pad 80 is pulled out by the register roller 90. Also, the conveying force of the register roller 90, which is set substantially larger than that of the separating roller 75, prevents the document from slipping in the conveyance by the register roller 90. Furthermore, the register roller 90 and the separating roller 75 in the center are spaced from each other by a distance D1 while the register rollers 90, 90 and the separating roller 75 on both sides are spaced from each other by a distance D2, with respect to a direction perpendicular to the document conveying direction. Accordingly, paper dust or the like generated at the pickup portion and the separating portion will never be transferred to the register roller 90, so that the conveying force of the register roller 90 is maintained constant. Moreover, the register roller 90 will never have adhesion of dirties, so that the document will never have dirties transferred from the register roller 90 thereonto.

<Mechanism for Opening and Closing the Document Feed Path of the Document Feed Section>

Figure 24:
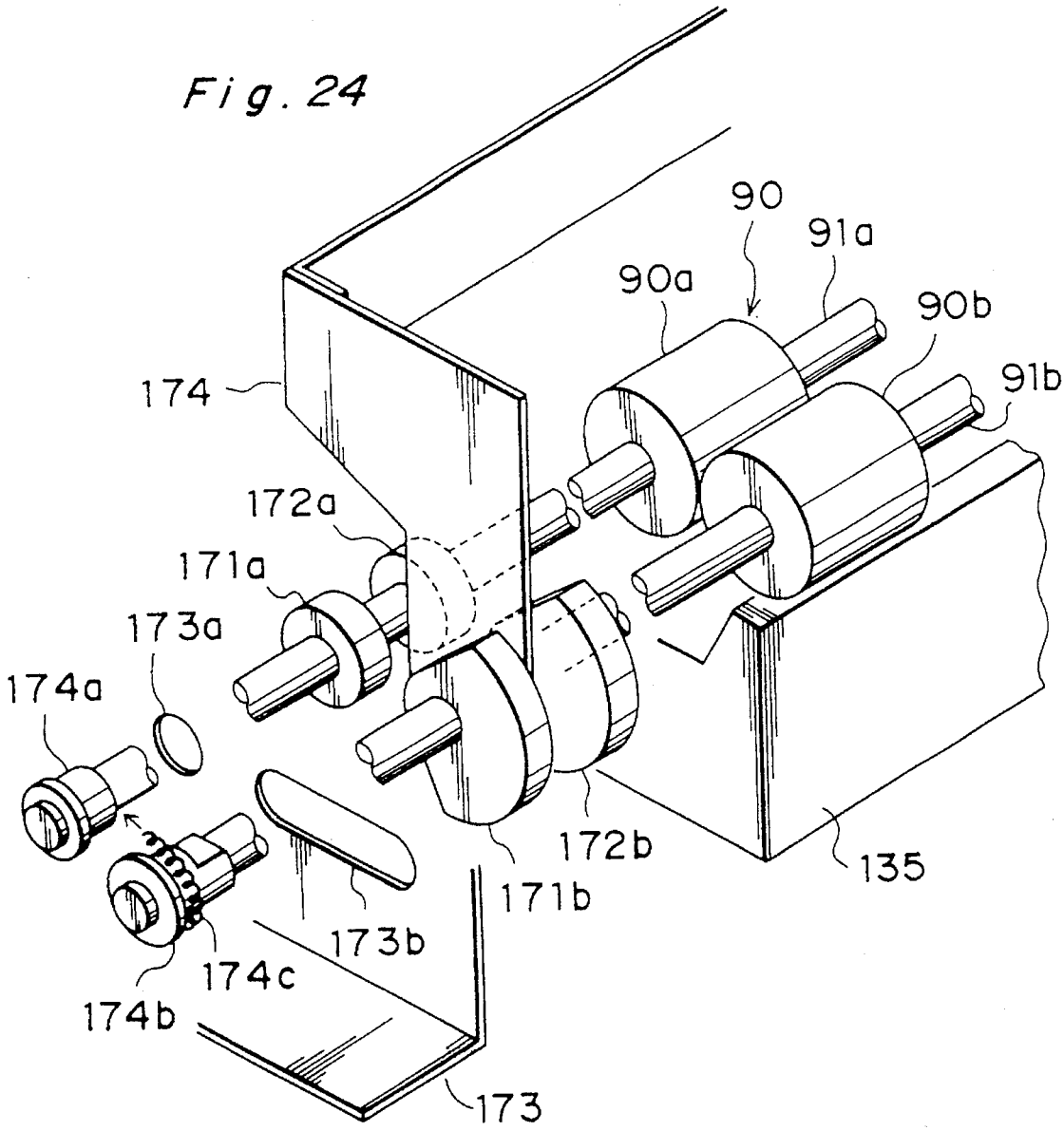
FIG. 24 is a perspective view of the support mechanism of the register roller and the paper-path opening/closing mechanism.

Referring to FIG. 24, a register driving roller 90*a*, which is one component of the register roller 90, is fixed to a shaft 91*a*. The shaft 91*a* is rotatably supported via bearings 174*a*, 174*a* by bearing holes 173*a*, 173*a* provided on a main frame 173 of the ADF 60, and coupled to the main motor M3 so as to be driven. Cams 171*a*, 172*a* are further provided to the shaft 91*a*. A register subordinate roller 90*b*, which is the other component of the register roller 90, is fixed to a shaft 91*b*. The shaft 91*b* is arranged in parallel with the shaft 91*a*, and supported via bearings 174*b*, 174*b* by long-hole shaped bearing holes 173*b*, 173*b* provided to the main frame 173 in such a way that the shaft 91*b* is rotatable and movable forward and backward. An eccentric cam 171*b* is rotatably provided on the eccentric cam 171*b*, a frame 174 for holding the opening/closing cover 604 for the document feed section 601 is fixed to the eccentric cam 171*b*, and a guide plate 135 for guiding the document that passed the register roller 90 onto the glass platen 29 is fixed to the eccentric cam 172*b*. Further, the shaft 91*b* is biased toward the shaft 91*a* by a biasing means such as springs 174*c*, 174*c* or the like.

Figure 25:
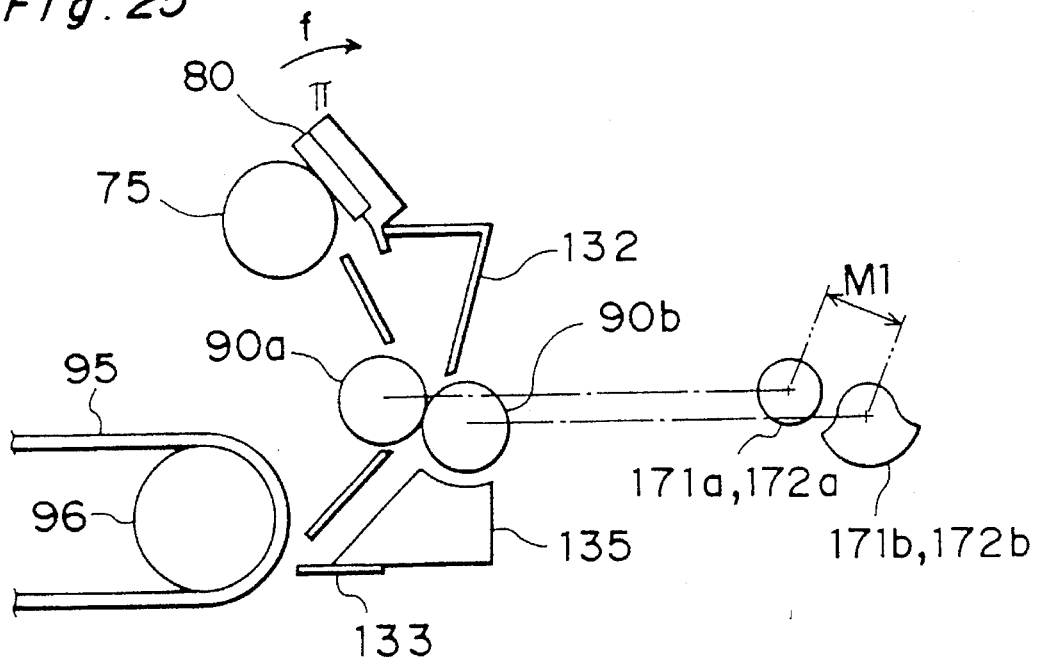
FIG. 25 is an explanatory view of the relation between the register roller and the cams in the paper-path opening/closing mechanism of FIG. 24.
Figure 26:
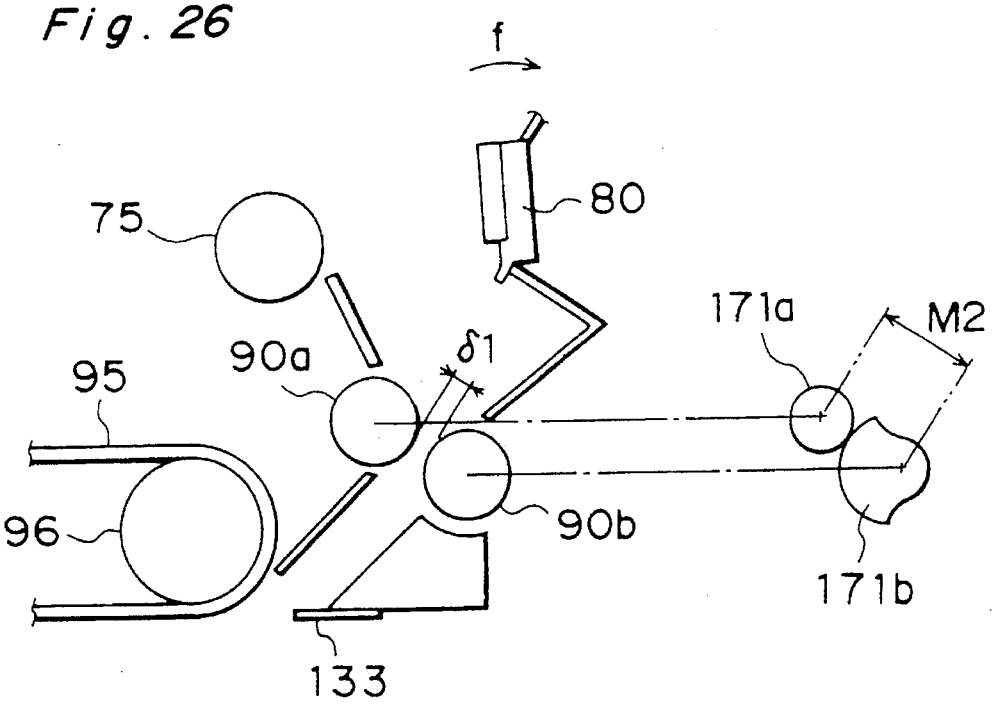
FIG. 26 is an operation explanatory view of the paper-path opening/closing mechanism of FIG. 24.
Figure 27:
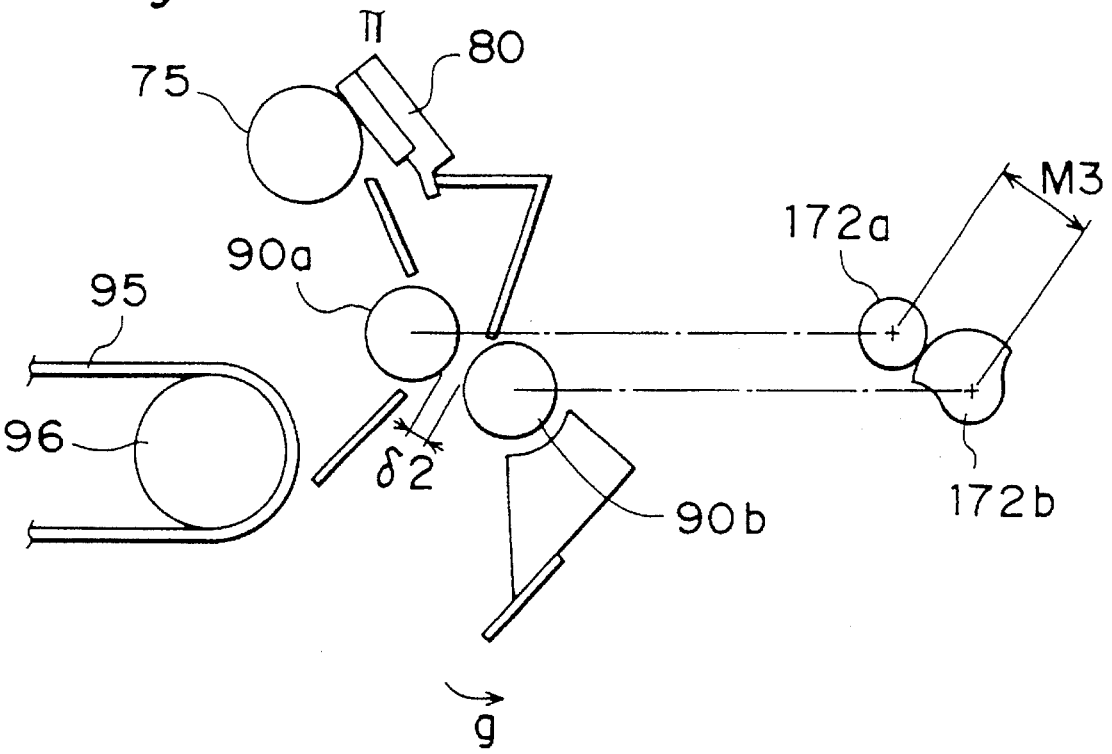
FIG. 27 is an operation explanatory view of the paper-path opening/closing mechanism of FIG. 24.

In the document feed section 601 having the above-described arrangement, in the normal state in which the cover 604 and the guide plate 135 are closed to the ADF 60, the register driving roller 90*a* and the register subordinate roller 90*b* are in press contact with each other as shown in FIG. 25. Meanwhile, the cams 171*a*, 172*a* are spaced away from the eccentric cams 171*b*, 172*b*, respectively, where their center spacing is set to M1. In this state, if the cover 604 is rotated in the direction of arrow "f" for example, in order to remove the document that has jammed in the paper feed path on the way from the separating section to the register section, the eccentric cam 171*b* rotates so that its outer circumferential portion is brought into contact with the cam 171*a*. Then, in this contact state, if the cover 604 is further rotated against the biasing force of the spring 174*c*, the center distance between the shaft 91*a* and the shaft 91*b* expands to M2 (>M1) such that the register subordinate roller 90*b* is separated away from the register driving roller 90*a* as shown in FIG. 26. Likewise, if the guide plate 135 is rotated in the direction of arrow "g" in order to remove the document that has jammed downstream of the register section as shown in FIG. 27, the eccentric cam 172*b* rotates so that its outer circumferential portion is brought into contact with the cam 172*a*. As a result, the center spacing between the shafts 91*a* and 91*b* expands to M3 (>M1), whereby the register subordinate roller 90*b* is separated away from the register driving roller 90*a*. In addition, the rollers 90*a*, 90*b* in many cases have their outer circumferential portions made of an elastic member such as rubber or sponge. With the use of such rollers, the rollers 90*a*, 90*b* do not need to be completely separated away from each other, but it is sufficient if the press contact force between them can be weakened so that the document nipped by them can be pulled out without being damaged. In this way, the document feed section 601 is so arranged that the register subordinate roller 90*b* is biased against the register driving roller 90*a* by the springs 174*c*, 174*c* while the cams 171*a*, 172*a* provided on the shaft 91*a* and the eccentric cams 171*b*, 172*b* fixed to the shaft 91*b* are engaged with each other based on the opening operation of the cover 604 and the guide plate 135, thereby releasing the register roller 90 from releasing. Accordingly, the press contact force between the rollers 90*a* and 90*b* can be set to be accurate uniformly over the axial direction and moreover maintained at proper level irrespectively of the mounting accuracy and locking force of the cover 604 and the like. Although the present embodiment has been so arranged that the register subordinate roller is withdrawn, yet the register driving roller may be withdrawn instead. Besides, another arrangement in which the rollers are reversed in the driving-and-subordinate relation is also applicable.

<Support Mechanism for the Cover>

Figure 28:
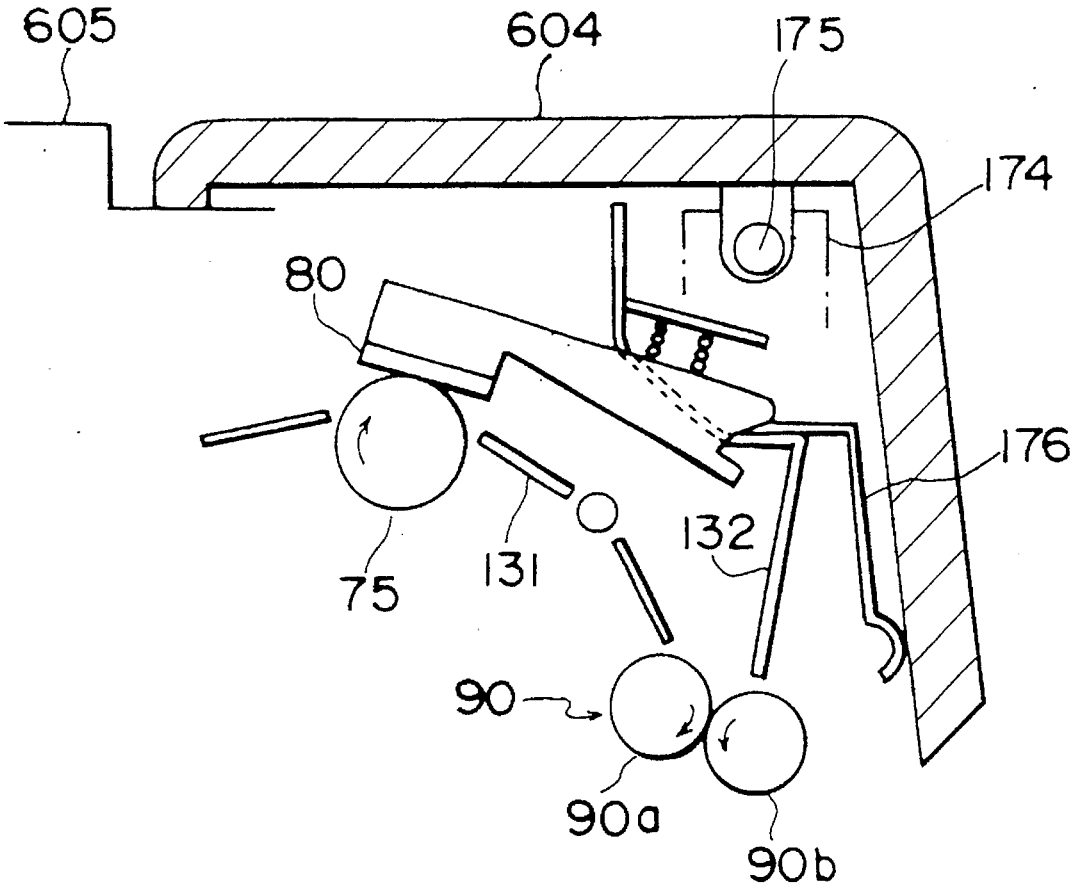
FIG. 28 is a schematic explanatory view of the mechanism that supports the cover of the document feed section.

The cover 604 is rotatably supported by the frame 174 via a shaft 175, as shown in FIG. 28. The frame 174 has the guide plate 132 fixed thereto, and the cover 604 is biased counterclockwise by a spring 176 provided to the document guide plate 132 or an elastic member such as sponge. Thus, with the cover 604 closed, the cover 604 is biased against the spring 176 so as to be positioned in contact with the document conveying section 605. Therefore, the separating pressure of the separating roller 75 and the separating pad 80 will never be affected by the action of external force, if any, due to the document or the like placed on the cover 604. Also, the separating pressure will never be affected by any force acting sideways onto the cover 604, because the movement of the cover 604 is absorbed by the spring 176. As a result, a stable separating pressure can be ensured at all times. Besides, the drive motor for the separating roller 75 will never be subject to excessive load.

<Document Conveying Modes of the ADF>

The document conveying modes of the ADF 60 are now explained. In the present embodiment, the document conveying modes include four modes of the prestep mode, the two-in-one mode, and the count mode in addition to the both-sides mode, which is a conventional practice, and further includes the scale mode suited for ordinary paper and the pulse control mode suited for thin paper, for the purpose of stopping the document conveyed by the ADF 60 at the exposure standard position SP. The selection between the scale mode and the pulse control mode is executed with a document selection key 105 provided on the control panel (see FIG. 126). Referring to the conveyance of the document, a position where the document is set with its front end registered at the exposure standard position SP is referred to as an exposure position, a position where the document is set with its front end registered at an intermediate position IP is referred to as a prestep position, and a position where the document is set with its front end registered at the nip position of the register roller 90 is referred to as a first-out position. In addition, the size of the document is here assumed so that the small size is A4 transverse, and the large size is A3 longitudinal, unless otherwise specified.

Figure 4:
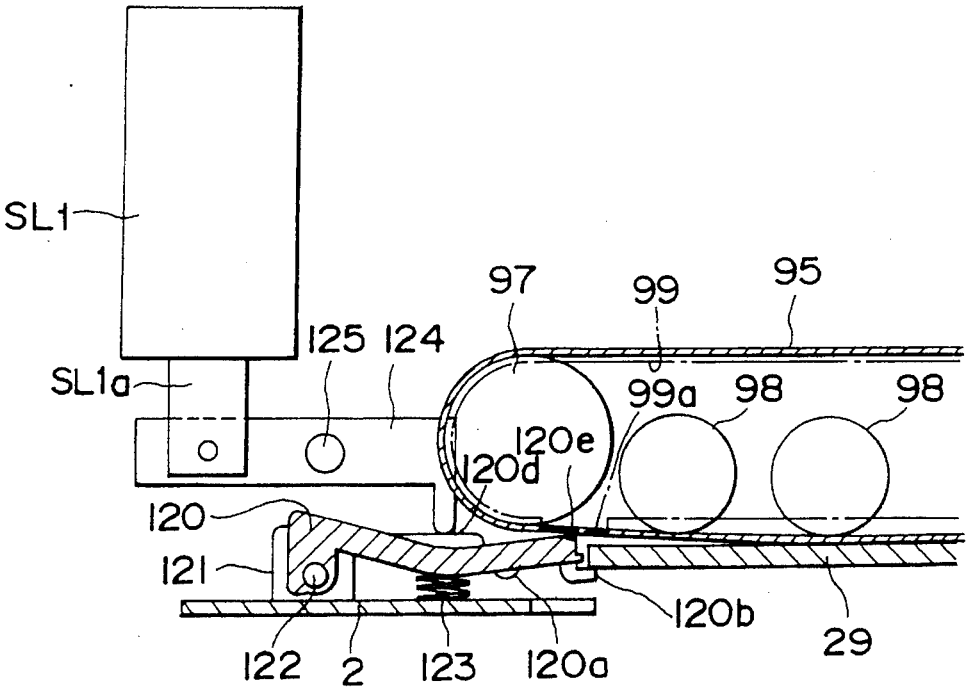
FIG. 4 is a sectional view of the first embodiment of the scale pressing mechanism, showing a state that the scale has been raised.

The scale mode is a mode in which the document that has been conveyed up by the conveyor belt 95 is forcedly stopped with its front end brought into contact with the scale 120. In this case, the solenoid SL1 is turned off as shown in FIG. 4. As a result, the front end of the scale 120 is protruded on the glass platen 29. The document D that has been conveyed up in the direction of arrow "d" by the conveyor belt 95 has its front end brought into contact with the scale 120. Then, a slip occurs between the document and the belt due to the arrangement that the conveying force of the conveyor belt 95 is set weaker than the buckling strength of the document, such that the document is stopped accurately at the standard position SP.

The pulse control mode is a mode in which, as will be described below, the register roller 90 and the conveyor belt 95 are driven by the single main motor (stepping motor) M3 so as to become equal to each other in the conveying speed, so that a document conveying length L (see FIG. 30) is accurately controlled. The document conveying length with respect to the number of drive pulses of the main motor M3 is previously known. Therefore, the position where the document is to be stopped is determined by driving the main motor M3 with a number of pulses corresponding to the length L over which the document on standby immediately before the register roller 90 is conveyed up to the standard position SP. For execution of this pulse control mode, the solenoid SL1 holds in the on state, while the scale 120 holds in the position where it has withdrawn downward from the upper surface of the glass platen 29.

In comparison between these scale mode and pulse control mode, the scale mode has an advantage of high stop-position accuracy based on the arrangement that the document is stopped by contact with the scale 120. However, when the document is a thin sheet, the buckling strength of the document is so small that a fold at its front end or a paper jam tends to occur, as a problem of the scale mode. The pulse control mode, although having an advantage of being free from any trouble in the stopping of the document even if the document is a thin one, yet is problematic in that the stop-position accuracy is not always as high as that in the scale mode, on account of a slippage of the document or some response shift of the drive mechanism.

Figure 29:
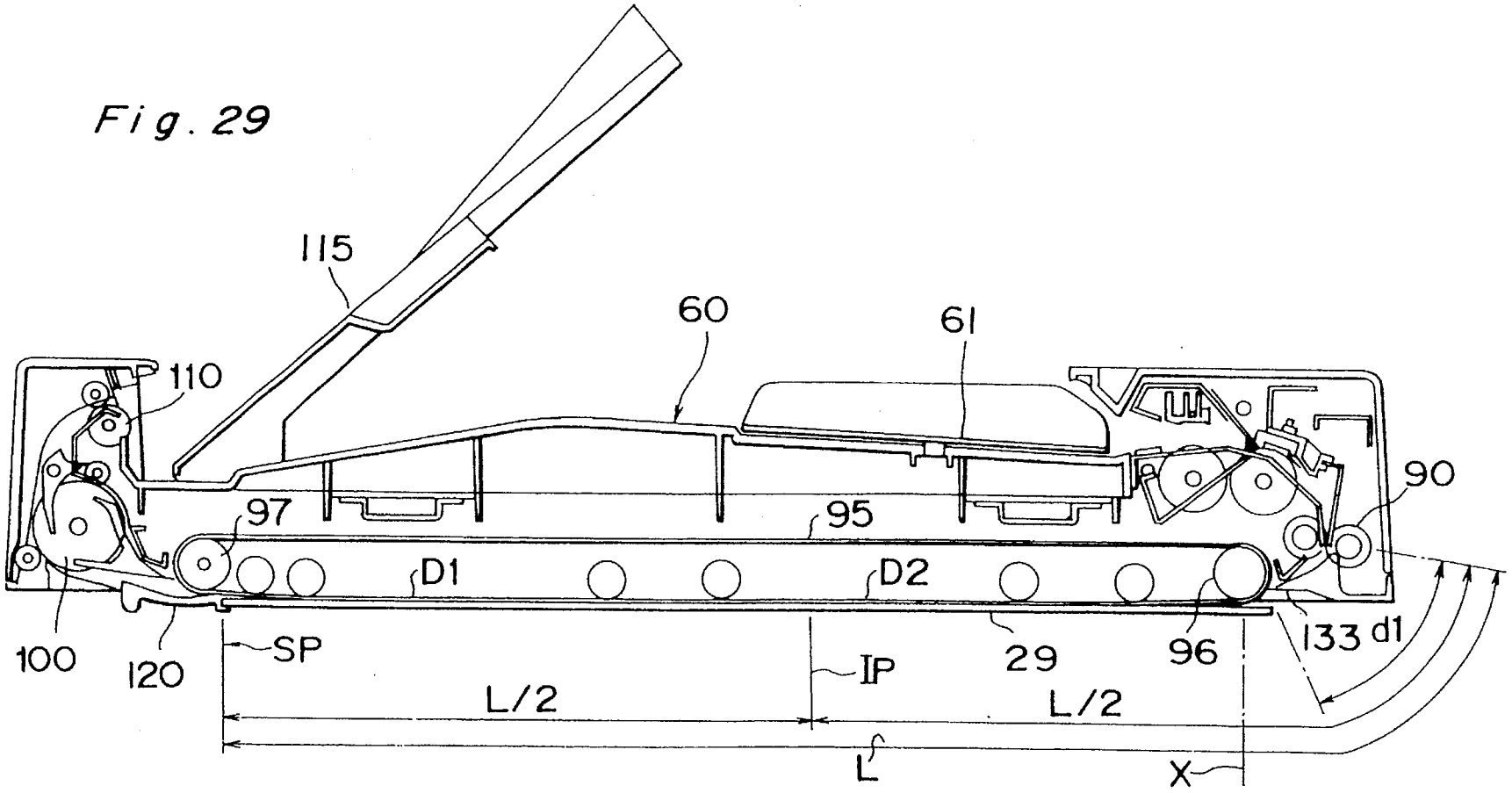
FIG. 29 is an explanatory view of document conveyance by the stepping motor, showing a case where the document is stopped in the pulse control mode.

The prestep mode is a mode in which when the document size is one half the length from the exposure standard position SP to the document first-out position (a position where the front end of the document is in contact with the register roller 90), a preceding document D1 is stopped with its front end registered with the exposure standard position SP and a succeeding document D2 is conveyed to a position where its front end is registered with the intermediate position IP, a succeeding (third-sheet) document sheet is first-out fed until its front end comes into contact with the register roller 90, as shown in FIG. 29. In this prestep mode, when it is combined with the pulse control mode, at replacement of the document, the main motor M3 is driven to rotate forward to an extent of pulse P02 so that the document is conveyed by a distance corresponding to ½ of the distance L from the register roller 90 to the standard position SP. That is, each time the first-sheet document D1 set at the exposure standard position SP has been finished in exposure, the main motor M3 is driven to rotate forward to an extent of pulse P02, so that the second-sheet document D2 is conveyed to the exposure standard position SP and that the third-sheet document having stood by at the register roller 90 is conveyed to the intermediate position IP.

Figure 30:
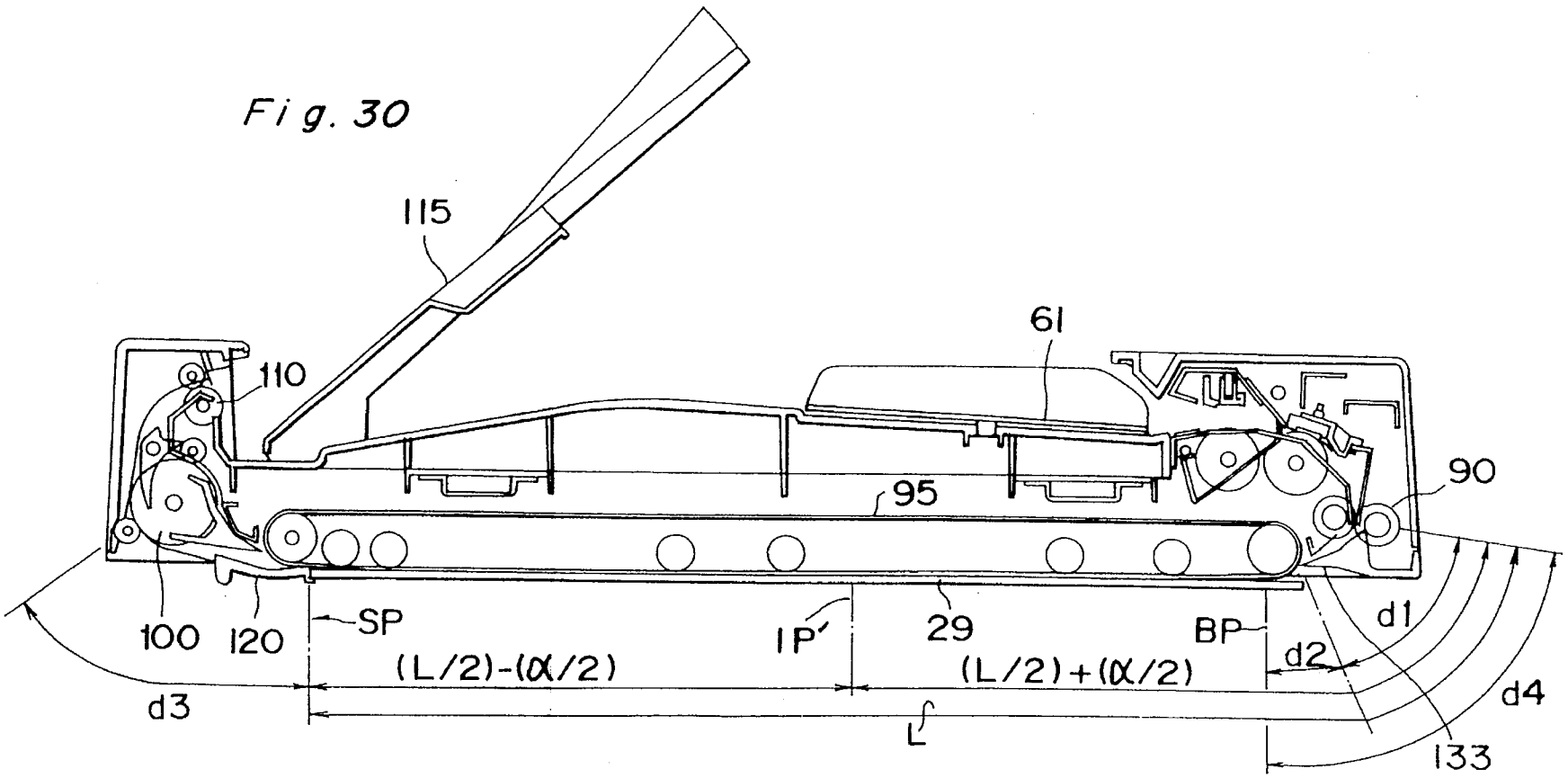
FIG. 30 is an explanatory view of document conveyance by the stepping motor, showing a case where the document is stopped in the scale mode.

Meanwhile, when the prestep mode is combined with the scale mode, at replacement of the document, the main motor M3 is driven to rotate forward to an extent of pulse P02' so that the document is conveyed by a distance corresponding to $(L/2)+(\alpha/2)$, as shown in FIG. 30, where $\alpha$ represents such an extent of overrun that the front end of the document is securely put into contact with the scale 120. Accordingly, the second-sheet document D2 stands by at an intermediate position IP' where the document has been conveyed to an extent of $(L/2)+(\alpha/2)$ from the register roller 90. This second-sheet document D2, which is to be conveyed by the conveyor belt 95 to an extent of $(L/2)+(\alpha/2)$ from the intermediate position IP', is stopped at the exposure standard position SP with its front end coming into contact with the scale 120 at a time point when the document has been conveyed by an extent of $(L/2)-(\alpha/2)$. This means that the conveyor belt 95 has slipped by the distance $\alpha$ with respect to the document.

In the scale mode as described above, normally, the solenoid SL1 is kept off and the scale 120 is protruding upward from the upper surface of the glass platen 29. The solenoid SL1 is turned on immediately before the document passes the exposure standard position SP, whereby the scale 120 is withdrawn to below the platen glass 29.

<Prestep Mode>

Figure 31:
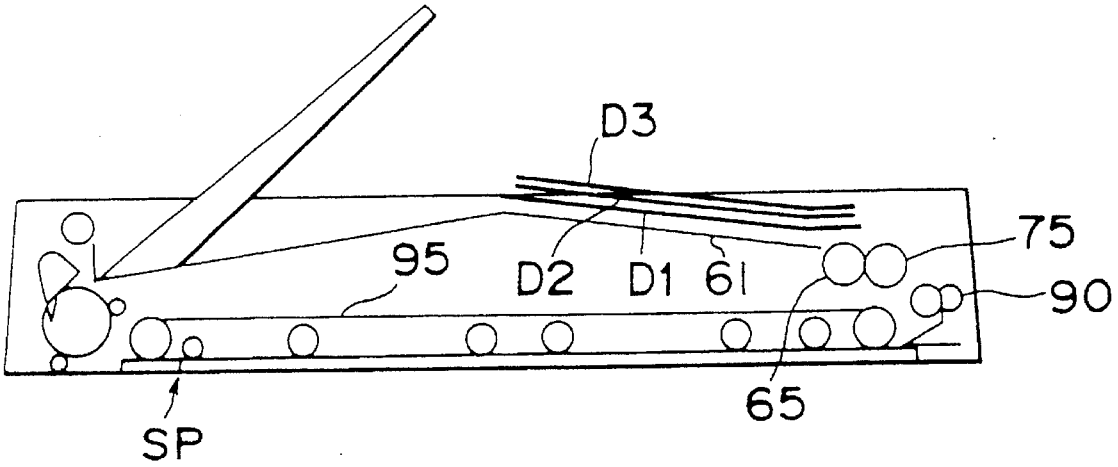
FIG. 31 is an explanatory view of document conveyance in the prestep mode.
Figure 32:
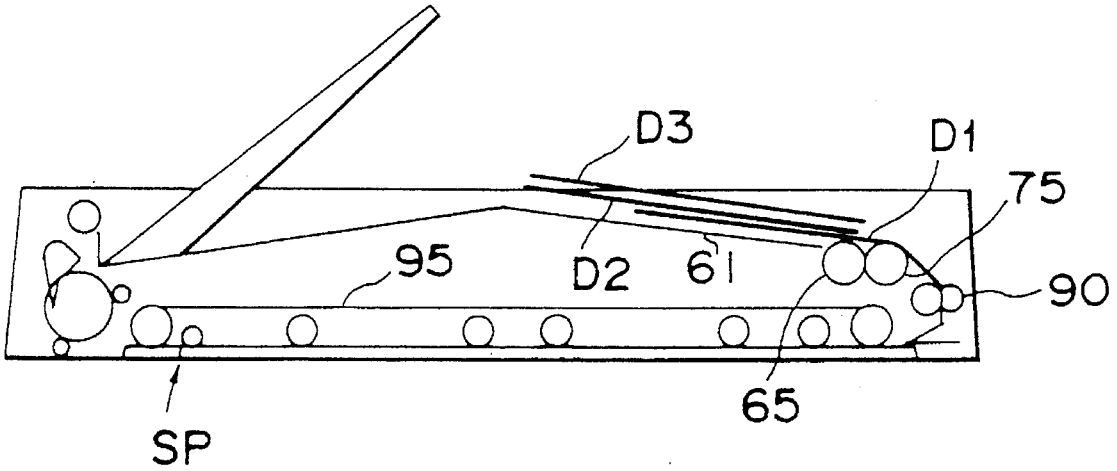
FIG. 32 is an explanatory view of document conveyance in the prestep mode subsequent to FIG. 31.
Figure 33:
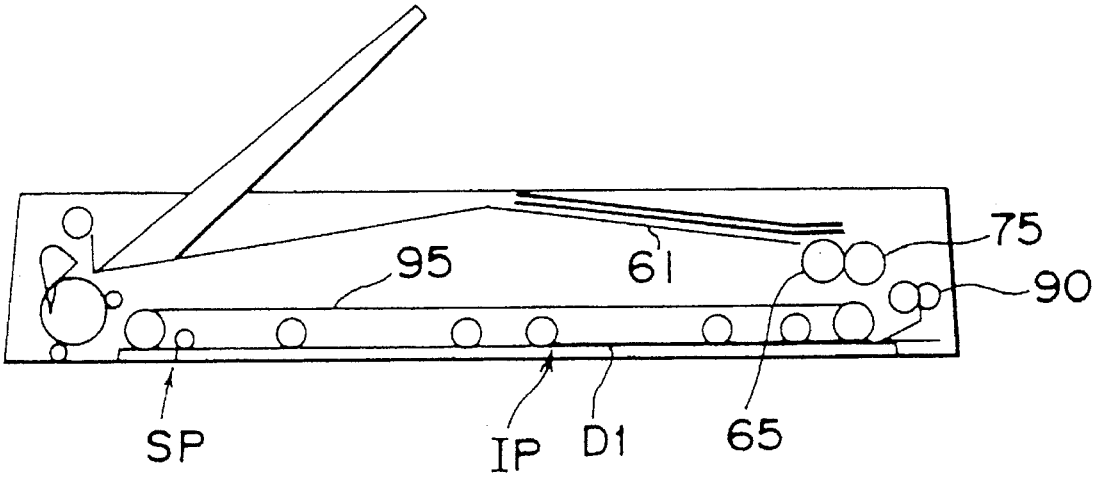
FIG. 33 is an explanatory view of document conveyance in the prestep mode subsequent to FIG. 32.
Figure 34:
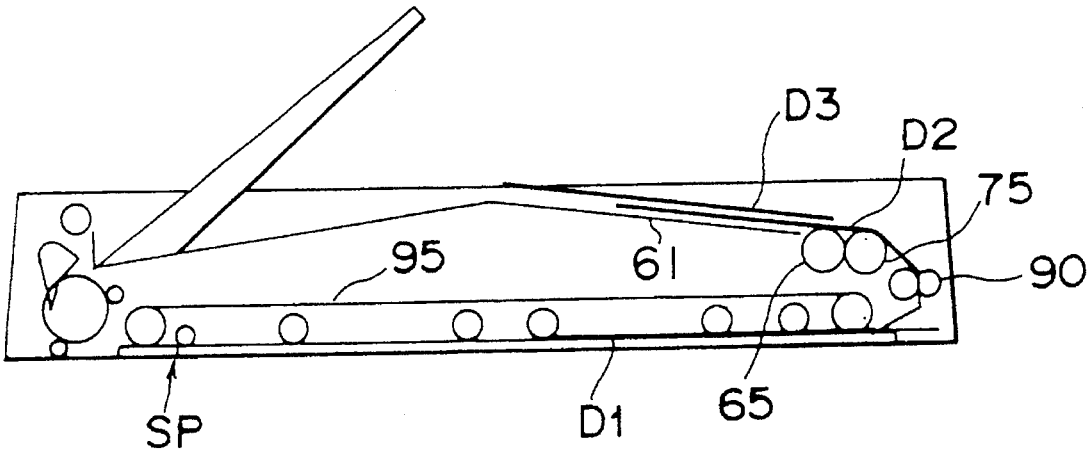
FIG. 34 is an explanatory view of document conveyance in the prestep mode subsequent to FIG. 33.
Figure 35:
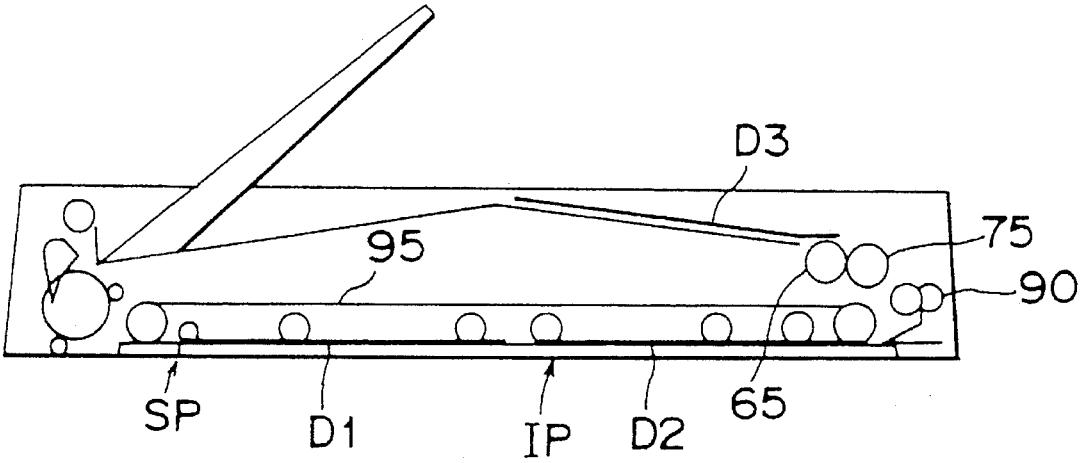
FIG. 35 is an explanatory view of document conveyance in the prestep mode subsequent to FIG. 34.
Figure 36:
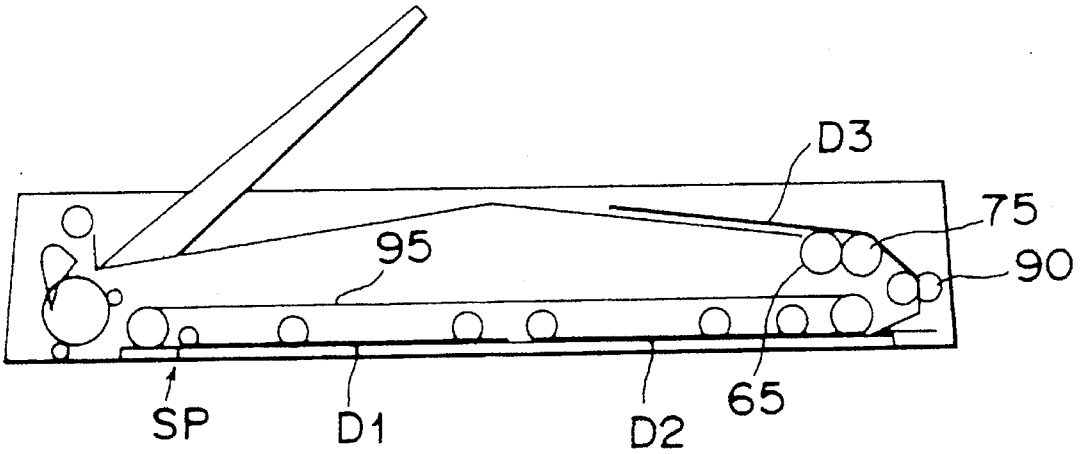
FIG. 36 is an explanatory view of document conveyance in the prestep mode subsequent to FIG. 35.
Figure 37:
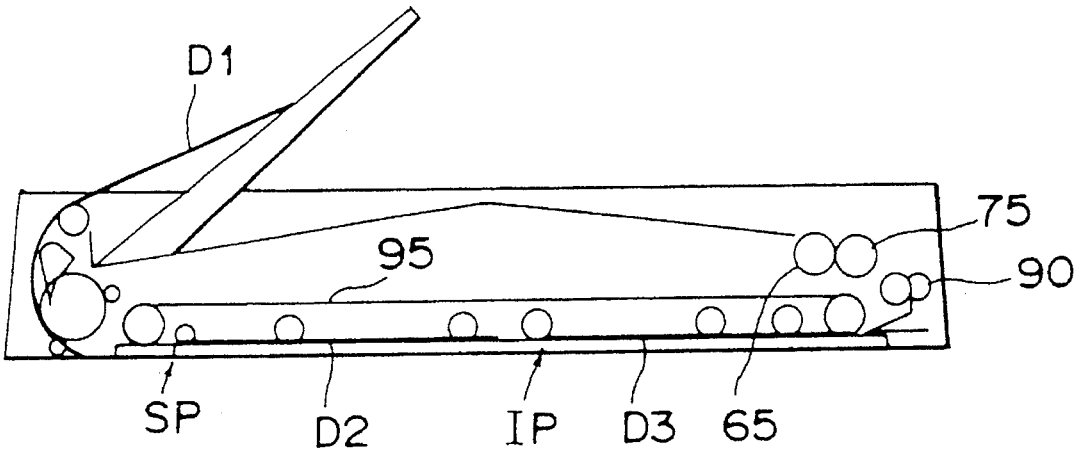
FIG. 37 is an explanatory view of document conveyance in the prestep mode subsequent to FIG. 36.
Figure 38:
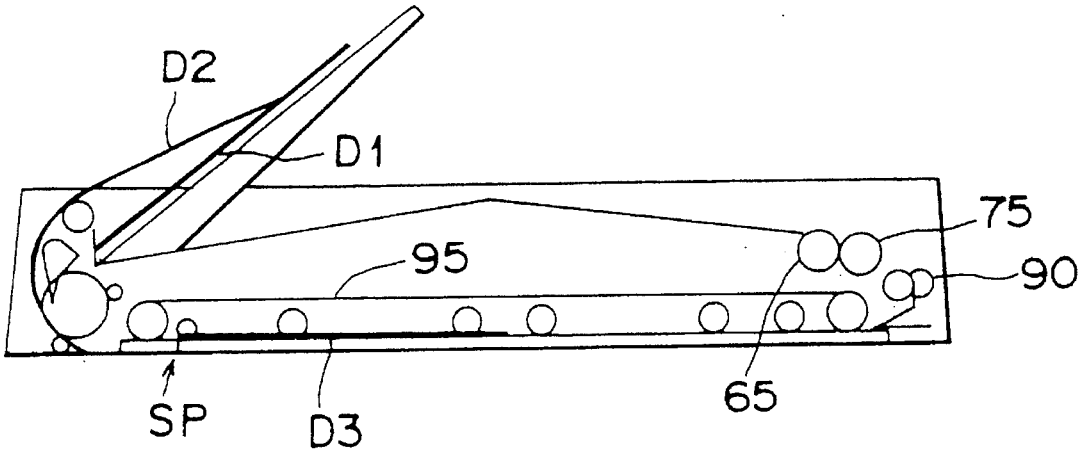
FIG. 38 is an explanatory view of document conveyance in the prestep mode subsequent to FIG. 37.
Figure 39:
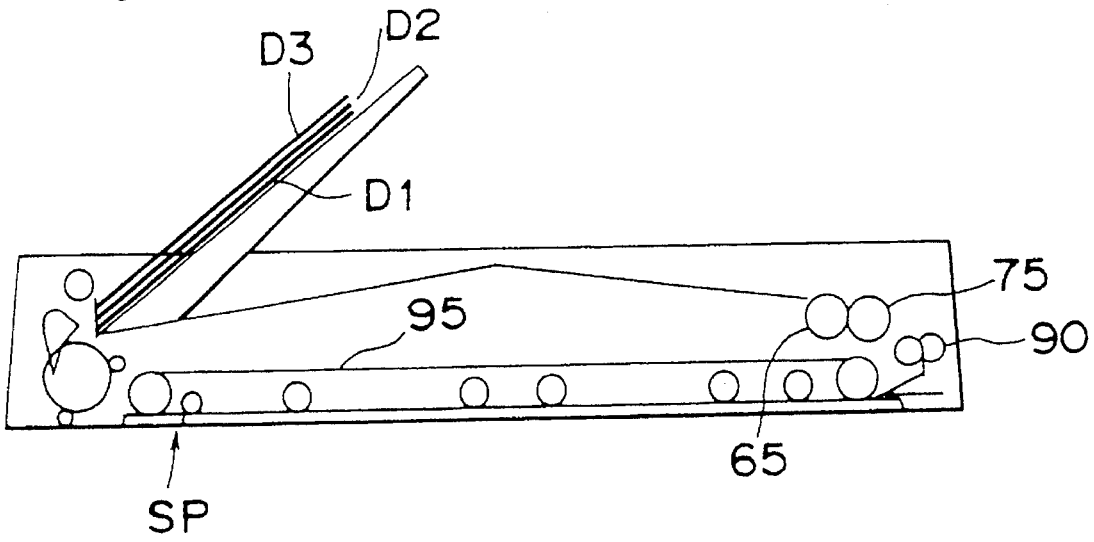
FIG. 39 is an explanatory view of document conveyance in the prestep mode subsequent to FIG. 38.

FIGS. 31 through 39 illustrate the document conveying state in the prestep mode. FIG. 31 shows a state that the document is set on the tray 61, where it is assumed that three sheets of small-size document D1, D2, and D3 are set. First, the front-end restricting plate 63 withdraws below, the pressing plate 70 moves downward, and the pickup roller 65 and the separating roller 75 are driven to rotate, whereby the first-sheet document D1 is fed, standing by with its front end in contact with the register roller 90 (see FIG. 32). Next, the main motor M3 is driven to rotate forward by an extent of pulse P02, so that the document D1 is conveyed up to the intermediate position IP (see FIG. 33). Next, the pickup roller 65 and the separating roller 75 are driven to rotate, so that the second-sheet document D2 comes to stand by at the register roller 90 (see FIG. 34). Further, the main motor M3 is driven to rotate forward by an extent of pulse P02, so that the first-sheet document D1 is conveyed to the exposure standard position SP while the document D2 is conveyed to the intermediate position IP (see FIG. 35). In this state, in the copying machine 1, the process of feeding copying paper and the process of exposure by the optical system 20 are performed in a number of times corresponding to a set copy number. During the exposure process, the third-sheet document D3 is first-out fed to the register roller 90 (see FIG. 36).

Upon completion of the exposure process on the document D1, the main motor M3 is driven to rotate to an extent of pulse P02, while the discharge motor M4 is driven so that the reverse roller 100 and the discharge roller 110 rotate. As a result, the document D1 is discharged onto the tray 115 while the document D2 is conveyed to the exposure standard position SP and the document D3 is conveyed to the intermediate position IP (see FIG. 37). In this state, the document D2 is subjected to exposure. Upon completion of the exposure, the main motor M3 is driven to rotate forward by an extent of pulse P02 so that the discharge motor M4 is also driven. Accordingly, the document D2 is discharged out onto the tray 115, and the document D3 is conveyed to the exposure standard position SP (see FIG. 38). After the exposure on the document D3, the main motor M3 and the discharge motor M4 are driven so that the document D3 is discharged onto the tray 115 (see FIG. 39).

In the present embodiment, when the first-out fed document is fed onto the platen glass 29 by the register roller 90 and the rear end of the document is detected by the register sensor SE2, the empty sensor SE1 is checked, where if the document remains on the tray 61, it is first-out feed, and if there is no document, the front-end restricting plate 63 is returned to the upward restricting position.

Now the positional relation among the register roller 90, the resin film 133, and the prestep position IP is explained with reference to FIG. 29. Whereas the conveyor belt 95 is driven by the driving roller 96, even if the driving roller 96 is stopped being driven and fixed by the brake, the subordinate roller 97 progresses further due to its inertia and a delay of transfer of the driving force of the conveyor belt 95 and then attempts to return to the original position where a relation between tense and loose sides that has occurred during the driving operation is balanced, thus causing the document on the glass platen 29 to be moved to a slight extent. In the copying machine of the present embodiment, the document moves on the glass platen 29 toward the upstream in the document conveying direction.

For this purpose, the ADF 60 of the present embodiment is provided with a resin film 133 at the belt conveying section. If the document length is dp and the distance from the nip of the register roller 90 to the front end of the resin film 133 is d1, then in the case where $L/2-d1 \approx dp$, the document to be stopped at the prestep position IP would interfere with the resin film 133 at the rear end. Also, if a small skew has taken place during the registered conveyance, only part of the rear end of the document would interfere with the resin film 133, further deteriorating the skew state. For this reason, the ADF 60 of the present embodiment is set to a relation that $L/2-d1<dp$, thus having resolved any possible disturbances in the document stopped state due to interference with the resin film 133. Further, if the return extent of the conveyor belt 95 is $\beta$, then the same functional effects can be obtained also by achieving a relation that $L/2-d1-\beta>dp$. Still, in the scale mode, the lengths involved may properly be set so as to meet the relations that $L/2-\alpha/2-d1<dp$ and that $L/2-\alpha/2-d1-\beta>dp$. In addition, although the nip position of the register roller 90 has been assumed to be the first-out position in the present embodiment, it may also be arranged that the document is positioned by a sensor or the like or restricted by a stopper gate.

As described above, in the prestep mode, the document is fed out in steps of (L/2), and therefore the document replacement time needs only to be such a short time that the document can be replaced with another within a time during which the optical system 20 returns to the home position upon the completion of exposure. Thus, the copy productivity is improved. Yet, the succeeding-sheet (third-sheet) document is first-out fed until its front end comes into contact with the register roller 90. This first-out paper feeding process is executed during the exposure of the preceding-sheet document, contributing to improvement in the copy productivity.

Also, as shown in FIG. 22, it has been arranged that the register roller 90 and the conveyor belt 95 are driven by the single main motor M3 without intervening a clutch, and that the main motor M3 is pulse-driven as a stepping motor. Thus, the document to be fed out from the register roller 90 can be accurately conveyed to or stopped at the standard position SP by controlling the number of pulses fed to the motor M3. In addition, even if the motor M3 is not a stepping motor, similar advantages can be obtained also by such an arrangement in which an encoder is attached to the rotating shaft and the motor M3 is controlled for its turning on and off with the number of its rotations converted into the number of pulses.

<Two-in-one Mode>

Figure 40:
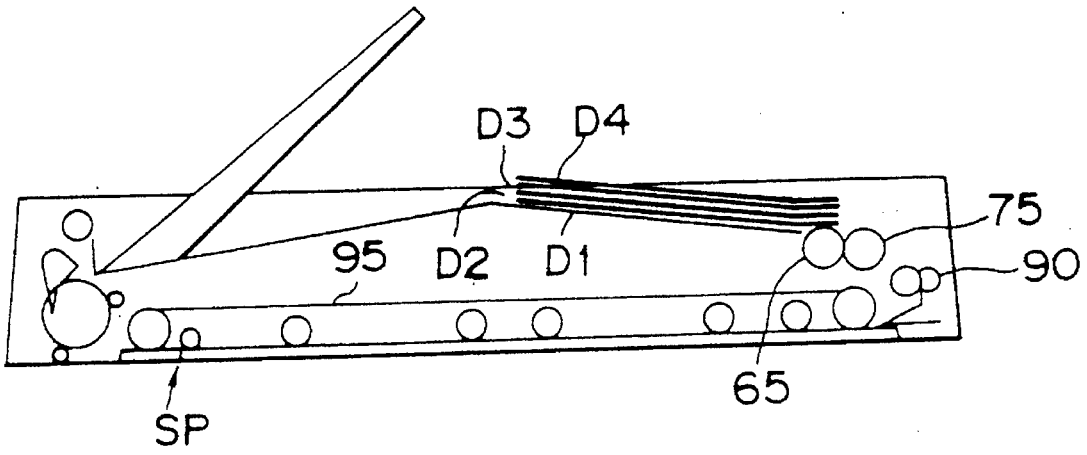
FIG. 40 is an explanatory view of document conveyance in the two-in-one mode.
Figure 41:
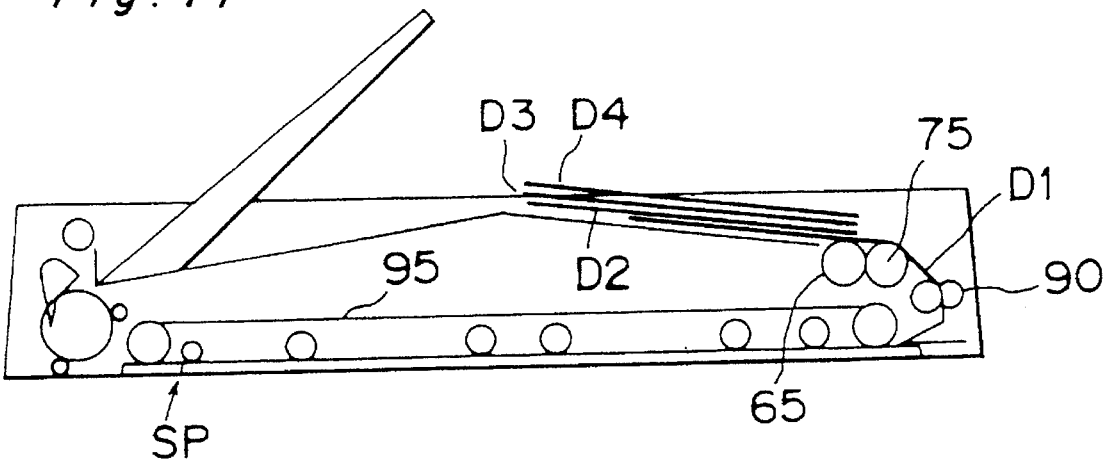
FIG. 41 is an explanatory view of document conveyance in the two-in-one mode subsequent to FIG. 40.
Figure 42:
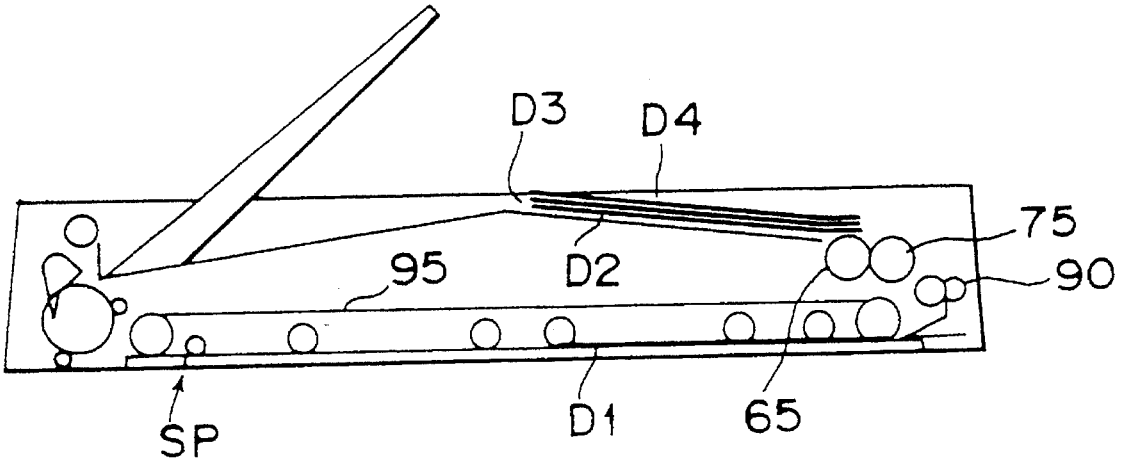
FIG. 42 is an explanatory view of document conveyance in the two-in-one mode subsequent to FIG. 41.
Figure 43:
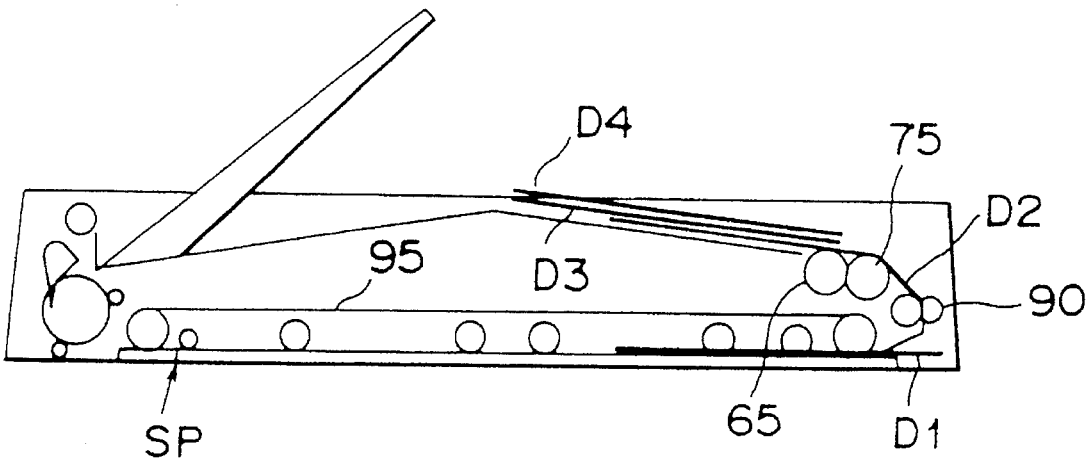
FIG. 43 is an explanatory view of document conveyance in the two-in-one mode subsequent to FIG. 42.
Figure 44:
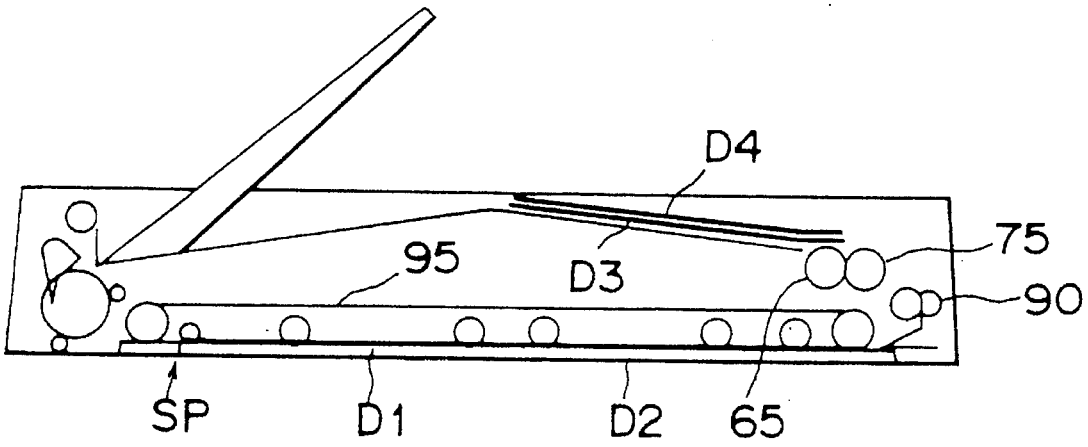
FIG. 44 is an explanatory view of document conveyance in the two-in-one mode subsequent to FIG. 43.
Figure 45:
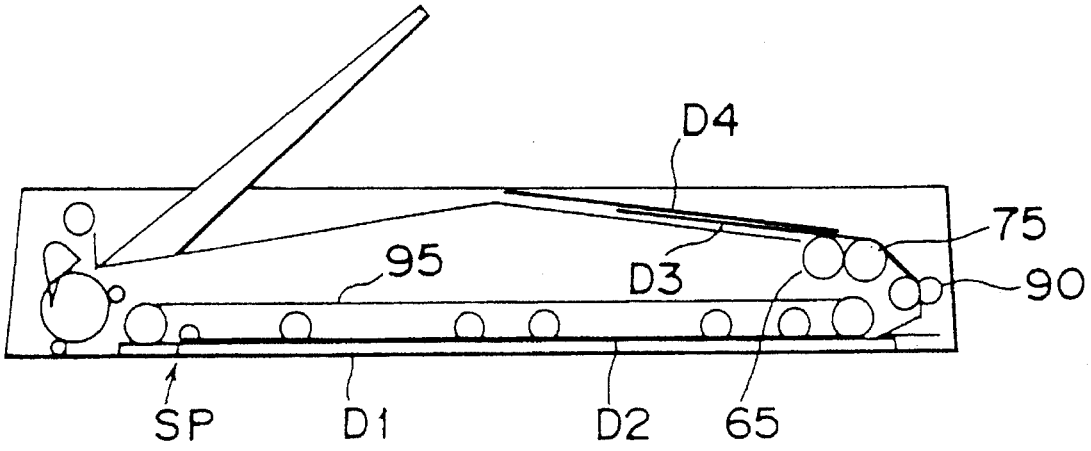
FIG. 45 is an explanatory view of document conveyance in the two-in-one mode subsequent to FIG. 44.
Figure 46:
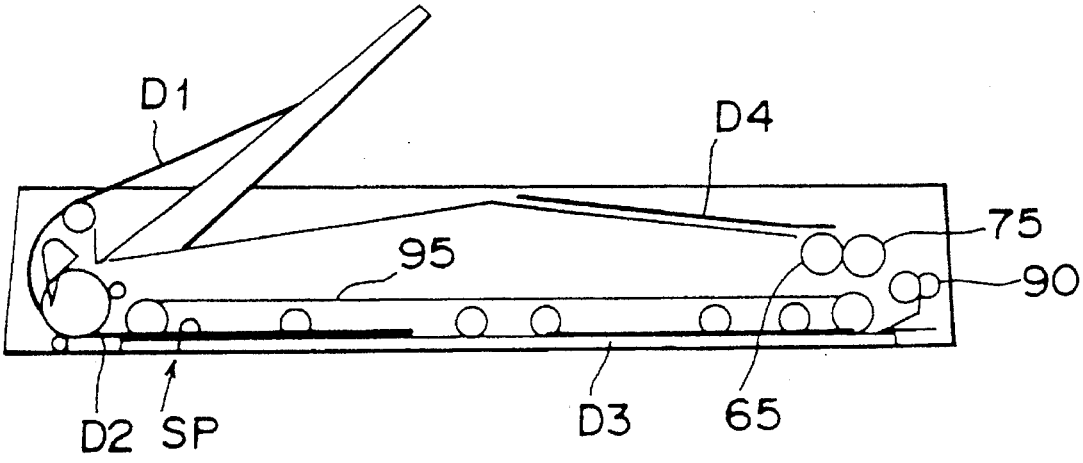
FIG. 46 is an explanatory view of document conveyance in the two-in-one mode subsequent to FIG. 45.
Figure 47:
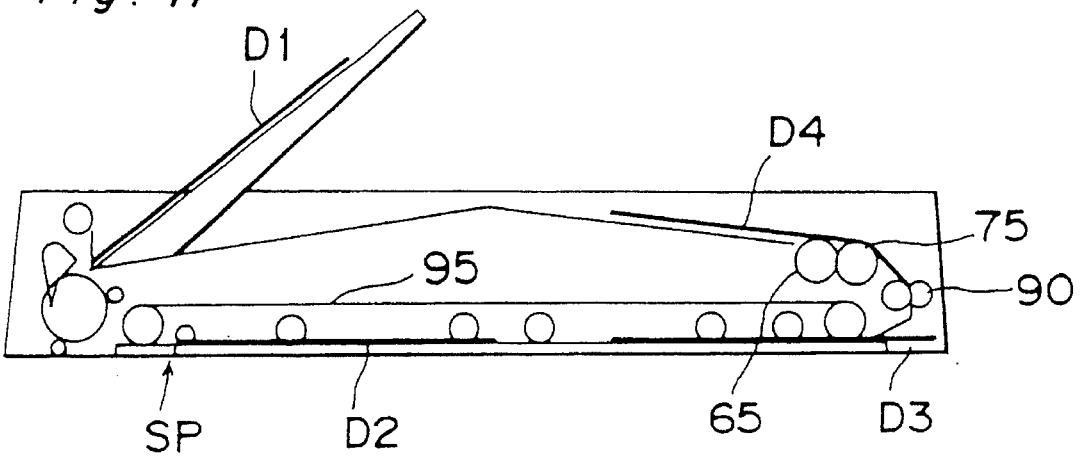
FIG. 47 is an explanatory view of document conveyance in the two-in-one mode subsequent to FIG. 46.
Figure 48:
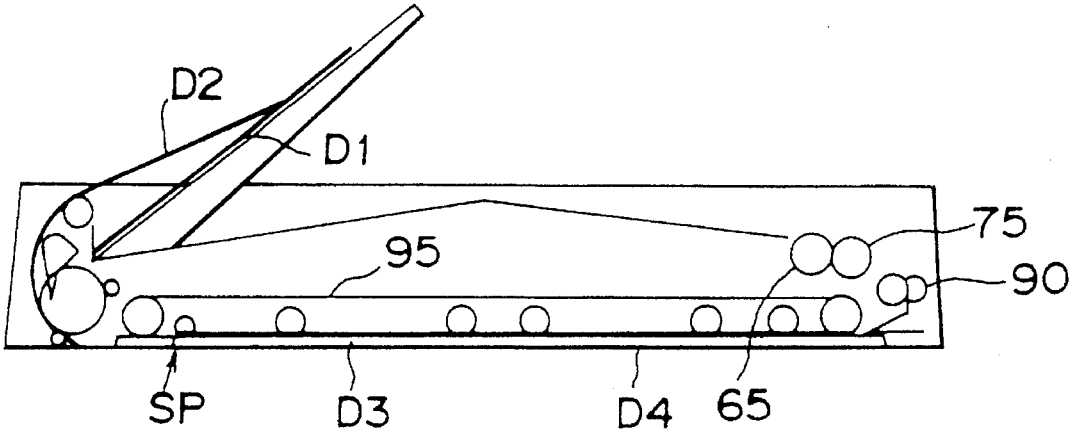
FIG. 48 is an explanatory view of document conveyance in the two-in-one mode subsequent to FIG. 47.
Figure 49:
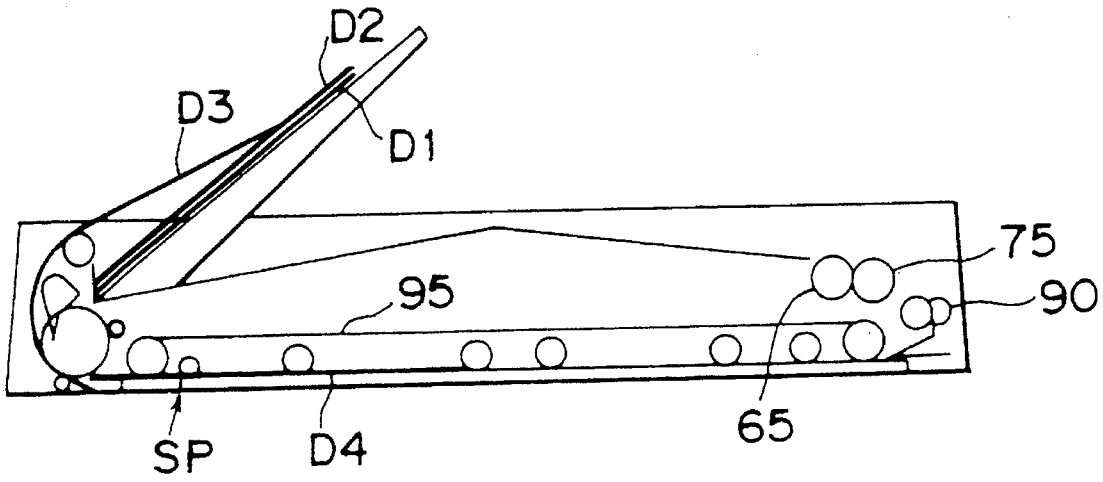
FIG. 49 is an explanatory view of document conveyance in the two-in-one mode subsequent to FIG. 48.
Figure 50:
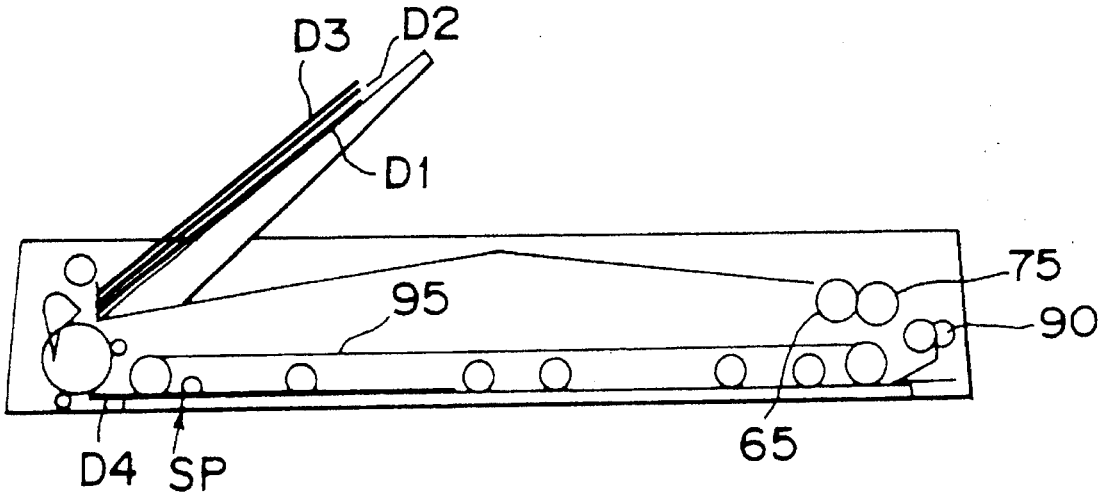
FIG. 50 is an explanatory view of document conveyance in the two-in-one mode subsequent to FIG. 49.
Figure 51:
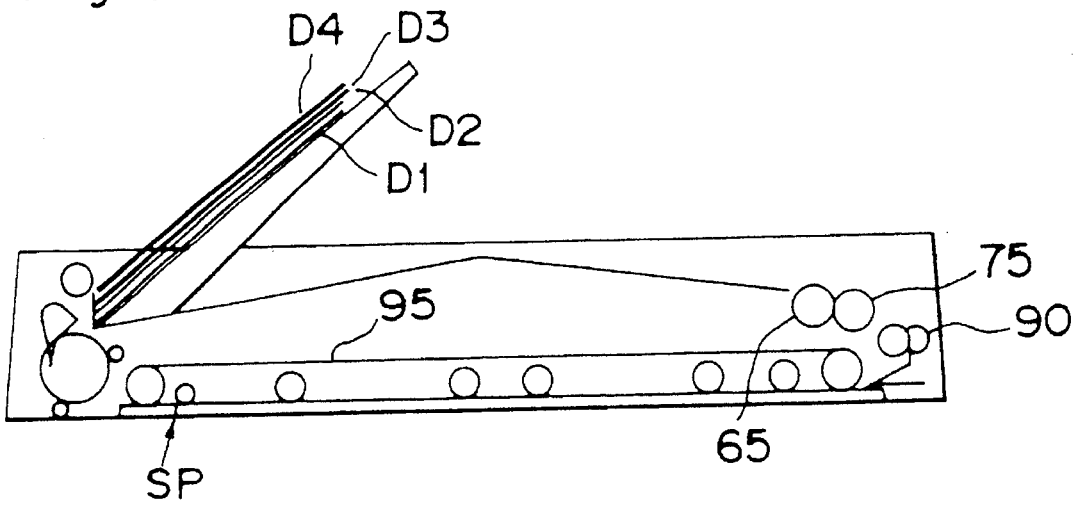
FIG. 51 is an explanatory view of document conveyance in the two-in-one mode subsequent to FIG. 50.

The two-in-one mode is here explained. The two in-one mode is a mode in which two document sheets are arranged as one set and the document image is formed on one sheet of copying paper. FIGS. 40 through 51 illustrate the document conveying state in the two-in-one mode. FIG. 40 shows a state in which the document is set on a tray 61, where it is assumed that four sheets of small-size documents D1, D2, D3, and D4 are set up. First, the first-sheet document D1 is fed, standing by with its front end in contact with the register roller 90 (see FIG. 41). Next, the main motor M3 is driven to rotate forward, so that the document D1 is fed onto the platen glass 29. When the rear end of the document D1 has reached onto the platen glass 29 (see FIG. 42), the main motor M3 is switched to reverse rotation, where the document D1 is switched back to a direction opposite to that of arrow "d". As a result, the rear end of the document D1 goes under the guide plate 132 and the film 133 (see FIG. 43). The extent of the switchback corresponds to a length over which the rear end of the document reaches the nip portion of the register roller 90. It is noted that the document is guided by the resin film 133 so that the rear end portion of the document will not return to the register roller 90 side. The second-sheet document D2 is started to be fed in a specified elapse after the rear end of the first-sheet document D1 is detected by the register sensor SE2. Immediately after the document D1 has been finished being switched back, the document D2 is stopped with its front end in contact with the register roller 90 (see FIG. 43).

Next, the main motor M3 is driven to rotate forward so that the documents D1, D2 are conveyed on the platen glass 29. At a time point when the front end of the document D1 has reached the exposure standard position SP, the main motor M3 is turned off. Thus, the documents D1, D2 have been juxtaposed (see FIG. 44). The main motor M3 is reduced in rotating speed immediately before the document D1 reaches the exposure standard position SP. In synchronization with this speed-reduction timing, the third-sheet document D3 is started to be fed. Before the exposure is completed on the documents D1, D2, the front end of the document D3 is brought into contact with the register roller 90, where the first-out paper feed is completed (see FIG. 45).

Upon completion of the documents D1, D2, the main motor M3 is driven to rotate forward while the discharge motor M4 is driven. The document D1 is fed to the tray 115 by the reverse roller 100 and the discharge roller 110, the document D2 follows the document D1, and the third-sheet document D3 is fed onto the platen glass 29 (see FIG. 46). When the rear end of the document D3 has reached onto the platen glass 29, the main motor M3 is switched to reverse rotation, so that the document D3 is switched back as like the foregoing document D1. In this process, the document D1 is given a conveying force by the reverse roller 100, and discharged onto the tray 115 as it is. The document D2, whose front end has not yet reached the reverse roller 100 at the time of the start of the switchback, switches back together with the document D3 (see FIG. 47). Immediately after the switchback is completed, the fourth-sheet document D4 is first-out fed to the register roller 90.

The discharge motor M4 remains being driven as it is, and the main motor M3 is driven to rotate forward. The main motor M3 continues being driven until the front end of the document D3 reaches the exposure standard position SP, whereby the documents D3, D4 are juxtaposed on the platen glass 29 while the document D2 is discharged onto the tray 115 (see FIG. 48). The discharge motor M4 is turned off when the document D2 is discharged. In this way, the documents D1, D2 are spaced from each other by the succeeding document D3 being once switched back on the way of discharge. If two document sheets were pushed out onto the tray 115 without interval, the succeeding document would rush on the preceding document, disturbing the order on the tray 115, or the succeeding document would slip under the preceding document, disturbing the order of page number. However, since the present embodiment is so arranged that the two sheets of documents D1, D2 are spaced from each other at the time of discharge, the possibility of disturbance of the document on the tray 115 can be eliminated.

Upon completion of the exposure on the documents D3, D4, the main motor M3 is driven to rotate forward, while the discharge motor M4 is driven. Then, at a time point when the rear end of the document D3 has separated from the conveyor befit 95, the main motor M3 is once turned off (see FIG. 49). The time duration for which the main motor M3 is kept off corresponds to a time duration for which the interval between the documents D3 and D4 is opened to such an extent as not to cause any disturbance on the tray 115 (see FIG. 50). At this point, the main motor M3 is driven to rotate forward, whereby the document D4 is discharged onto the tray 115 (see FIG. 51).

The discharging process of the document that is over the exposure and the setting process of the succeeding document to the exposure position SP are conveyed out in the manner as described above. The reverse roller 100 and the discharge roller 110 are driven by the discharge motor M4, which is other than and independent of the main motor M3. Besides, the conveying force by the reverse roller 100 and the pinch roller 101 is set larger than that by the conveyor belt 95. These arrangements make it possible to discharge onto the tray 115 the document introduced to the discharge section, regardless of the operating state of the conveyor belt 95. The switchback point BP (see FIG. 30) is constant irrespectively of the length of the document.

However, with a document size of dp, if the distance from the nip portion of the register roller 90 to the front end of the resin film 133 is d1, the distance from the front end of the film 133 to the switchback point BP is d2, and if the distance from the pinch roller 101 to the exposure standard position SP is d3, then without a positional relation where d3>d1+d2 (=d4) (see FIG. 30), the second sheet of the preceding documents would reach the reverse roller 100 and the pinch roller 101 at a time point when the rear end of the succeeding document reaches the switchback point BP, so that the preceding second-sheet document would be discharged continuously without interval. In this discharging process, if a front end and a rear end of two documents overlap each other, the second-sheet document would slip under the document that is first discharged on the discharge tray 115, or would rush on the preceding document, disturbing the order of the document. Similar problems would be involved also when a preceding (especially the first-sheet) document is short size and a succeeding (especially the third-sheet) document is long size. However, if the difference in length of the document in such a case is expressed as Δdp (Δdp=dpmax−dpmin, where dpmax is the length in the document conveying direction of a document of a maximum length at which the two-in-one mode is feasible with the copying machine, and dpmin is the length in the document conveying direction of a document with a minimum length), then such a positional relation that d3>d4+Δdp (d4=d1+d2) is set. By so doing, two document sheets to be exposed at the same time are discharged from on the glass platen 29 with a sufficient interval therebetween, so that the arrangement order of these two document sheets will never be disturbed.

<Both-sides Mode>

Figure 52:
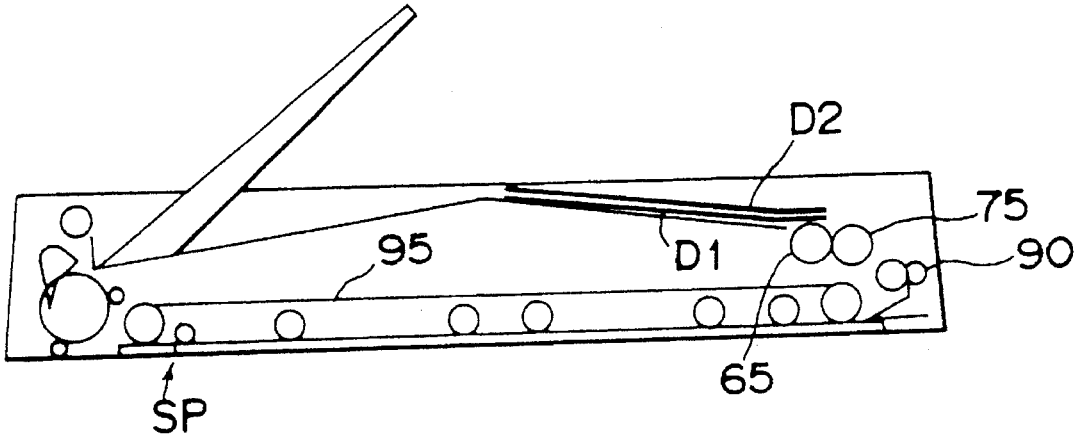
FIG. 52 is an explanatory view of document conveyance in the both-sides mode.
Figure 53:
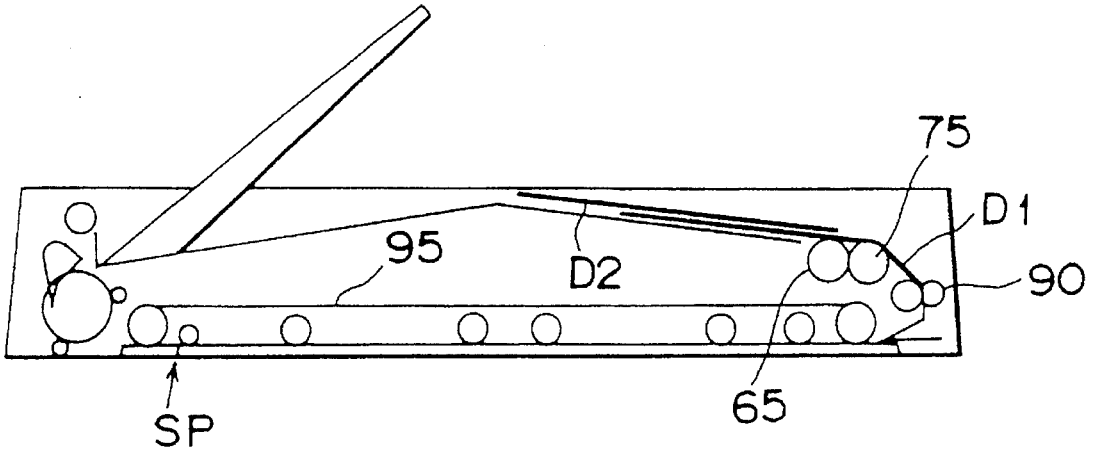
FIG. 53 is an explanatory view of document conveyance in the both-sides mode subsequent to FIG. 52.

The basic operation in the both-sides mode is explained. As shown in FIG. 52, when the copy start button of the copying machine main body 1 is turned on with the documents D1, D2 set up on the document tray 61, then the ADF 60 starts the document feed operation. During the document feed, the pressing plate 70 presses the front end of the document D1. Then, based on the rotation of the pickup roller 65 and the feed roller 75, the document D1 is fed to the position of the register roller 90, and the pickup roller 65 and the feed roller 75 stop rotating at a time point when the front end of the document has come into contact with the register roller 90 to form a loop (see FIG. 53). Also, the pressing plate 70 is released from pressing the document D1, thus completing the document feeding operation for the first sheet.

Figure 54:
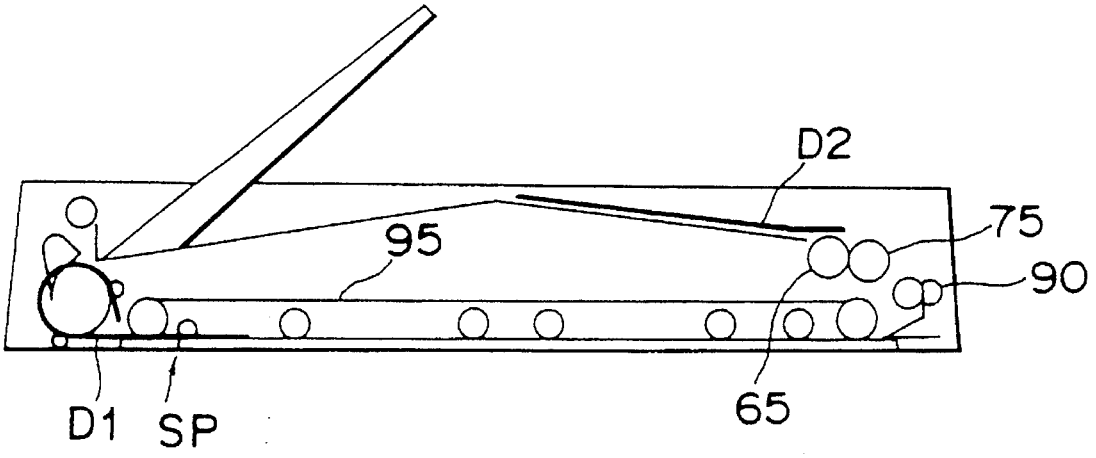
FIG. 54 is an explanatory view of document conveyance in the both-sides mode subsequent to FIG. 53.

Next, the register roller 90, the conveyor belt 95, and the reverse roller 100 rotate so that the document D1 is fed onto the glass platen 29. Meanwhile, the scale solenoid SL1 is turned so that the front end portion of the scale 120 is withdrawn to under the glass platen 29, where the switching claw 103 operates to cause the paper path in the document discharge section to be switched to the reversal path. Upon completion of exposure, the document D1 is sent to the reversal path in the discharge section. Then, the register roller 90, the conveyor belt 95, and the reverse roller 100 temporarily stop with the front end of the document held at a second subordinate roller 102 (see FIG. 54).

Figure 55:
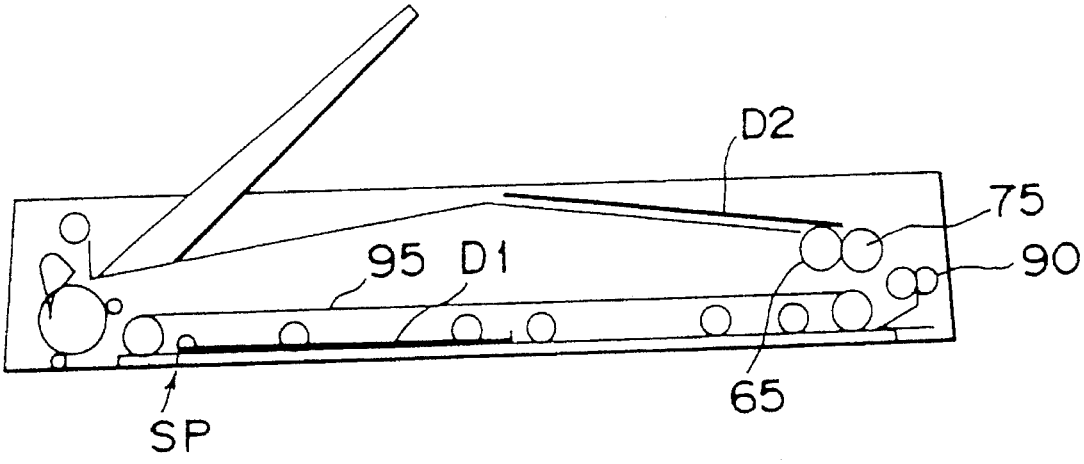
FIG. 55 is an explanatory view of document conveyance in the both-sides mode subsequent to FIG. 54.
Figure 56:
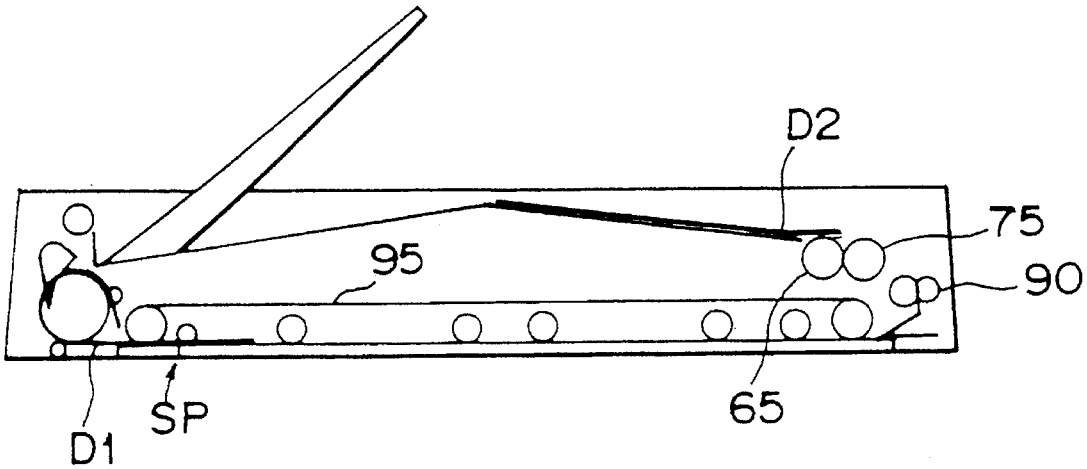
FIG. 56 is an explanatory view of document conveyance in the both-sides mode subsequent to FIG. 55.
Figure 57:
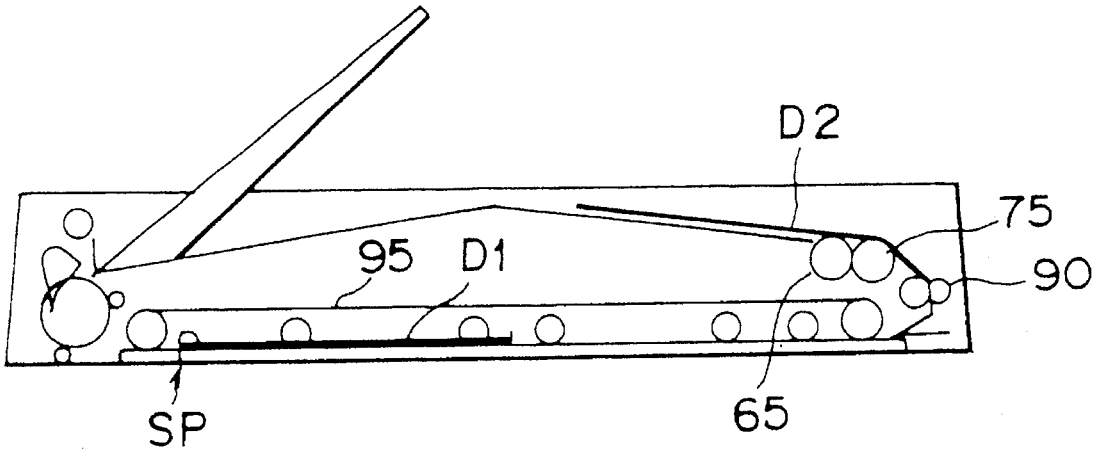
FIG. 57 is an explanatory view of document conveyance in the both-sides mode subsequent to FIG. 56.
Figure 58:
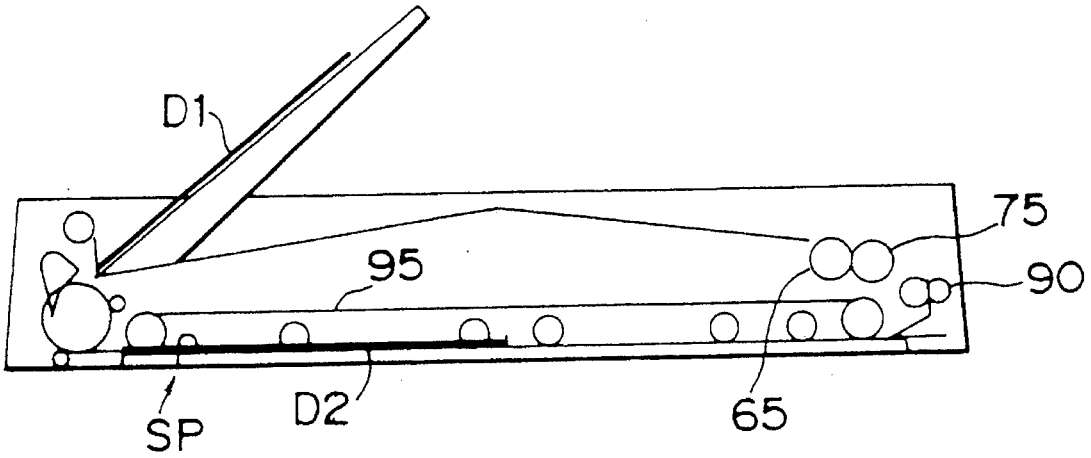
FIG. 58 is an explanatory view of document conveyance in the both-sides mode subsequent to FIG. 57.
Figure 59:
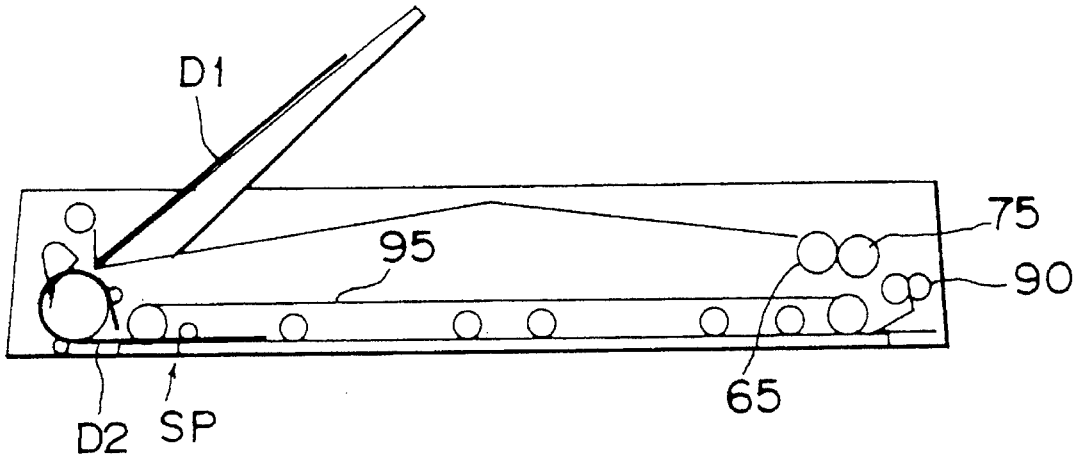
FIG. 59 is an explanatory view of document conveyance in the both-sides mode subsequent to FIG. 58.
Figure 60:
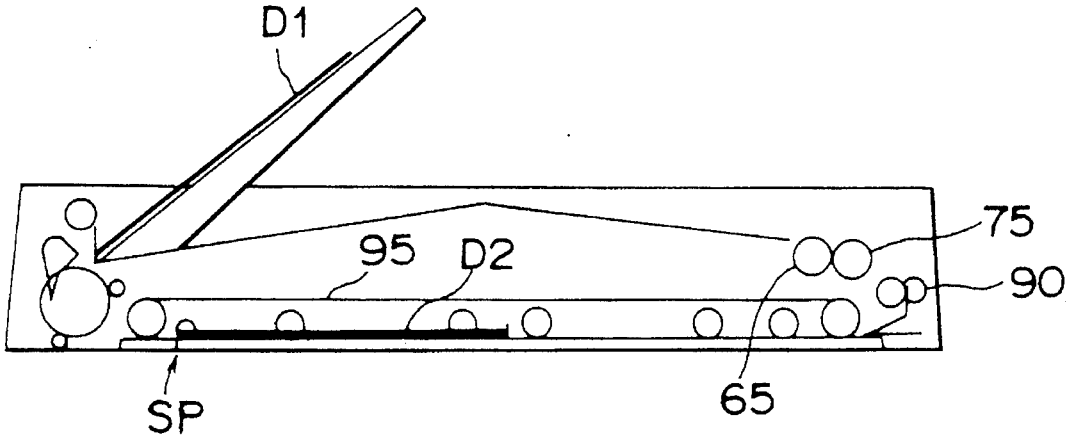
FIG. 60 is an explanatory view of document conveyance in the both-sides mode subsequent to FIG. 59.
Figure 61:
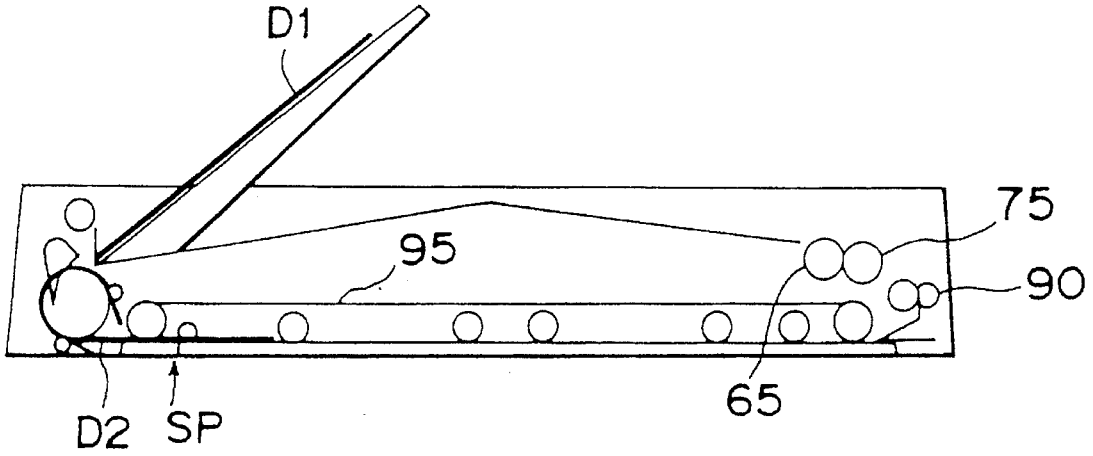
FIG. 61 is an explanatory view of document conveyance in the both-sides mode subsequent to FIG. 60.
Figure 62:
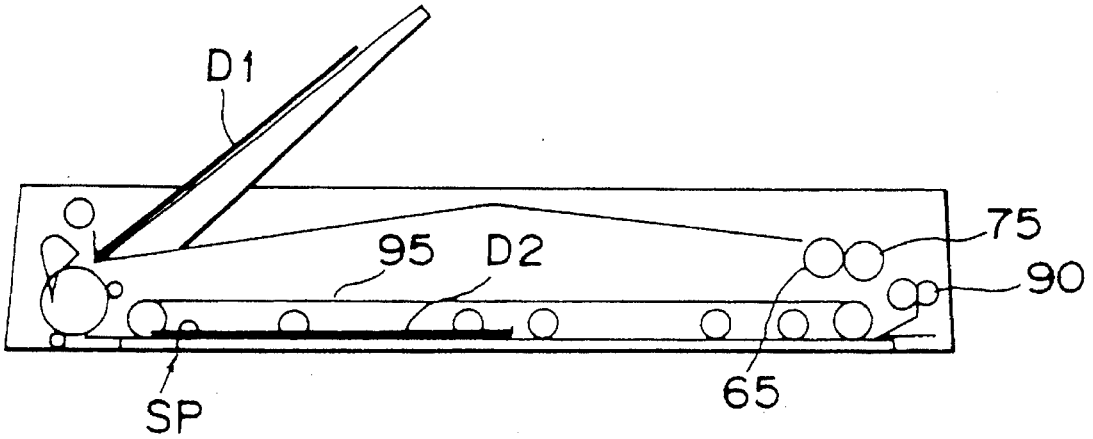
FIG. 62 is an explanatory view of document conveyance in the both-sides mode subsequent to FIG. 61.
Figure 63:
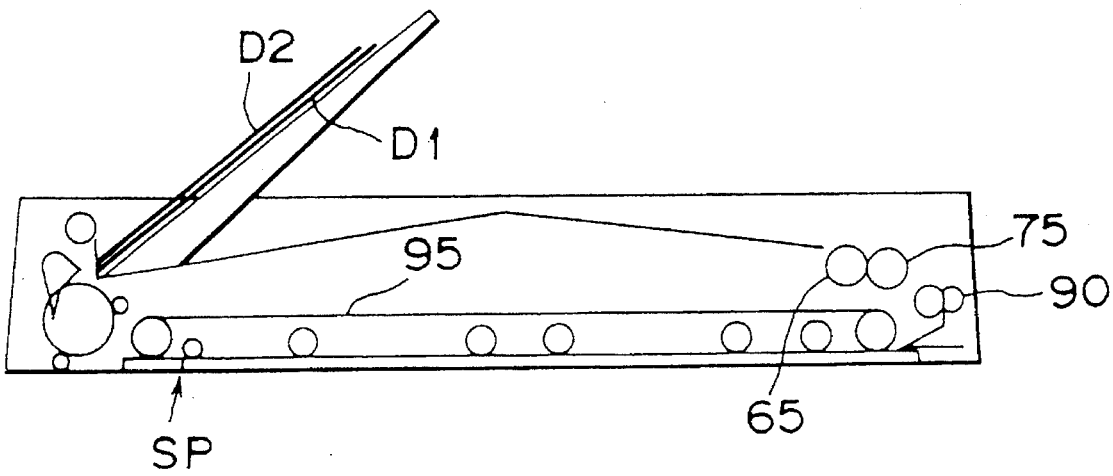
FIG. 63 is an explanatory view of document conveyance in the both-sides mode subsequent to FIG. 62.

In a specified elapse, the reverse roller 100 rotates again so that the conveyor belt 95 rotates reverse, whereby the conveying of the document D1 is resumed. Thus, the document D1, passing through the reversal path, is again fed onto the glass platen 29 so that the rear surface of the document is copied (see FIG. 55). After the rear surface of the document is finished being copied, the document D1 is again conveyed to the reversal path, so that the front surface of the document is copied (see FIGS. 56, 57). Upon completion of the exposure on the document surface, the register roller 90, the conveyor belt 95, and the reverse roller 100 rotate so that the switching claw 103 operates in the reverse direction, whereby the first-sheet document is discharged onto the discharge tray 115 (see FIG. 58). When the first-sheet document is discharged, the switching claw 103 operates again, switching the document conveying path to the reversal path to reverse the second-sheet document (see FIG. 59). The second-sheet document is conveyed to the position of the register roller 90 during the exposure of the surface of the first-sheet document (see FIG. 57). Then, immediately after the first-sheet document is discharged from the glass platen 29, the second-sheet document is fed to the exposure standard position SP on the glass platen 29 and processed in the same way as the first-sheet document (see FIGS. 60 to 63).

<Count Mode>

Now the count mode is explained. The count mode is a mode in which the number of document sheets are counted by making the document sheets are circulated over one cycle without being accompanied by the copying operation before the copying operation is started with the use of the ADF 60. In the two-in-one mode, if the number of document sheets is an odd number, the ADF 60, which feeds the document sheets by starting with the final page, would encounter a trouble that the image of the first-page sheet is copied on a half of one copying sheet, which means that the cover page of the copied document has a blank half. Accordingly, by the ADF 60 previously counting the number of document sheets, if the count is an odd number, the final page sheet to be first fed is conveyed by one sheet alone onto the platen glass 29 and the following document sheets are conveyed in the aforementioned two-in-one mode. Also, since a similar trouble would occur even in the both-sides copy mode and the combined copy mode, it is necessary to previously count the number of document sheets in the count mode.

Since the count mode does not involve the copying operation, it is desirable to carry out the process as fast as possible (in as short a time as possible). However, the present ADF 60 adopts a system that the front end of the document is stopped at a standard position SP on the platen glass 29 downstream of in the conveying direction. As a result, if the document is stopped at the standard position SP also in the count mode, the interval between two document sheets would become too large, resulting in an increase in the idle feeding time.

Thus, in the count mode, it has been arranged that the document is temporarily stopped by referencing a time point when the rear end of the document has reached a stop reference position X on the platen glass 29 (see FIG. 29). With this arrangement, the interval between document sheets during the execution of the count mode is given by a length from the stop reference position X to the nip portion of the register roller 90, so that the processing time is largely reduced. That the rear end of the document has reached the reference position X can be detected by counting the number of pulses from when the rear end of the document is detected by the register sensor SE2 until when the main motor M3 is driven.

The reference position X in this case may be arbitrarily set without being limited to the position as shown in FIG. 29. The reference position X, only if upstream of the stop reference position SP for copying operation, contributes to reduction in the processing time in the count mode. Further, the reference position X does not need to be set on the glass platen 29, but needs only to be downstream of the nip portion of the register roller 90. The more the reference position X is close to the nip portion of the register roller 90, the more the processing time is reduced.

Preferably, the ADF 60 conveys the document in the count mode at a speed higher than it does in the copying operation. It is also preferable to accelerate the document conveying speed higher than the reference speed, in executing an operation of the ADF 60 that causes the copying operation to be delayed or that causes the copying productivity of 100% as described before to be lowered, as well as in effecting the count mode. The aforementioned operation that causes the copying operation to be delayed is involved in reversing a both-sides document by the reverse roller 100, conveying the first-fed document up to the exposure standard position SP, and discharging the last-fed document from the glass platen 29 to the tray 115.

<Control Circuit and Control Procedure for ADF 60>

Figure 64:
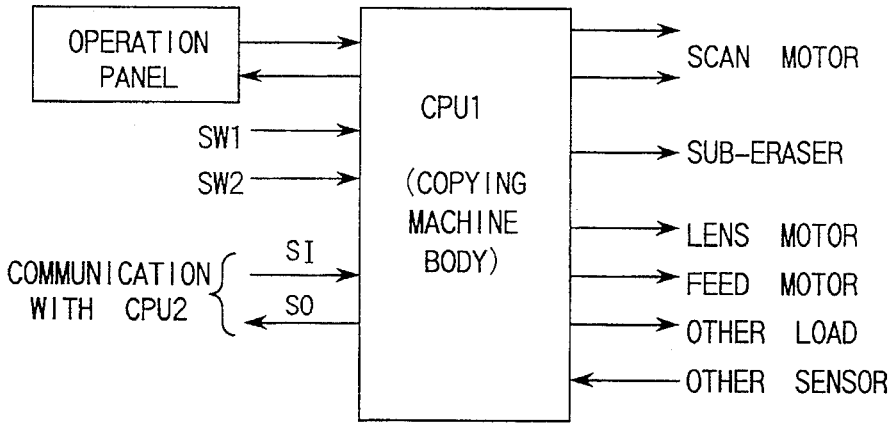
FIG. 64 is a block diagram showing the control section of the copying machine main body.

The control circuit and control procedure for the ADF 60 is now explained. FIG. 64 shows a control circuit of the copying machine. The control circuit comprises a CPU1 for controlling the copying machine 1 and a CPU2 (see FIG. 65) for controlling the ADF 60. The CPU1 and CPU2 exchange information with each other at necessary timing.

Hereinbelow, the control of the copying machine is described in details with reference to flow charts. It is to be noted that in the following control operation, the ON-EDGE means that the switch, sensor, signal, or the like is switched from off to on state, and the OFF-EDGE means that the switch, sensor, signal, or the like is switched from on to off state. It is also assumed that the sensors SE1, SE2, SE3, SE10, SE11, and SE12 will be turned on when the optical axis is shielded, and turned off when it is opened. If a flag is used, it is assumed that "1" represents the ON operation, and "0" represents the OFF operation.

<Main Routine of CPU1>

Figure 66:
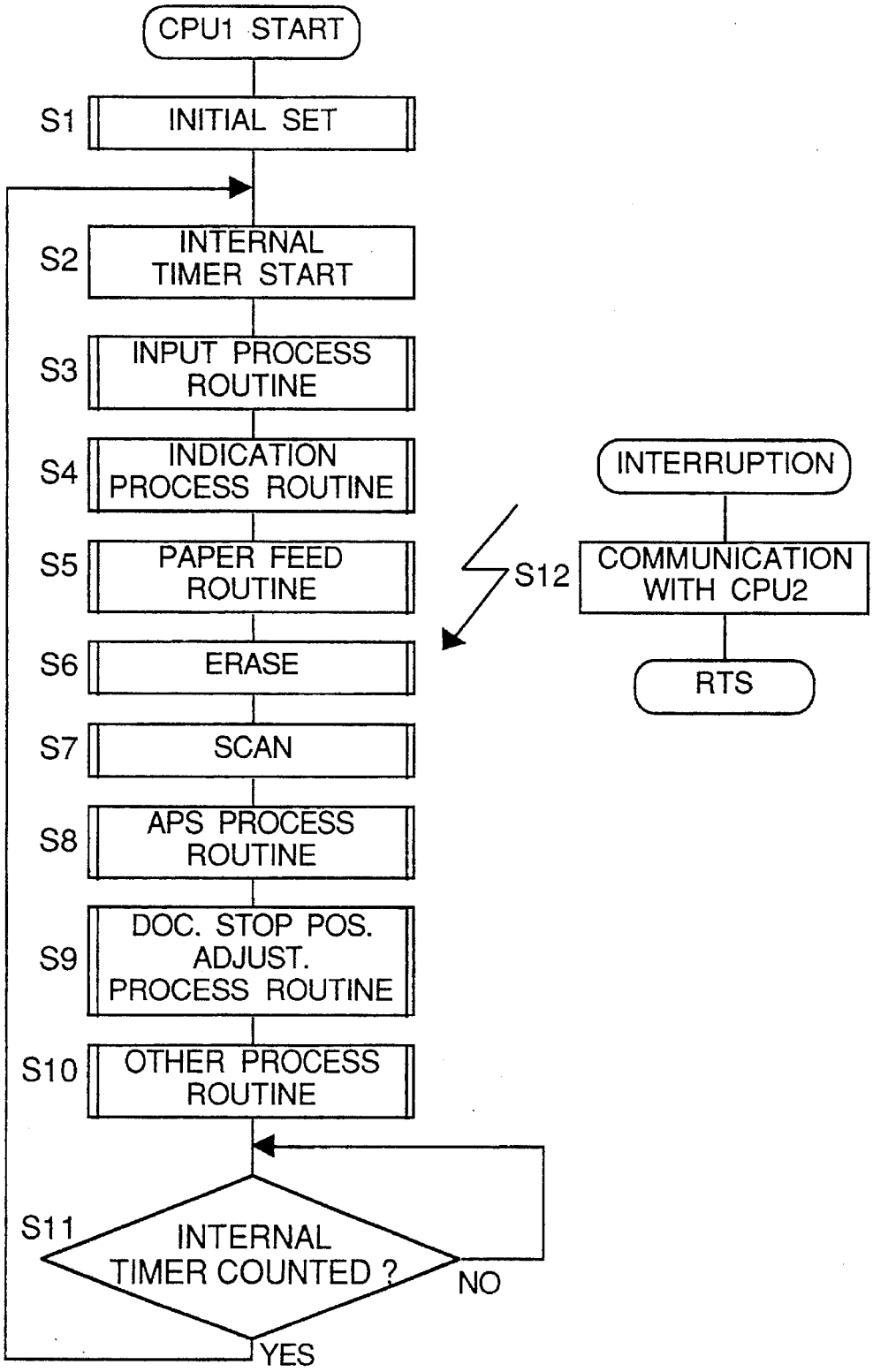
FIG. 66 is flow chart showing the main routine of the CPU1 for controlling the copying machine main body.

FIG. 66 shows a main routine of the CPU1 that controls the copying machine 1. With power on, the CPU1 is reset and the program starts. At S1, initial setting is performed, where the RAM is cleared, various registers are reset, and various types of equipment are set to their initial modes. Subsequently at S2, an internal timer is started. The internal timer functions to determine the required time of one cycle routine of this main routine and its value is set at S1. Also, the internal timer serves as a reference for the count of other various timers involved in subroutines.

Next, the subroutines of S3 through S10 are sequentially called and necessary processes are executed. Then, at S11, the program returns to S2 upon completion of the count of the internal timer. S3 is an input subroutine for processing information inputted from a control panel or the like; S4 is an indication subroutine for processing the indication of various indicators arranged on the control panel; S5 is a subroutine for feeding copying paper up to the timing roller 38; S6 is a subroutine for erasing surface charges of the photosensitive drum 10; S7 is a subroutine for forming an electrostatic latent image on the photosensitive drum 10 with scanning operation by the optical system 20; S8 is an APS (Automatic Paper Selection) subroutine for automatically selecting a proper size of sheets from the document size and the copying magnification; S9 is a document stop position adjustment subroutine for adjusting the document stop position on the glass platen 29; S10 is a subroutine for executing other operations including the driving of the photosensitive drum 10 and other peripheral elements, the conveying of copying paper, the fixing, the detection of paper jams, and the like, as well as a process for adjusting the document stop position on the glass platen 29 when the stop position adjustment mode is entered. In addition, the CPU1 is connected to the CPU2 via a serial communication line and the transmission and reception between them is executed at S12 by interrupt processing.

<APS Routine>

Figure 67:
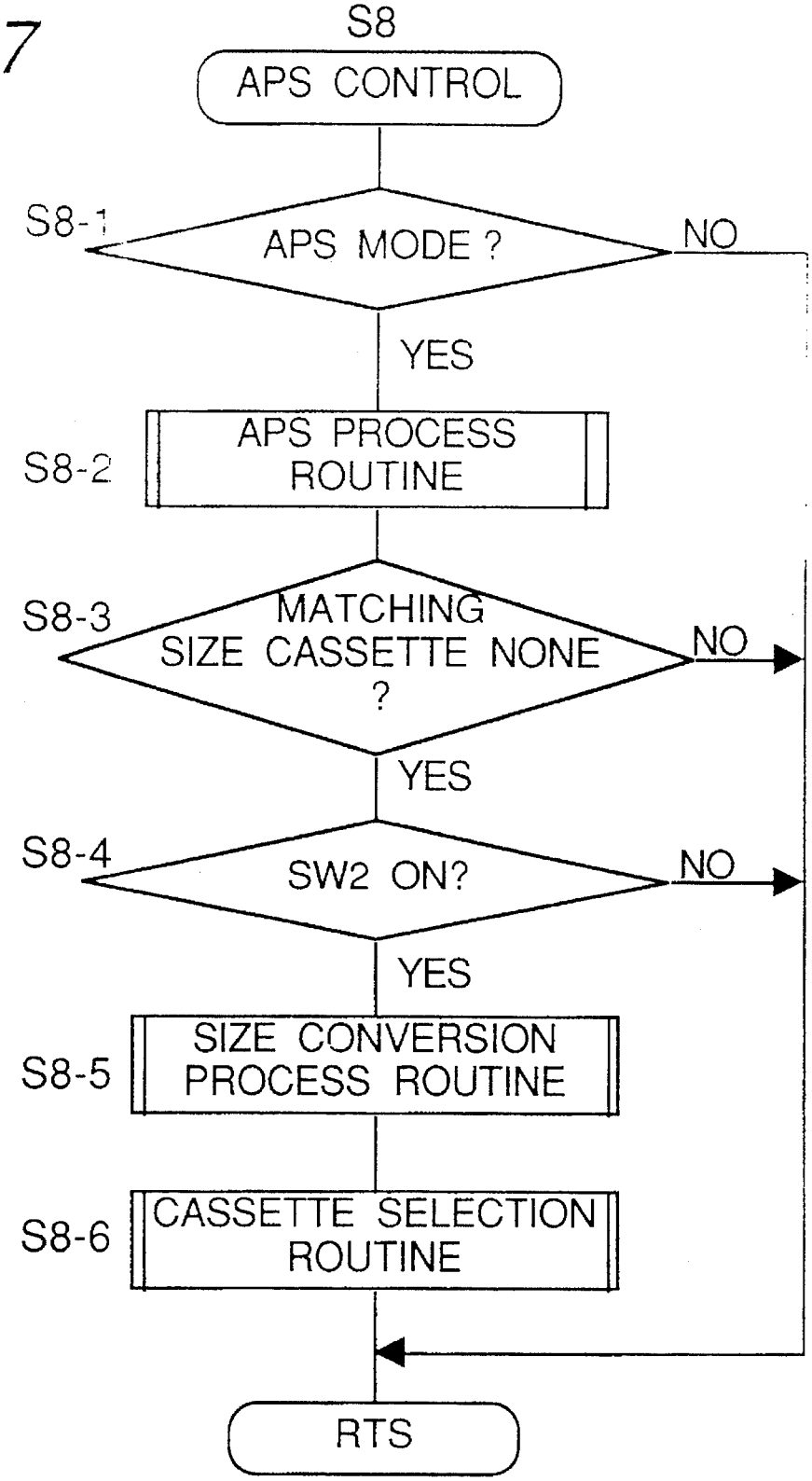
FIG. 67 is a flow chart showing the APS control subroutine in the CPU1.

In the APS control routine, as shown in FIG. 67, it is decided at S8-1 whether or not the APS mode has been selected. This APS mode is to be set or canceled by an APS mode select key (not: shown) provided on the control panel of the copying machine main body 1. Then if the APS mode has been selected, the APS process is executed at S8-2, where a sheet of an optimum size is fed depending on the document size and the copying magnification. Now, if a sheet of matching size has been accommodated in the paper feed section, the program returns (S8-3); if a sheet of matching size has not been accommodated in the paper feed section, it is decided at S8-4 whether or not a switch SW2 has been turned on. This switch is a switch for designating whether or not an inch-base size is converted into a metric-base size (A size or B size). For example in a copying machine that takes the metric size as the reference size, when the switch SW2 is turned on, an inch-base size read in the APS mode is converted as shown in Table 1 below at S8-5, and paper is fed from the paper feed section in which the sheets of the size resulting from the conversion are accommodated, at S8-6. Conversely, when the switch SW2 is turned off, metric-base sizes on the right hand of Table 1 are converted into inch-base sizes on the right hand. In this table, L represents the longitudinal direction (longer side) and T represents the transverse direction (short side).

TABLE 1

| Size read | Size after conversion |
|---|---|
| Letter (L/T) | → A4 (L/T) |
| Legal | → B4 (L) |
| FLS | → B4 (L) |
| 11 × 15 (L) | → A3 (L) |
| 11 × 17 (L) | → A3 (L) |

<Document Stop Position Adjustment Routine>

Figure 68:
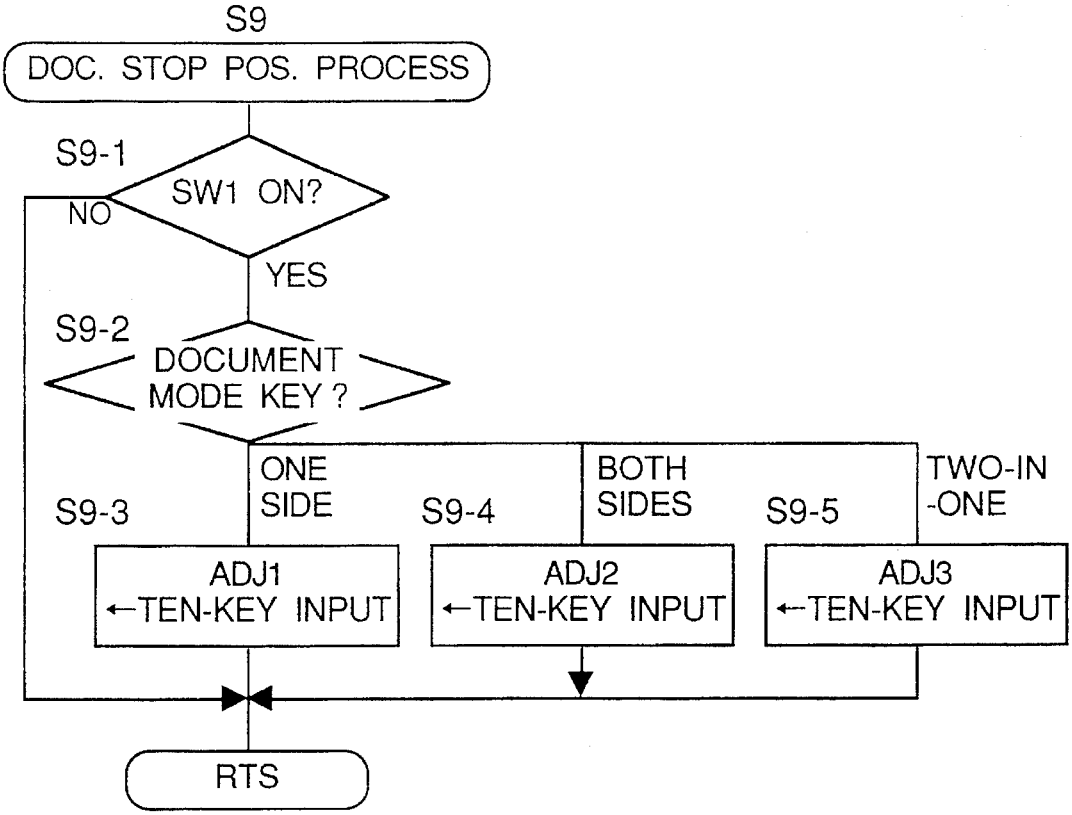
FIG. 68 is a flow chart showing the document stop position subroutine in the CPU1.

In the document stop position adjustment routine (S9), as shown in FIG. 68, it is decided at S9-1 whether or not a document stop position adjustment switch SW1 has been turned on. This document stop position adjustment switch SW1 is preferably disposed at a place that cannot normally be viewed by the user, such as behind the copying machine main body 1. If the document stop position adjustment switch SW1 has been turned off, the program returns. If it has been turned on, a document mode is set at S9-2, where the program is branched to S9-3, S9-4, or S9-5 according to the one-side mode, the both-sides mode, or the two-in-one mode, respectively. At this point, adjustment quantities of document stop position inputted with the ten-key pad, ADJ1, ADJ2, and ADJ3, are stored in the RAM of the copying machine main body 1, whereupon the program returns.

In more detail, the ADJ1 is data for use of document stop position adjustment in the one-side mode and the two-in-one mode. As the ADJ1, a positive numerical value is inputted when the document stop position is moved to the upstream side in the document conveying direction. Conversely, a negative numerical value is inputted when the document stop position is moved to the downstream side. The ADJ2 is data for use of document stop position adjustment in the both-sides mode. As the ADJ2, a negative numerical value or a positive numerical value is inputted according to the moving direction. The ADJ3 indicates an interval adjustment quantity of two document sheets arranged on the glass platen 29 in the two-in-one mode, where a positive numerical value implies an expansion of the document interval while a negative numerical value implies a reduction of the document interval. These adjustment quantities ADJ1 to 3 stored in the RAM of the copying machine main body 1 are transmitted from the CPU1 to the CPU2 of the ADF 60, whereby the driving system is controlled based on these data. Thus, the document stop position in the various modes as well as the interval between two document sheets exposed simultaneously in the two-in-one mode can be controlled to a proper value by inputting the adjustment quantities ADJ1, ADJ2, and ADJ3 with the ten-key pad.

<Erase>

Figure 69:
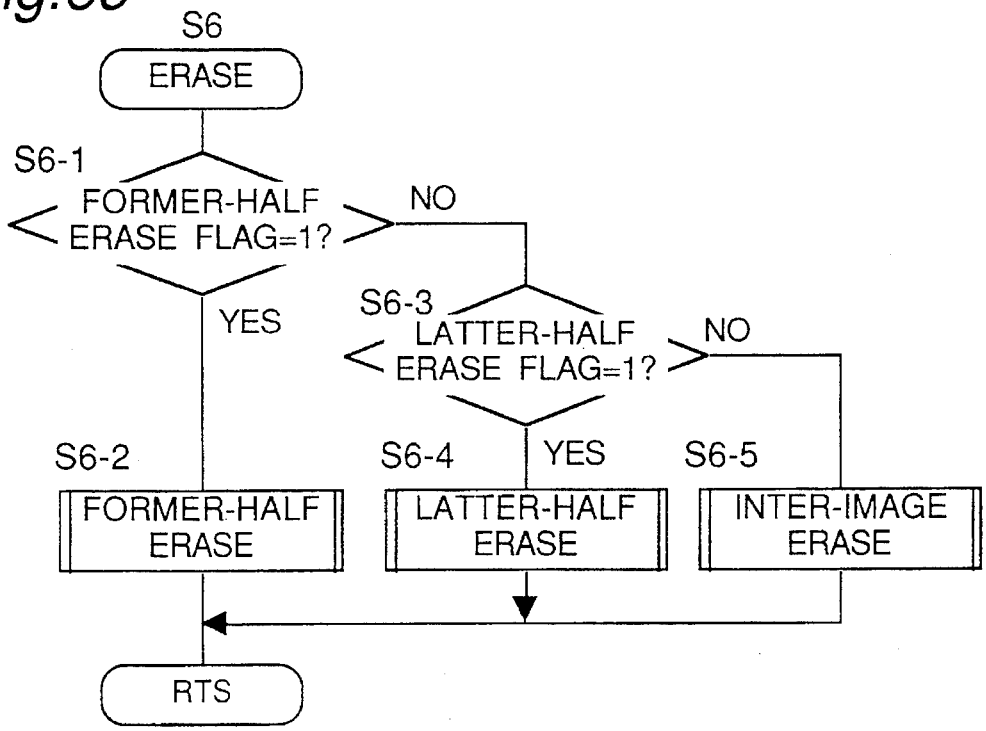
FIG. 69 is a flow chart showing the erase subroutine in the CPU1.

FIG. 69 shows an erase subroutine to be executed at S6. In this subroutine, it is first decided at S6-1 whether or not a former-half erase flag is "1". Then, if the former-half erase flag is "1", charges on the former-half portion of an area of the photosensitive member corresponding to the document placed on the glass platen are erased by the eraser 13, at S6-2. For example, on condition that an area on the photosensitive member corresponding to the A3 size should be charged from a view point of the size or the arrangement position of the document placed on the glass platen, if the former-half erase flag has been set to "1", then the first half portion in the charging area on the photosensitive member corresponding to the A3 size is illuminated so that the charges are removed. Meanwhile, if the former-half erase flag is "0", then it is decided at S6-3 whether or not the latter-half erase flag is "1". If the latter-half erase flag is "1", then charges on the latter-half portion of an area of the photosensitive member corresponding to the document placed on the glass platen 29 are removed by the eraser 13, at S6-4. However, if the latter-half erase flag is also "0", then inter-image portions are erased at S6-5.

Actually, when the ADF adopted is of such a type that the document is fed by starting with its last page, the two-in-one mode is set. With an odd number of document sheets set onto the document tray 61, the aforementioned former-half erase flag is set to "1" in the copying operation for the last page document sheet, the flag being transmitted to the CPU1. As a result, the last-page document is set onto the glass platen 29 with its front end coincident with the IP, and charges on an area of the photosensitive member corresponding to the area from the scale 120 to the document are removed. The latter-half erase flag, with the two-in-one mode set, is set to "1" when the second-sheet document is large size out of a pair of document sheets set onto the glass platen, the flag being transmitted to the CPU1. As a result, charges on an area on the photosensitive member corresponding to the second-sheet document are removed. It is noted that the second-sheet document is subsequently copied onto one sheet alone by its entire surface.

<Scan>

Figure 70:
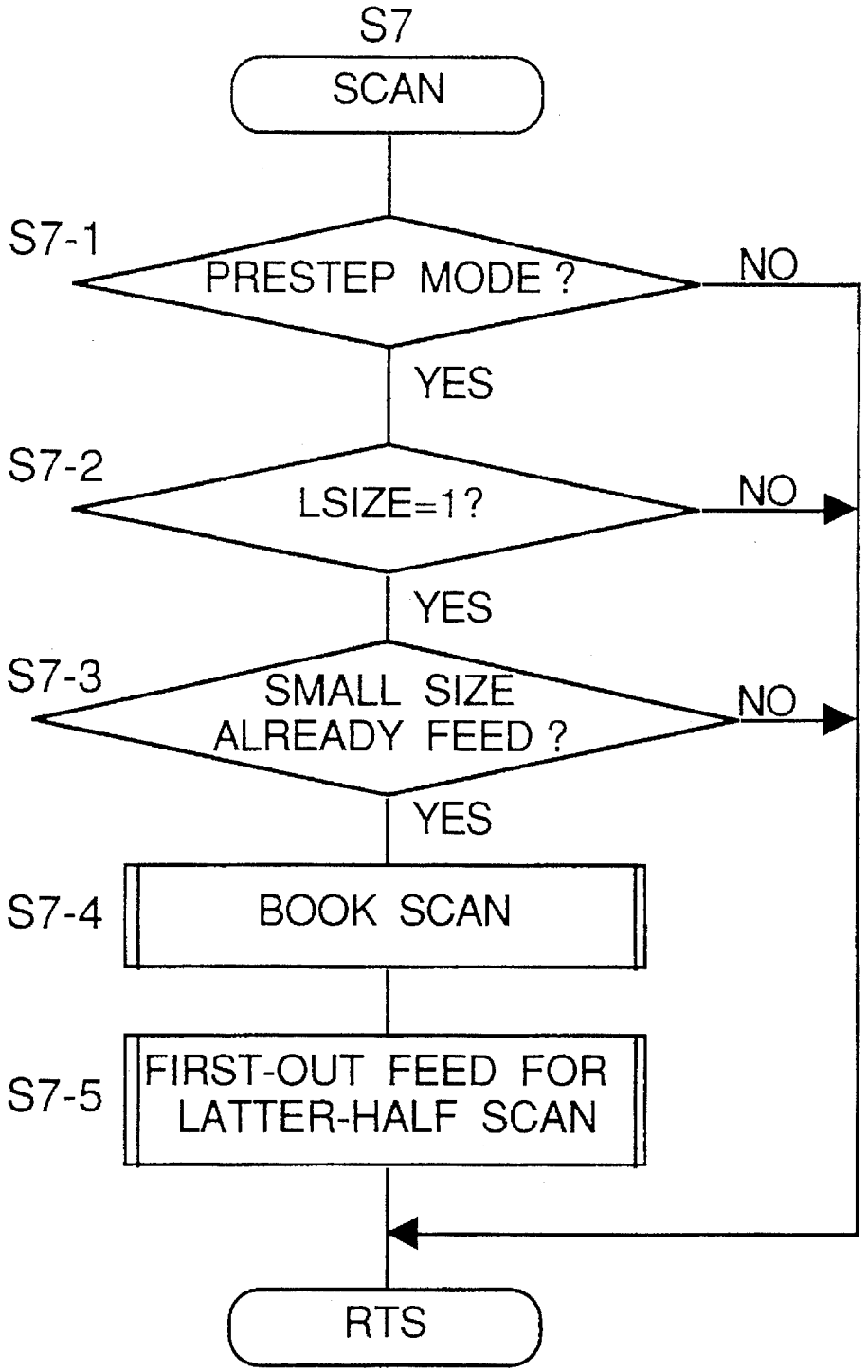
FIG. 70 is a flow chart showing the scan subroutine in the CPU1.

FIG. 70 shows a subroutine of scan by the optical system 20 to be executed at S7. First, it is decided at S7-1 whether or not the current mode is the prestep mode. Then, it is decided at S7-2 whether or not a flag LSIZE is "1". It is decided at S7-3 whether or not small-size paper has already been fed. The flag LSIZE is set to "1" when a large-size document is set to the exposure position, the flag being transmitted to the CPU1. If YES has been decided at every step of S7-1, S7-2 and S7-3, a book scan is processed at S7-4. The book scan refers to a scan mode of the optical system 20 in a book-divided copy process described in the above-described document conveyance in the prestep mode. At S7-5, the paper onto which an image is to be transferred in the latter-half scan of the book scan is first-out fed.

<Description of Pulses and Timers>

Before describing the procedure by which the CPU2 controls the ADF 60, explained are pulses and timers for controlling the counter and the main motor M3.

Counter DCNT1: Used to feed copying paper to the copying machine main body 1; its value is transmitted to the CPU1 by an interrupt process. When the document is set to the tray 61 (when the empty sensor SE1 is turned on), the counter DCNT1 is set to "1". The counter is incremented if the sensor SE1 is on at the OFF EDGE of the register sensor SE2, and decremented at the ON EDGE of a flag DCHG that requests replacement of the document. The copying machine main body 1 is controlled so as to feed sheets of a number resulting from multiplying the value of the DCNT1 by the copy number.

Counter DCNT2: Counts the number of document sheets that are present in the conveying path of the ADF 60 in the count mode. The counter DCNT2 is incremented at the ON EDGE of the register sensor SE2, and decremented upon completion of the discharge of the document.

Counter DCNT3: Used to count the number of document sheets discharged at the time of a document replacement process in the prestep mode and the two-in-one mode. The number of document sheets set by the document replacement process is set to the counter. The counter is decremented upon completion of the discharge of the document.

Counter GCNT: Used to count the number of document sheets during a copying operation. The counter is incremented at the OFF EDGE of the register sensor SE2, and reset upon completion of a copying operation.

Counter PLSCNT1: Counts the number of pulses from when the main motor M3 is turned on. The counter is incremented in the forward rotation mode and decremented in the reverse rotation mode.

Counter PLSCNT2: Counts the number of pulses of the main motor M3 from when the register sensor SE2 is turned off. The counter is incremented in the forward rotation mode and decremented in the reverse rotation mode.

Counter SIZCNT1: Used to detect the size of the document. A value of the PLSCNT1 is stored when the register sensor SE2 is turned off.

Pulse P01: A number of pulses to be counted from when the main motor M3 is driven to rotate forward until when it is reduced in speed, in the case where a small-size document is conveyed in the prestep mode. At a time point when this number of pulses has been fully counted, the next document sheet is started to be first-out fed.

Pulse P02: A number of pulses to be counted from when the main motor M3 is driven to rotate forward until when it is turned off, in the case where a small-size document is conveyed in the prestep mode. The number corresponds to L/2.

Pulse P03: A number of pulses to be counted from when the main motor M3 is driven to rotate forward until when it is reduced in speed, in the case where a document other than small size is conveyed in the prestep mode. At a time point when this number of pulses has been fully counted, the next document sheet is started to be first-out fed.

Pulse P04 (corresponding to L): A number of pulses to be counted from when the main motor M3 is driven into forward rotation until when it is turned off, in the case where a document other than small size is conveyed in the prestep mode.

Pulse P05: A number of pulses to be counted from when the main motor M3 is driven to rotate forward until when it is reduced in speed, in the case where two sheets of a small size document are set on the platen glass 29 in the two-in-one mode and next a large size document is conveyed.

Pulse P06 (A4 transverse+α, or corresponding to L/2): A number of pulses to be counted from when the main motor M3 is driven to rotate forward until when it is turned off, in the case where two small-size document sheets on the platen glass 29 and successively a large-size document sheet are conveyed in the two-in-one mode (the main motor M3 is temporarily stopped for discharge of the preceding document).

Pulse P07: A number of pulses to be counted from when the register sensor SE2 is turned off until when the main motor M3 is driven to rotate reverse, in the case where a small-size document sheet is conveyed in the two-in-one mode.

Pulse P08: A number of pulses to be counted from when a small-size document sheet is switched back in the two-in-one mode.

Pulse P09: A number of pulses to be counted from when the register sensor SE2 is turned off until when the main motor M3 is turned off in the count mode.

Timer T101: Provides timing with which the feed motor M2 is turned on after the pickup motor M1 is turned off.

Timer T102: Provides timing with which the feed motor M2 is turned off after the register sensor SE2 is turned on.

Timer T201: Provides timing with which the stopper solenoid SL1 is turned off after the main motor M3 is turned off.

Timer T202: Provides timing with which the pickup motor M1 is turned on after the register sensor SE2 is turned off in the two-in-one mode.

Timer T301: Provides timing with which the discharge motor M4 is turned off after the discharge sensor SE3 is turned off.

Timer T401: Provides timing with which the main motor M3 is turned off after it is turned on, for the process of discharging the last two document sheets in the two-in-one mode, in the second embodiment.

Timer T501: Provides timing with which the main motor M3 is turned off after it is driven to rotate reverse, for the process of switching back the document in the two-in-one mode, in the second embodiment.

<Main Routine of CPU2>

Figure 71:
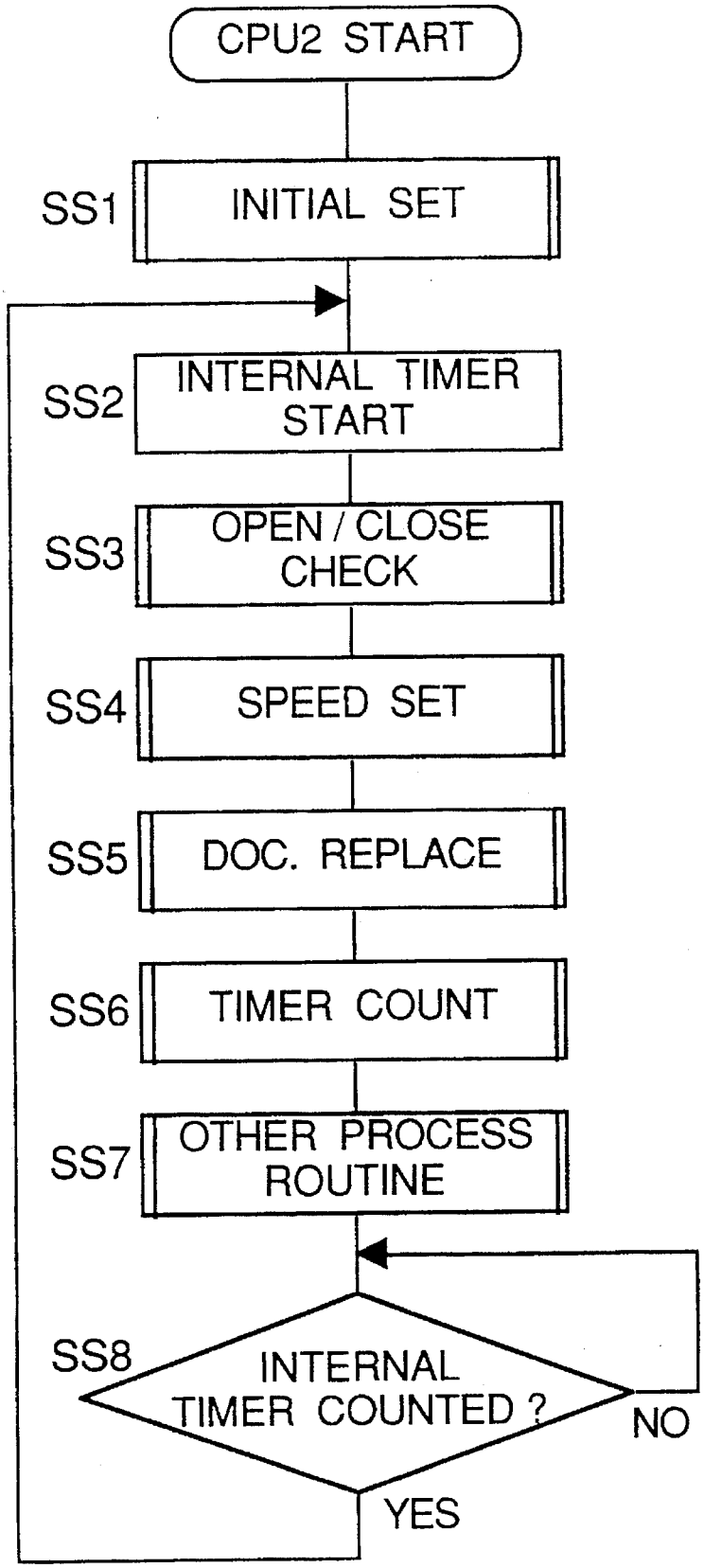
FIG. 71 is a flow chart showing the main routine of the CPU2 for controlling the ADF.

FIG. 71 shows a main routine of the CPU2 for controlling the ADF 60. With power on, the CPU2 is reset and the program starts. At SS1, initial setting is performed, where the RAM is cleared, various registers are reset, and various types of equipment are set to their initial modes. Subsequently at SS2, an internal timer is started. The internal timer functions to determine the required time of one cycle routine of this main routine and its value is set at SS1. Also, the internal timer serves as a reference for the count of other various timers involved in subroutines as described below.

Next, the subroutines of SS3 through SS7 are sequentially called and necessary processes are executed. Then, at S8, the program returns to SS2 upon completion of the count of the internal timer. SS3 is a subroutine for checking whether the opening/closing mechanisms for opening/closing operation upon the glass platen and the jam process of the ADF are opened or closed, to thereby decide whether the individual parts are opened or closed. SS4 is a subroutine for setting a document conveying speed of the ADF 60. SS5 is a subroutine for replacing a document sheet with another on the platen glass 29. SS6 is a subroutine for executing the count of the various timers. SS7 is to execute other operations, including A/D conversion, input process, output process, and detection of paper jams.

Figure 72A:
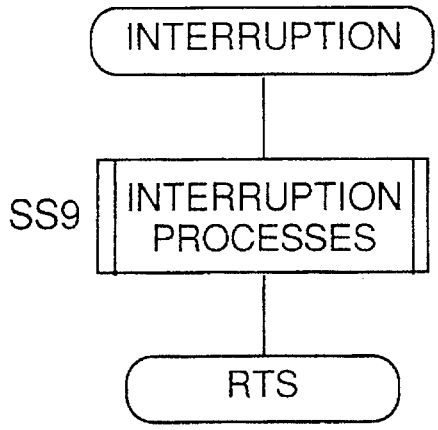
FIGS. 72A–72C are flow charts showing the interrupt subroutine in the CPU2.
Figure 72B:
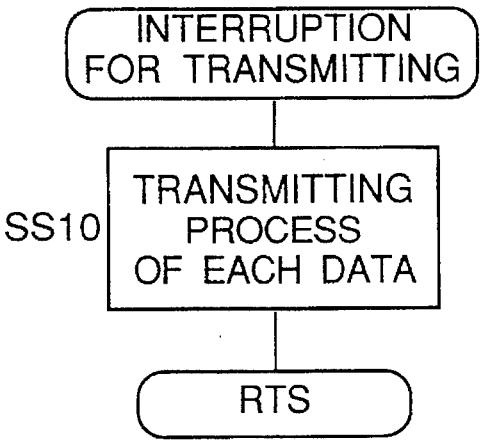
Figure 72C:
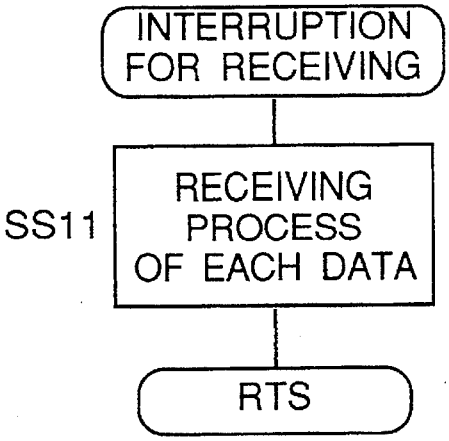

Interrupt operations to the CPU2, as shown in FIG. 72, include various types of interrupt operations such as control of the main motor M3 at SS9, data transmission and data reception in conjunction with the CPU1 at SS10 and SS11, where all the interrupt operations are executed independently of the processing involved in the main routine of the CPU2.

<Initial Setting>

Figure 73:
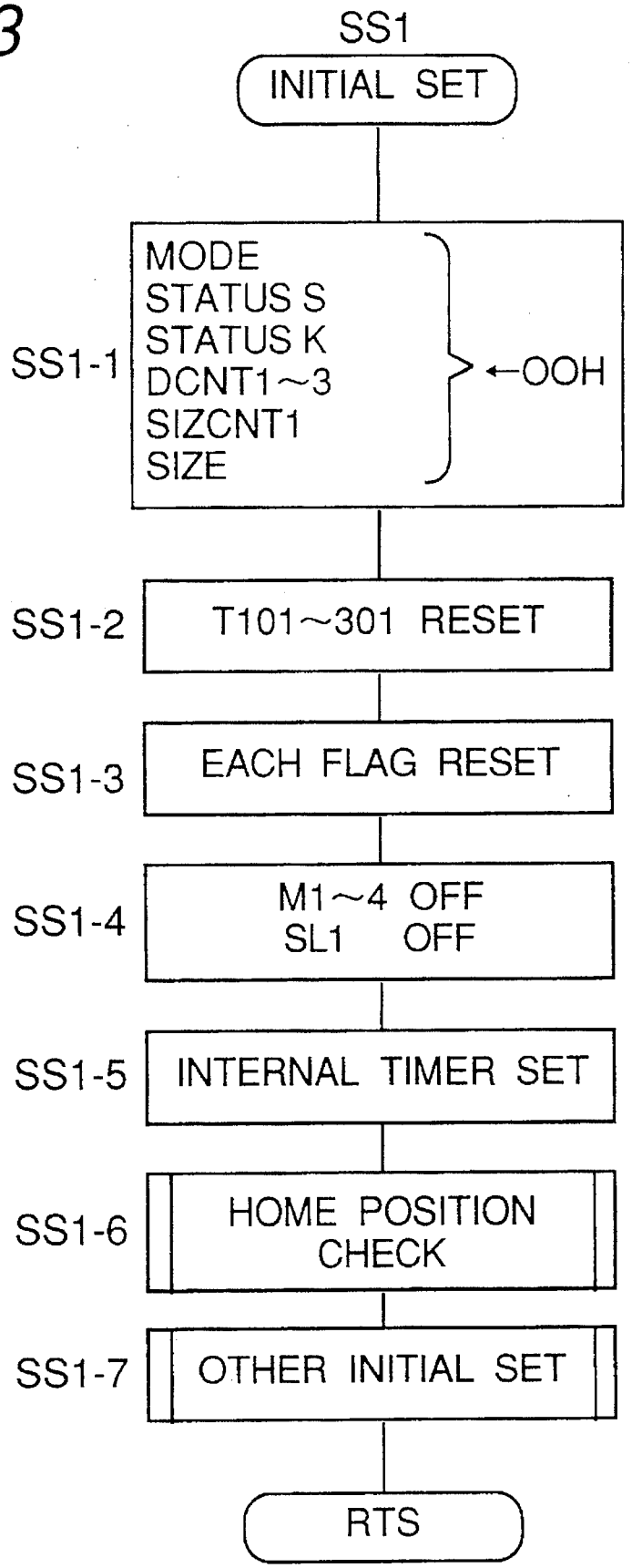
FIG. 73 is a flow chart showing the initial setting subroutine in the CPU2.

FIG. 73 shows a subroutine for initial setting (SS1) to be executed by CPU2. At SS1-1, the data of the RAM and the counters are all cleared. At SS1-2, timers T101, T102, T202, T301 are reset. At SS1-3, the flags are reset. At SS1-4, the motors M1, M2, M3, M4 and the scale solenoid SL1 are all turned off. At SS1-5, the internal timer is set to a specified value. At SS1-6, it is checked whether or not the front-end restricting plate and the pressing plate are in their initial home positions. At SS1-7, other initial settings are processed.

<Home Check>

Figure 74:
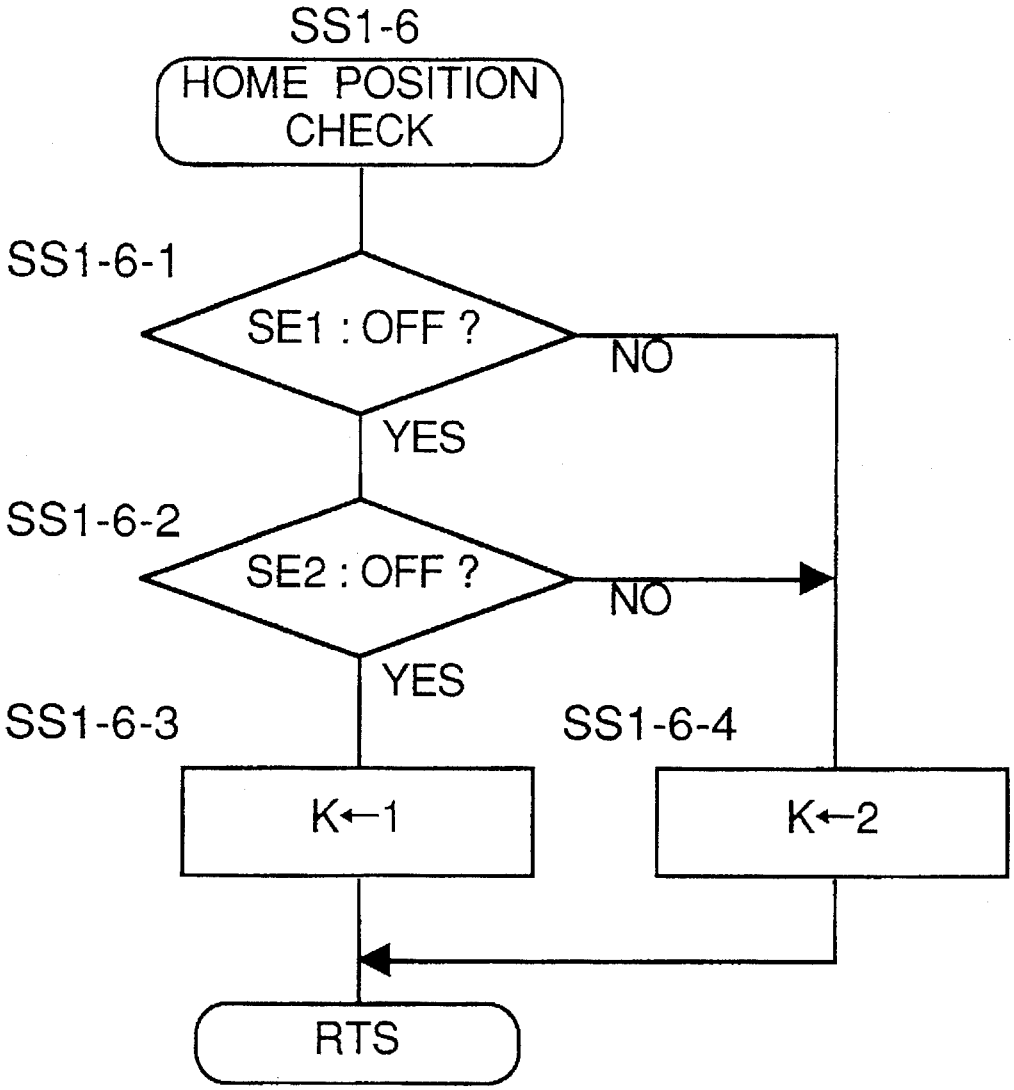
FIG. 74 is a flow chart showing the home check subroutine in the CPU2.

A home check subroutine as shown in FIG. 74 is to check whether or not the front-end restricting plate 63 and the pressing plate 70 (which are hereinafter referred to generically as a "pickup section") should be positioned in their specified home positions. First at SS1-6-1, it is decided whether or not the sensor SE1 has been turned off and it is decided at SS1-6-2 whether or not the sensor SE2 has been turned off. Then, if both sensors SE1, SE2 have been turned off, which means that there is document neither on the document tray 61 nor at the first-out position, a document feed status K is set to "1" at SS1-6-3, where an operation for returning the pickup section to the home position. If the document is present either on the document tray 61 or at the first-out position and either one of the sensor SE1 or SE2 has been turned on, then the feed status K is set to "2" where the current state is maintained without executing the returning process to the home position.

<Opening/Closing Check>

Figure 75:
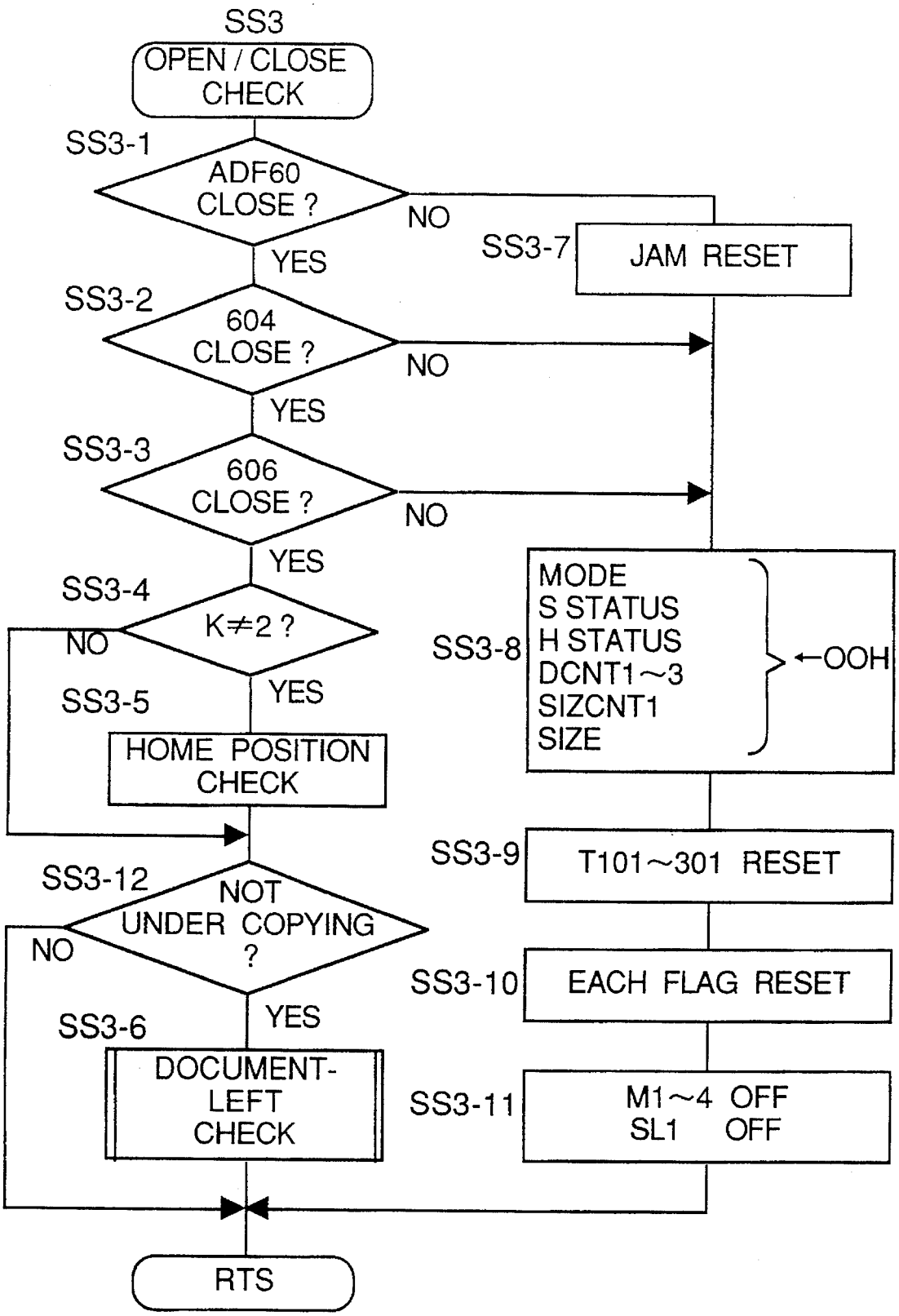
FIG. 75 is a flow chart showing the opening/closing check subroutine in the CPU2.

FIG. 75 details the opening/closing check subroutine of SS3. In this subroutine, it is decided at SS3-1 whether or not the ADF 60 has been closed to the glass platen 29. If the ADF 60 has been closed, then it is decided whether or not the feed-side cover 604 and the discharge-side cover 606 are opened or closed, at SS3-2 and SS3-3, respectively. If both covers 604, 606 are closed, then it is decided at SS3-4 whether or not the feed status K is "2". If K≠2, which means that the pickup section is not in the home position, the aforementioned home check operation is executed (SS3-5). If K=2, it is decided at SS3-12 whether or not a copying operation is under progress, without executing the home check operation. If a copying operation is under progress, then the step of SS3-6 is not executed. If a copying operation is not under progress, then it is decided at SS3-6 whether or not there is a document sheet left in the ADF 60, for example, after jam processing. Meanwhile, if the ADF 60 has been decided at SS3-1 to be opened to the glass platen 29, the jam state is reset at SS3-7 irrespectively of whether or not the document has jammed in the feed section or the discharge section of the ADF 60. As a result, even if the document has jammed inside the ADF 60, opening the ADF 60 makes it possible to place a document sheet on the glass platen 29 and execute a copying operation. Accordingly, a user who will place a document onto the glass platen 29 ,and copy it without using the ADF 60 may execute a necessary copying operation in preference to jam processing with the ADF 60. Next, when the jammed state is reset, or when the feed-section or discharge-section cover 604 or 606 is opened, data in the RAM and the counters are all cleared at SS3-8, the timers T101, T102 T202 and T301 are reset at SS3-9, the flags are reset at SS3-10, and the motors M1, M2, M3, and M4 and the scale solenoid SL1 are turned off at SS3-11.

<Document-left Check>

Figure 76:
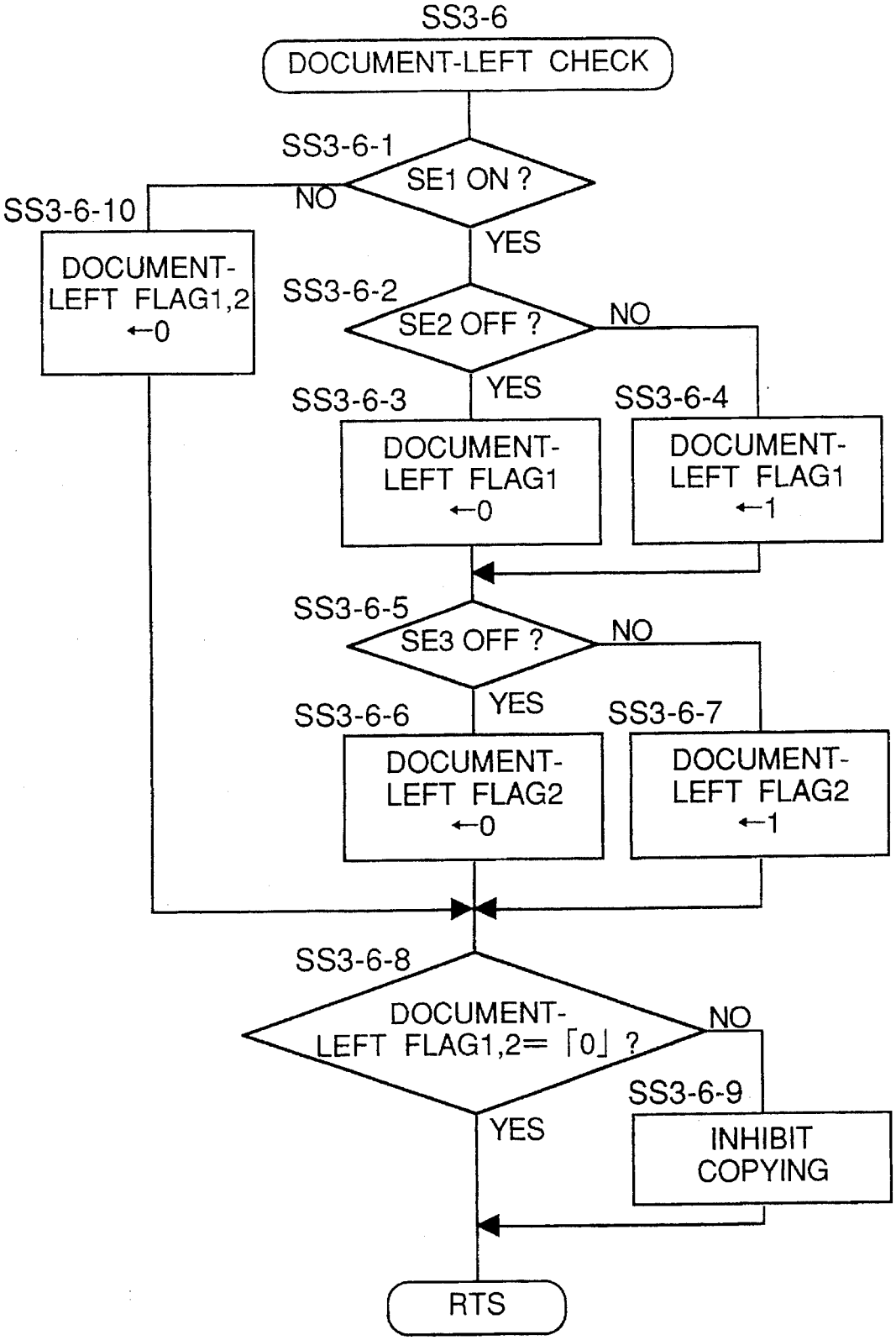
FIG. 76 is a flow chart showing the document-left check subroutine in the CPU2.

FIG. 76 details a document-left check subroutine of SS3-6. In this subroutine, it is first decided at SS3-6-1 whether or not the sensor SE1 has been turned on, or whether or not there is a document on the document tray 61. If the sensor SE1 has been turned off (there is no document), then a document-left flag 1 and a document-left flag 2 are set to "0" at SS3-6-10. Meanwhile, if the sensor SE1 is decided to be on (there is a document), then it is decided at SS3-6-2 whether or not the sensor SE2 has been turned off, or whether or not there is a document at the first-out position of the register roller. If the sensor SE2 has been turned off (there is no document), then the document-left flag 1 is reset to "0" at SS3-6-3; if the sensor SE2 has been turned on (there is a document), then the document-left flag 1 is set to "1" at SS3-6-4. Next, it is decided at SS3-6-5 whether or not the sensor SE3 has been turned off, or whether or not there is a document at the reversing section. If the sensor SE3 is off (there is no document), then the document-left flag 2 is reset to "0" at SS3-6-6; if the sensor SE3 is on (there is a document), the document-left flag 2 is set to "1" at SS3-6-7. Now that both document-left flag 1 and document-left flag 2 have been set as a result of the above steps, if it has been decided at SS3-6-8 that both document-left flag 1 and document-left flag 2 are "0", which means that there is no document left, then the program returns; if it has been decided that either one of the document-left flag 1 or the document-left flag 2 is set to "1", then the program inhibits a copying operation, returning. Thus, it is checked at SS2-6-9 whether or not there is a document left within the ADF 60 at a time point when a document is set onto the document tray 61, whereby copying operation is inhibited so as to allow the user to take measures promptly. Also, if a means for indicating the position where a document left is present is provided on the control panel or the like, the position of the document left can be known immediately, allowing a prompt countermeasure.

<Speed Setting>

Figure 77:
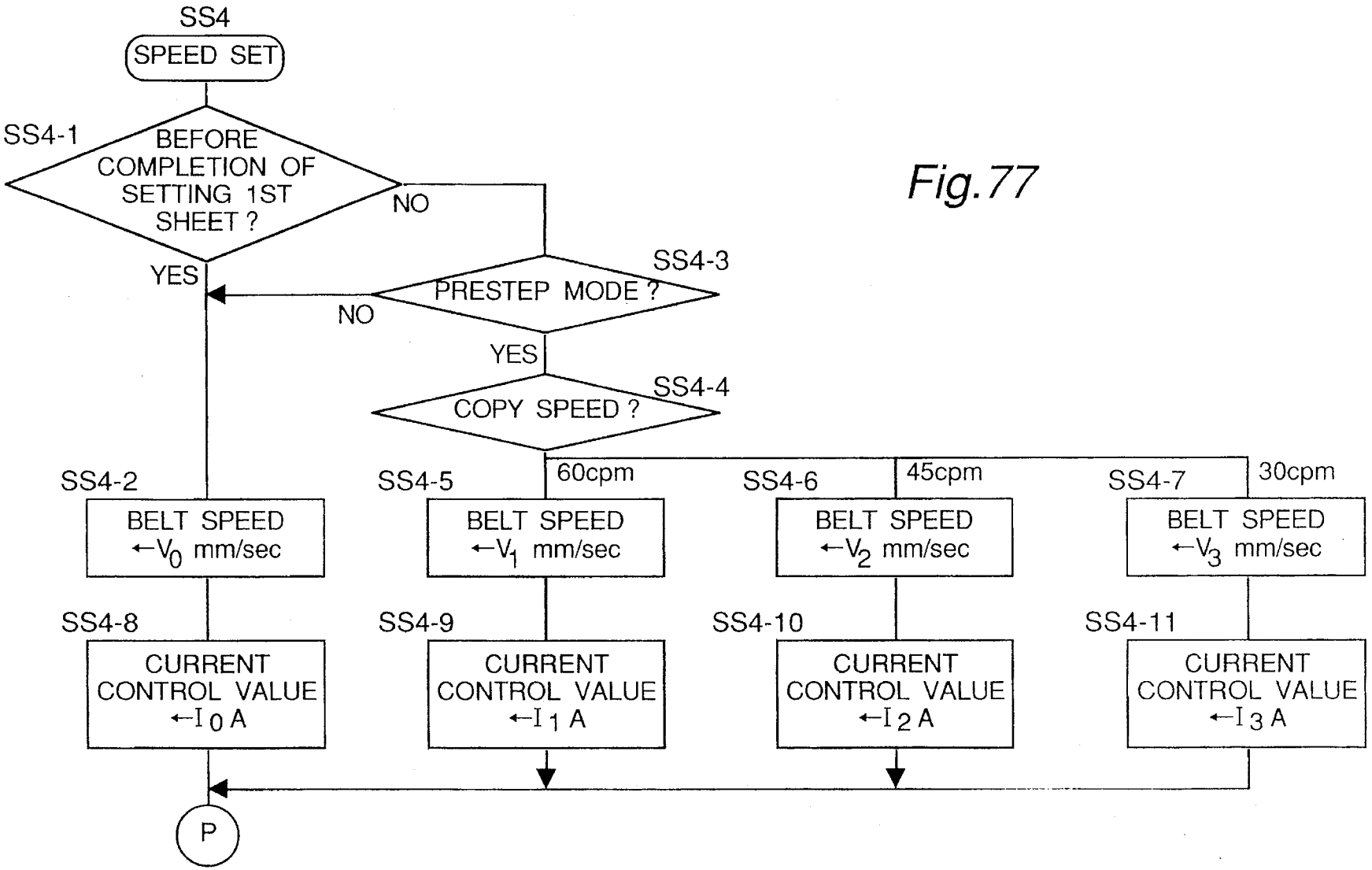
FIG. 77 is a flow chart showing the speed setting subroutine in the CPU2.

FIG. 77 shows a speed setting subroutine to be executed at SS4. In this example, the document conveying speed (belt speed) of the conveyor belt 95 is set to four types of $V_0$, $V_1$, $V_2$, and $V_3$. The belt speeds $V_1$, $V_2$, and $V_3$ are values corresponding to supposed three kinds of copy speeds, respectively, due to differences among the models of the copying machine.

The belt speed $V_1$ is a speed at which 100% of copy productivity is maintained in a combination with a model of A4 transverse feed and a copy speed of 60 cpm. This means that the belt speed $V_1$ is such that document replacement can be accomplished within a return time of the optical system 20. More specifically, if the system speed of the copying machine is 300 mm/sec, the scan length for A4 transverse is 210 mm. The return time of the optical system 20 is (60 sec/60 cpm)−(210 mm/300 mm/sec)=0.3 sec (cpm: cycle per minute). As shown in FIG. 28, if the distance from the nip portion of the register roller 90 to the exposure standard position SP is expressed as L, the conveying distance for the document replacement in the prestep mode is L/2, resulting in a document replacement time of ($L/2V_1$). Hence, $L/2V_1 \leqq 0.3$, and $V_1 \geqq L/2 \times 0.3$.

The belt speed $V_2$ corresponds to a copying machine having a copy speed of 45 cpm, while the belt speed $V_3$ corresponds to a copying machine having a copy speed of 30 cpm. In this example, $V_1 > V_2 > V_3$.

The belt speed $V_0$ is a speed at which the first-sheet document is conveyed to the exposure standard position SP, and which is set to a value larger than the aforementioned belt speed $V_1$ so as not to deteriorate the copy productivity. Further, the belt speed is set to $V_0$ also for the modes other than the prestep mode, i.e., for the both-sides document conveying mode and the number-of-document-sheets count mode.

In this subroutine, it is first decided at SS4-1 whether or not the process of setting the first-sheet document to the exposure position SP has already been completed. If it has not yet been completed, the belt speed is set to $V_0$ at SS4-2. If the process has been completed, it is decided at SS4-3 whether or not the current mode is the prestep mode. Then, if it is not the prestep mode, the program moves to the foregoing SS4-2. If it is the prestep mode, the copy speed is checked at SS4-4. The copy speed is checked based on copy speed data of the copying machine 1 transmitted from the CPU1. If the copy speed is 60 cpm, the belt speed is set to $V_1$ at SS4-5; if the copy speed is 45 cpm, the belt speed is set to $V_2$ at SS4-6. Further, if the copy speed is 30 cpm, the belt speed is set to $V_3$ at SS4-7. Moreover, if the belt speed is set to $V_0$, the current control value outputted from the CPU2 is set to $I_0A$ at SS4-8. Likewise, if the belt speed is set to $V_1$, $V_2$, or $V_3$, then the current control value is set to $I_1A$, $I_2A$, or $I_3A$ at SS4-9, SS4-10, or SS4-11, respectively.

Figure 78:
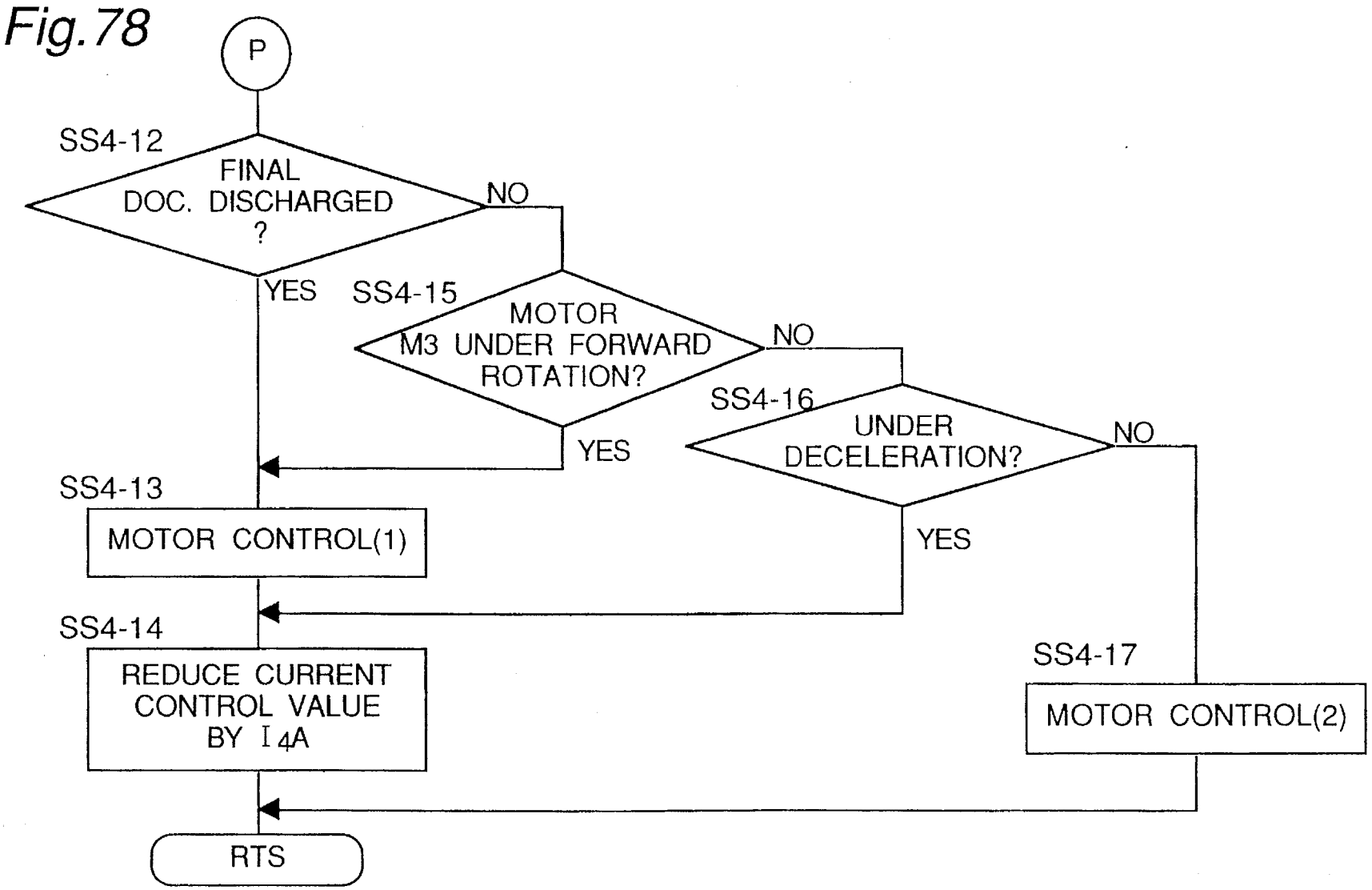
FIG. 78 is a flow chart showing the speed setting subroutine in the CPU2 subsequent to FIG. 76.
Figure 79A:
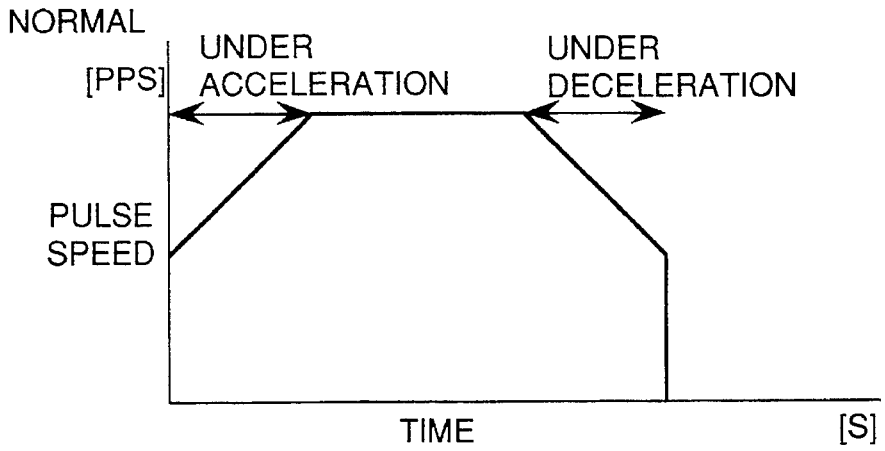
FIGS. 79A–79C are relational views between time and pulse speed, showing the pulse control of the main motor.
Figure 79B:
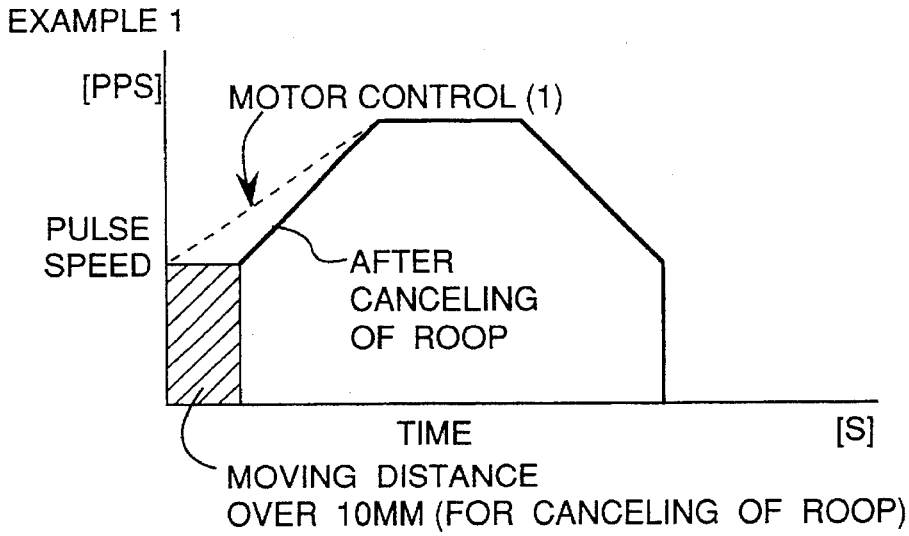
Figure 79C:
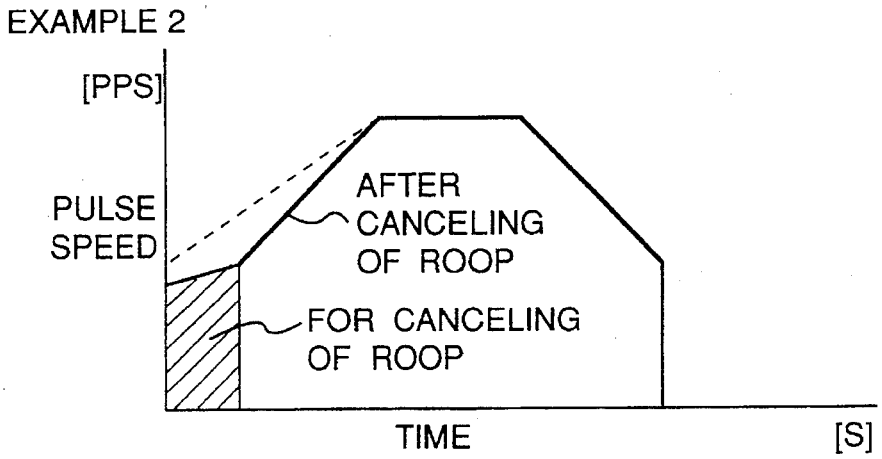

Next, as shown in FIG. 78, it is decided at SS4-12 whether or not the final document sheet is being discharged, and at SS4-15 whether or not the main motor M3 is being rotated forward for reversing the document sheet from rear to front surface in the both-sides mode. If the ADF 60 has been set to any one of these states, the load imposed on the conveyor belt 95 at that time is a small one, in which case the main motor M3 is subjected to normal trapezoidal control at SS4-13 (see FIG. 79 (*a*)). Under this condition, it is unnecessary to pull off the document from the separating section, and the main motor M3 is not subject to any excessive load. Therefore, the current control value is reduced by $I_4A$ or so at SS4-14. Meanwhile, if the final document sheet is not being discharged or if the operation of setting a document surface in the both-sides mode is not under progress, it is decided at SS4-16 whether or not the main motor M3 is under deceleration. If it is under deceleration (see FIG. 79A), the main motor M3 requires a small torque and the separating section has caught no document so that it is less loaded. Therefore, the current control value is reduced by $I_4A$ or so at SS4-14. However, if it has been decided at SS4-12, SS4-15, or SS4-16 that the final document sheet is not being discharged, that the motor M3 is under operation of setting a front surface of the document in the both-sides mode, or that the main motor M3 is not under deceleration, i.e., if there is a document in the register section or the separating section, then there will be a large variation in the load imposed on the main motor M3 when the loop of the document that has been stopped in the first-out position is canceled. The main motor M3, therefore, will be driven at a constant low speed until the loop is canceled, and thereafter controlled so as to be accelerated at the time of the canceling of the loop (SS4-17) (see FIG. 79B, C). An excessive load will be imposed on the stepping motor M3 when the document is pulled off from the separating section, in which case the current value is held in normal state. As a result, in this subroutine, the current value is controlled in response to the load imposed on the main motor M3, leading to a reduction in power consumption.

The belt speeds $V_1$, $V_2$, $V_3$ may be arranged to be able to be set by a DIP switch contained in the ADF 60, other than the way that the belt speeds are set based on data transmitted from the CPU1. Otherwise, this type of data detection means may be provided at a portion of the ADF 60 where it is in contact with the copying machine main body 1. More specifically, a magnet showing the copy speed is provided on the upper frame of the copying machine main body 1, and a sensor for detecting the magnet is provided on the ADF 60. The CPU2 reads the copy speed of the copying machine main body 1 based on a signal shown by the magnet and derived from the sensor, to set a belt speed.

<Document Replacement>

Figure 80:
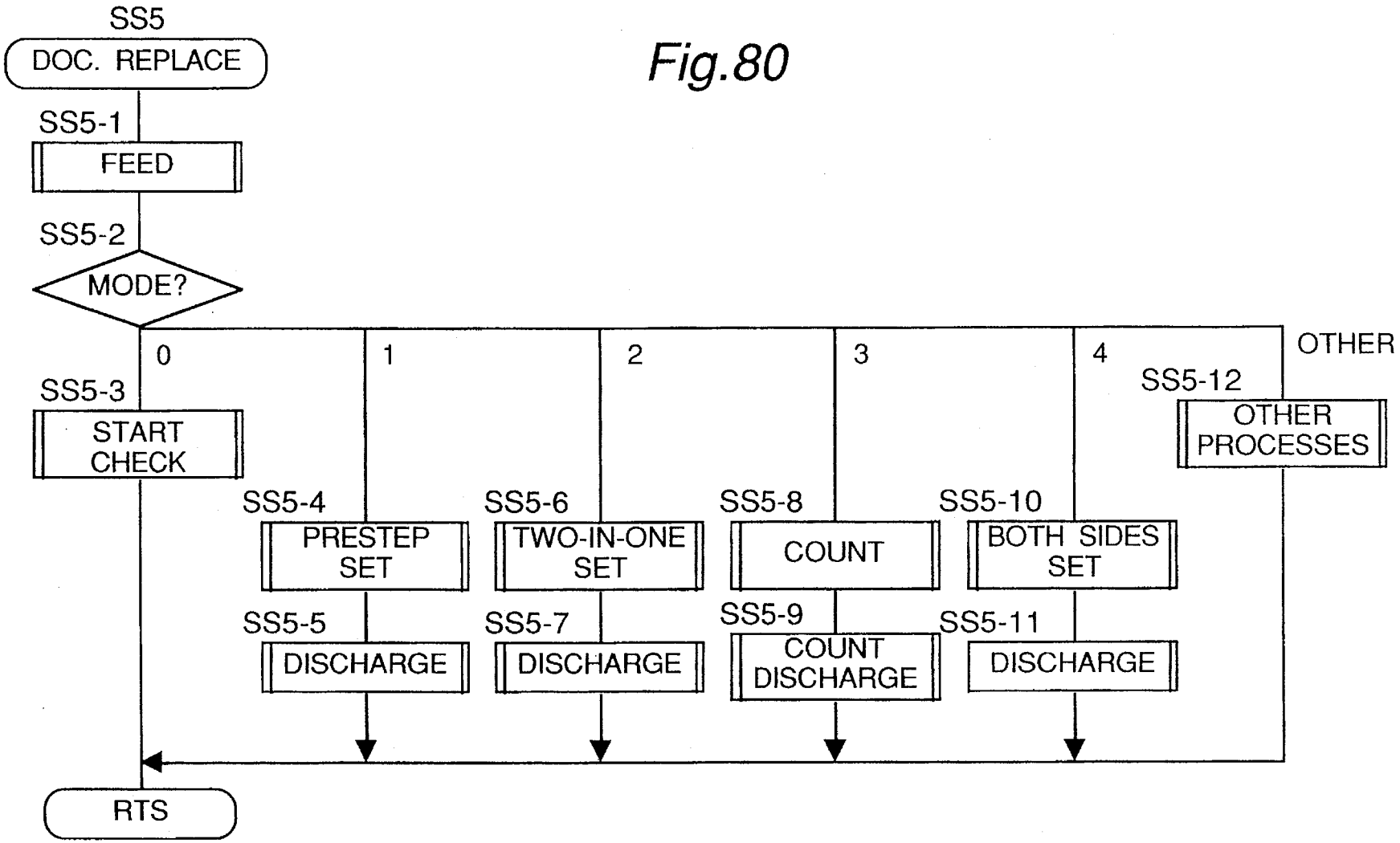
FIG. 80 is a flow chart showing the document replacement subroutine in the CPU2.

FIG. 80 shows a document replacement subroutine to be executed at SS5. In this subroutine, the MODE is checked at SS5-2, and the following operations are executed based on the resulting value. The MODE is set to a specified value depending on the document conveyance form selected by the operator.

A paper feed process is first executed at SS5-1, and then the MODE is decided at SS5-2 If the MODE is "0" the start check is processed at SS5-3. If the MODE is "1", the prestep setting is processed at SS5-4 and the paper is discharged at SS5-5. If the MODE is "2", the two-in-one setting is processed at SS5-6, and the paper is discharged at SS5-7. If the MODE is "3", the counting of the number of document sheets is processed at SS5-8, and the counted paper discharge is processed at SS5-9. If the MODE is "4", paper feed for the both-sides mode is executed at SS5-10, and the paper is discharged at SS5-11. If the MODE is other than any of the foregoing, other operations such as the both-sides mode are processed at SS5-12.

<Start Check>

Figure 81:
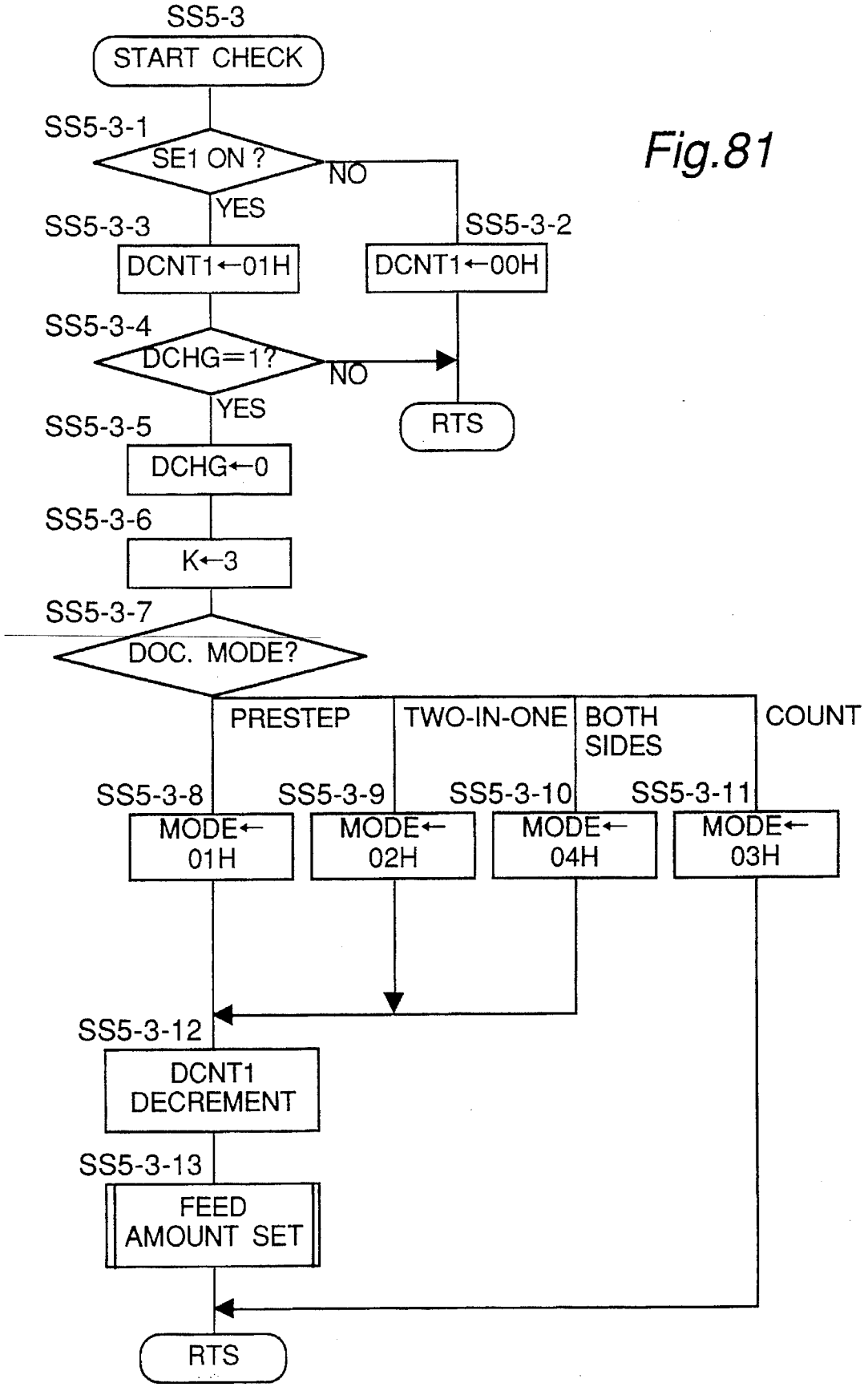
FIG. 81 is a flow chart showing the start check subroutine in the CPU2.

FIG. 81 shows a start check subroutine to be executed at SS5-3. This subroutine is processed when the MODE is "0", i.e., when the ADF 60 is on standby. It is first decided at SS5-3-1 whether or not the empty sensor SE1 has been turned on. If it has not been turned on, no document has been set onto the tray 61, where the DCNT1 is reset to "0" at SS5-3-2. When the sensor SE1 is turned on (when a document is set to the tray 61), the DCNT1 is set to "1" and it is decided at SS5-3-4 whether or not the flag DCHG is "1". The flag DCHG is a command that requests document replacement when it is "1", which command is transmitted from the CPU1. This flag DCHG is set to "1" at a time point when the print key is turned on and when the scanning of a copy number of document sheets is completed. Accordingly, if the flag DCHG is "0" the program immediately returns; if it is "1", the flag DCHG is reset to "0" at SS5-3-5, and the status K is set to "3" at SS5-3-6. The status K is used in the paper feed subroutine, and causes the document to be fed one sheet each time when it is set to "3".

Next, the document mode is checked at SS5-3-7. If it is the prestep mode, the MODE is set to "1" at SS5-3-8; if it is the two-in-one mode, the MODE is set to "2" at SS5-3-9; if it is the both-sides mode, the MODE is set to "4" at SS5-3-10; and if it is the count mode, the MODE is set to "3" at SS5-3-11. The cases of the other document modes are omitted. If the document mode is the count mode, this subroutine is terminated. If it is the prestep mode or the two-in-one mode, the DCNT1 is decremented at SS5-3-12, and the feed amount setting process is executed at SS5-3-13.

<Feed Amount Setting>

Figure 82:
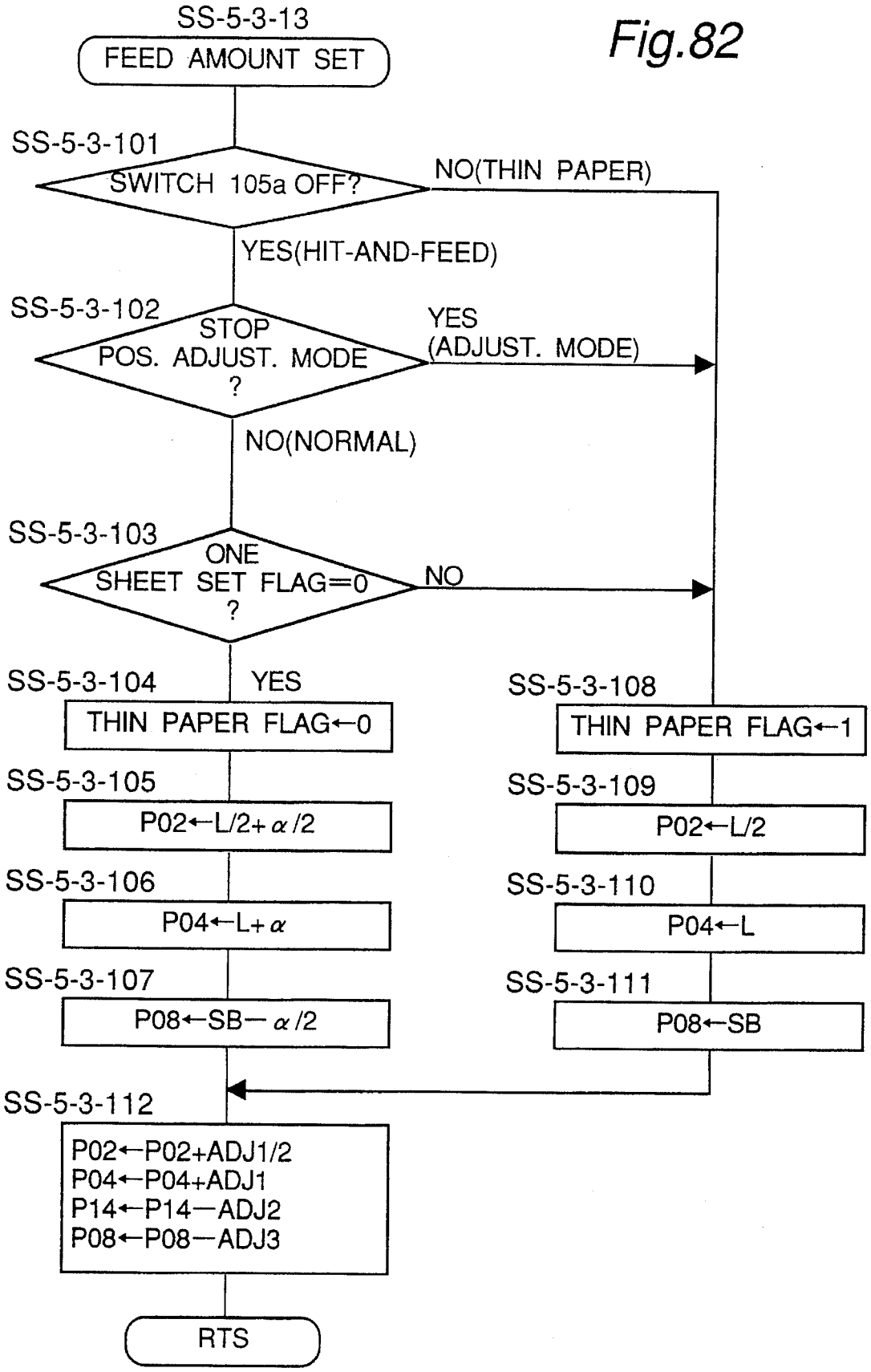
FIG. 82 is a flow chart showing the feed amount setting subroutine in the CPU2.
Figure 83:
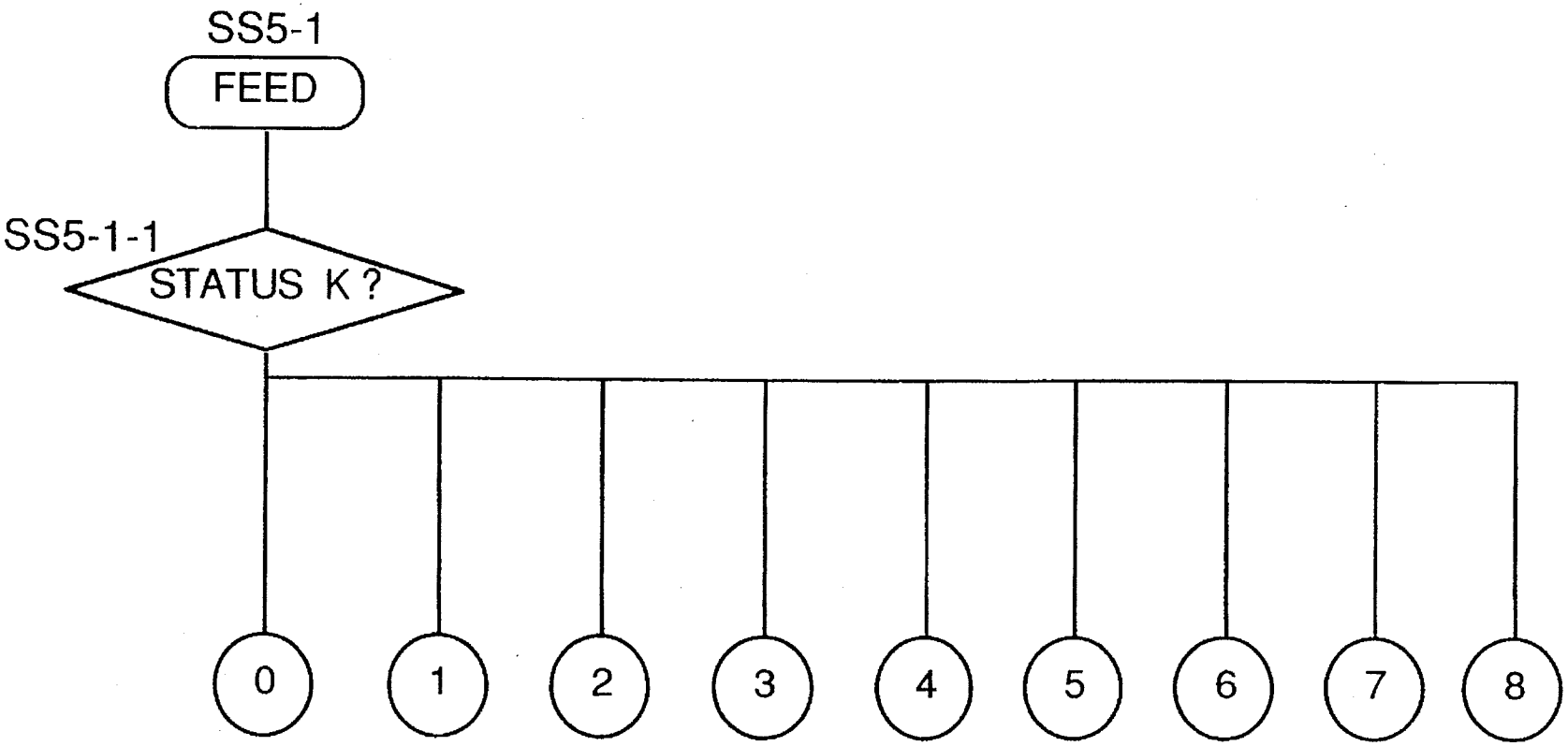
FIG. 83 is a flow chart showing the paper feed subroutine in the CPU2.

FIG. 82 shows the processing contents of a feed amount setting subroutine in the two-in-one mode, which subroutine is to be executed at SS5-3-13. It is decided at SS5-3-101 whether or not a thin-paper mode setting switch 105*a* on the control panel has been turned off, i.e., whether the current mode has been set to a hit-and-feed mode or the thin-paper mode. This thin-paper mode setting switch 105*a* may be freely operated by the user, and is to be pressed when the document is thin paper. Further, it is decided at SS5-3-102 whether or not the document stop position adjustment mode has been set, and at SS5-3-103 whether or not a one-sheet setting flag has been set to "0". This one-sheet setting flag is set to "1" when the final-page document sheet (that will be first fed in the copying machine of the present embodiment) is set onto the glass platen 29 on condition that the number of document sheets is an odd number in the two-in-one mode. As a result of these operations, if the thin-paper mode setting switch is turned off (i.e., the hit-and-feed mode has been set) and if the stop position adjustment mode is not set and if the one-sheet setting flag is set to "0", then the operations of SS5-3-105 through SS5-3-107 are executed. Otherwise, the operations of SS5-3-108 through SS5-3-111 are executed.

The thin-paper flag is set to "0" at SS5-3-104, and the counters P02, P04, and P08 for specifying the document feed amount are set to ($L/2+\alpha/2$), ($L+\alpha$), and ($SB-\alpha/2$) at SS5-3-105, SS5-3-106, and SS5-3-107, respectively. Meanwhile, the thin-paper flag is set to "1" at SS5-3-108, and the document feed amount counters P02, P04, and P08 are L/2, L, and SB at SS5-3-109, SS5-3-110, and SS5-3-111, respectively. It is noted that SB represents the number of pulses required for the stepping motor to temporarily switch back the first-sheet document in the two-in-one mode. As SB is increased, the interval between the rear end of the first-sheet document and the front end of the second-sheet document is reduced; conversely, as it is decreased, the interval is lengthened. That is, the document sheets are conveyed on the glass platen with a larger interval between the rear end of the first sheet and the second sheet in the hit-and-feed mode, than in the thin-paper mode.

Now that the number of pulses of the main motor M3 for specifying the document feed amount has been set in the above way, the counters P02 and the like are corrected according to different types of ADF at SS5-3-112. More specifically, the document feed amount counter P02 for the one-side mode, the document feed amount counter P04 for one-side large-size documents, the document feed amount counter P014 for reversing the document in the both-sides mode, and the document feed amount P08 required for a switchback are updated to (P02+ADJ1/2), (P04+ADJ1), (P014−ADJ2), and (P08−ADJ3), respectively. It is noted that the counter correction amounts ADJ1, ADJ2, and ADJ3 are inputted from the copying machine main body 1 (see FIG. 68). As seen above, even in the normal mode (hit-and-feed mode), when the final-page document sheet is set onto the glass platen in the case of an odd number of document sheets, the operation enters the document conveyance control process based on pulse control, so that the document can be stopped accurately at a position where no scale is present.

<Paper Feed>

FIGS. 83 through 88 show a paper feed subroutine to be executed at SS5-1. In this subroutine, the paper feed status K is checked at SS5-1, and the following operations are executed based on the resulting values "0" to "8".

Figure 84:
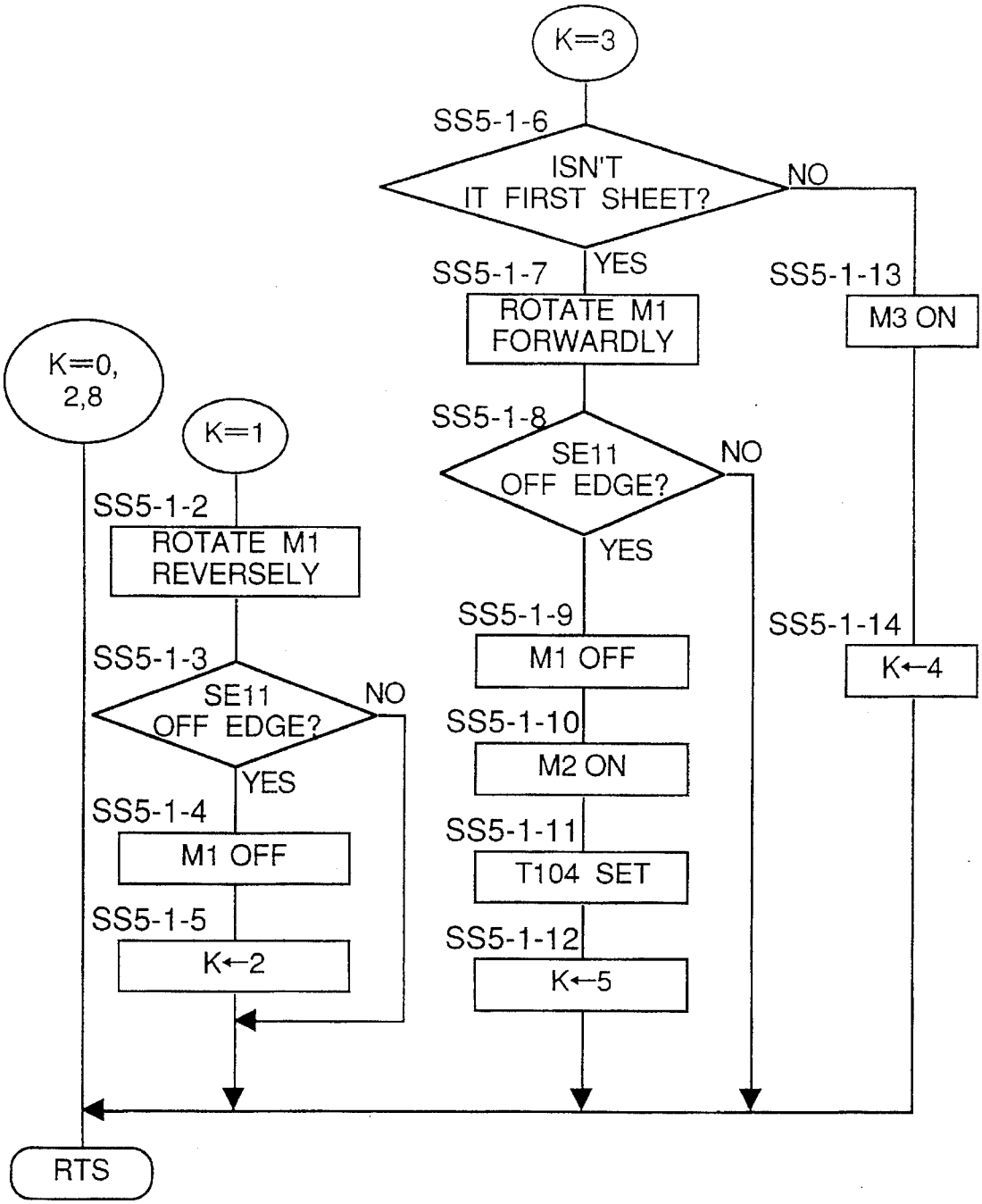
FIG. 84 is a flow chart showing the paper feed subroutine subsequent to FIG. 83.

If the status K is "1", the front-end restricting plate 63 and the pressing plate 70 are moved to their home positions. In more detail, as shown in FIG. 84, the pickup motor M1 is rotated reverse at SS5-1-2, and it is decided at SS5-1-3 whether or not the cam sensor SE11 is at the OFF EDGE. The home position of the front-end restricting plate 63 is a restricting position (upward movement) for the document, while the home position of the pressing plate 70 is a press-releasing position (upward movement) for the document. When the pickup motor M1 coupled with the cam shaft 147 is rotated reverse so that the cam sensor SE11 is shielded from light at the edge 148*a* of the disc 148 to be turned off, then both the front-end restricting plate 63 and the pressing plate 70 have been set to their home positions (positions of FIG. 19). Accordingly, when the cam sensor SE11 has been verified at SS5-1-3 to be at the OFF EDGE, the pickup motor M1 is turned off at SS5-1-4 and the status K is set to "2" at SS5-1-5.

If the status K is "2", then nothing is processed. If the status K is "3", then the front-end restricting plate 63 is moved to the withdrawal position while the 70 is moved downward to impart a feed pressure to the document. More specifically, it is decided at SS5-1-6 whether or not the document, is the first sheet. If it is not the first sheet document, the front-end restricting plate 63 is in the withdrawal position while the pressing plate 70 is in the release position (where the edge 149a is detected by the sensor SE12: position of FIG. 20). Therefore, the pickup motor M1 is rotated forward at SS5-1-7, and it is decided at SS5-1-8 whether or not the cam sensor SE11 is at the OFF EDGE. The cams 145, 146 are rotated counterclockwise from the position of FIG. 20 with the pickup motor M1 rotating forward, so that the cam sensor SE11 is shielded from light by the edge 148*b* of the disc 148 and thereby turned off. When this is done, the front-end restricting plate 63 is held in the withdrawal position while the pressing plate 70 presses the front end of the document against the pickup roller 65, as shown in FIG. 21. Therefore, when the cam sensor SE11 is verified at SS5-1-8 to be at the ON EDGE, the pickup motor M1 is turned off at SS5-1-9 and the motor M2 is turned on at SS5-1-10. Further, the timer T104 is set at SS5-1-11, and the status K is set to "5" at SS5-1-12. Meanwhile, if the document is decided at SS5-1-6 to be the first sheet, then the main motor M3 is turned on at SS5-1-13 and the status K is set to "4" at SS5-1-14.

Figure 85:
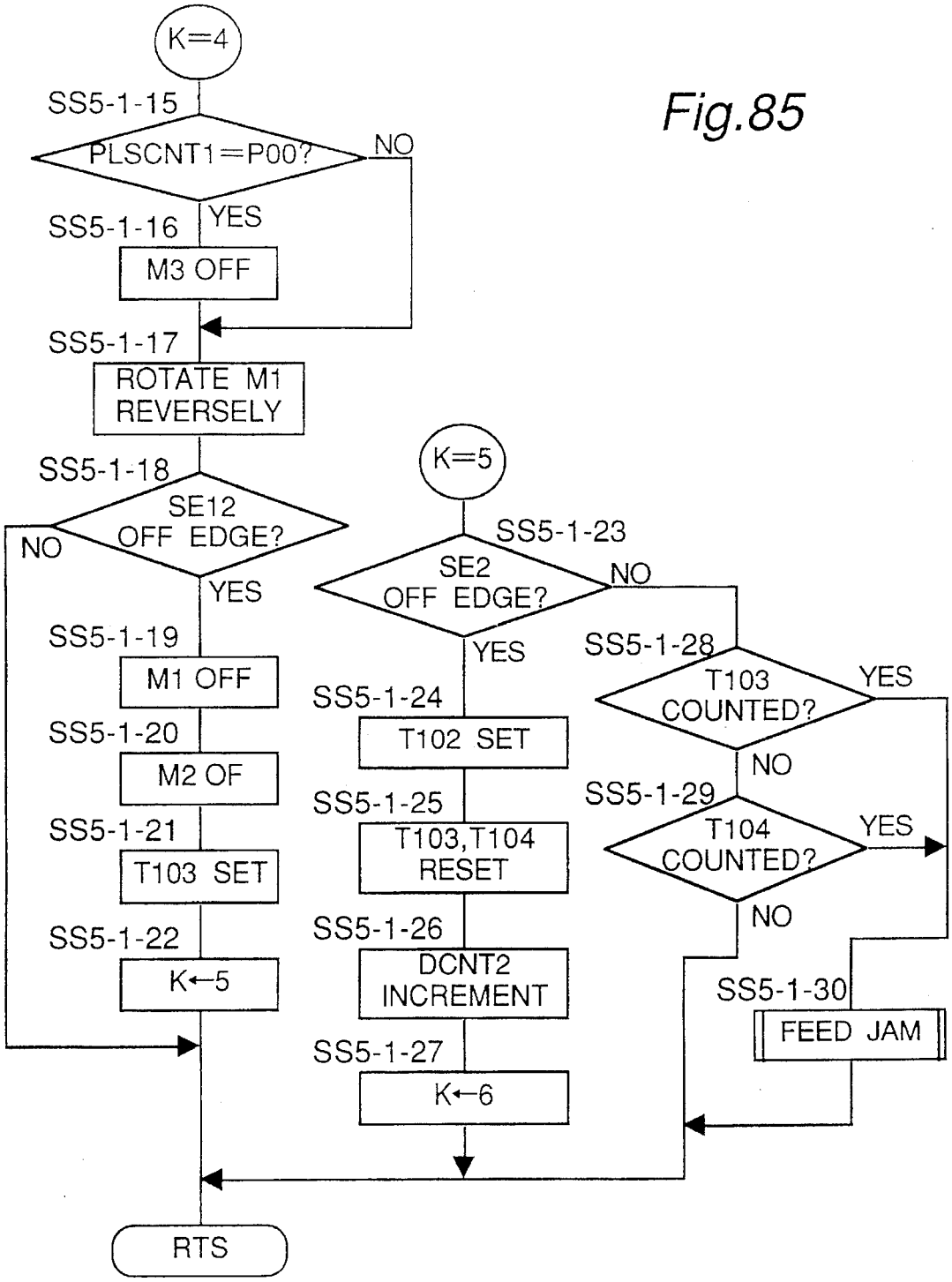
FIG. 85 is a flow chart showing the paper feed subroutine subsequent to FIG. 84.
Figure 86:
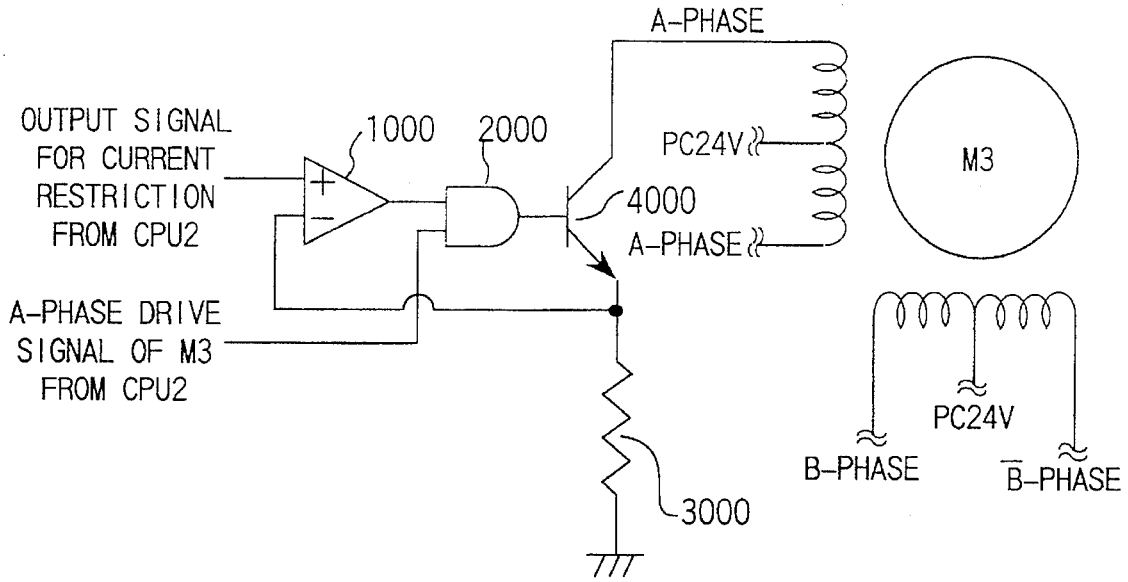
FIG. 86 is a circuit diagram of the main motor (stepping motor)
Figure 87:
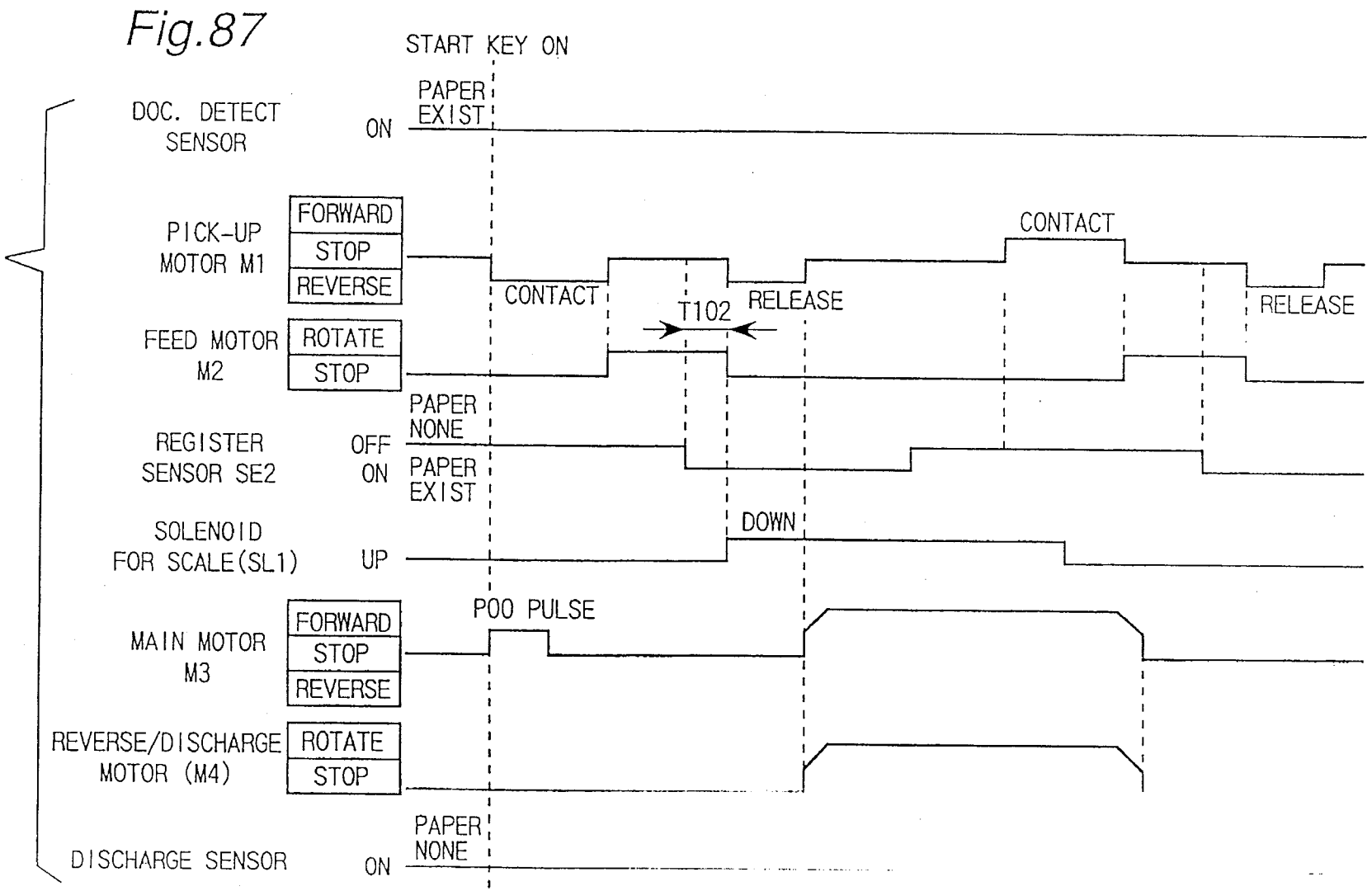
FIG. 87 is a time chart showing the control of the main motor (stepping motor)

As shown in FIG. 85, since the document is the first sheet when the status K is "4", at the step SS5-1-15 where the main motor M3 is adjusted in phase and the pickup motor M1 is rotated reverse from the home position to the pressing position, the main motor (stepping motor) M3 is kept rotating for a specified period, whereby it is decided whether or not the operations of phase-adjusting the main motor M3 and canceling any backlash of the driving system have been completed. In this connection, the circuit of the main motor M3 is shown in FIG. 86. In this circuit, the stepping motor M3 is arranged to be rotated with drive signals fed in the order of A phase→A'phase→B phase→B' phase, and a current control output and an A-phase drive signal of the main motor M3 are given by the CPU2. The current value of the current control output is inputted to a comparator 1000, where it is compared to a specified current value set by a resistor 3000. Then, when the value of the current control output is large (+), an "H" signal is generated from the comparator 1000. Subsequently, the signal is ANDed with the A-phase drive signal of the main motor M3 where if the drive signal is also on, or "H", then a drive current is fed to the A phase by a transistor 4000. Although only the circuit diagram for feeding an ON signal to the A phase is shown as an example in this figure, yet the case is the same also with A' phase, B phase, and B' phase, where a drive signal is passed in the order of A phase→A'phase→B phase→B' phase, causing the main motor M3 to be driven to rotate. However, when the rotating shaft of the main motor M3 is forcedly rotated because of jam processing or the like so that the main motor M3 is run starting with A' phase or B' phase, the motor rotating shaft is once rotated reverse to turn back to A phase or B phase and starts forward rotation therewith, in which case the number of pulses fed to the main motor M3 and its feed amount would result in a mismatch. Also, the driving system, which is equipped with a multiplicity of gears and toothed belts and others, moves from a state that backlashes of the gears and the like have been cleared, into normal rotating operation at the time of start. Thus, at SS5-1-15, the stepping motor M3 is first driven before the start of document feed operation, whereby it is decided whether or not the count value of the pulse counter PLSCNT1 has reached a value (P00) necessary to solve any variation in feed amount due to the reverse rotation of the main motor M3 and backlashes of the driving system. When the PLSCNT1 has reached P00, the main motor M3 is stopped (SS5-1-16). Therefore, the count value P00 must be a value necessary for the phase adjustment of the main motor M3 and the solving of the backlashes of the driving system. For example, as shown in FIG. 87, when the start switch of the copying machine is turned on, it is desirable to give the main motor M3 at least four pulses of rotation because the present main motor M3 is of two phase excitation. In the case of one-two phase excitation, eight or more pulses are necessary.

Next, at SS5-1-17, the motor M1 is rotated reverse so that the front-end restricting plate 63 is moved down to the withdrawal position, and that the pressing plate 70 is moved down to the pressing position. When the edge 149*b* of the disc 149 is detected by the OFF EDGE of the sensor SE12 at SS5-1-18, the motor M1 is stopped at SS5-1-19. As a result, the position of FIG. 19 changes to the position of FIG. 21. Then, the motor M2 is driven at SS5-1-20 so that the document is conveyed forward, the timer T103 is set at SS5-1-21, and the status K is set to "5" at SS5-1-22, where the program returns. The timer T103 functions to detect whether or not the document has jammed by detecting whether or not the document fed from the document tray 61 has reached a specified position within a specified time. The timer T104 that has been set at SS5-1-11 is a similar jam-detecting timer, but their timer values are such that T104 <T103, the value for the first sheet being set a little longer. This setting is based on the fact that although the front end of the first-sheet document is positioned at the front-end restricting plate 63, the second and following sheets have been fed more or less in accompaniment up to near the nip portion of the separating roller 75 and the separating pad 80. This arrangement prevents the possibility that paper jams would be caused frequently due to too short a timer value for the first sheet, or that the document would be damaged because of too short a timer value for the second and following sheets.

If the status K is "5", it is decided at SS5-1-23 whether or not the document has been conveyed to the position of the register roller 90 by detecting the ON EDGE of the sensor SE2 (i.e., there is a document). Another timer T102 is set at SS5-1-24 in which the ON EDGE is detected. The timers T103, T104 are reset at SS5-1-25 so that the document counter DCNT2 is incremented. The status K is changed to "6" at SS5-1-27. Meanwhile, if the document has not been detected at SS5-1-23, it is decided at SS5-1-28 and SS5-1-29 whether or not the timers T103 and T104 have counted up, respectively. If the timers have expired, it is decided at SS5-1-30 that there has occurred a paper jam.

Figure 88:
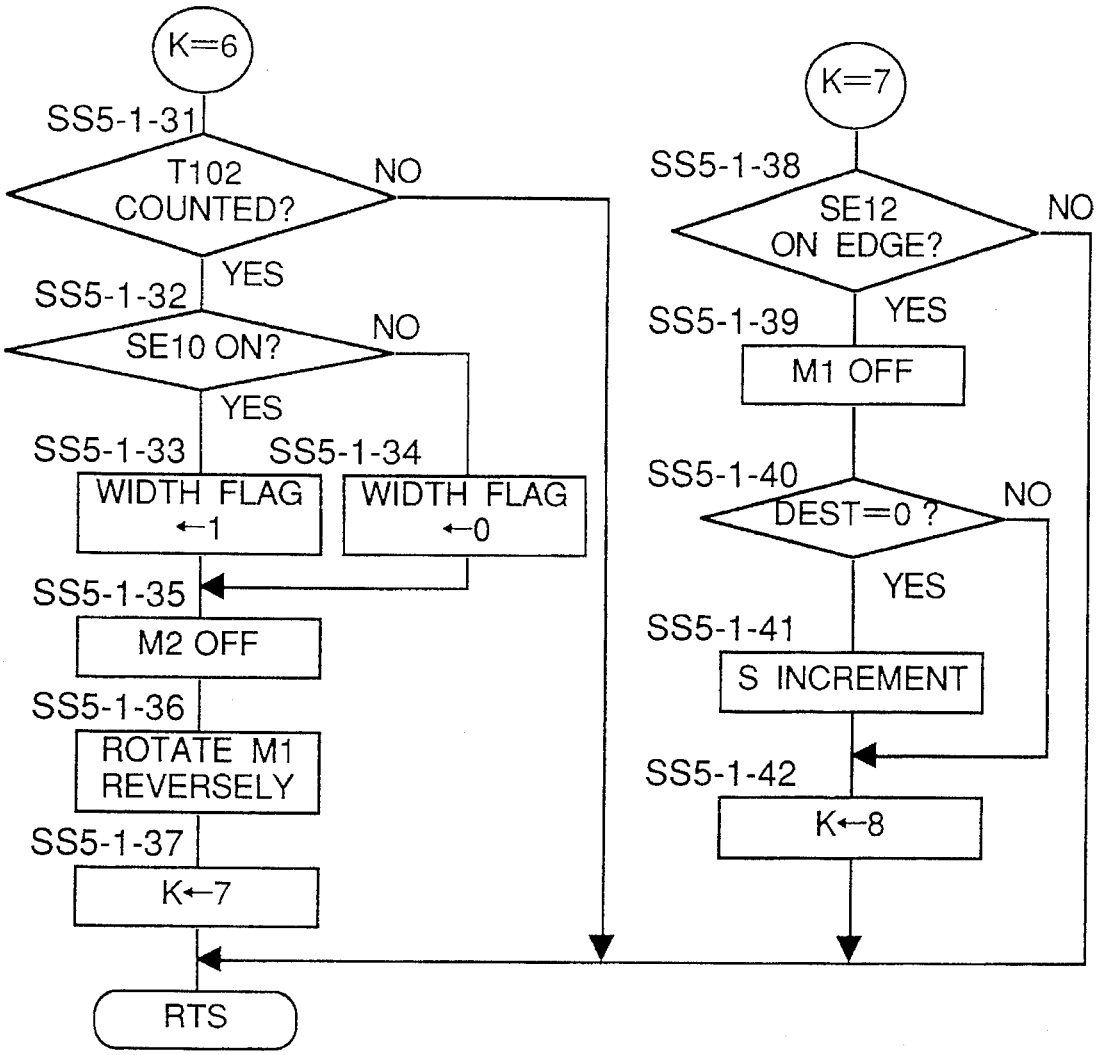
FIG. 88 is a flow chart showing the paper feed subroutine subsequent to FIG. 87.

If the status K is "6", it is confirmed at SS5-1-31 whether or not the timer T102 has counted up, as shown in FIG. 88. At a time point when the timer T102 expires, the document has formed a loop with its front end in contact with the register roller. Then, if the timer T102 has been confirmed to have expired, it is decided at SS5-1-32 whether the sensor SE10 has been turned on or off. The width sensor SE10 is intended to detect the width of a fed document. If it has been turned on, the width flag is set to "1" at SS5-1-33; if it has been turned off, the width flag is reset to "0" at SS5-1-34. Subsequently, the feed motor M2 is turned off at SS5-1-35, and the pickup motor M1 is rotated reverse at SS5-1-36. As a result, only the pressing plate 70 starts to move upward to the press-releasing position. In this operation, the end restricting plate 63 remains in the withdrawal position. Further, the status K is set to "7" an SS5-1-37.

If the status K is "7", the pressing plate 70 is moved upward to the press-releasing position. When the cam plates 145, 146 have rotated 160° clockwise (see FIG. 20), the end restricting plate 63 remains in the down withdrawal position while the pressing plate 70 withdraws upward. In this operation, the sensor SE12 is shielded from light by the edge 149*a* of the disc 149 and thereby turned on. Therefore, if the sensor SE12 has been confirmed at SS5-1-38 to be at the ON EDGE, the pickup motor M1 is turned off at SS5-1-39. Subsequently, it is decided at SS5-1-40 whether or not the flag DSET is "0". This flag DSET will be set to "1" when the document is set to the exposure position. Only when the flag DSET is "0", a set status S is incremented at SS5-1-41. Further, the status K is set to "8" at SS5-1-42.

Thus, the document feed operation is completed. If the status K is "8", nothing is processed.

As described above, the direction of the motor is changed between the first sheet of a document and the others (see FIG. 87). The motor M1 is rotated reverse for the first sheet (K=4), while it is rotated forward for the other sheets (K=3). This arrangement is intended to reduce the operating time by reducing the rotating angle needed to rotate the motor M1 from the home position (position of FIG. 19) to the pressing position (position of FIG. 21) for the first sheet and to rotate the motor M1 from the press-releasing position (position of FIG. 20) to the pressing position (FIG. 21) for the other sheets. Also in this operation, detecting the same edge by the same sensor would cause the motor to be stopped finally at positions shifted in different directions from the position of FIG. 21 because of overrun of the motor. In such a case, the configuration of the cams would need to be designed by taking into consideration shift amounts due to the overrun of the motor, necessitating an broadened angle for holding the press-releasing position. This would also make a factor for delaying the operating time. Accordingly, in the present invention, the motor M1 is arranged to be turned off by detecting the edge **149*b* with the OFF EDGE of the sensor SE12 for the first sheet (with M1 rotating reverse), and by detecting the edge 148*b* with the OFF EDGE of the sensor SE11 for the other sheets (with M1 rotating forward). The positional relation in this case is designed so that the positions where the cams are stopped each with an overrun will be those of FIG. 21**. Thus, the stopping positions with an overrun of the motor will never be shifted due to difference in the rotating direction.

<Prestep Set>

Figure 89:
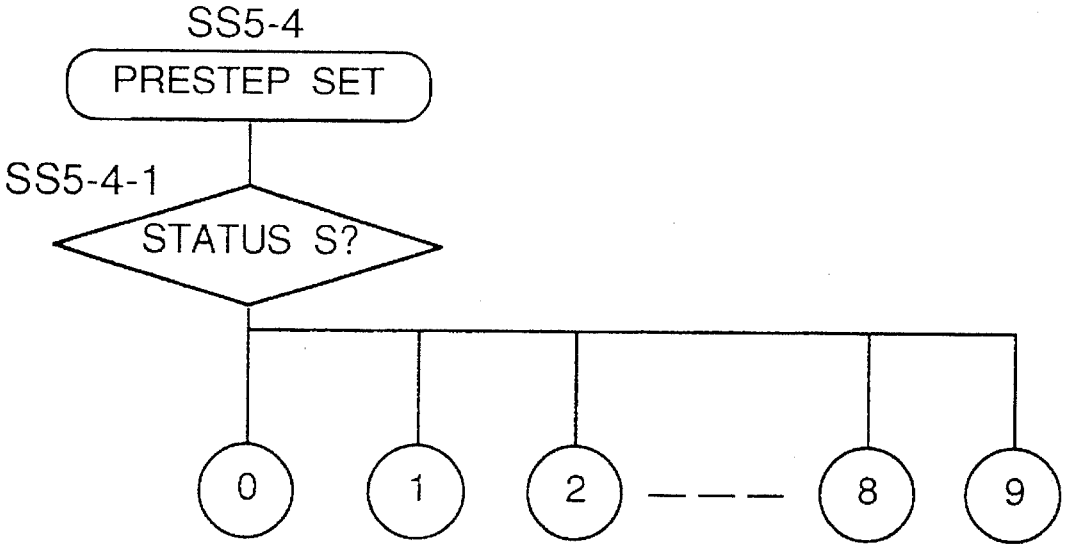
FIG. 89 is a flow chart showing the prestep set subroutine in the CPU2.

FIGS. 89 through 96 show a prestep set subroutine to be executed at SS5-4. In this subroutine, as shown in FIG. 89, the set status S is checked at SS5-4-1, and the following operations are executed based on the resulting values "0" to "9".

Figure 90:
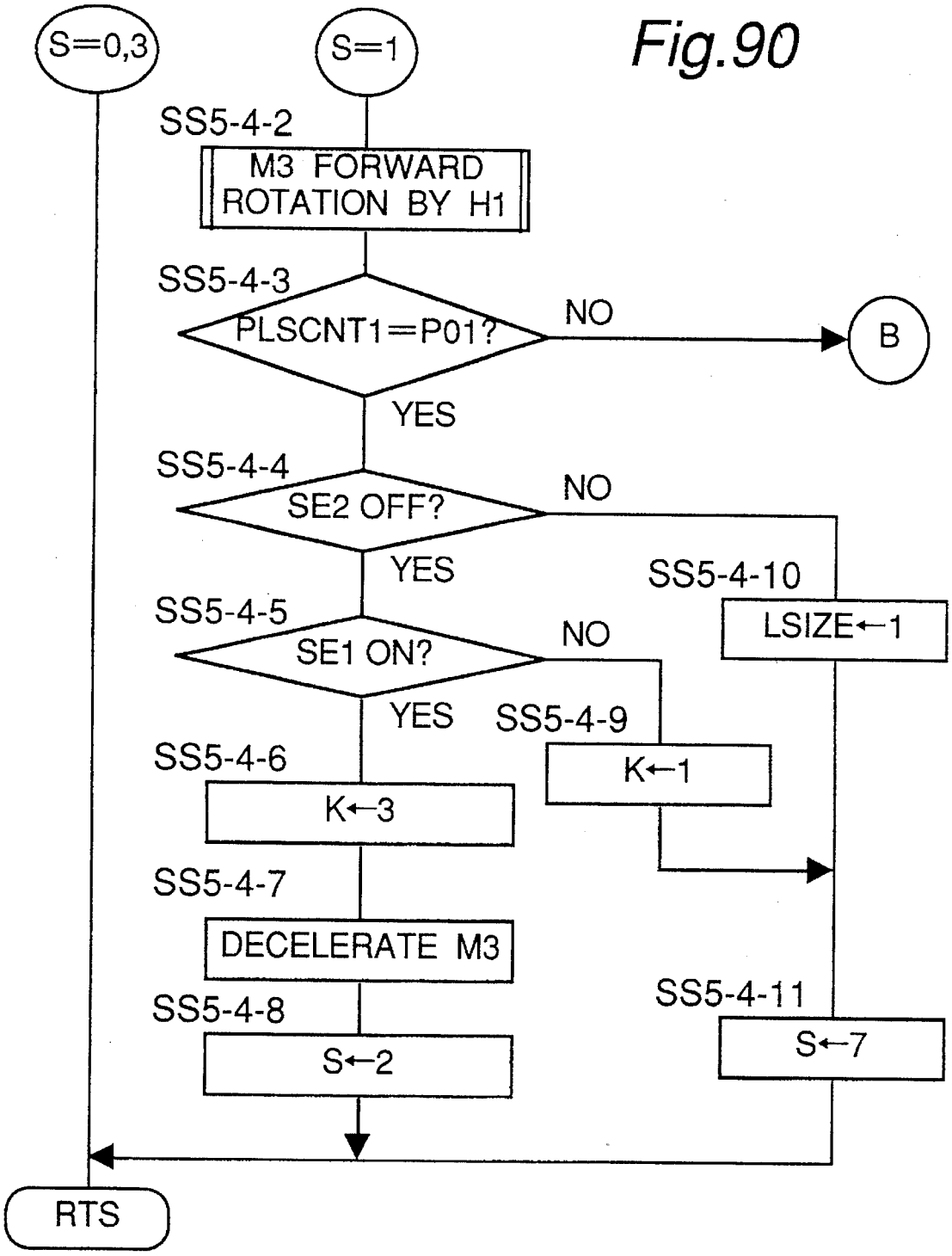
FIG. 90 is a flow chart showing the prestep set subroutine in the CPU2 subsequent to FIG. 89.

As shown in FIG. 90, if the set status S is "0", nothing is processed. If the set status S is "1", the main motor M3 is rotated forward at high speed at SS5-4-2. As a result, the document is fed from the register roller 90 onto the platen glass 29. Then, it is decided at SS5-4-3 whether or not the PLSCNT1 has counted the pulse P01. If the PLSCNT1 has counted the pulse P01, it is decided at SS5-4-4 whether or not the register sensor SE2 is off, and at SS5-4-5 whether or not the empty sensor SE1 is on. The pulse P01 is a number of pulses corresponding to the small size document. If the register sensor SE2 is off while the empty sensor SE1 is on, i.e., if the document fed is small size and there is a document sheet left on the tray 61, then status K is set to "3" at SS5-4-6, the main motor M3 is reduced in speed at SS5-4-7, and the set status S is set to "2" at SS5-4-8.

Meanwhile, if the register sensor SE2 is turned on, then the document is large size. Therefore, the flag LSIZE is set to "1" at SS5-4-10, and the status S is set to "7" at SS5-4-11. If the empty sensor SE1 is off, then no document sheet is left. Therefore, the status K is set to "1" at SS5-4-9, and the set status S is set to "7" at SS5-4-11.

Figure 91:
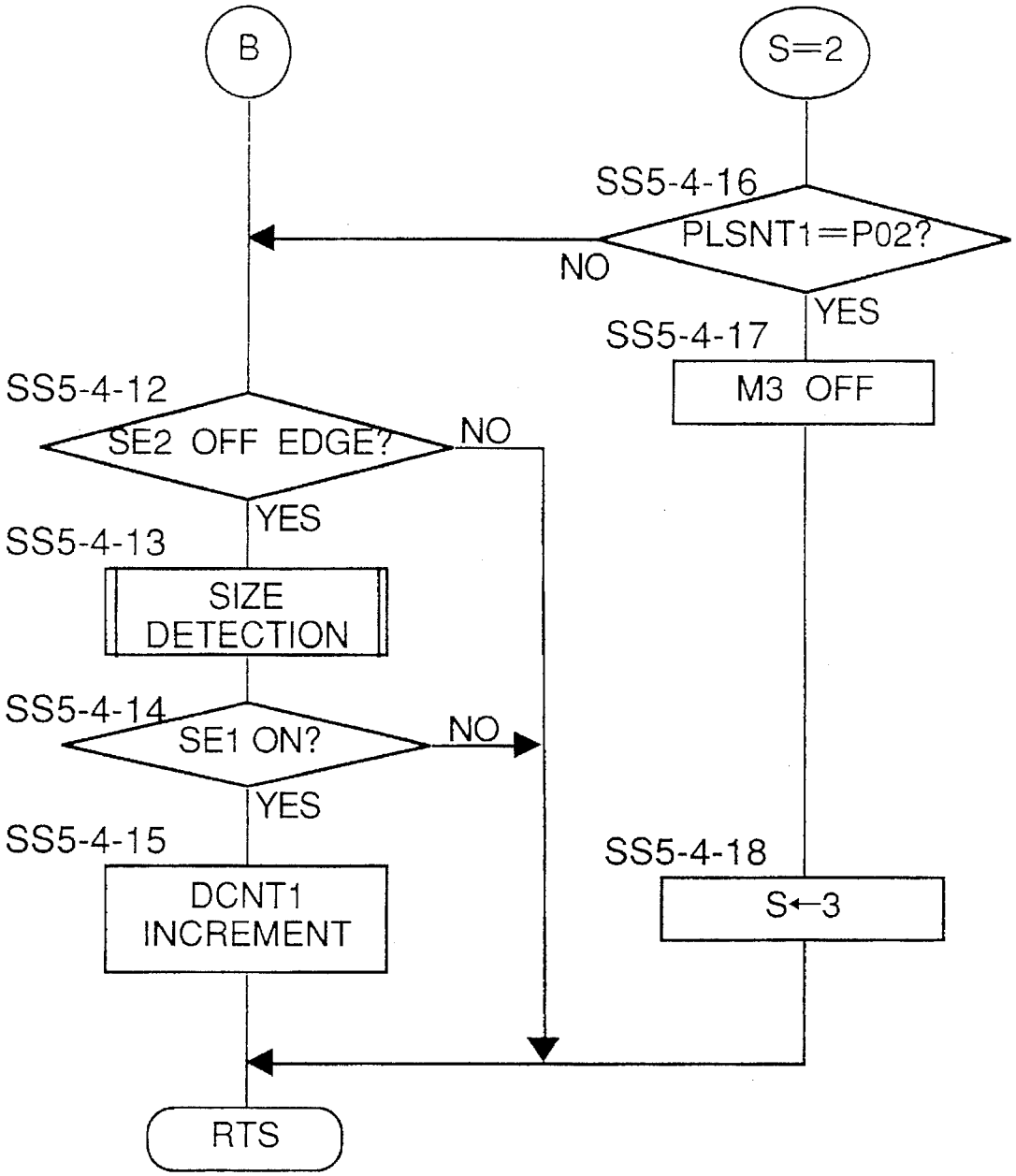
FIG. 91 is a flow chart showing the prestep set subroutine in the CPU2 subsequent to FIG. 90.

On condition that the PLSCNT1 is counting the pulse P01 (NO at the above SS5-4-3), if the register sensor SE2 has been confirmed at SS5-4-12 to be at the OFF EDGE, then the document size is detected at SS5-4-13, as shown in FIG. 91. Further, it is decided at SS5-4-14 whether or not the empty sensor SE1 is on. If it is on (the next document sheet is present), the DCNT1 is incremented at SS5-4-15.

If the status S is "2", it is decided at SS5-4-16 whether or not the PLSCNT1 has counted the P02. The pulse P02 is a number of pulses needed to convey the document by a distance L/2 (see FIG. 28). Therefore, if the PLSCNT1 has counted the pulse P02 (when the front end of the document has reached the intermediate position IP), the main motor M3 is turned off at SS5-4-17, and the set status S is set to "3" at SS5-4-18. If the PLSCNT1 is counting the pulse P02, the above-mentioned SS5-4-12 through SS5-4-15 are processed.

If the set status S is "3", nothing is processed as shown in FIG. 90.

Figure 92:
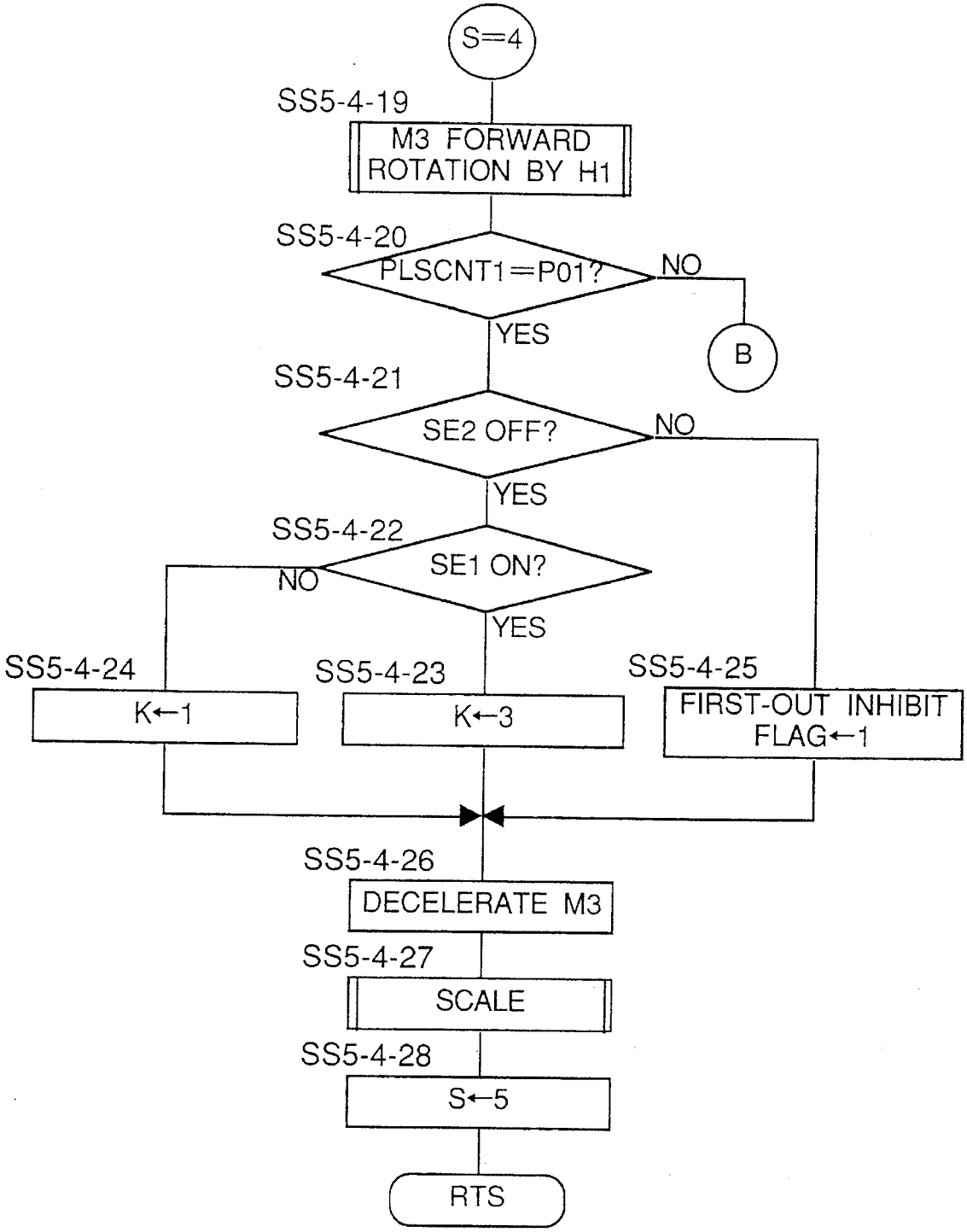
FIG. 92 is a flow chart showing the prestep set subroutine in the CPU2 subsequent to FIG. 91.

As shown in FIG. 92, if the set status S is "4" (on completion of first-out feed of the next document sheet), the main motor M3 is rotated forward at high speed at SS5-4-19. As a result of this operation, the preceding document sheet is conveyed to the exposure position and the succeeding document sheet is conveyed to the prestep position. Then, if the PLSCNT1 has been decided at SS5-4-20 to have counted the pulse P01, it is decided at SS5-4-21 whether or not the register sensor SE2 is off, and at SS5-4-22 whether or not the empty sensor SE1 is on. If the sensor SE2 is off while the sensor SE1 is on, i.e., if the succeeding document sheet is small size and there is a document sheet left on the tray 61, then the status K is set to "3" at SS5-4-23, the main motor M3 is reduced in speed at SS5-4-26, the scale 120 is protruded at SS5-4-27 (in the case of the scale mode), and the status S is set to "5" at SS5-4-28.

Meanwhile, if the register sensor SE2 is on, the succeeding document sheet is large size. Therefore, a first-out inhibit flag is set to "1" at SS5-4-25, and the above-mentioned operations of SS5-4-26 to -28 are processed. If the empty sensor SE1 is off, there is no document sheet left. Therefore, the feed status K is set to "1" at SS5-4-24, and the above-mentioned operations of SS5-4-26 to -28 are processed. If the PLSCNT1 is counting the pulse P01 (NO at the above SS5-4-20), then the operations of SS5-4-12 to -15 are processed and the size of the succeeding document sheet is detected.

Figure 93:
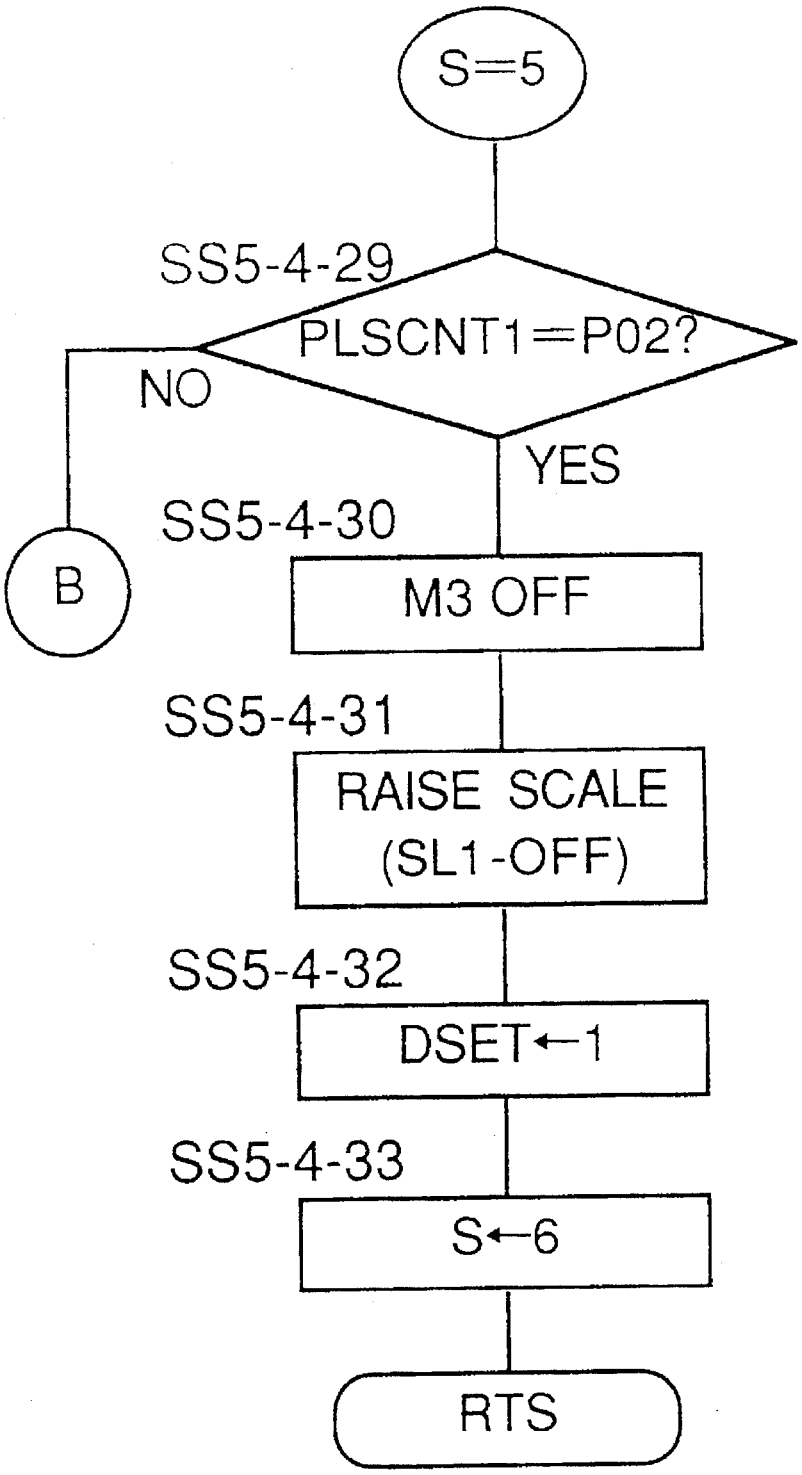
FIG. 93 is a flow chart showing the prestep set subroutine in the CPU2 subsequent to FIG. 92.

If the set status S is "5", it is decided at SS5-4-29 whether or not the PLSCNT1 has counted the pulse P02, as shown in FIG. 93. If it is YES, i.e., if the front end of the preceding document has reached the exposure standard position SP while the succeeding document has reached the intermediate position IP, then the main motor M3 is turned off at SS5-4-30. Subsequently, the scale 120 is raised by the solenoid SL1 at SS5-4-31, a flag DSET is set to "1" at SS5-4-32, and the status S is set to "6" at SS5-4-33. The flag DSET, when set to "1", represents that the document has been set at the exposure position, the flag being transmitted to the CPU1. In the copying machine main body 1, when this flag DSET is "1", the scanning operation of the optical system 20 becomes possible. If the PLSCNT1 is counting the pulse P02, the above-mentioned operations of SS5-4-12 to -15 are processed.

Figure 94:
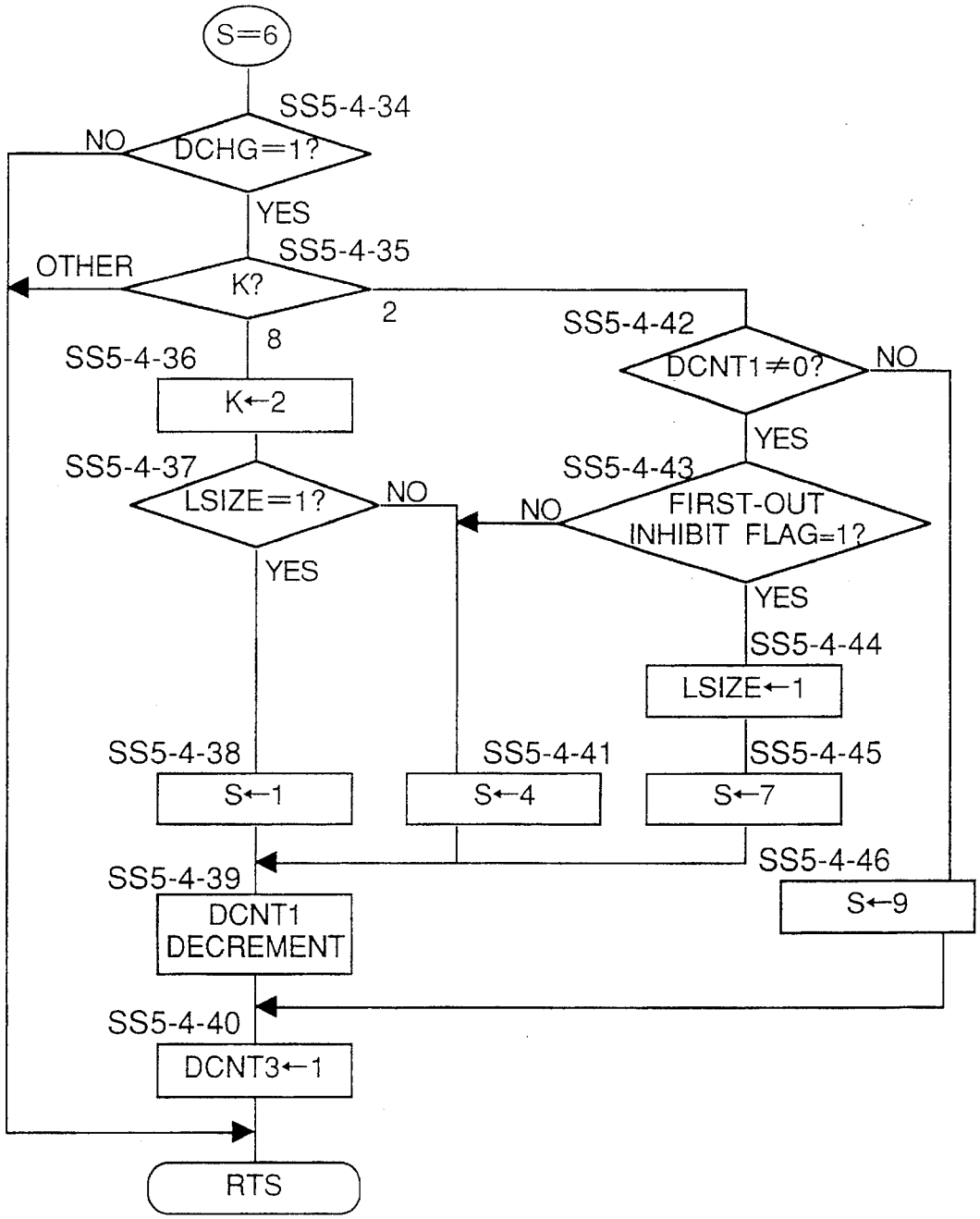
FIG. 94 is a flow chart showing the prestep set subroutine in the CPU2 subsequent to FIG. 93.

If the set status S is "6", it is decided at SS5-4-34 whether or not the flag DCHG is "1" as shown in FIG. 94. Then, only when it is "1", the following operations are executed. The flag DCHG is transmitted from the CPU1 of the copying machine main body 1 in order to request a document replacement to the ADF 60.

If the flag DCHG is "1", the value of the status K is checked at SS5-4-35. In this example, only when the value of the status K is "2" or "8", the following operations are executed. If the status K is "8" (if the succeeding document sheet has already been first-out fed), the status K is set to "2" at SS5-4-36, and it is decided at SS5-4-37 whether or not the flag LSIZE is "1". If the flag LSIZE is "1" (if a large-size document sheet has been fed), then the status S is set to "1"

at SS5-4-38, the DCNT1 is decremented at SS5-4-39, and the DCNT3 for counting the number of document sheets to be discharged is set to "1" at SS5-4-40. If the flag LSIZE is "0" (if a small-size document sheet has been fed), then the status S is set to "4" at SS5-4-41, and the above-mentioned operations of SS5-4-39 to -40 are processed.

If the status K has been decided at SS5-4-35 to be "2" (a state in which the succeeding document has not been fed, i.e., there is no succeeding document or it is in the first-out feed state), .then it is decided at SS5-4-42 whether or not the DCNT1 is "0". If the DCNT1 is "0", it is decided at SS5-4-43 whether or not a first-out inhibit flag is "1". If the first-out inhibit flag is "1", then the flag LSIZE is set to "1" at SS5-4-44, the status S is set to "7" at SS5-4-45, and the above-mentioned operations of SS5-4-39 to -40 are processed. If the first-out inhibit flag is "0", then the above-mentioned operations of SS5-4-41 and SS5-4-39 to -40 are processed. If the DCNT is not "0", then the status S is set to "9" at SS5-4-46 and the operation of SS5-4-40 is processed.

Figure 95:
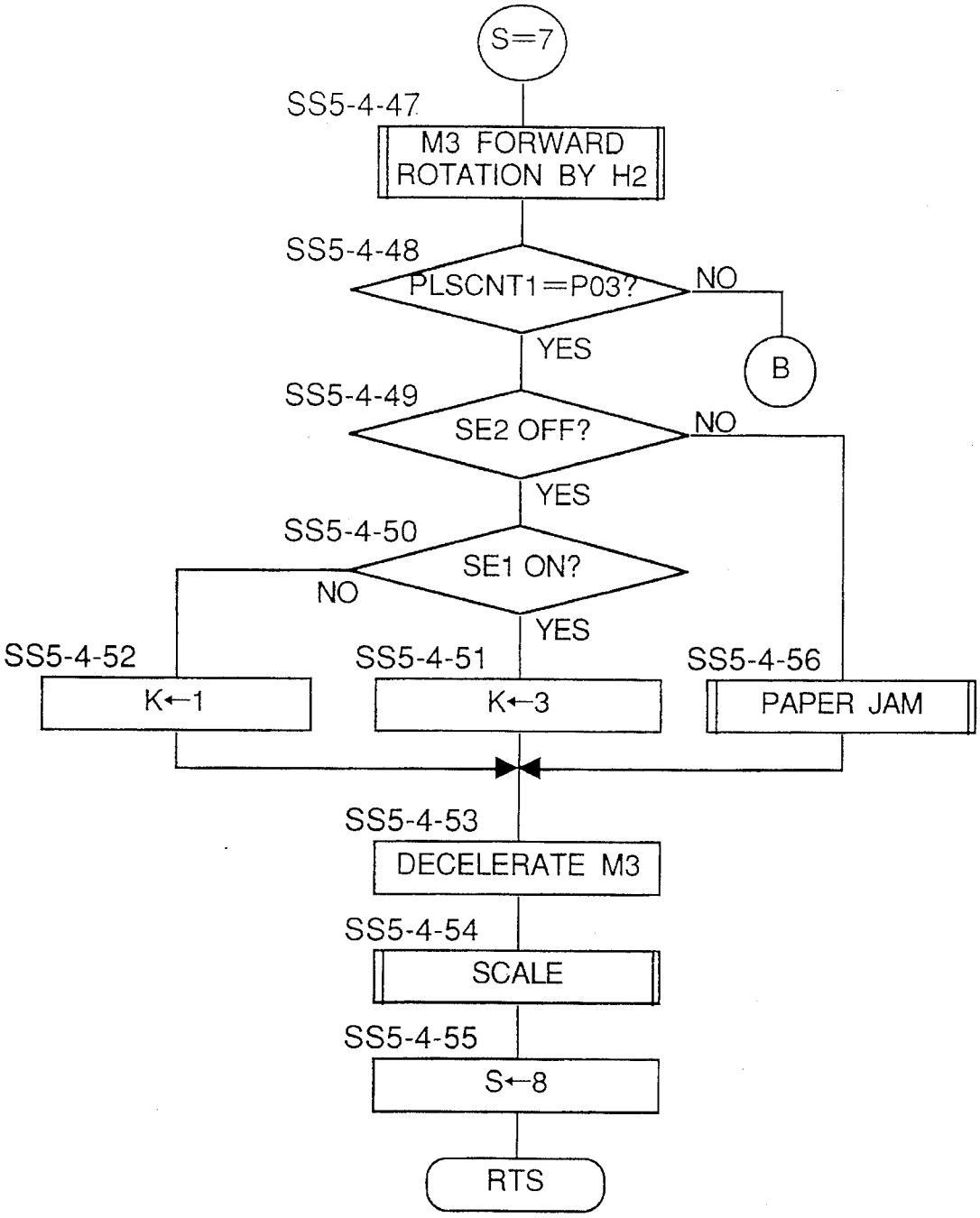
FIG. 95 is a flow chart showing the prestep set subroutine in the CPU2 subsequent to FIG. 94.

If the status S is "7", then the main motor M3 is rotated forward at high speed at SS5-4-47 as shown in FIG. 95. As a result, the large-size document sheet is conveyed from the intermediate position IP. Then, it is decided at SS5-4-48 whether or not the PLSCNT1 has counted the pulse P03. If the PLSCNT1 has counted the pulse P03, it is decided at SS5-4-49 whether or not the register sensor SE2 is off, and at SS5-4-50 whether or not the empty sensor SE1 is on. If the register sensor SE2 is off while the empty sensor SE1 is on, then the status K is set to "3" at SS5-4-51 for feeding the next document sheet. Further, the main motor M3 is reduced in speed at SS5-4-53, the scale 120 is protruded at SS5-4-54 (in the scale mode), and the status S is set to "8" at SS5-4-55.

If the register sensor SE2 has been turned on, then the rear end of the large-size document sheet has not yet passed the register roller 90. Therefore, a paper jam is processed at SS5-4-56. Also, if the empty sensor SE1 is off, there is no succeeding document. Therefore, the status K is set to "1" at SS5-4-52, and the above-mentioned operations of SS5-4-53 to -55 are processed. If the PLSCNT1 is counting the pulse P03 (NO at SS5-4-48), the operations of SS5-4-12 to -15 are processed and the size of the document is detected.

Figure 96:
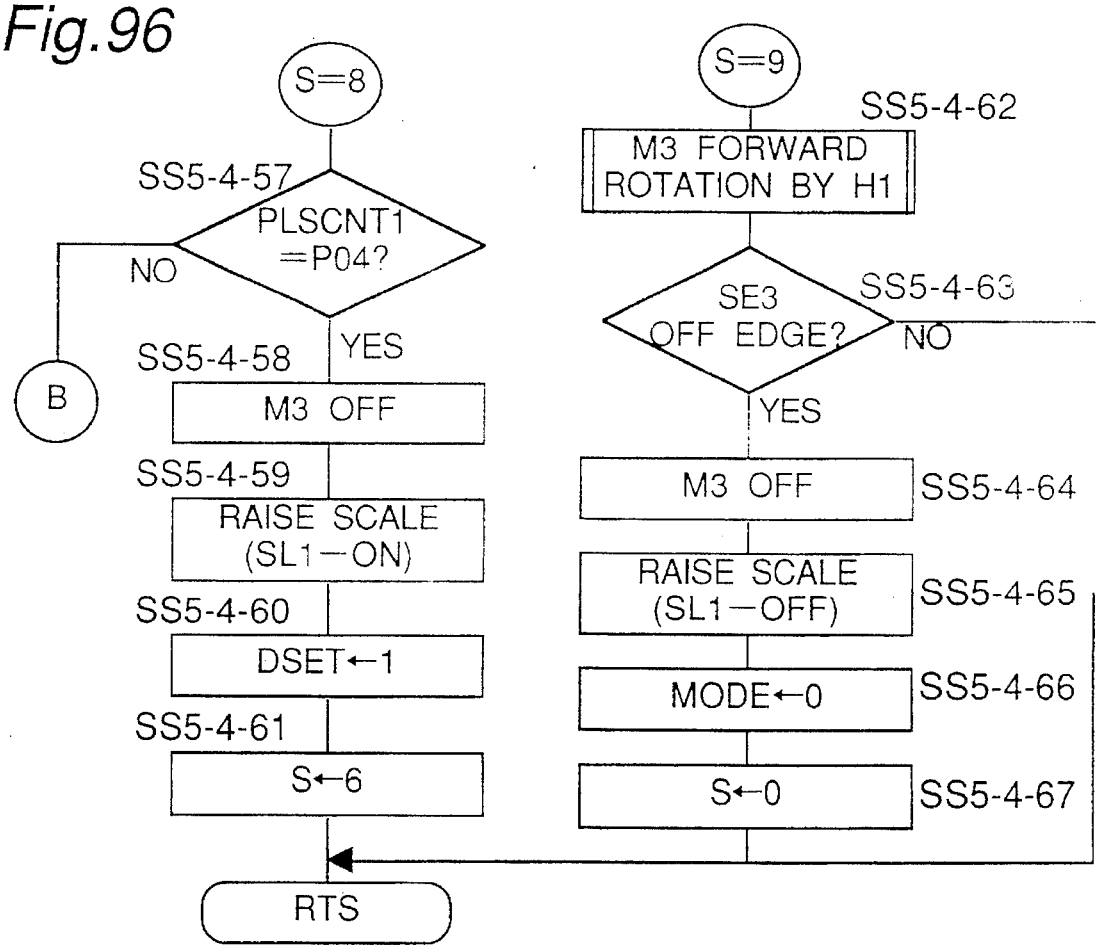
FIG. 96 is a flow chart showing the prestep set subroutine in the CPU2 subsequent to FIG. 95.

If the status S is "8", it is decided at SS5-4-57 whether or not the PLSCNT1 has counted the pulse P04, as shown in FIG. 96. If it is YES, i.e., if the front end of the large-size document has reached the exposure standard position SP, then the main motor M3 is turned off at SS5-4-58. Subsequently, the solenoid SL1 is turned on at SS5-4-59 so that scale 120 is raised to protrude upward from the upper surface of the glass platen 29, the flag DSET is set to "1" at SS5-4-60, and the status S is set to "6" at SS5-4-61. If the PLSCNT1 it is counting the pulse P04, then the above-mentioned operations of SS5-4-53 to -55 are processed.

If the status S is "9", the main motor M3 is rotated forward at high speed at SS5-4-62. As a result, the document is discharged from the exposure position. Then, when the discharge sensor SE3 is confirmed at SS5-4-63 to be at the OFF EDGE, i.e., when the rear end of the document is separated from the conveyor belt 95, the main motor M3 is turned off at SS5-4-64, and the solenoid SL1 is turned off at SS5-4-65 so that the scale 120 is raised. Subsequently, the MODE is reset to "0" at SS5-4-66, and the status S is reset to "0" at SS5-4-67.

Here is explained the detection of a paper jam in the prestep mode. If the status S is "1", a paper jam will not be processed even if the register sensor SE2 is on (i.e., even if NO at SS5-4-4). However, if the status S is "7", a paper jam will be processed if the register sensor SE2 has been turned on after the document is conveyed up to an extent of the pulse P03 (NO at SS5-4-49). More specifically, the pulse P03 is set slightly shorter than the distance L (see FIG. 28), such that a NO decided at SS5-4-49 means that the document is longer than L (500 mm) or that the document stays in proximity to the register roller 90 due to some conveyance fault. Such a case is detected to be a paper jam. Further, if the status S is "4", the first-out inhibit flag is set to "1" even if the register sensor SE2 is on (NO at SS5-4-21), but a paper jam will not be processed. Through the above processes, the document can be successfully conveyed even if large-size document sheets are mixedly set on the tray 61 in the prestep mode, it is possible to convey the document successfully.

<Scale>

Figure 97:
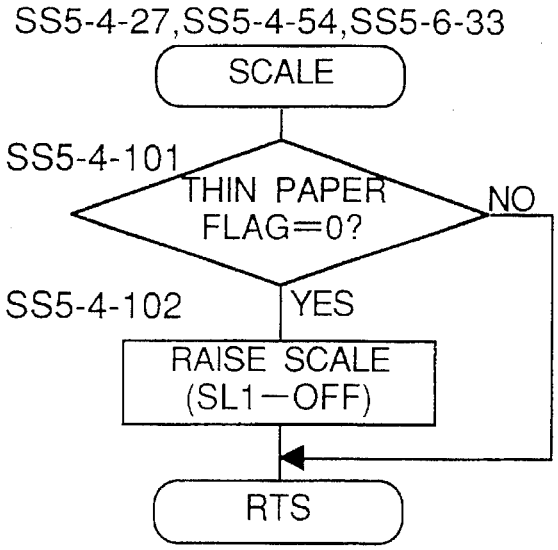
FIG. 97 is a flow chart showing the scale subroutine in the CPU2.

FIG. 97 shows a subroutine for the scale (SS5-4-27, SS5-4-54, SS5-6-33). In this subroutine, it is decided at SS5-4-101 whether or not the thin-paper flag is "0". If it is "0" (if the scale mode has been selected), the solenoid SL1 is turned on at SS5-4-102 so that the scale 120 is raised to slightly protrude from the upper surface of the glass platen 29, whereby the document is forcedly stopped at the exposure standard position SP.

<Main Motor High-Speed Rotation>

Figure 98:
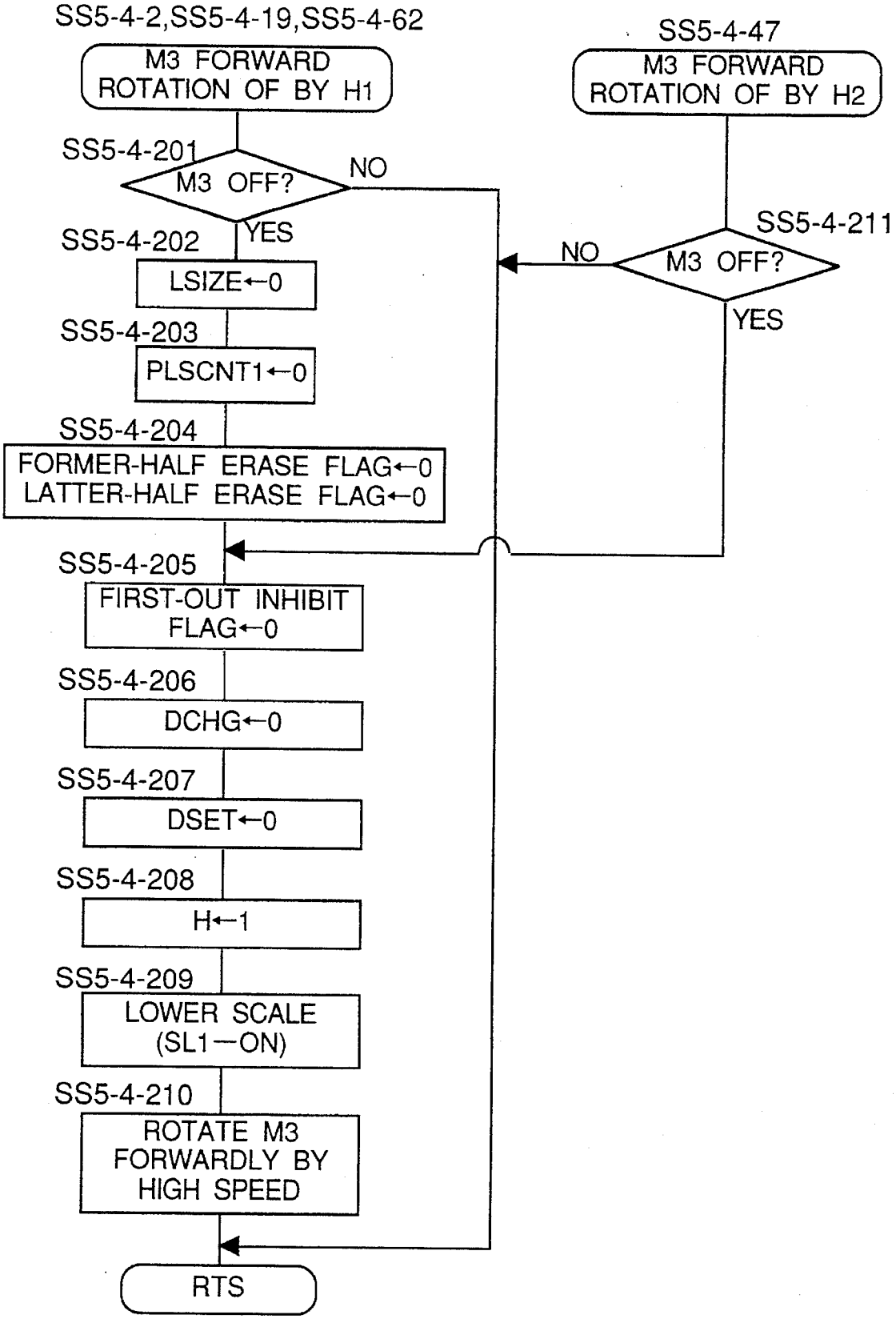
FIG. 98 is a flow chart showing the main motor control subroutine in the CPU2.

FIG. 98 shows a subroutine for high-speed forward rotation of the main motor M3 to be executed in the main motor high-speed rotation (SS5-4-2, SS5-4-19, SS5-4-62). In this subroutine, it is decided at SS5-4-201 and at SS5-4-211 whether or not the main motor has been turned off. If it has already been turned on, this subroutine is terminated immediately. If the main motor has been decided at SS5-4-201 to have been turned off, i.e., if the set status S is "1", "4", and "9", then the flag LSIZE is reset to "0" at SS5-4-202, the PLSCNT1 is reset to "0" at SS5-4-203, and the former-half and latter-half erase flags are reset to "0" at SS5-4 -204. Subsequently, the first-out inhibit flag is reset to "0" at SS5-4-205, the flag DCHG is reset to "0" at SS5-4-206, and the flag DSET is reset to "0" at SS5-4-207. Further, a discharge status H is set to "1" at SS5-4-208, the solenoid SL1 is turned on at SS5-4-209 so that the scale 120 is lowered, and the main motor M3 is set to the high-speed forward rotation at SS5-4-210, permitting an interrupt. Each time this interrupt is permitted, the main motor M3 is driven, where the PLSCNT1 and the PLSCNT2 count. Meanwhile, if the main motor M3 has been decided at SS5-4-211 to have been turned off, i.e., if the set status S is "7", the above-mentioned operations of SS5-4-205 to -210 are processed.

<Two-in-one Mode>

Figure 99:
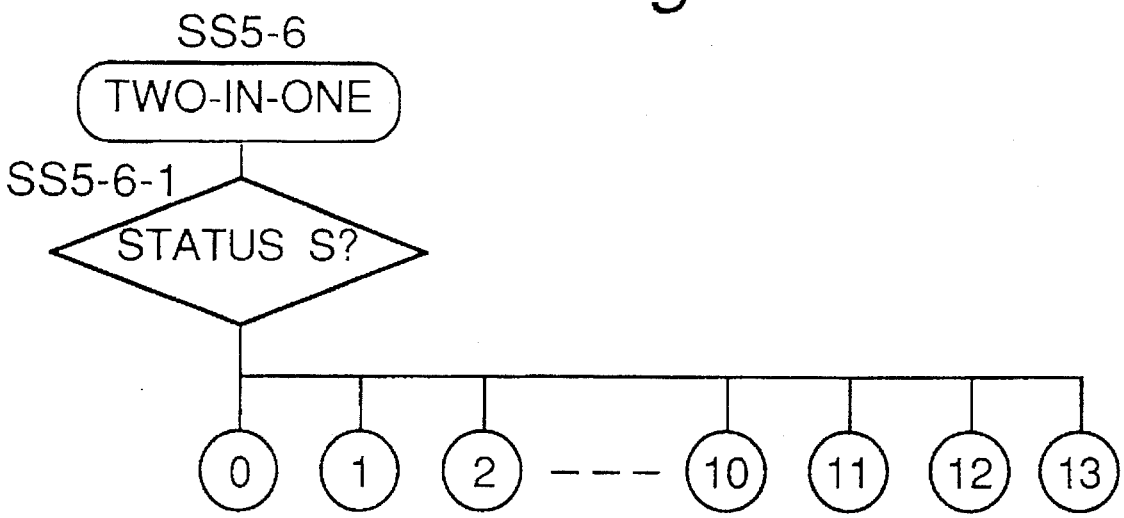
FIG. 99 is a flow chart showing the two-in-one set subroutine in the CPU2.

FIGS. 99 through 108 show a two-in-one set subroutine to be executed at SS5-6. In this subroutine, as shown in FIG. 99, the status S is checked at SS5-6-1 and the following operations are executed based on the resulting values "0" through "13".

Figure 100:
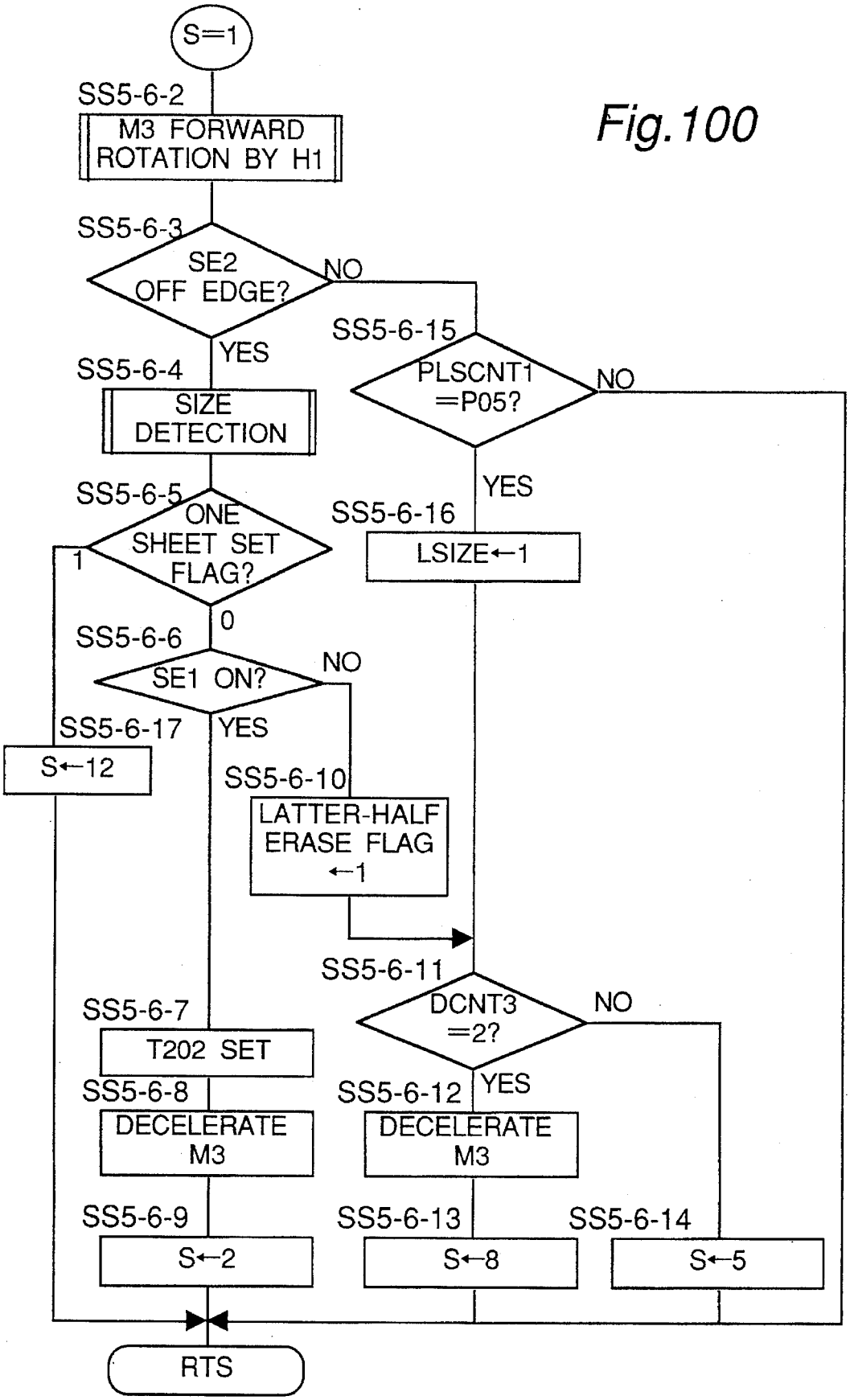
FIG. 100 ms a flow chart showing the two-in-one set subroutine in the CPU2 subsequent to FIG. 99.

If the status S is "0", nothing is processed. As shown in FIG. 100, if the status S is "1" (paper feed is completed), the main motor M3 is rotated forward at high speed at SS5-6-2. As a result, the document is fed from the register roller 90 onto the platen glass 29. Then, it is decided at SS5-6-3 Whether or not the register sensor SE2 is at the OFF EDGE. If it is at the OFF EDGE (if the rear end of the document has passed the detection point of the sensor SE2), the size of the document is detected at SS5-6-4. Next, a one-sheet set flag is decided at SS5-6-5. If the one-sheet set flag is "0", it is decided at SS5-6-6 whether or not the empty sensor SE1 is on. If the register sensor SE2 is at the OFF EDGE while the empty sensor SE1 is on, i.e., if the document fed is small size and the succeeding document sheet is left on the tray 61, then the timer T202 for feeding the succeeding document sheet is set at SS5-6-7, the main motor M3 is decelerated at SS5-6-8, and the status S is set to "2" at SS5-6-9.

Meanwhile, if the empty sensor SE1 has been decided at SS5-6-6 to be off, i.e., if only one sheet of the last document, which has been provided totally in an odd number of sheets, is left as a result of paper feeding, then there is no succeeding document sheet so that the latter-half erase flag is set to "1" at SS5-6-10. The latter-half erase flag designates the erasing of charges on the photosensitive drum 10 on the latter-half scanning area of the optical system 20 in the two-in-one mode. Subsequently, it is decided at SS5-6-11 whether or not the DCNT3 is "2". If it is "2", i.e., if two document sheets are present on the platen glass 29, the main motor M3 is decelerated at SS5-6-12 and the status S is set to "8" at SS5-6-13. If the DCNT3 is not "2", the status S is set to "5" at SS5-6-14.

If the register sensor SE2 has been decided at SS5-6-3 not to be at the OFF EDGE, it is decided at SS5-6-15 whether or not the PLSCNT1 has counted the pulse P05. The pulse P05 is a number of pulses larger than the number of pulses to be counted until the small-size document passes the register sensor SE2. If the PLSCNT1 counts up to the number before the register sensor SE2 is turned off, then the document is large size and therefore the flag LSIZE is set to "1" at SS5-6-15 and the above-mentioned operations of SS5-6-11 to -13 or operation of SS5-6-14 are processed. If the one-sheet set flag is decided at SS5-6-5 to be "1", i.e., if the document, which is previously known to be provided in an odd number of sheets as a result of the document count or the like, is small size, then the status S is set to "12" at SS5-6-17.

If the status S is "2", it is decided at SS5-6-18 whether or not the timer T202 has counted up. After completion of the count, if the status K has been decided at SS5-6-19 to be "2", then the status K is set to "3" at SS5-6-20, whereby the succeeding document is started to be first-out fed. If the timer T202 has not completed the count, or if the status K is not "2" even if the timer has completed, then it is decided at SS5-6-21 whether or not the PLSCNT2 has counted the pulse P07. If the PLSCNT2 has counted the pulse P07, then the main motor M3 is changed to the low-speed reverse rotation. At this point, the document starts to switch back. Then, the status S is set to "3" at SS5-6-23.

Figure 102:
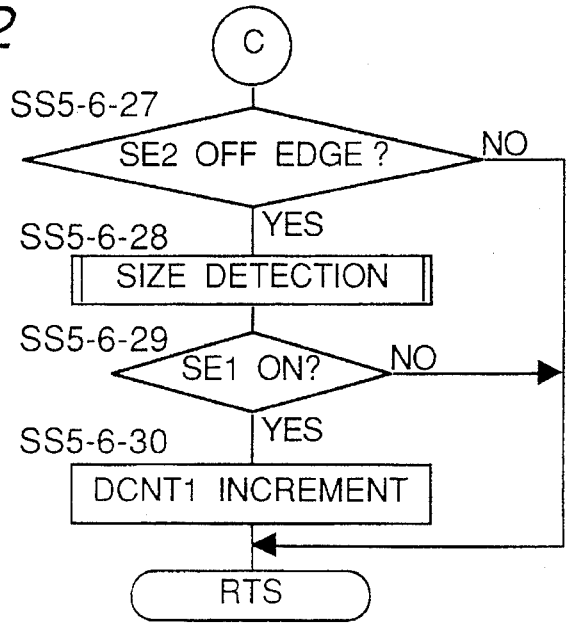
FIG. 102 is a flow chart showing the two-in-one set subroutine in the CPU2 subsequent to FIG. 101.

As shown in FIG. 102, if the PLSCNT2 has been decided at SS5-6-21 to be counting the pulse P07, the register sensor SE2 is confirmed to be at the OFF EDGE at SS5-6-27 and, if it has been confirmed, the size of the document to be then fed onto the platen glass 29 is detected at SS5-6-28. Subsequently, if the empty sensor SE1 is decided at SS5-6-29 to be on (if a document sheet remains left on the tray 61), then the DCNT1 is incremented at SS5-6-30.

Figure 101:
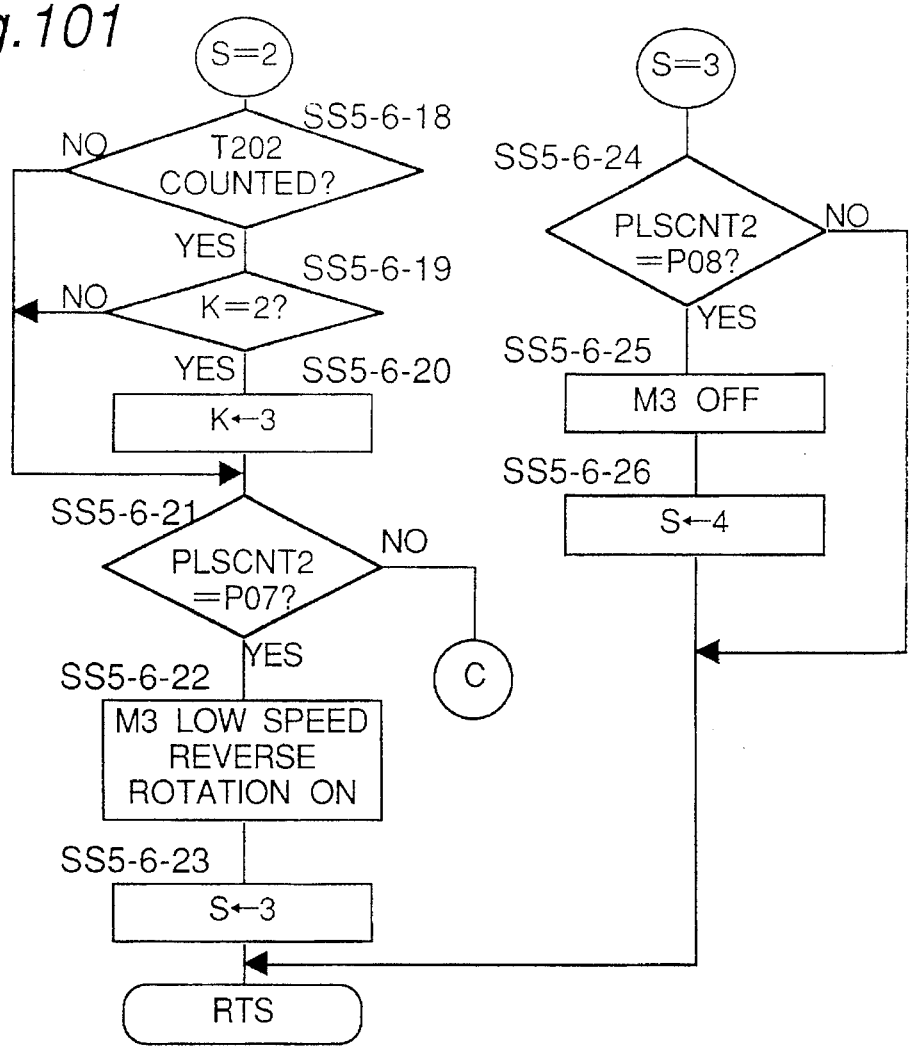
FIG. 101 ms a flow chart showing the two-in-one set subroutine in the CPU2 subsequent to FIG. 100.

If the status S is "3", it is decided at SS5-6-24 whether or not the PLSCNT2 has counted the pulse P08, as shown in FIG. 101. If it has completed the count, the main motor M3 is turned off at SS5-6-25. As a result, the document is finished being switched back. Then, the status S is set to "4". If the status S is "4", nothing is processed.

Figure 103:
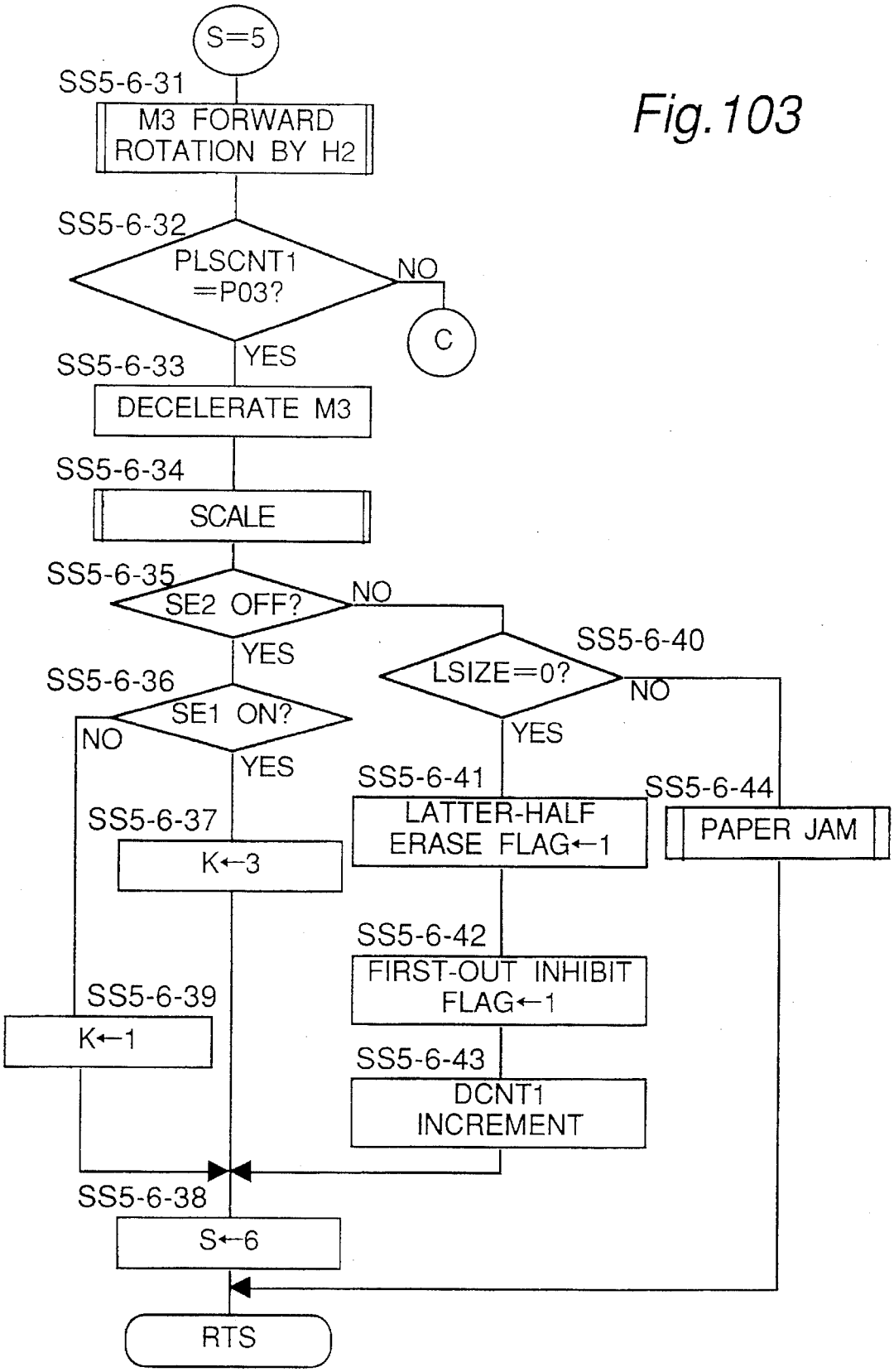
FIG. 103 is a flow chart showing the two-in-one set subroutine in the CPU2 subsequent to FIG. 102.

If the status S is "5" (feed-out of the succeeding document from the register roller 90), the main motor M3 is rotated forward at high speed at SS5-6-31 as shown in FIG. 103. As a result, the preceding switched-back document and the succeeding document are conveyed to the exposure position. Then, if the PLSCNT1 has been decided at SS5-6-32 to have counted the pulse P03, the main motor M3 is decelerated at SS5-6-33 and the scale 120 is protruded at SS5-6-34 (in the case of scale mode).

Next, it is decided at SS5-6-35 whether or not the register sensor SE2 is off, and at SS5-6-36 whether or not the empty sensor SE1 is on. If the sensor SE2 is off while the sensor SE1 is on, i.e., if the succeeding document is small size and there is a following document left on the tray 61, then the feed status K is set to "3" at SS5-6-37, and the status S is set to "6" at SS5-6-38. If the empty sensor SE1 has been decided at SS5-6-36 to be off, then there is no succeeding document. Therefore, the feed status K is set to "1" at SS5-6-39 and the above-mentioned operation of SS5-6-38 is processed.

If the register sensor SE2 has been decided at SS5-6-35 to be on, then it is decided at SS5-6-40 whether or not the flag LSIZE is "0". If it is YES, then a large-size document is two-in-one set in succession to the small-size document. Therefore, the latter-half erase flag is set to "1" in order to copy only the first-going small-size document at SS5-6-41. Further, first-out inhibit flag is set to "1" at SS5-6-42, the DCNT1 is incremented at SS5-6-43, and the above-mentioned operation of SS5-6-38 is processed. If the flag LSIZE is decided at SS5-6-40 to be "1", then the large-size document, which has been fed alone up to the position of the scale 120, still stays in proximity to the register roller 90, such that a paper jam process is executed at SS5-6-44. If the PLSCNT1 has been decided to be counting the pulse P03 (NO at SS5-6-32), then the above-mentioned operations of SS5-6-27 to SS5-6-30 (see FIG. 102) are processed and the size of the succeeding document is detected.

Figure 104:
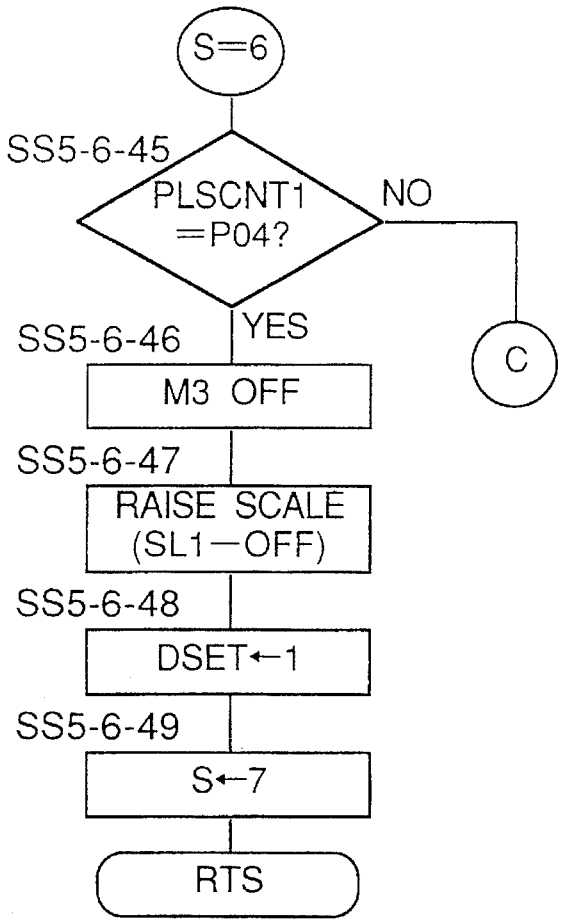
FIG. 104 is a flow chart showing the two-in-one set subroutine in the CPU2 subsequent to FIG. 103.

If the status S is "6", it is decided at SS5-6-45 whether or not the PLSCNT1 has counted the pulse P04, as shown in FIG. 104. If it is YES, i.e., if the front end of the document has reached the exposure standard position SP, then the main motor M3 is turned off at SS5-6-46. At this point, if the succeeding document is large size, then the second half of the document stays in the paper feed section. Subsequently, the solenoid SL1 is turned off at SS5-6-47 so that the scale 120 is raised, the flag DSET is set to "1" at SS5-6-48, and the status S is set to "7" at SS5-6-49.

Figure 105:
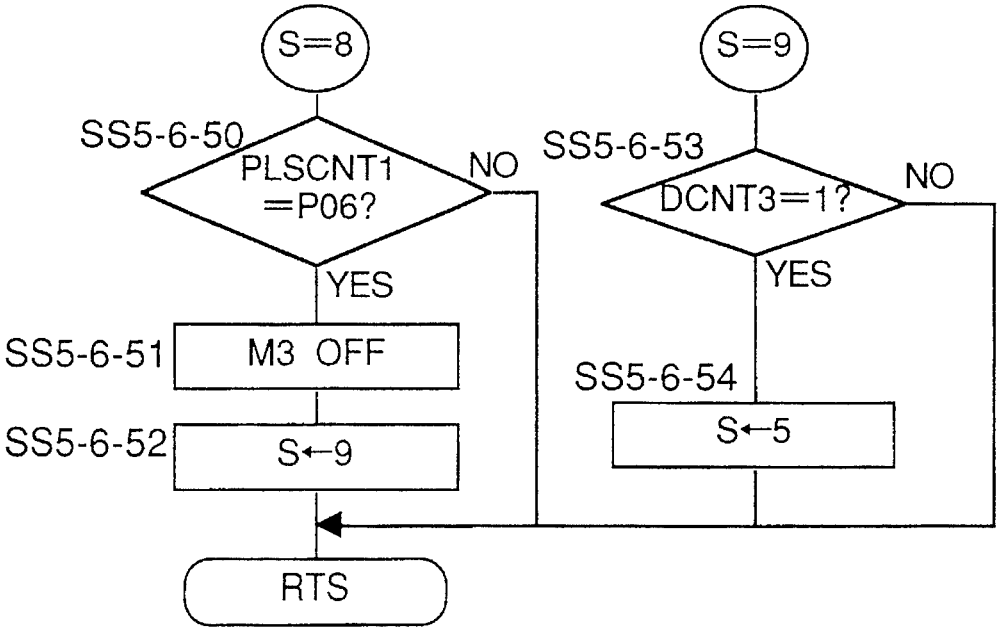
FIG. 105 is a flow chart showing the two-in-one set subroutine in the CPU2 subsequent to FIG. 104.

As shown in FIG. 105, if the status S is "8" (paper feed of a large-size document), it is confirmed at SS5-6-50 that the PLSCNT1 has completed the count of the pulse P06, and the main motor M3 is turned off at SS5-6-51. Further, the status S is set to "9" at SS5-6-52.

If the status S is "9" the status S is set to "5" at SS5-6-54 only when the DCNT3 has been decided at SS5-6-53 to be "1" (one-sheet document is discharged).

Figure 106:
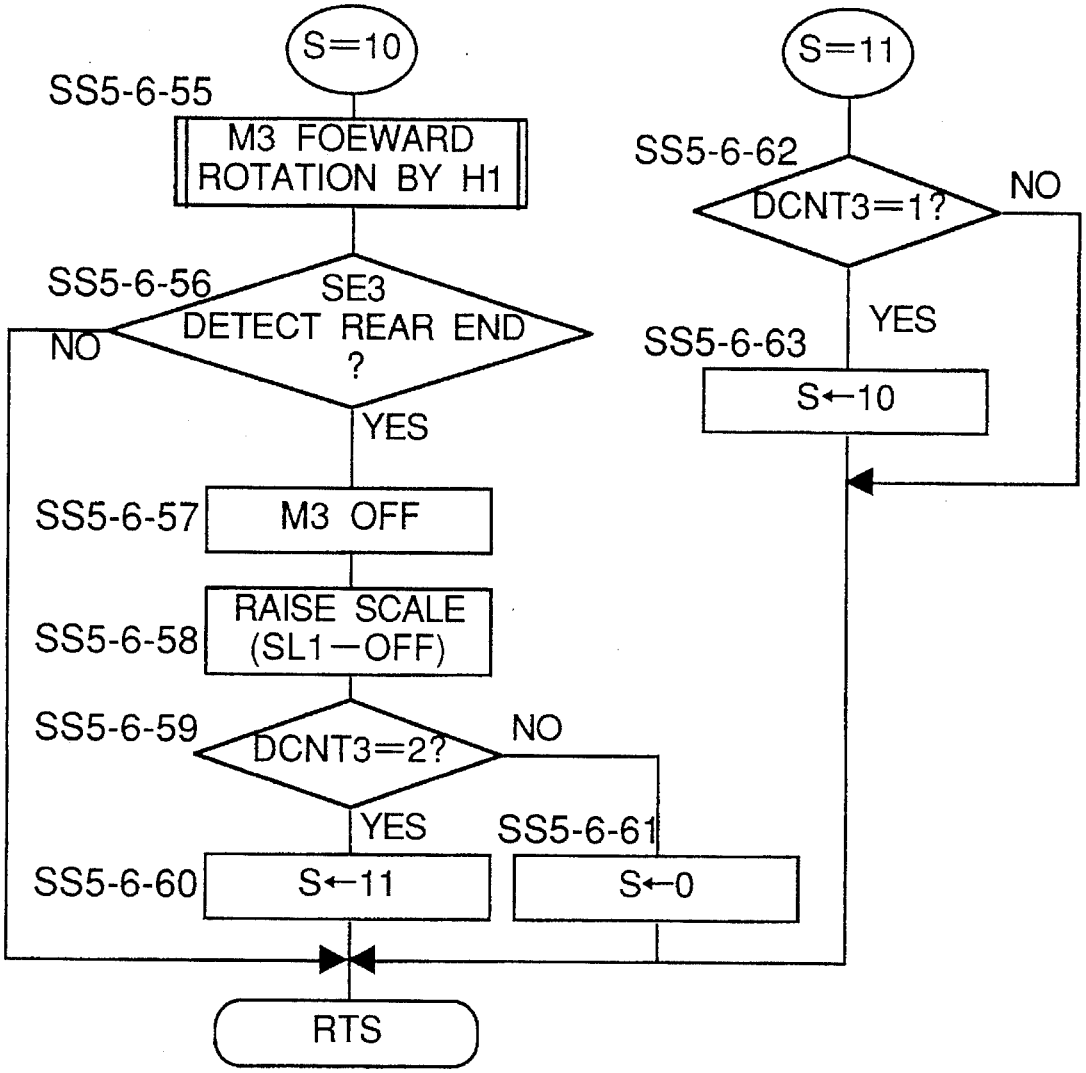
FIG. 106 is a flow chart showing the two-in-one set subroutine in the CPU2 subsequent to FIG. 105.

If the status S is "10", the main motor M3 is rotated at high speed at SS5-6-55 as shown in FIG. 106. As a result, the document is discharged from the exposure position. Then, when the rear end of the document to be discharged is detected by the discharge sensor SE3 at SS5-6-56, i.e., when the rear end of the document has separated from the conveyor belt 95, the main motor M3 is turned off at SS5-6-57. By this Operation, an interval is provided between two document sheets if they are simultaneously discharged. Next, the solenoid SL1 is turned off at SS5-6-58 so that the scale 120 is raised. Also, it is decided at SS5-6-59 whether or not the DCNT3 is "2". If it is "2", the status S is set to "11" at SS5-6-60; if it is not "2" (only one sheet of document is discharged), the status S is reset to "0" at SS5-6-61.

If the status S is "11", then it is decided at SS5-6-62 whether or not the DCNT3 is "1". If it is "1", the status S is set to "10" at SS5-6-63. As a result, the succeeding document is discharged. If the DCNT3 is not "1", i.e., if the DCNT3 is "2", the first-fed document is to be discharged, in which case nothing is processed.

Figure 107:
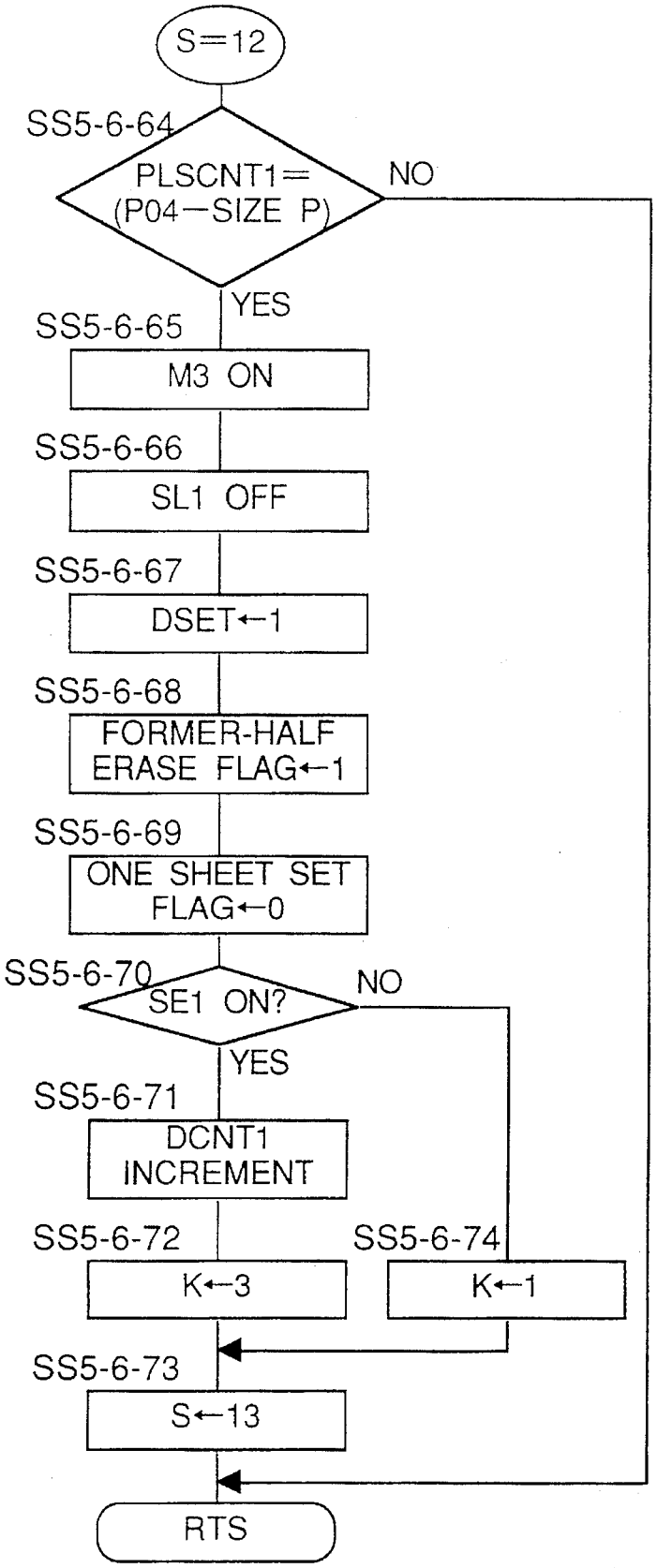
FIG. 107 is a flow chart showing the two-in-one set subroutine in the CPU2 subsequent to FIG. 106.

If the status S is "12", operations shown in FIG. 107 are executed. The status S is set to "12" when the one-sheet set flag is "1", i.e., when the number of document sheets is an odd number and moreover the last-page document sheet to be first set is set onto the glass platen 29 one sheet alone. In this step, it is decided at SS5-6-64 whether or not the pulse counter PLSCNT1 has reached the "P04—size P". It is noted that P04 is a number of pulses required for the main motor M3 to convey the document from the register roller 90 to the scale 120. Set as this number of pulses at SS5-3-13 is L+ADJ1, which does not include the hit-and-feed amount α. Size P is a number of pulses corresponding to the document size determined by the document size detection process. Accordingly, that the pulse counter PLSCNT1 is "P04—size P" means that the second document sheet is set onto the glass platen 29 with a spacing apart from the scale 120 by an extent of the document size. Then, if the PLSCNT1 has become "P04—size P", where the document is set on the glass platen 29 with a spacing apart from the scale 120 by an extent of the document size, then the main motor M3 is turned off at SS5-6-65. Next, the solenoid SL1 is turned off at SS5-6-66 so that the scale 120 is moved up, the flag DSET is set to "1" at SS5-6-67, the former-half erase flag is set to "1" at SS5-6-68, and electrostatic latent images on the photosensitive member corresponding to its portions where no document is present on the glass platen 29 are erased. Thereafter, the one-sheet set flag is reset to "0" at SS5-6-69. Subsequently, if it is confirmed at SS5-6-70 that the sensor SE1 has been turned on and that there is a document sheet left on the document tray 61, then the DCNT1 is incremented by "1" at SS5-6-71, the status K is set to "3" at SS5-6-72, and the status S is set to "13" at SS5-6-73. If it is confirmed at SS5-6-70 that no document sheet is present on the document tray 61, then the status K is set to "1" at SS5-6-74. As seen above, when the number of document sheets is an odd number, the last-page document is set to a position apart from the scale 120 by an extent of the document size as measured from the exposure standard position SP on the glass platen 29, i.e., to the intermediate position IP. In the present case, since one-sheet small-size document is set to the latter-half part, the former-half erase flag is set so that the former-half part is erased. Even in such a case that the number of document sheets has been counted as an odd number and therefore the one-sheet set flag has been set, if the document is large size at the time of actual copying operation, the operation goes from SS5-6-15 to SS5-6-16, so that the document is set alone in accordance with the scale 120 and that the erasing is not performed. When only one document sheet remains as the last document at the last time of paper feed, the document is set to the scale side so that the latter-half erase flag is set (SS5-6-10). Also when a small-size document and a large-size document are two-in-one set, only the small-size document located on the scale side is copied while the latter-half erase flag is set on the large-size document side for erasing. Then, the large-size document is subsequently subjected to copying operation. In this copying, the document is copied on its entire surface and a copy free from any excessive copy, shadows and dirties of the belt projected into marginal portions, and any image defects can be obtained.

As described above, the last-page document is set to a position apart from the scale 120 by an extent of the document size, and then the former-half part of the electrostatic latent images on the photosensitive member corresponding to its portions where no document is present on the glass platen 29 are erased. Alternatively, it would be also possible to arrange such that the last-page document is set to a position coincident with the exposure reference, i.e., the scale 120, and that the outer surface of the photosensitive member corresponding to the former-half part of the sheet is erased before forming the electrostatic latent images of the document on the photosensitive member. This means that the copying process is started from the latter-half part of the sheet.

Figure 108:
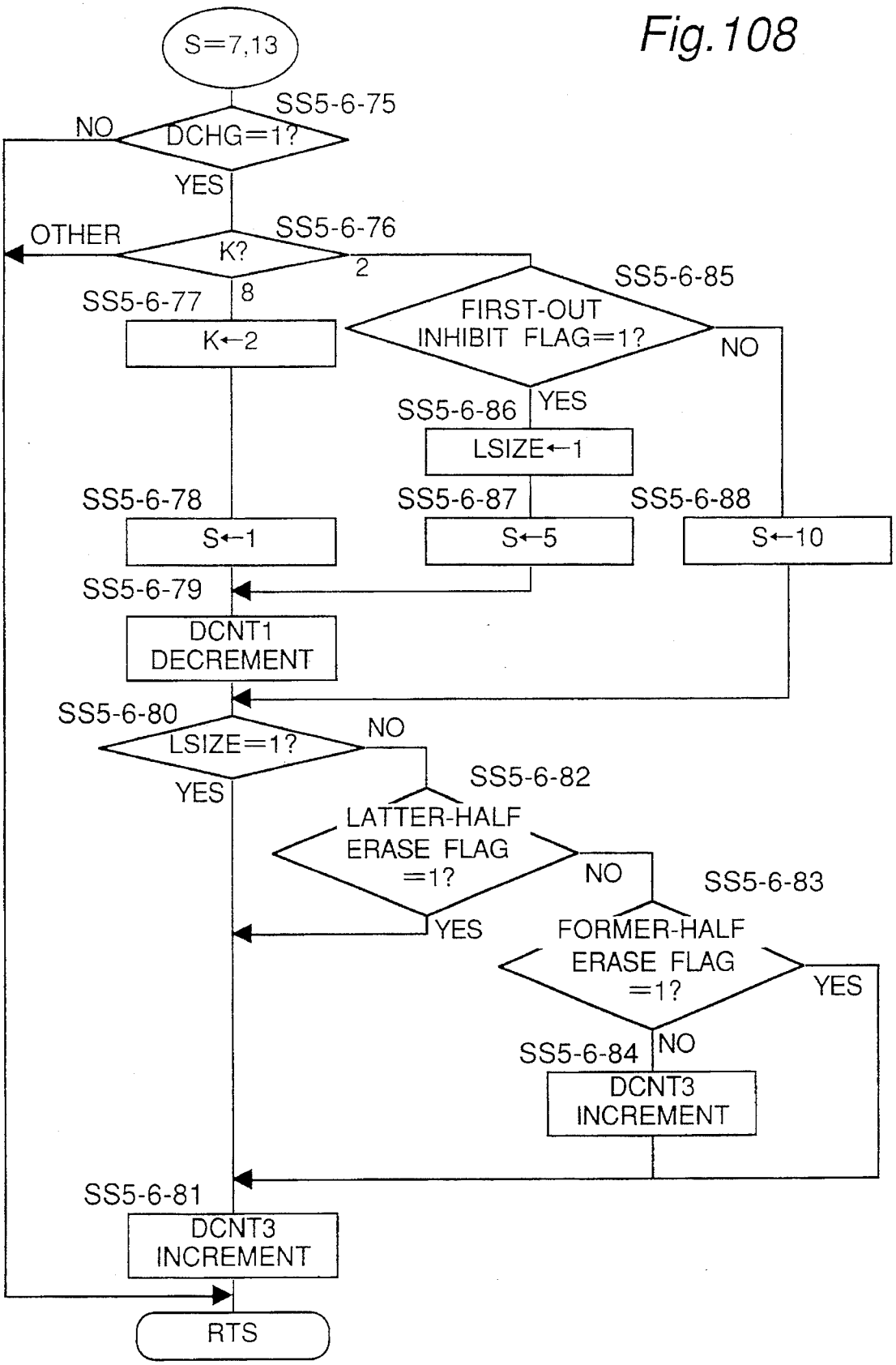
FIG. 108 is a flow chart showing the two-in-one set subroutine in the CPU2 subsequent to FIG. 107.

FIG. 108 shows operations to be executed when the status S is "7" or "13". In this process, it is decided at SS5-6-75 whether or not the flag DCHG is "1", and the following operations are executed only when the flag DCHG is "1". If the flag DCHG is "1", the value of the feed status K is checked at SS5-6-76. In this case, the following operations are executed only when the status K is "2" or "8".

If the status K is "8" (when the succeeding document has already been first-out fed), the status K is set to "2" at SS5-6-77, and the status S is set to "1" at SS5-6-78. Further, the DCNT1 is decremented at SS5-6-79 and it is decided at SS5-6-80 whether or not the flag LSIZE is "1". If the flag LSIZE is "1" (if a large-size document has been fed) , the DCNT3 for counting the number of document sheets to be discharged is incremented at SS5-6-81. If the flag LSIZE is "0" (if a large-size document has been fed), it is decided at SS5-6-82 whether or not the latter-half erase flag is "1". If the latter-half erase flag is "1" (if one sheet of small-size document has been set or if one sheet of small-size document and one sheet of large-size document have been set), then the above-mentioned operation of SS5-6-81 is processed. If the latter-half erase flag is "0", then it is decided at SS5-6-83 whether or not the former-half erase flag is "1". If the former-half erase flag is "0", the DCNT3 is incremented at SS5-6-84 and thereafter the operation of SS5-6-81 is processed.

If the status K has been decided at SS5-6-76 to be "2" (when the succeeding document has not been first-out fed), it is decided at SS5-6-85 whether or not the first-out inhibit flag is "1". If the first-out inhibit flag is "1", then the flag LSIZE is set to "1" at SS5-6-86, the status S is set to "5" at SS5-6-87, and the operations of SS5-6-79 to -84 are processed. If the first-out inhibit flag is "0", then the status S is set to "10" at SS5-6-88 and the operations of SS5-6-80 to -84 are processed.

<Paper Discharge>

Figure 109:
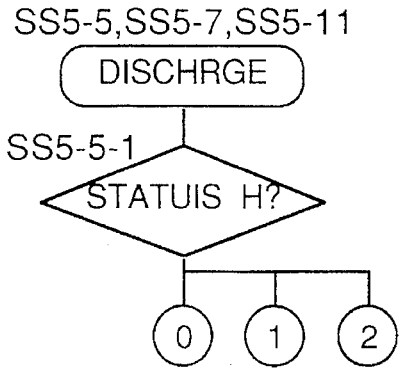
FIG. 109 is a flow chart showing the paper discharge subroutine in the CPU2.
Figure 110:
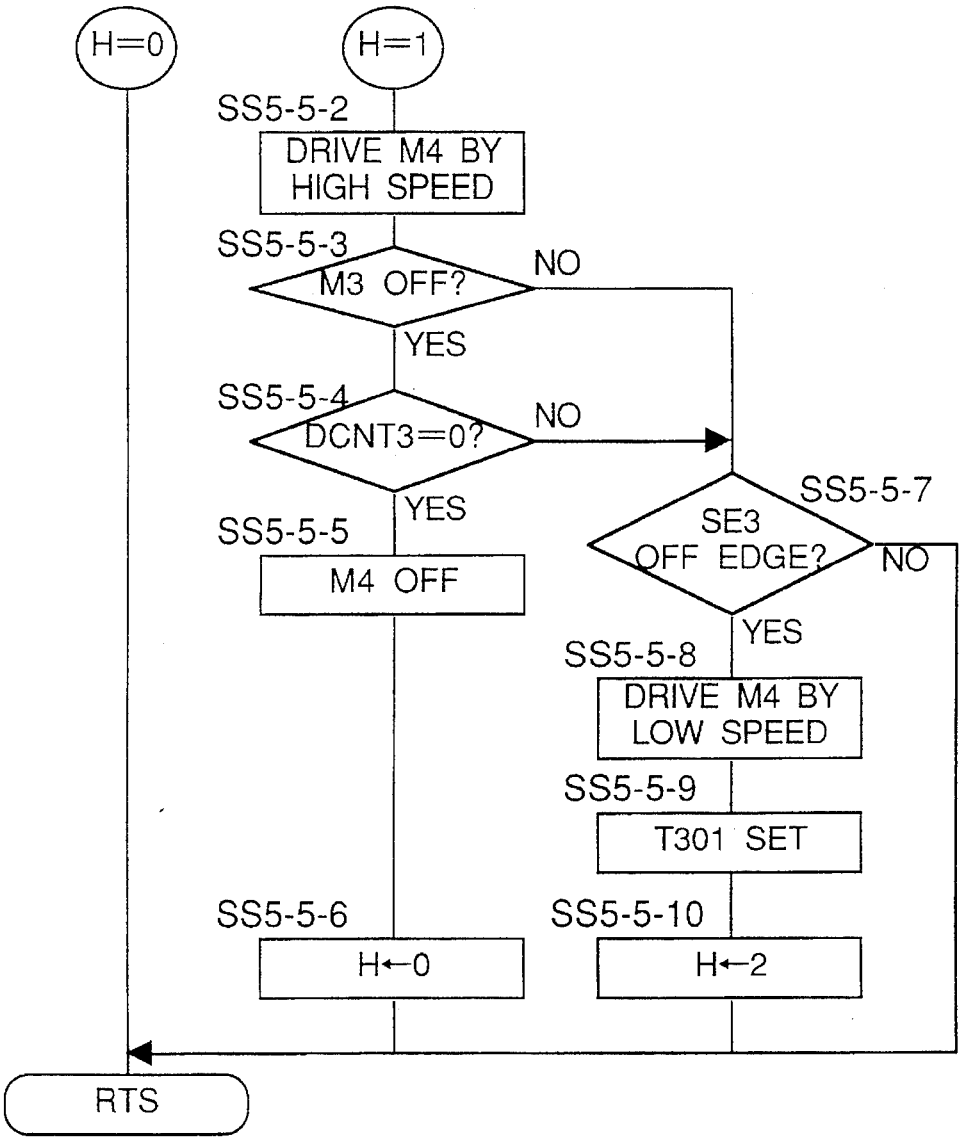
FIG. 110 is a flow chart showing the paper discharge subroutine in the CPU2 subsequent to FIG. 108.
Figure 111:
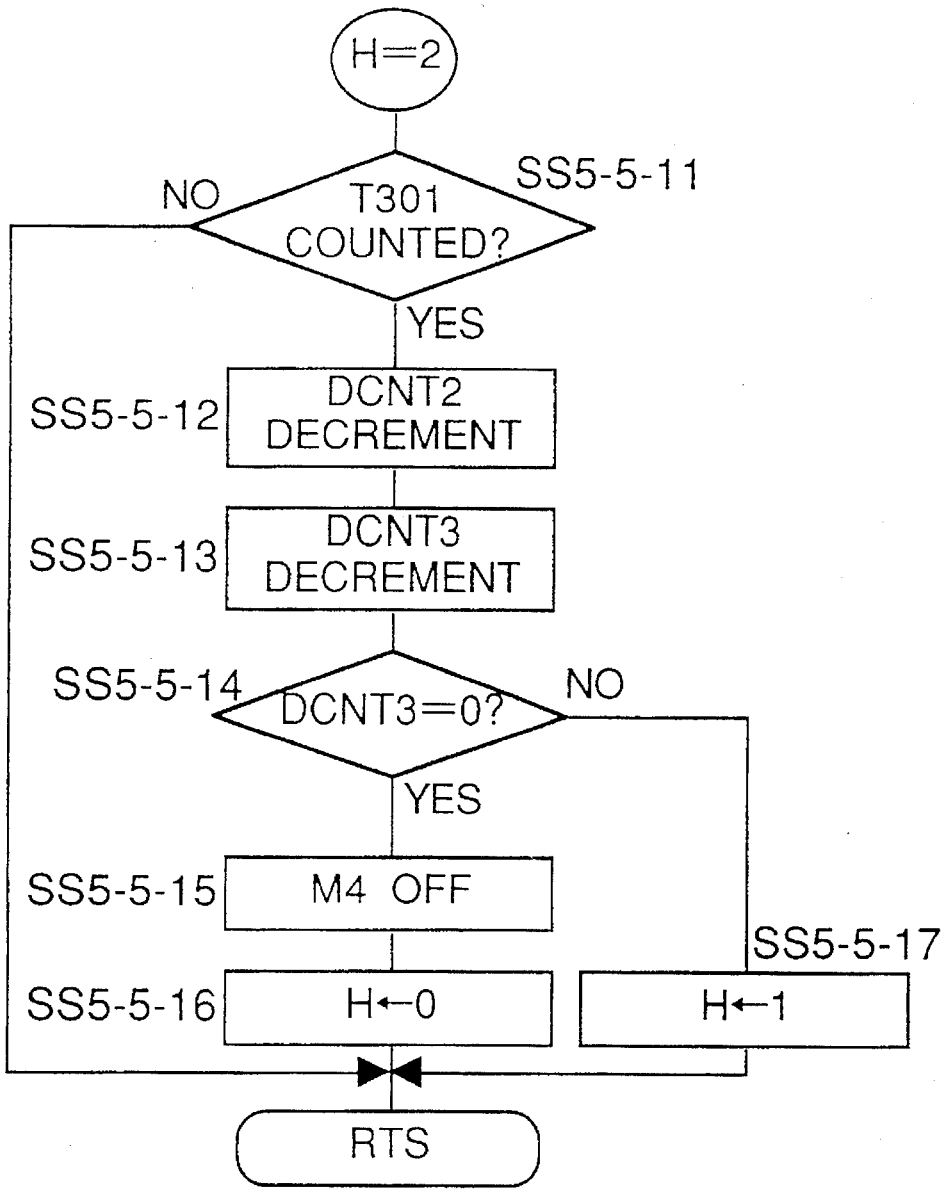
FIG. 111 is a flow chart showing the paper discharge subroutine in the CPU2 subsequent to FIG. 109.

FIGS. 109 to 111 show a counted paper discharge subroutine to be executed at SS5-5, SS5-7, and SS5-11. The paper discharge executed in this subroutine is that in the prestep mode and the two-in-one mode. In this subroutine, as shown in FIG. 109, the paper discharge status H is checked at SS5-5-1 and the following operations are executed based on the resulting values "0", "1", and "2".

As shown in FIG. 106, if the status H is "0", nothing is processed. If the status H is "1", then the discharge motor M4 is driven into high-speed rotation at SS5-5-2 and it is decided at SS5-5-3 whether or not the main motor M3 is on, and at SS5-5-4 whether or not the DCNT3 is "0". If the main motor M3 has been turned off and the DCNT3 is "0", then there is no document to be discharged so that the discharge motor M4 is turned off at SS5-5-5 and the status H is reset to "0" at SS5-5-6.

If the main motor M3 has been turned on, or if the DCNT3 is not "0" even with the main motor M3 off (a state that the document is being conveyed), then it is decided at SS5-5-7 whether or not the discharge sensor SE3 is at the OFF EDGE. If the discharge sensor SE3 is at the OFF EDGE, i.e., if the rear end of the document has passed the detection point of the discharge sensor SE3, then the discharge motor M4 is changed to low-speed drive at SS5-5-8, and the timer T301 is set at SS5-5-9. Further, the status H is set to "2" at SS5-5-10.

If the status H is "2", it is confirmed at SS5-5-11 that the timer T301 has counted up, as shown in FIG. 111, and then the DCNT2 is decremented at SS5-5-12 and the DCNT3 is decremented at SS5-5-13. Subsequently, it is decided at SS5-5-14 whether or not the DCNT3 is "0". If the DCNT3 is "0", i.e., if one sheet of the document is to be discharged, then the discharge motor M4 is turned off at SS5-5-15, and the status H is reset to "0" at SS5-5-16. If the DCNT3 is not "3", i.e., if two or more sheets of the document are to be discharged, then the status H is set to "1" at SS5-5-17 so that the discharging operation is continued.

<Count>

Figure 112:
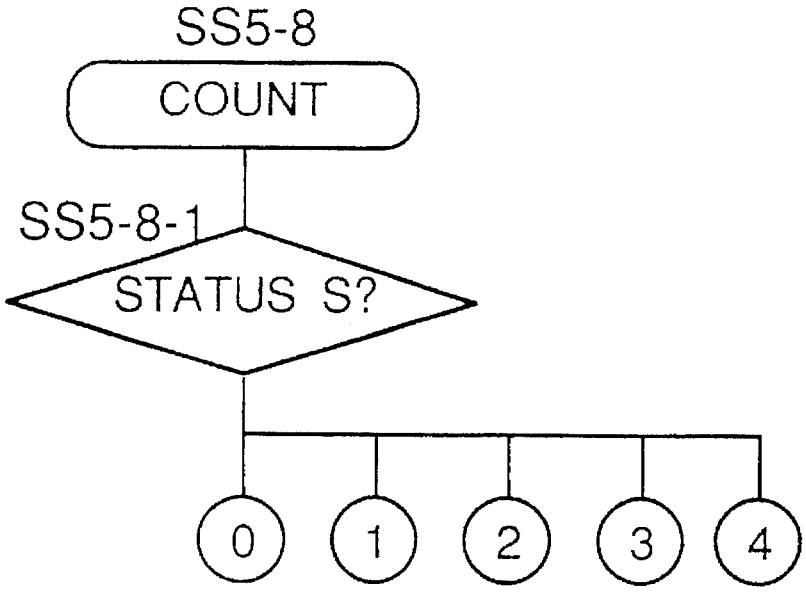
FIG. 112 is a flow chart showing the count subroutine in the CPU2.
Figure 113:
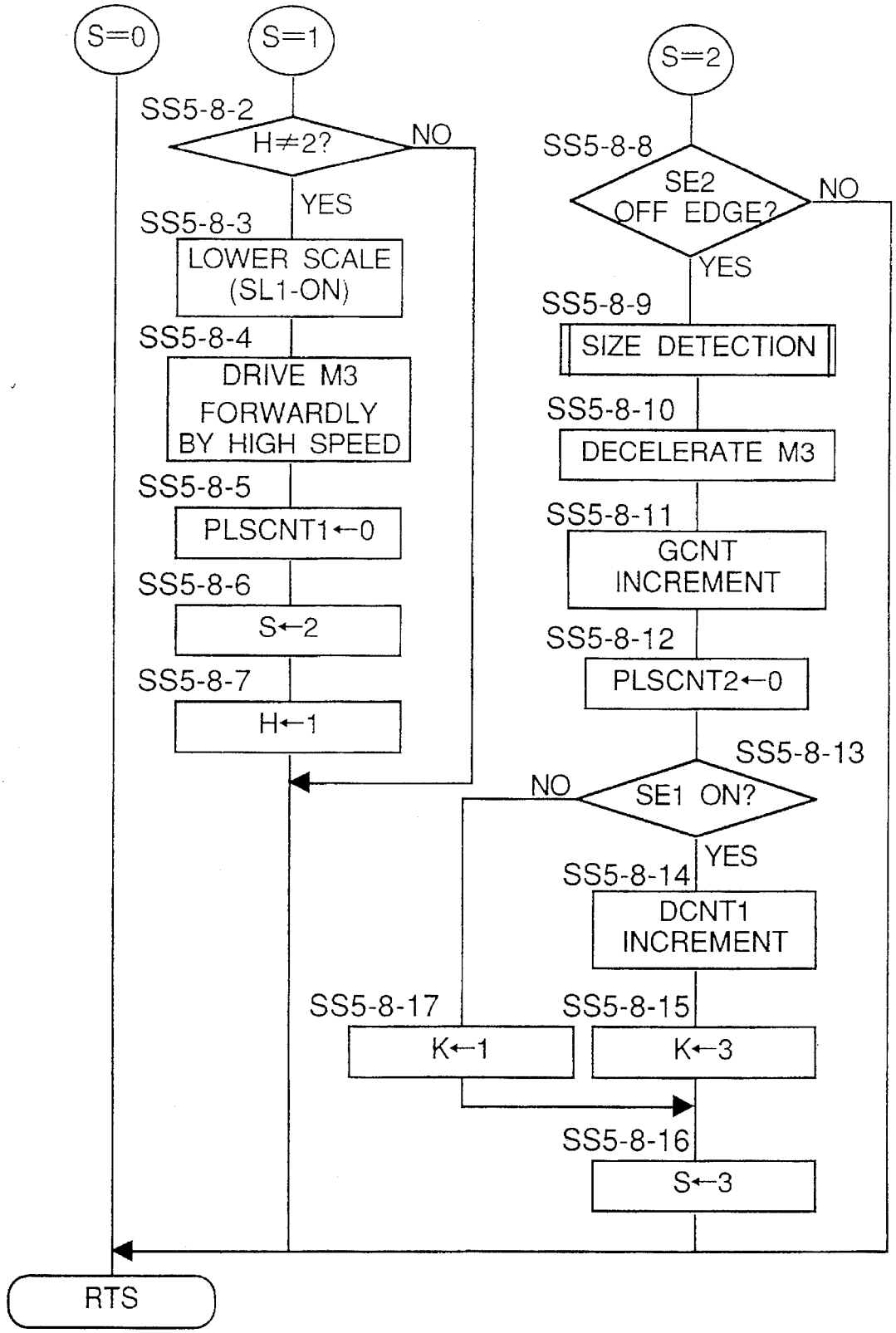
FIG. 113 is a flow chart showing the count subroutine in the CPU2 subsequent to FIG. 112.
Figure 114:
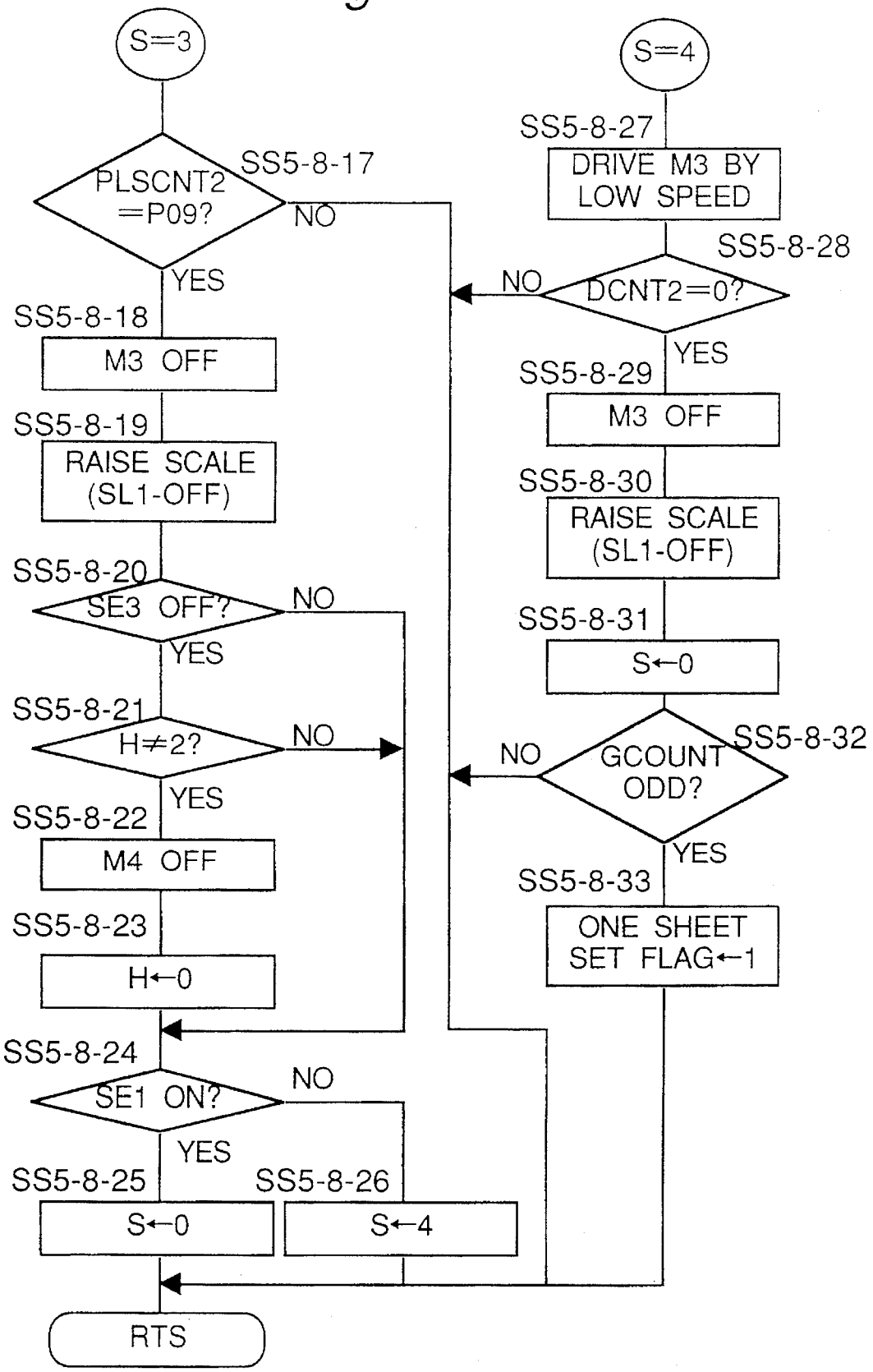
FIG. 114 is a flow chart showing the count subroutine in the CPU2 subsequent to FIG. 113.

FIGS. 112 to 114 show a count subroutine to be executed at SS5-8. In this subroutine in conjunction with a counted paper-discharge subroutine as will be explained in succession, the document is circulated around so that the number of document sheets is automatically counted. In this subroutine, as shown in FIG. 112, the status S is checked at SS5-8-1 and the following operations are executed based on the resulting values "0" to "4".

As shown in FIG. 113, if the status S is "0", nothing is processed. If the status S is "1" (completion of paper feed), it is confirmed at SS5-8-2 that the discharge status H is not "2", i.e., that the discharge motor M4 has not been reduced in speed. Then, the solenoid SL1 is turned on at SS5-8-3 so that the scale 120 is lowered, and the main motor M3 is rotated forward at high speed at SS5-8-4. As a result, the document is fed from the register roller 90 onto the platen glass 29. Further, the PLSCNT1 is reset to "0" at SS5-8-5, the status S is set to "2" at SS5-8-6, and the status H is set to "1" at SS5-8-7.

If the status S is "2", the register sensor SE2 is confirmed at SS5-8-8 to be at the OFF EDGE (if the rear end of the document has passed the detection point of the sensor SE2), the document size is detected at SS5-8-9. Subsequently, the main motor M3 is decelerated at SS5-8-10, the GCNT for counting the number of document sheets is incremented at SS5-8-11, and the PLSCNT2 is reset to "0" at SS5-8-12. Further, it is decided at SS5-8-13 whether or not the empty sensor SE1 is on. If the sensor SE1 is on, the DCNT1 is incremented at SS5-8-14 for feeding the succeeding document, the feed status K is set to "3" at SS5-8-15, and the status S is set to "3" at SS5-8-16. If the sensor SE1 has been turned off, then there is no document left on the tray 61 so that feed status K is set to "1" at SS5-8-17 and the status S is set to "3" at SS5-8-16.

As shown in FIG. 114, if the status S is "3", it is confirmed at SS5-8-17 that the PLSCNT2 has completed the count of the pulse P09, and then the main motor M3 is turned off at SS5-8-18. The pulse P09 is intended to temporarily stop the document on the platen glass 29, and it corresponds to a number of pulses with which the main motor is driven from when the rear end of the document is detected by the register sensor SE2 until when it passes by at least the nip portion of the register roller 90. By such control, the processing time in the count mode can be reduced.

Next, the solenoid SL1 is turned off at SS5-8-19 so that the scale 120 is raised. Thereafter, it is decided at SS5-8-20 whether or not the discharge sensor SE3 is off, and at SS5-8-21 whether or not the discharge status H is "2". If the sensor SE3 is off and if the status H is not "2" (if the document has not been discharged), then the discharge motor M4 is turned off at SS5-8-22, and the status H is reset to "0" at SS5-8-23. Then, it is decided at SS5-8-24 whether the empty sensor SE1 is on or off. If the sensor SE1 is on, then the status S is reset to "0" at SS5-8-25 for awaiting the completion of the feed of the succeeding document. If the sensor SE1 is off, then the status S is set to "4" at SS5-8-26. Also, if the discharge sensor SE3 has been turned on or if the status H is "2" even with the discharge sensor SE3 off, then the operations of SS5-8-24 to -26 are processed.

If the status S is "4", then all the document sheets have already been fed out onto the platen glass 29, where the main motor M3 is driven into low-speed rotation at SS5-8-27. Then, it is confirmed at SS5-8-28 that the DCNT2 is "0", i.e., that there are no longer document sheets left on the platen glass 29. The main motor M3 is turned off at SS5-8-29, the solenoid SL1 is turned off at SS5-8-30 so that the scale 120 is raised, and the status S is reset to "0" at SS5-8-31. Subsequently, it is decided at SS5-8-32 whether or not the number of document sheets is an odd number. If it is an odd number, then the one-sheet set flag is set to "1" at SS5-8-33.

<Counted Paper Discharge>

Figure 115:
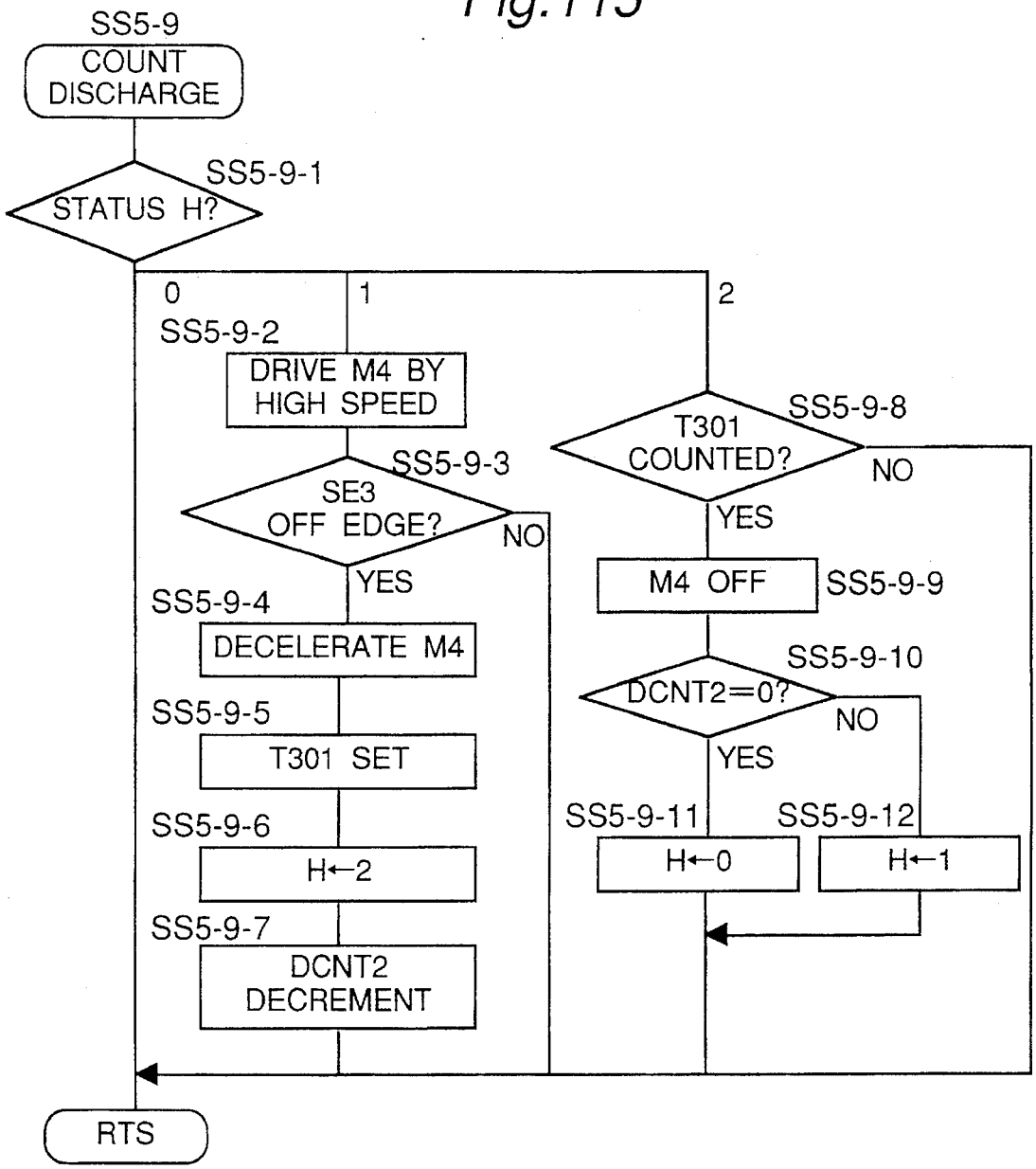
FIG. 115 is a flow chart showing the counted paper-discharge subroutine in the CPU2.

FIG. 115 shows a counted paper-discharge subroutine to be executed at SS5-9. In this subroutine, the discharge status H is checked at SS5-9-1, and the following operations are executed based on the resulting values "0", "1", and "2".

If the status H is "0", nothing is processed. If the status H is "1" (when the document starts to be conveyed by the main motor M3 rotating forward), the discharge motor M4 is driven into high-speed rotation at SS5-9-2. As a result, the reverse roller 100 and the discharge roller 110 start to rotate, so that the document is fed to the tray 115. Next, if the discharge sensor SE3 is confirmed at SS5-9-3 to be at the OFF EDGE (if the rear end of the document has passed the detection point of the discharge sensor SE3), the discharge motor M4 is reduced in speed at SS5-9-4. Further, the timer T301 is set at SS5-9-5, the status H is set to "2" at SS5-9-6, and the DCNT2 is decremented at SS5-9-7.

If the status H is "2", it is confirmed at SS5-9-8 that the timer T301 has counted up. Then, the discharge motor M4 is turned off at SS5-9-9, and it is decided at SS5-9-10 whether or not the DCNT2 is "0". If the DCNT2 is "0" (there is no document on the platen glass 29), then the status H is reset to "0" at SS5-9-11. If the DCNT2 is not "0" (there is a document on the platen glass 29), then status H is set to "1" at SS5-9-12.

<Size Detection>

Figure 116:
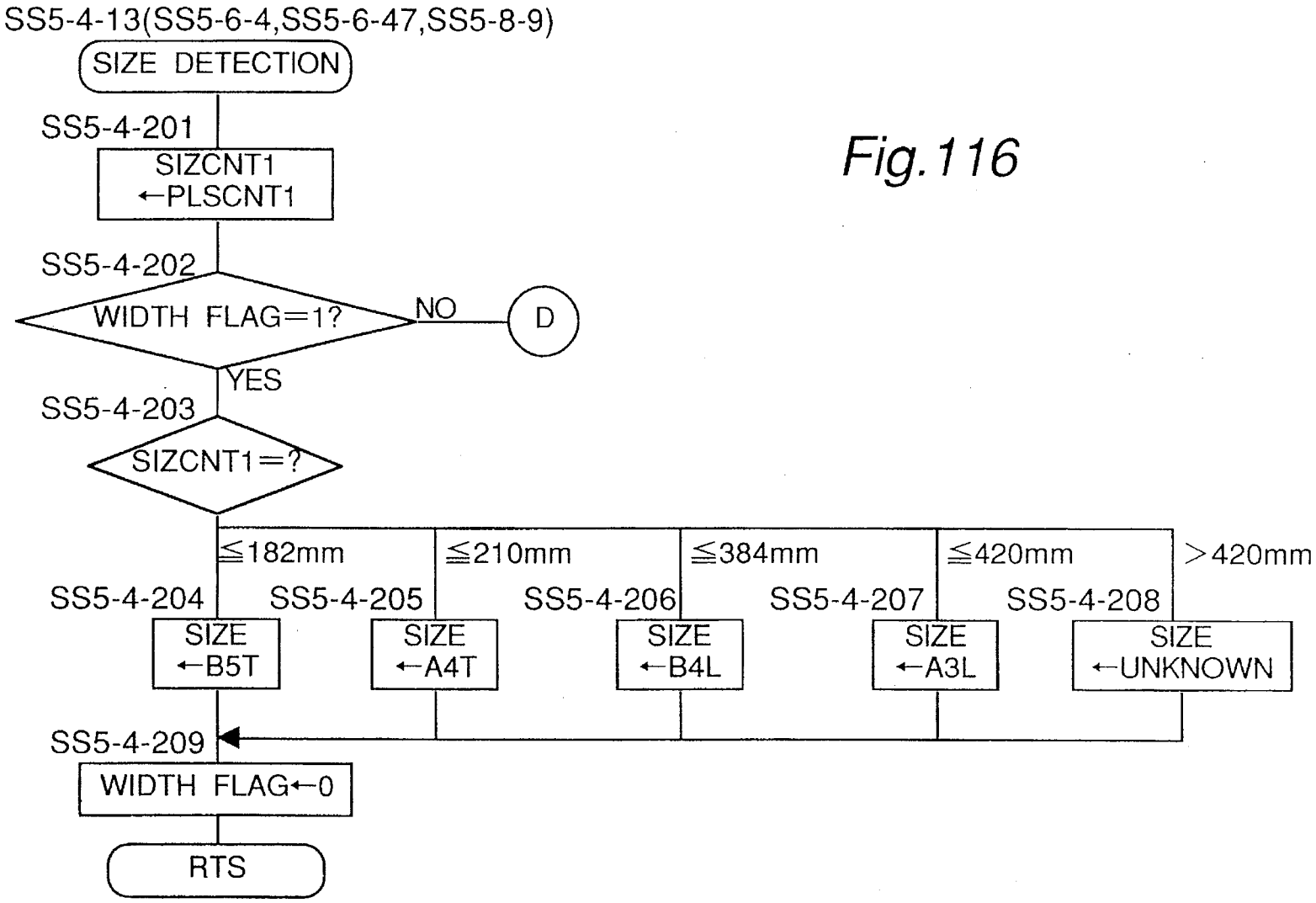
FIG. 116 is a flow chart showing the size detection subroutine in the CPU2.

FIG. 116 shows a size detection subroutine. In this example, the pulse count of the PLSCNT1 is stored into the counter SIZCNT1 for use of size detection at SS5-4-201. The PLSCNT1 counts the number of forward-rotation pulses of the main motor M3, and its value corresponds to the length of the document. Next, it is decided at SS5-4-202 whether or not the width flag is "1." The width flag is set by the width sensor SE10 turning on and off, and the width sensor SE10 is turned on by a document having a width dimension larger than B5 transverse, in which case the width flag is set to "1". The document size is set by a combination of a value of the SIZCNT1 and a width flag. In the figure, T denotes the transverse feed while L denotes the longitudinal feed.

More specifically, if the width flag is "1", the value of the SIZCNT1 is checked at SS5-4-203. Then, if the resulting value corresponds to 182 mm, the SIZE is set to B5 transverse. Subsequently, specified sizes are similarly set according to values of the SIZCNT1 at SS5-4-205 to SS5-4-207. Further, if the document is longer than 420 mm, the size is decided as unknown at SS5-4-208. After this process, the width flag is reset to "0" at SS5-4-209.

Figure 117:
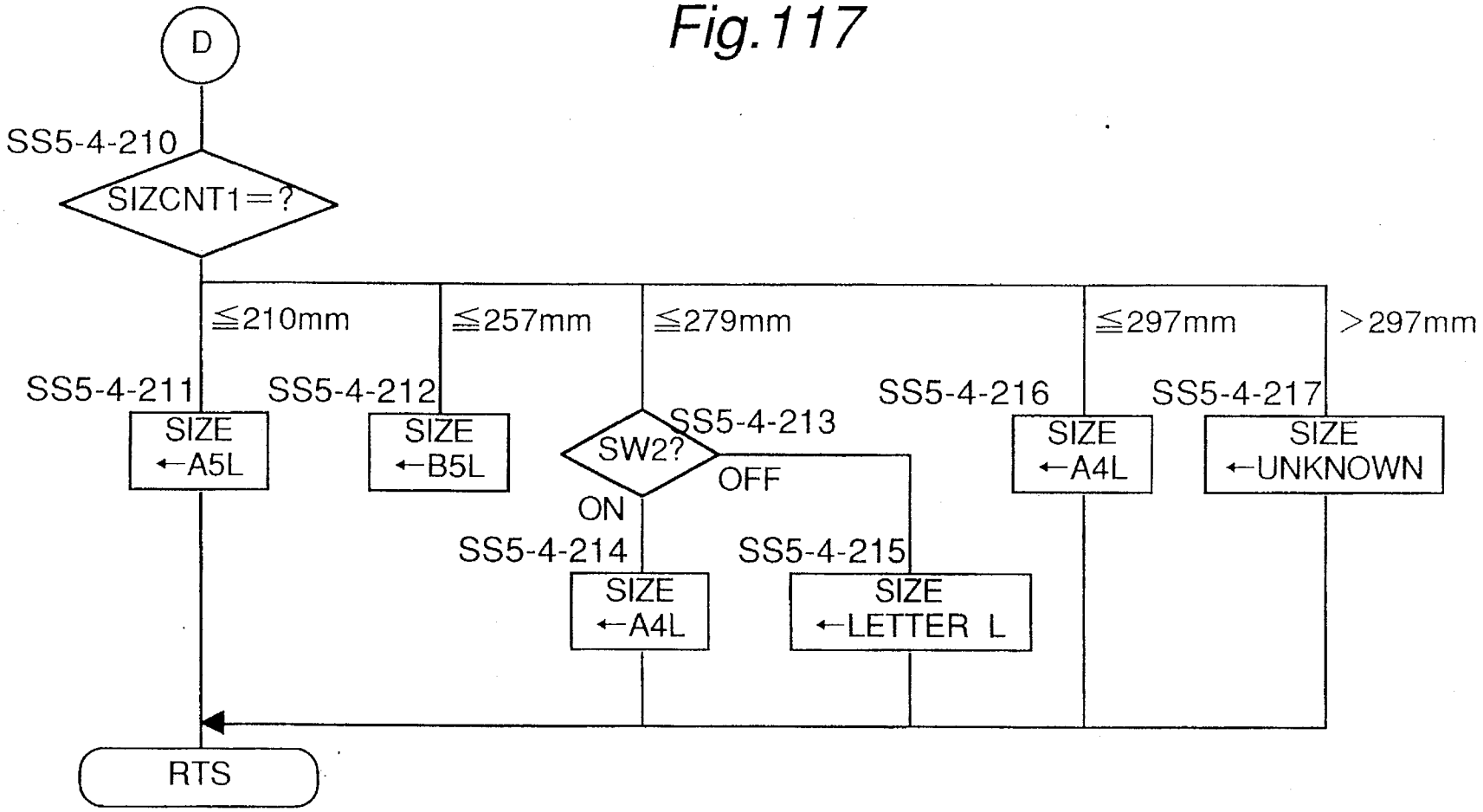
FIG. 117 is a flow chart showing the size detection subroutine in the CPU2 subsequent to FIG. 115.
Figure 118:
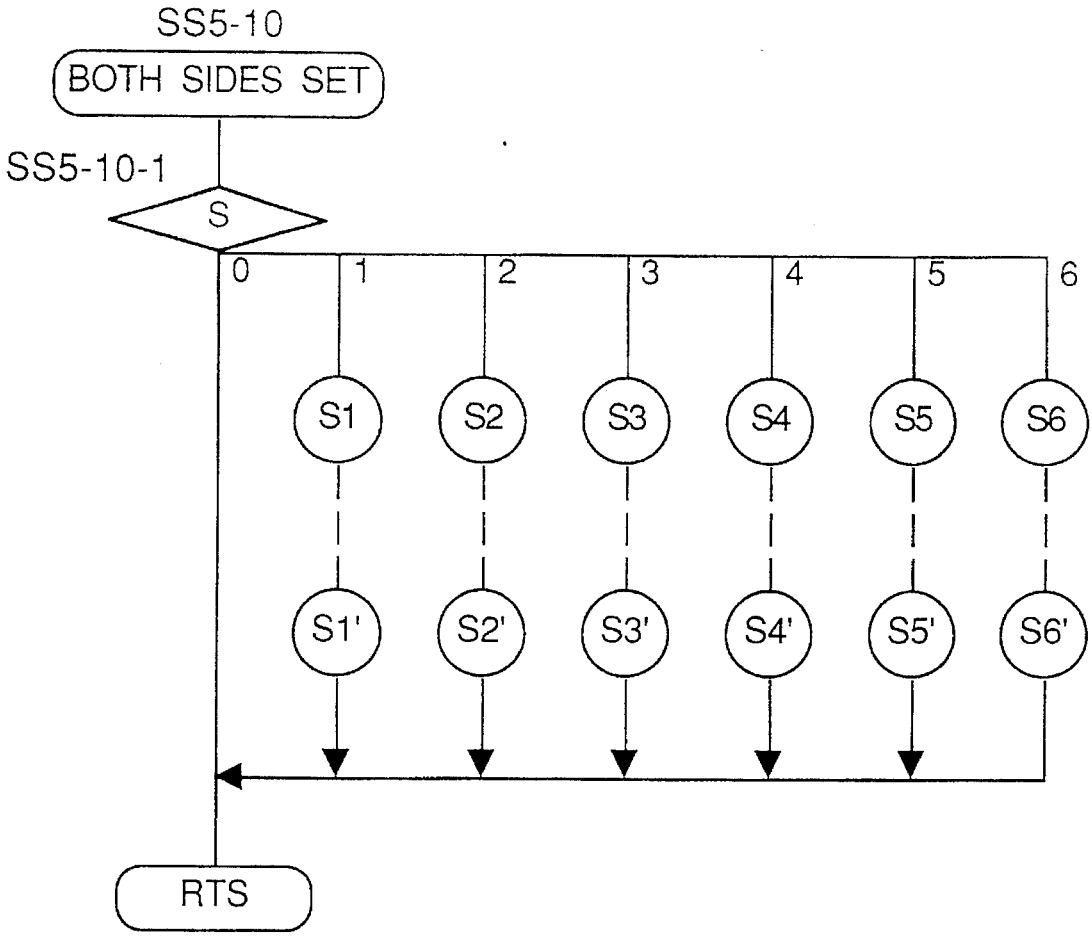
FIG. 118 is a flow chart showing the both-sides set subroutine in the CPU2.

Meanwhile, as shown in FIG. 117, if the width flag is "0", the value of the SIZCNT1 is checked at SS5-4-210 and specified document sizes are set to the SIZE at SS5-4-211 to SS5-4-217 according to the resulting values. In addition, if the document is shorter than 297 mm, it is decided at SS5-4-213 whether or not the switch SW2 has been turned on. If it has been turned on, the size is set to "A4L" at SS5-4-214; if it has not been turned on, the size is set to "Letter L" at SS5-4-215. Besides, in the two-in-one mode, each detected size is doubled when it is set. It is noted that the steps of SS5-4-213 and -214 are other embodiments of the steps of S8-4 and following in FIG. 67.

<Both-sides Set>

FIGS. 118 through 124 show a subroutine for processing the document conveyance in the both-sides mode. First, the status "S" is decided at SS5-10-1, and the subroutine is branched into "0" through "6" according to the resulting values.

Figure 119:
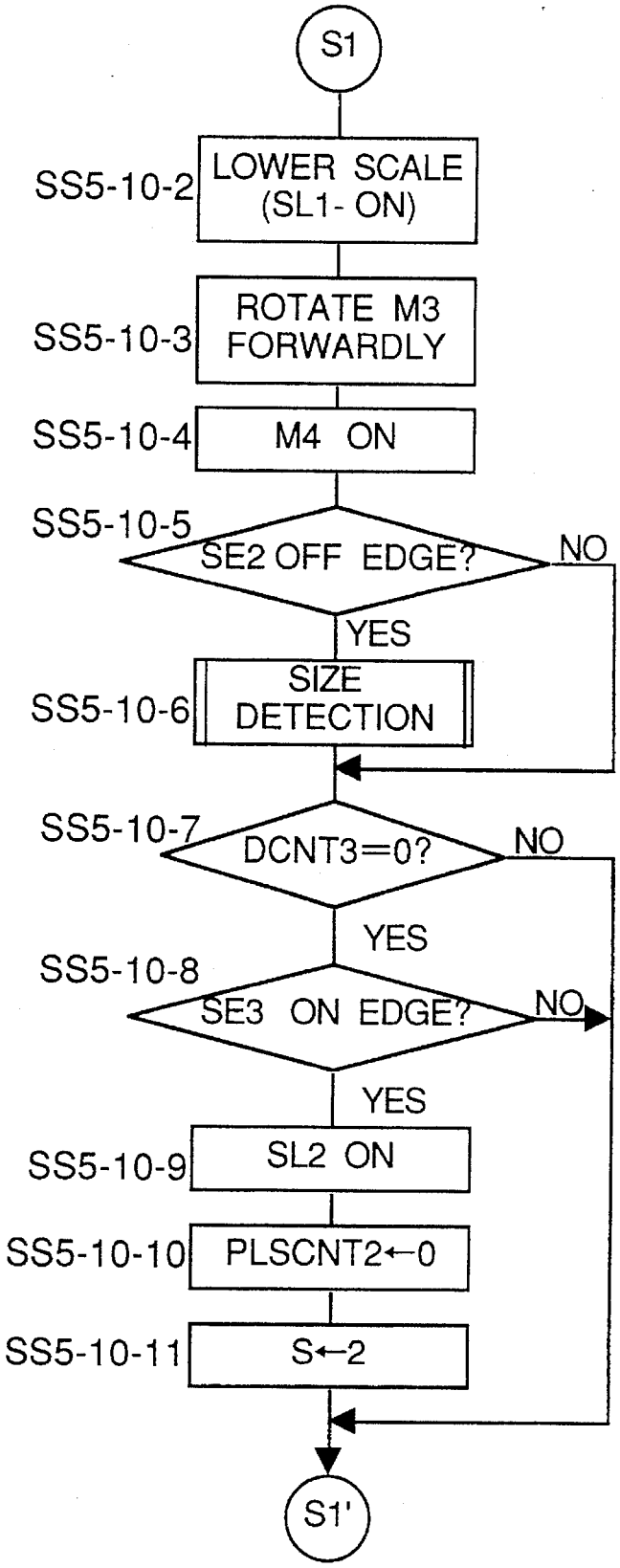
FIG. 119 is a flow chart showing the both-sides set subroutine in the CPU2 subsequent to FIG. 118.
Figure 120:
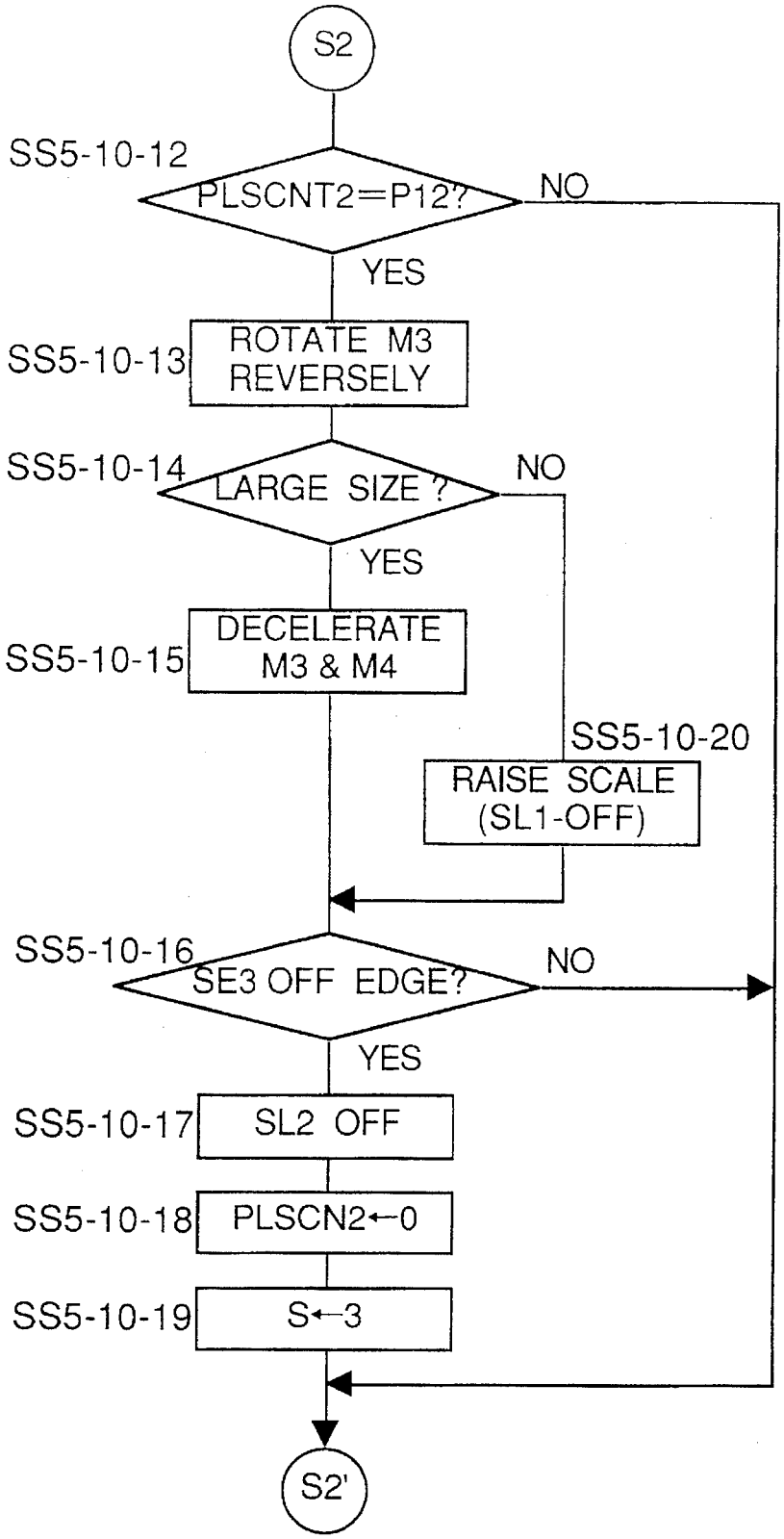

If the status S is "0", nothing is processed. As shown in FIG. 119, if the status S is "1", then the solenoid SL1 is turned on at SS5-10-2 so that the scale 120 is lowered, the main motor M3 is rotated forward at SS5-10-3 so that the document is conveyed along the glass platen 29, and the discharge motor M4 is driven at SS5-10-4. Next, the OFF EDGE of the register sensor SE2 is detected at SS5-10-5. If the OFF EDGE, or the rear end of the document, is detected, the document size is detected from signals of the sensors SE2 and SE10 at SS5-10-6. Subsequently, it is decided at SS5-10-7 whether or not the number-of-document-sheets counter DCNT3 is "0". This number-of-document-sheets counter is a counter that counts the number of document sheets to be discharged, and is set to "0" when the rear surface of the first document sheet is set and when its front surface is set. Also, when the rear surface of the second and following document sheets is set, the counter changes from "1" to "0" as the preceding document is discharged. Then, if the number-of-document-sheets counter DCNT3 is decided to be "0", the ON EDGE of the discharge sensor SE3 is detected at SS5-10-8. As the ON EDGE has been detected, the solenoid SL2 is turned on at SS5-10-9 so that the switching claw 103 is operated to form a reversal path, and the document is again conveyed toward the glass platen 29. Also, the PLSCNT2 is reset to "0" at SS5-10-10, where the count is started therewith. The status S is set to "2" at SS5-10-11.

If the status S is "2", it is decided at SS5-10-12 whether or not the PLSCNT2 has reached P12, i.e., whether or not the front end of the document that had passed the sensor SE3 has passed through the reversal path and reached to intermediately before the conveyor belt 95. Then, immediately before the front end of the document reaches the conveyor belt 95, the main motor M3 is rotated reverse at SS5-10-13. Also, it is decided at SS5-10-14 whether or not the document is large size. If the document is large size, the motors M3 and M4 are decelerated. In this connection, a large-size document may be pinched between the conveyor belt 95 and the glass platen 29 at both the front end and the rear end, resulting in an increased load. In such a case, the motors M3 and M4 are switched to low speed so that the stepping motors can be protected from stepping out and that paper-running noise can be reduced. In this case, similar functions and advantages can be obtained also when the scale 120 is held lowered below the upper surface of the glass platen 29. Meanwhile, when the document is not large size, the solenoid SL1 is turned off at SS5-10-20 so that the scale 120 is raised, with a view to eliminating the possibility that the front end of the document may interfere with an end face of the glass, which would lead to a paper jam, as well as to preparing for the document front-end restriction. Next, the OFF EDGE of the sensor SE3 is detected at SS5-10-16, where if it is confirmed that the rear end of the document has passed the switching claw 103, the solenoid SL2 is turned off at SS5-10-17 so that the switching claw 103 is operated, whereby the document conveying path is switched to the path which leads to the document-discharge tray 115. Further, the PLSCNT2 is reset to "0" at SS5-10-18, and the status S is set to "3" at SS5-10-19.

Figure 121:
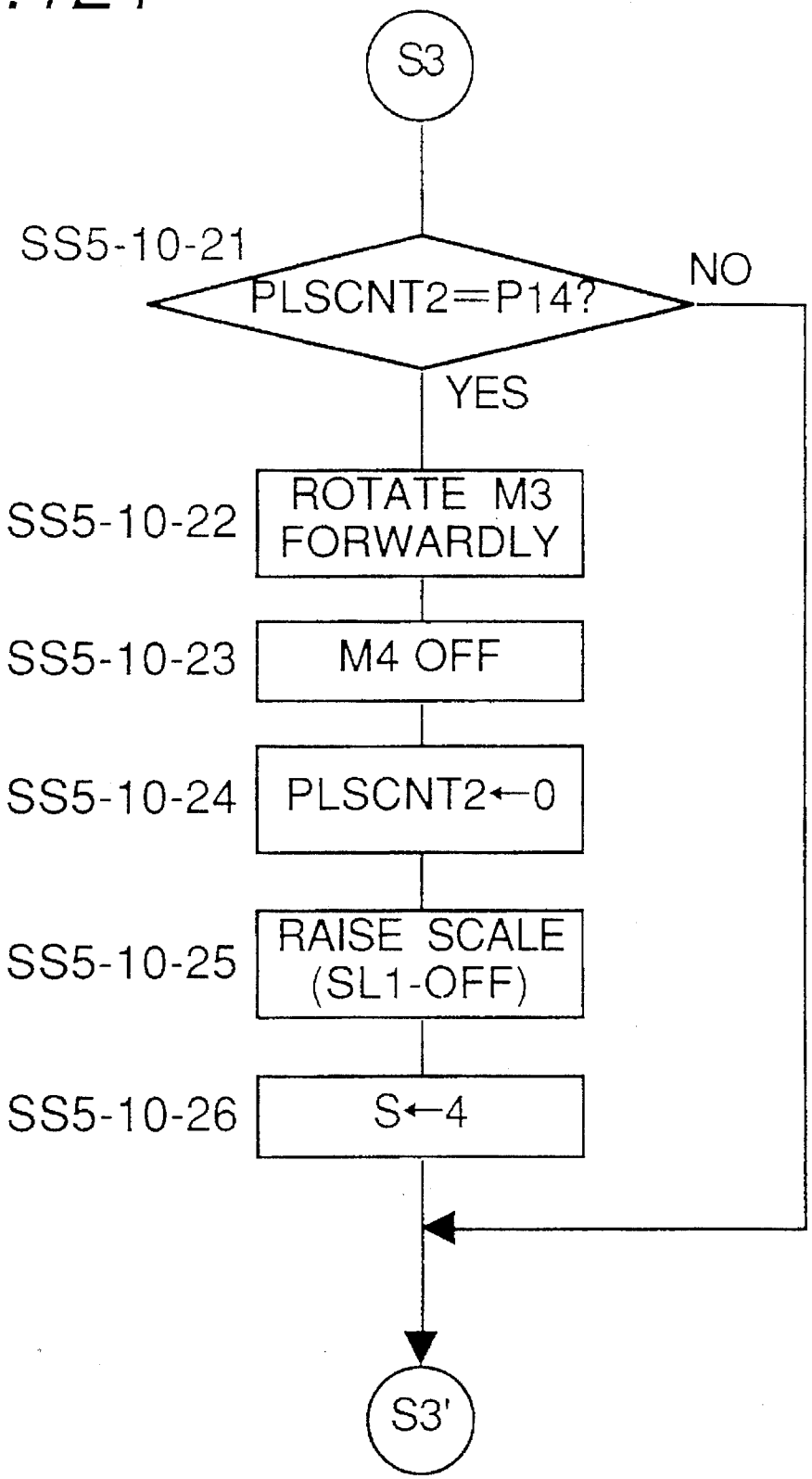

As shown in FIG. 121, if the status S is "3", it is confirmed whether or not the PLSCNT2 has reached P14, i.e., whether or not the document has moved fully onto the glass platen 29 with the rear end of the document moved to a position 20 to 30 mm away from the scale 120. Then, when the PLSCNT2 has reached P14, the main motor M3 is switched to forward rotation at SS5-10-22. By this operation, document is conveyed on the glass platen 29 toward the scale 120. Also, the discharge motor M4 is turned off at SS5-10-23. Next, the PLSCNT2 is reset to "0" at SS5-10-24, and the solenoid SL1 is turned off at SS5-10-25 so that the scale 120 is raised, thus providing for the front-end restriction of the document. Finally, the status S is set to "4" at SS5-10-26.

Figure 122:
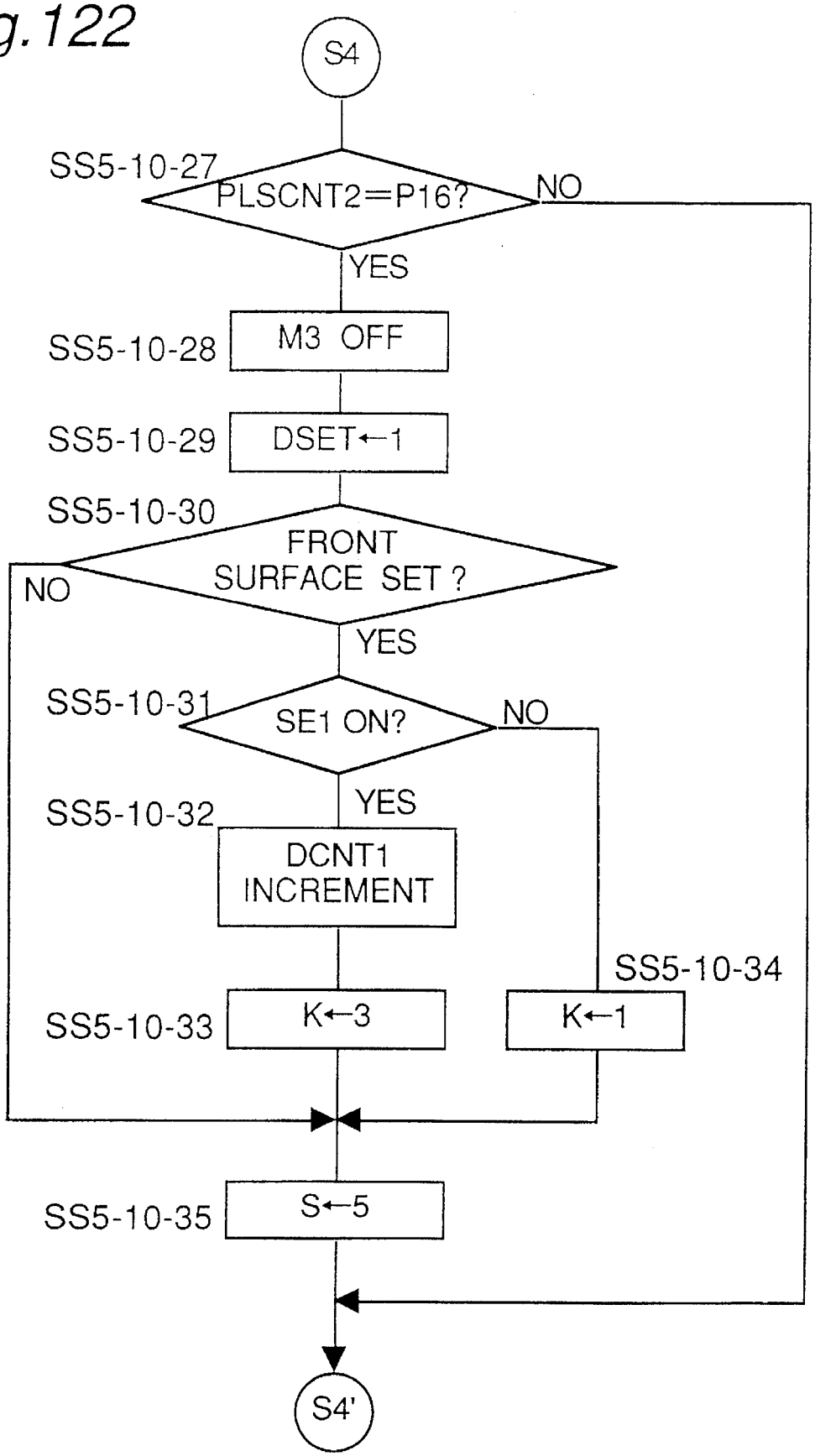

As shown in FIG. 122, if the status S is "4", it is decided at SS5-10-27 whether or not the PLSCNT2 is P16, i.e., whether or not the document has been conveyed until an end portion of the document on the scale 120 side is restricted by the scale 120. Then, if the PLSCNT2 has reached P16, the main motor M3 is turned off at SS5-10-28, and the DSET is set to "1" at SS5-10-29 so that the pickup 10 roller is returned to the home position. Further, it is decided at SS5-10-30 whether the front surface of the document is set into a copying state or the rear surface of the document is set into a copying state. At this step, if the front surface of the document is set into a copying state, it is detected at SS5-10-31 whether or not there is a succeeding document sheet on the document tray 61. If there is, the document counter DCNT1 is set to "1" at SS5-10-32 and thereafter the status K is set to "3" at SS5-10-33, whereby the succeeding document is fed. If there is no succeeding document, the status K is set to "1" at SS5-10-34 and the status S is set to "5" at SS5-10-35. In addition, if it is decided at SS5-10-30 that the rear surface of the document is set into a copying state, the status S is set to "5" at SS5-10-35 without executing the operations of SS5-10-31 to -34.

Figure 123:
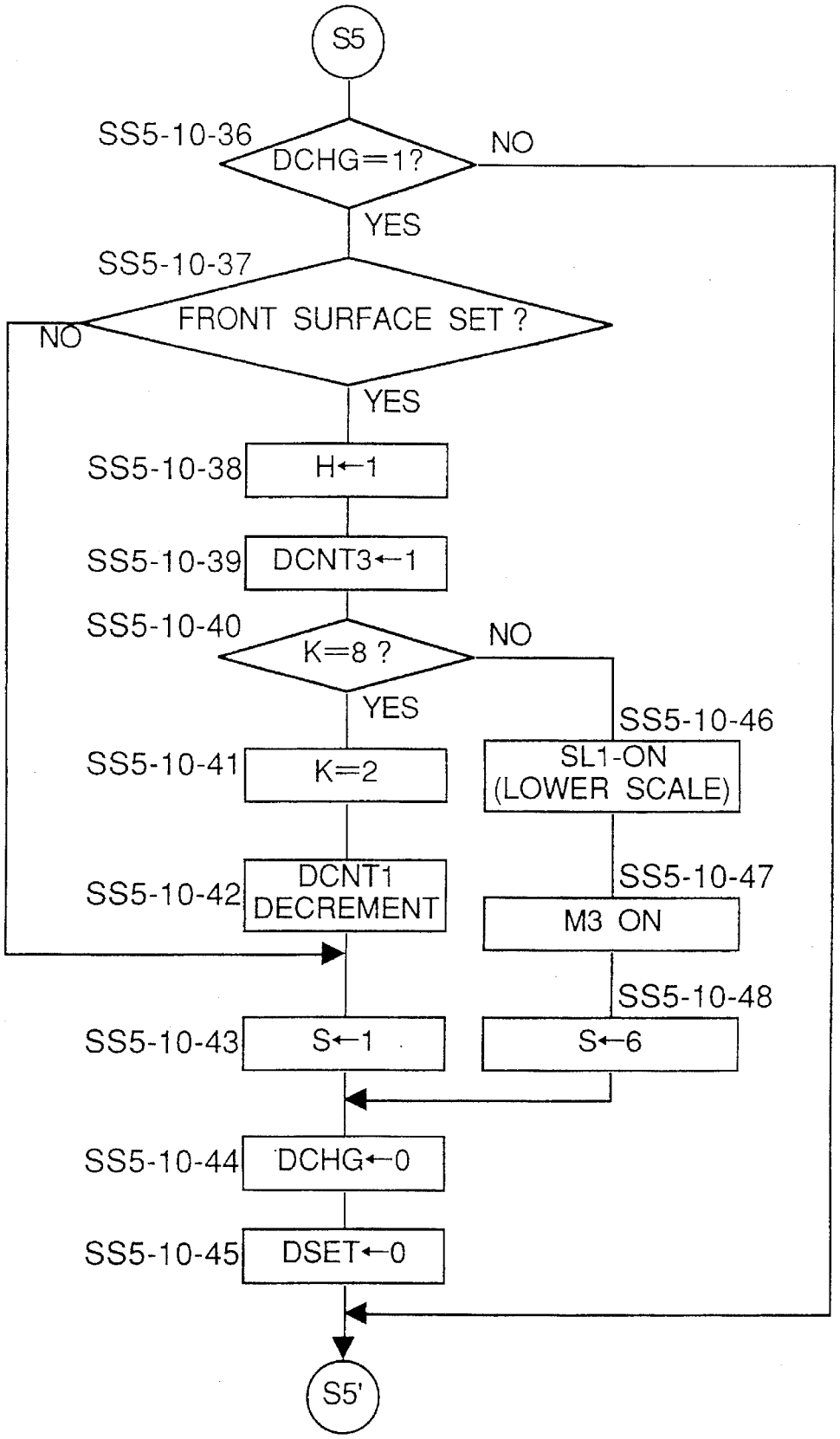

As shown in FIG. 123, if the status S is "5", it is decided at SS5-10-36 whether or not the document replacement request signal DCGH is set to "1" in the copying machine main body 1. Also, it is decided at SS5-10-37 whether or not the document is completely set into a front-surface copying state. Subsequently, if the DCHG is set to "1", requesting a document replacement, and if the document is set into a front-surface copying state, then a paper-discharge control counter H is set to "1" at SS5-10-38 and the counter DCNT3 for the number of document sheets to be discharged is set to "1" at SS5-10-39. Further, it is decided at SS5-10-40 whether or not the status K is set to "8" i.e., whether or not the succeeding document is set into a first-out feeding state. If the succeeding document is in the first-out feeding state, then the status K is changed to "2" at SS5-10-41, and the DCNT1 is decremented at SS5-10-42. Also, the status S is set to "1" at SS5-10-43, the DCHG is set to "0" at SS5-10-44, and the DSET is set to "0" at SS5-10-45. Meanwhile, if the status K is decided at SS5-10-40 not to be "8", then the solenoid SL1 is turned on so that the scale 120 is lowered, and the main motor M3 is driven at SS5-10-47 so that the document on the glass platen 29 is discharged to the discharge section. Further, the status s is set to "6" at SS5-10-48, so that the operation enters the discharge process of the final document sheet, and the DCHG is set to "0" at SS5-10-44 and the DSET is set to "0" at SS5-10-45. If it is decided at SS5-10-37 that the document is set in a rear-surface copying state, then the operations of SS5-10-43 to -45 are executed.

Figure 124:
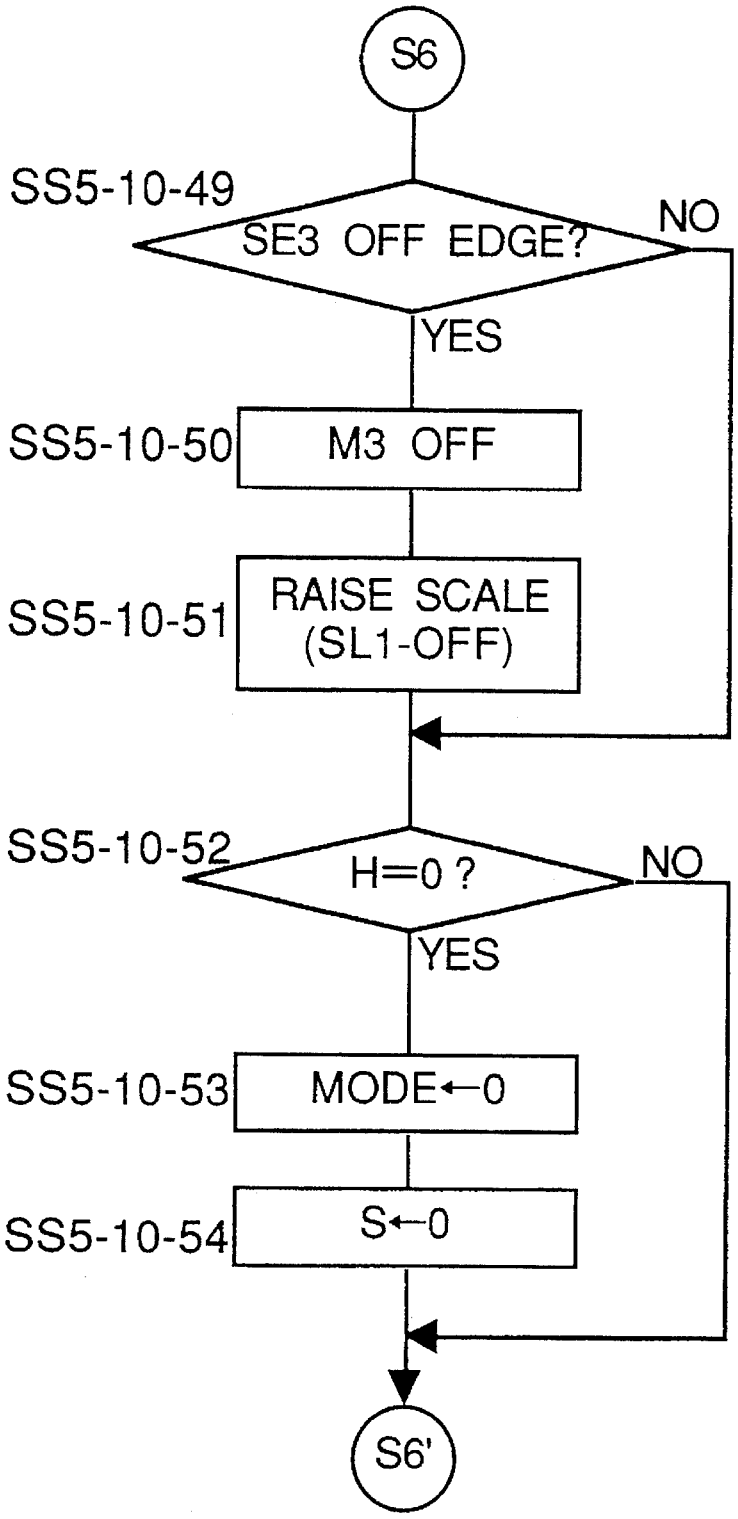

As shown in FIG. 124, if the status S is "6", the OFF EDGE of the discharge sensor SE3, i.e., a document rear-end detection signal, is detected at SS5-10-49. If the OFF EDGE has been detected, whereby it is confirmed that the rear end of the document has passed the sensor SE3, then the main motor M3 is turned off at SS5-10-50, and the solenoid SL1 is turned off at SS5-10-51 so that the scale 120 is raised. Next, it is decided at SS5-10-52 whether or not the discharge control counter H is "0", i.e., whether or not the discharge of the document has been completed. Then, if the discharge has been completed, the MODE is set to "0" at SS5-10-53, and the status S is set to "0" at SS5-10-54, thereby setting the standby state.

<Input>

Figure 125:
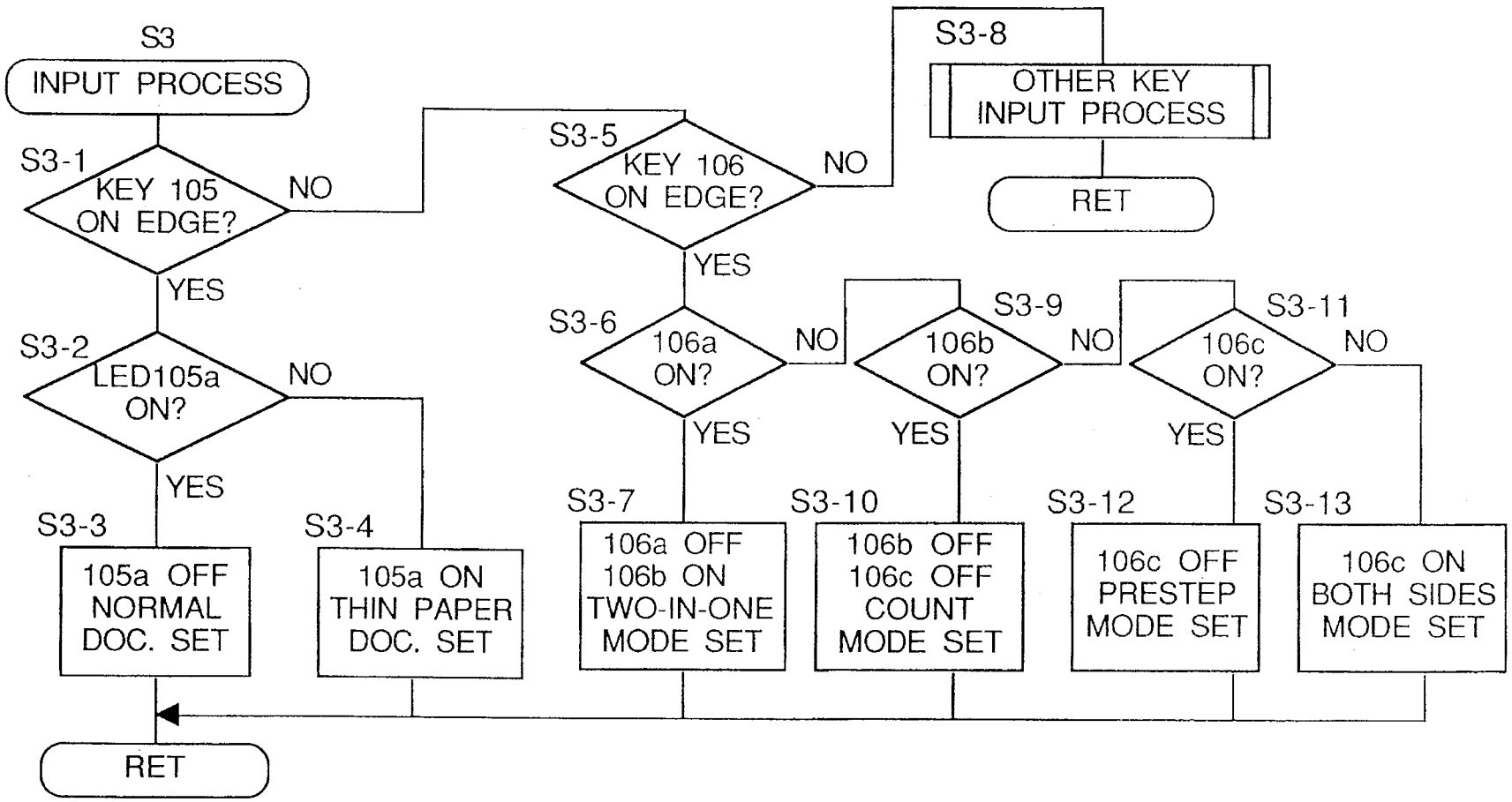
Figure 126:
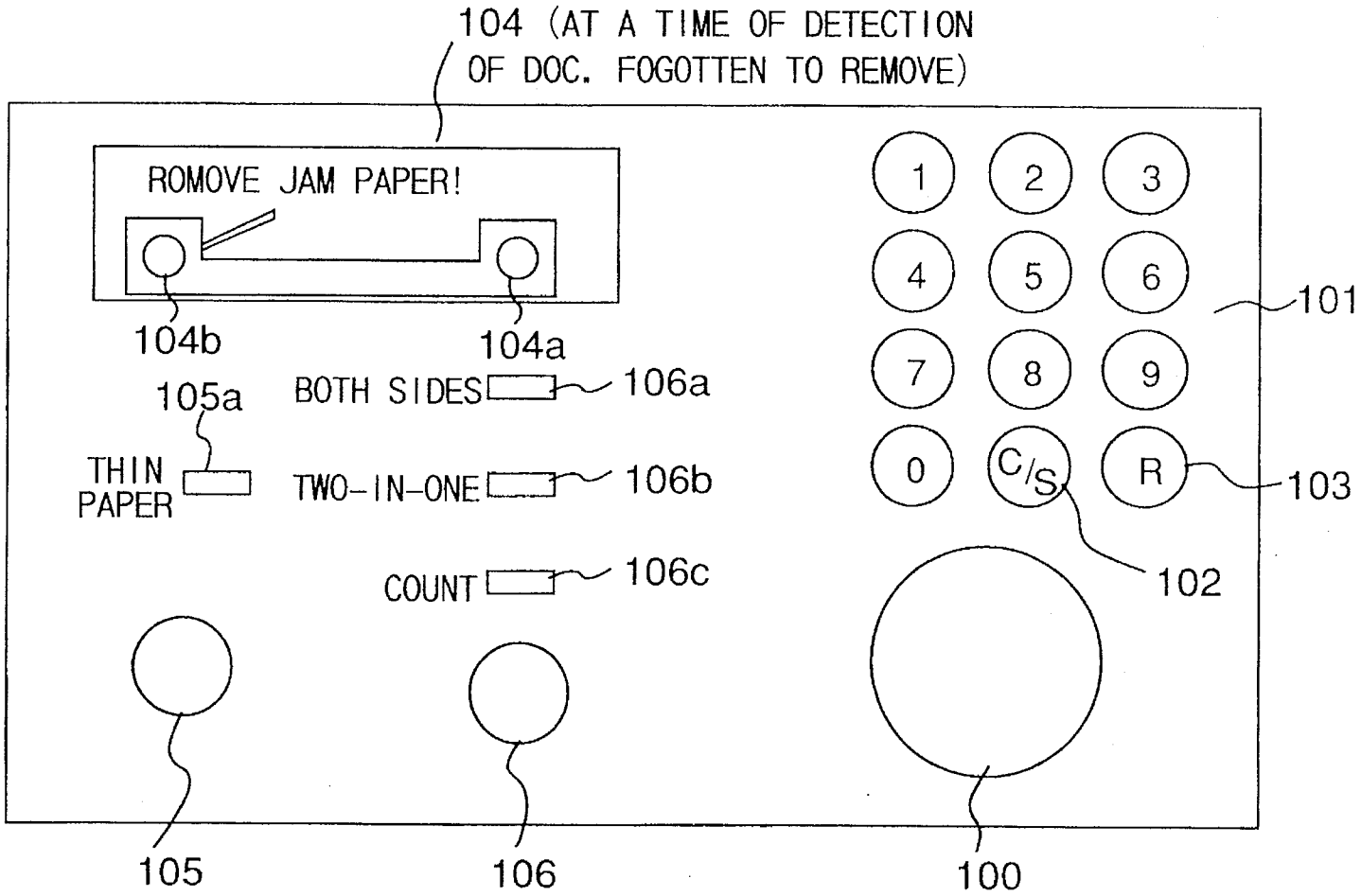

FIG. 125 shows control for an input operation S3 of the CPU1. As this input operation S3, an input operation from the control panel of the copying machine as shown in FIG. 126 is processed. In the control panel of the copying machine, reference numeral 100 denotes a copy start key; 101 denotes a ten-key pad; 102 denotes a clear/stop key; 103 denotes a reset key; and 104 denotes an indicator. Numeral 105 denotes a document selector key and **105*a* denotes a thin-paper mode indicator LED, where when the thin-paper mode is selected by the document selector key 105, the thin-paper mode indicator LED lights. Numeral 106 denotes a mode selector key, numeral 106*a* denotes a both-sides mode indicator LED, numeral 107*b* denotes a two-in-one mode indicator LED, and numeral 106*c* denotes a count mode indicator LED, where modes selected by the mode selector key 106 are indicated by the indicator LEDs 106*a*, 106*b*, and 106*c***, respectively.

In the above input operation, when the ON EDGE of the document selector key 105 is detected at S3-1, it is decided at S3-2 whether or not the thin-paper mode indicator LED **105*a* is on. If the LED is on, then the LED 105*a* is turned off at S3-3 so that a normal document copying state is set. If the LED is off, then the LED 105*a* is turned on at S3-4**, whereby a thin-paper document copying state is set.

If the ON EDGE of the document selector key 105 has not been detected at S3-1, then the ON EDGE of the mode selector key 106 is detected at S3-5. At this step, if the ON EDGE has not been detected, the other key-input operation is executed at S3-8. Meanwhile, if the ON EDGE is detected at S3-5, it is decided at S3-6, S3-9, and S3-11 whether or not the LED **106*a*, LED 106*b*, LED 106*c*, respectively, are on. If the LED 106*a* is on, the LED 106*a* is turned off while the LED 106*b* is turned on at S3-7, whereby the two-in-one mode is set. If the LED 106*b* is on, the LED 106*b* is turned off while the LED 106*c* is turned on at S3-10, whereby the count mode is set. If the LED 106*c* is on, the LED 106*c* is turned off at S3-12; if the LED 106*c* is off, the LED 106*c* is turned on at S3-13**, whereby the both-sides mode is set.

<Indication>

Figure 127:
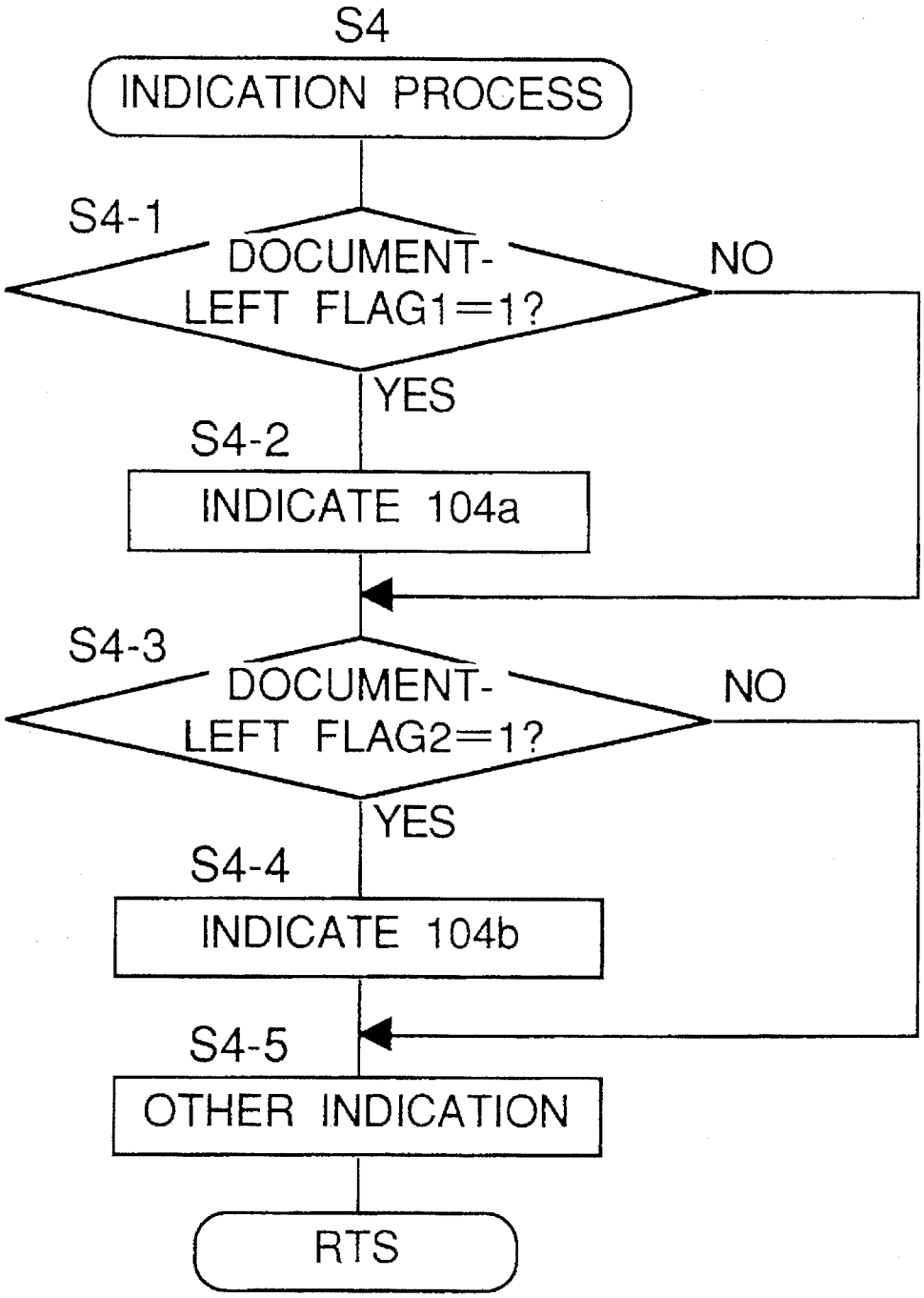

FIG. 127 shows a subroutine for controlling the indication of the indicator 104 in the control panel of the copying machine. It is decided at S4-1 whether or not a document-left flag 1 is set to "1"; if the document-left flag 1 is set, then feed-section jam indication **104*a* is displayed in the indicator 104 at S4-2. Next, it is decided at S4-3 whether or not a document-left flag 2 is set to "1"; if the document-left flag 2 is set to "1", then discharge-section jam indication 104*b* is displayed in the indicator 104. Also, when the document-left flag 1 or 2 is set to "1", the indicator 104 gives an alarm on removal of the jammed paper as shown in the figure. Further, other necessary indications are processed at S4-5**.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

For example, the present invention is adaptable to any copying machine with ADF having various forms. There are seven parameters to decide the form of the ADF as described below.

Document feed order (A): a parameter whether the document sheet set on the document tray is fed from the first page or the last page.

Document set direction (B): a parameter whether the document sheet is set on the document tray in face-up condition or face-down condition.

Position of document tray (C): a parameter whether the document tray is positioned above the platen or beside the platen.

Document feed order (D): a parameter whether the document sheet set on the document tray is fed from the upper sheet or the lower sheet.

Document feed direction (E): a parameter whether the document sheet is fed from scale side or non-scale side.

Document set direction (F): a parameter whether the lower end of the document to be set on the document tray is directed to front side (correct direction) or back side (upside-down direction).

Position of exposure reference (G): a parameter whether the exposure reference position is in left side of the platen or right side of the platen.

The form of ADF is defined by the combination of these parameter as shown in Table 2, The embodiment described is of type 6 in Table 2, It should be noted that the present invention is applicable to the other type of ADF in Table 2.

TABLE 2

| | PARAMETER | | | | | | |
|---|---|---|---|---|---|---|---|
| TYPE | A | B | C | D | E | F | G |
| 1 | first page | face-up | above | upper | scale side | upside-down | right side |
| 2 | first page | face-up | above | upper | scale side | correct | left side |
| 3 | first page | face-down | beside | lower | scale side | upside-down | right side |
| 4 | first page | face-down | beside | lower | scale side | correct | left side |
| 5 | last page | face-up | above | lower | non-scale side | upside-down | right side |
| 6 | last page | face-up | above | lower | non-scale side | correct | left side |
| 7 | last page | face-down | beside | upper | non-scale side | upside-down | right side |
| 8 | last page | face-down | beside | upper | non-scale side | correct | left side |

What is claimed is:

1. A copying machine for copying a document through the steps of feeding a plurality of stacked document sheets one by one; arranging two document sheets on a glass platen in series with respect to a document conveying direction; and copying images of the two document sheets onto one sheet by a single exposure scanning process, the copying machine comprising:

a scale arranged upstream or downstream of the glass platen in the document conveying direction and protruded upward from an upper surface of the glass platen;

a document conveying means having a first mode and a second mode, in the first mode the document conveying means conveying two document sheets to an exposure position with their ends made coincident with each other without restricting them by the scale, in the second mode the document conveying means conveying two document sheets on the glass platen with an interval provided therebetween and making the ends of the two document sheets coincident with each other by restricting one of the two sheets arranged on one side close to the scale;

selection means for selecting either the first mode or the second mode according to the quality of the document; and control means for controlling the document conveying means in the mode selected by the selection means.

2. A copying machine of claim 1, wherein the scale is biased upward by spring means and is position-restricted in a state protruding from the glass platen by a specified height so as to be pressed down by a scale pressing mechanism, and wherein in the second mode the scale is held in a position where the scale is lowered from the upper surface of the glass platen by the scale pressing mechanism.

3. A copying machine of claim 1, wherein the document conveying means gives the document a conveying amount corresponding to a distance such that the document overruns the scale, whereby the document surely comes into contact with the scale.

4. A copying machine of claim 1, wherein the selection means comprises a key provided on an operational panel of the copying machine for inquiring whether the document is thin paper or not, whereby the first mode is selected when pressing down the key while the second mode is selected when not pressing down the key.

5. A copying method for copying a document through the steps of feeding a plurality of stacked document sheets one by one; arranging two document sheets on a glass platen in series with respect to a document conveying direction; and copying an image of the two document sheets onto one sheet by a single exposure scanning process, the copying method further comprising:

a step of changing a relative relation between a position on the glass platen where a document sheet fed out first or last is set and a position on the sheet where the image is formed, when the number of stacked document sheets is an odd number.

6. A copying method of claim 5 further comprising a step of detecting whether or not the number of the document is an odd number by making the document circulate an automatic document feeder over one cycle without being accompanied by the copying operation.

7. A copying method of claim 5 further comprising a step of detecting whether or not the number of the document is an odd number according to the number inputted by keys provided on an operational panel of the copying machine.

8. A copying method of claim 5, wherein the document sheet fed out first or last is conveyed alone on the glass platen while the other document are conveyed in two-in-one mode.

9. A copying method of claim 5, wherein the document sheet fed out first or last is stopped to a position apart from an exposure reference by an extent of the document size, and wherein the copying process is started from a former-half portion of the sheet.

10. A copying method of claim 5, wherein the document sheet fed out first or last is stopped to a position coincident with an exposure reference, and wherein the copying process is started from a latter-half portion of the sheet.

11. A copying machine for copying a document through the steps of feeding a plurality of stacked document sheets one by one; arranging two document sheets on a glass platen in series with respect to a document conveying direction; and copying images of the two document sheets onto one sheet by a single exposure scanning process, the copying machine comprising:

detecting means for detecting whether or not the number of the document is an odd number;

conveying means for conveying the document sheet fed out first or last alone on the glass platen to stop to a position apart from an exposure reference by an extent of the document size when the number of stacked document sheets is an odd number; and copying means which starts the copying process of the document sheet fed out first or last from a former-half portion of the sheet when the number of stacked document sheets is an odd number.

12. A copying machine for copying a document through the steps of feeding a plurality of stacked document sheets one by one; arranging two document sheets on a glass platen in series with respect to a document conveying direction; and copying images of the two document sheets onto one sheet by a single exposure scanning process, the copying machine comprising:

detecting means for detecting whether or not the number of the document is an odd number;

conveying means for conveying the document sheet fed out first or last alone on the glass platen to stop to a position coincident with an exposure reference when the number of stacked document sheets is an odd number; and copying means which starts the copying process of the document sheet fed out first or last from a latter-half portion of the sheet when the number of stacked document sheets is an odd number.

13. A copying method for copying a document through the steps of feeding a plurality of stacked document sheets one by one; arranging two document sheets on a glass platen in series with respect to a document conveying direction; and copying an image of the two document sheets onto one sheet by a single exposure scanning process, the copying method further comprising:

a step of changing a position on the sheet where an image is formed when the number of stacked document sheets is an odd number.

* * * * *